US006901988B2

(12) United States Patent
Colson et al.

(10) Patent No.: US 6,901,988 B2
(45) Date of Patent: Jun. 7, 2005

(54) SHUTTER-LIKE COVERING AND HARDWARE FOR ARCHITECTURAL OPENING

(75) Inventors: Wendell B. Colson, Weston, MA (US); James M. Anthony, Denver, CO (US); Richard N. Anderson, Whitesville, KY (US); Steven R. Haarer, Whitesville, KY (US); Donald E. Fraser, Owensboro, KY (US); Robert A. Null, Arvada, CO (US)

(73) Assignee: Hunter Douglas Inc., Upper Saddle, NJ (US)

( * ) Notice: Subject to any disclaimer, the term of this patent is extended or adjusted under 35 U.S.C. 154(b) by 51 days.

(21) Appl. No.: 10/197,674

(22) Filed: Jul. 16, 2002

(65) Prior Publication Data

US 2003/0015300 A1 Jan. 23, 2003

Related U.S. Application Data

(60) Provisional application No. 60/306,049, filed on Jul. 16, 2001.

(51) Int. Cl.[7] ..... E06B 9/38

(52) U.S. Cl. ..... 160/168.1 R; 160/176.1 R

(58) Field of Search ..... 160/168.1 R, 176.1 R, 160/174 R, 175 R, 167 R, 902; 49/74.1, 80.1, 87.1, 92.1, 64, 403

(56) References Cited

U.S. PATENT DOCUMENTS

| | | | | | |
|---|---|---|---|---|---|
| 1,625,021 | A | * | 4/1927 | Dodge | 160/167 R |
| 1,952,739 | A | | 3/1934 | Weisfeld | 156/17 |
| 2,105,082 | A | | 1/1938 | Johnson | 156/17 |
| 2,116,357 | A | | 5/1938 | Laborda et al. | 156/17 |
| 2,169,873 | A | | 8/1939 | Clark et al. | 156/17 |
| 2,218,508 | A | | 10/1940 | Gentile | 156/17 |
| 2,244,094 | A | | 6/1941 | Wread | 156/17 |
| 2,274,837 | A | * | 3/1942 | Lawson | 160/175 |
| 2,326,454 | A | | 8/1943 | Gentile | 160/236 |
| 2,410,549 | A | * | 11/1946 | Olson | 160/176.1 R |
| 2,493,234 | A | | 1/1950 | Dunn | |
| 2,603,285 | A | * | 7/1952 | Caligari | 160/168.1 R |
| 2,994,370 | A | * | 8/1961 | Pinto | 160/89 |
| 3,319,695 | A | | 5/1967 | Houmere | 160/168 |
| 5,553,653 | A | | 9/1996 | Rozon | 160/173 |

FOREIGN PATENT DOCUMENTS

| | | |
|---|---|---|
| DE | 29904993 | 7/1999 |
| DE | 19805272 | 12/1999 |
| GB | 2163372 | 2/1986 |
| JP | 1-73297 | 5/1989 |
| WO | 02/06619 | 1/2002 |

* cited by examiner

*Primary Examiner*—David Purol
(74) *Attorney, Agent, or Firm*—Dorsey & Whitney LLP

(57) ABSTRACT

A modular shutter blind system for a window blind application. A window blind is made to look like a window shutter by having airfoil shaped slats which traverse in toward the window when the blind is tilted closed and traverse away from the window and toward the room when the blind is tilted open in order to give the blind the clearance needed to tilt open while making it appear as if the window frame is the shutter blind frame. This traverse motion of the slats is accomplished by having the tilting axis along the centroid of the head rail move in and out while the blind is tilted closed or open respectively.

4 Claims, 110 Drawing Sheets

40A
20
70
40A 130
80
10B
14
110
120
90
21
40A
10B 80
21A
40A
30
50
150
210
60
50
210
210
70
150
20
40A
60
40A
210
80
130
90
40A
30
14
120
120
80
30
120
110
21
16
160
120
21A
210
150
140
160
40A
210
150
30
140

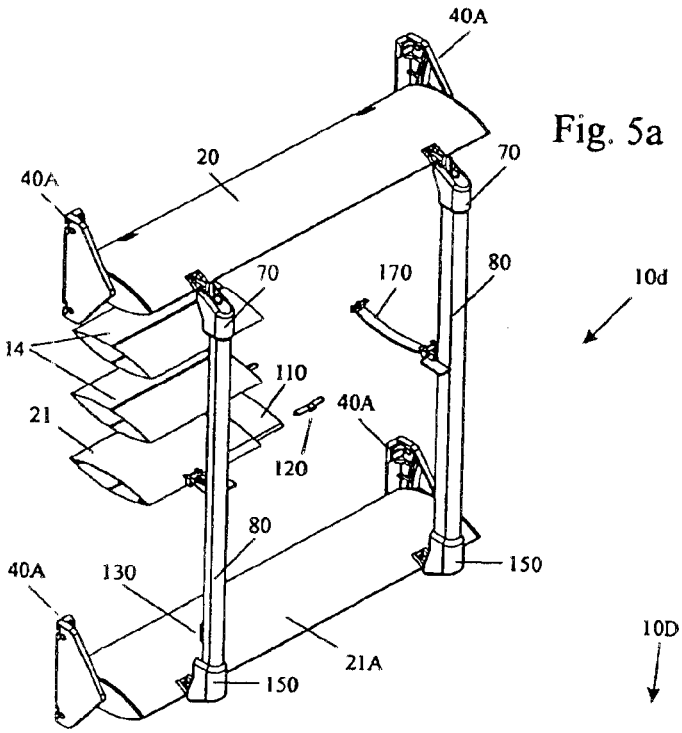
Fig. 5a
Fig. 5b
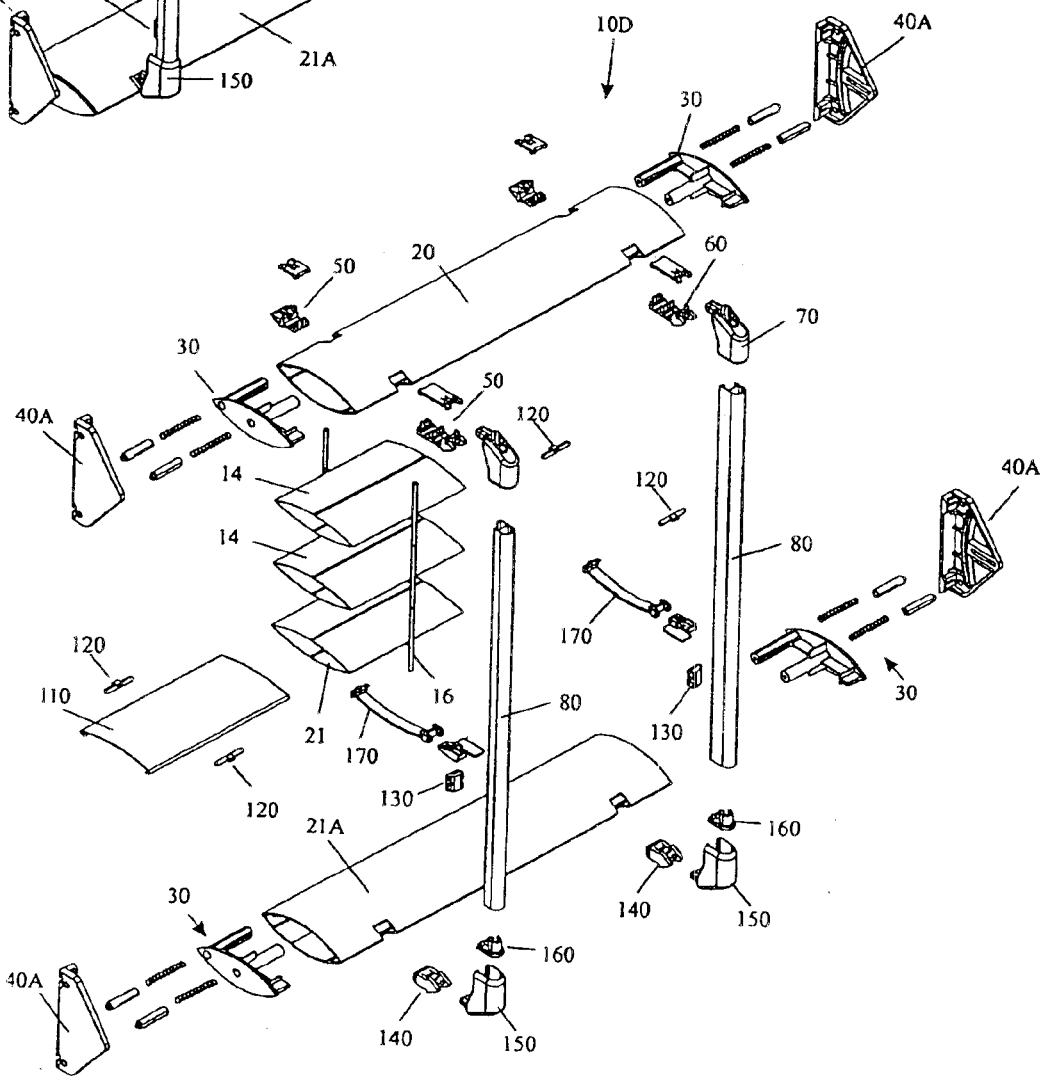

Fig. 24d
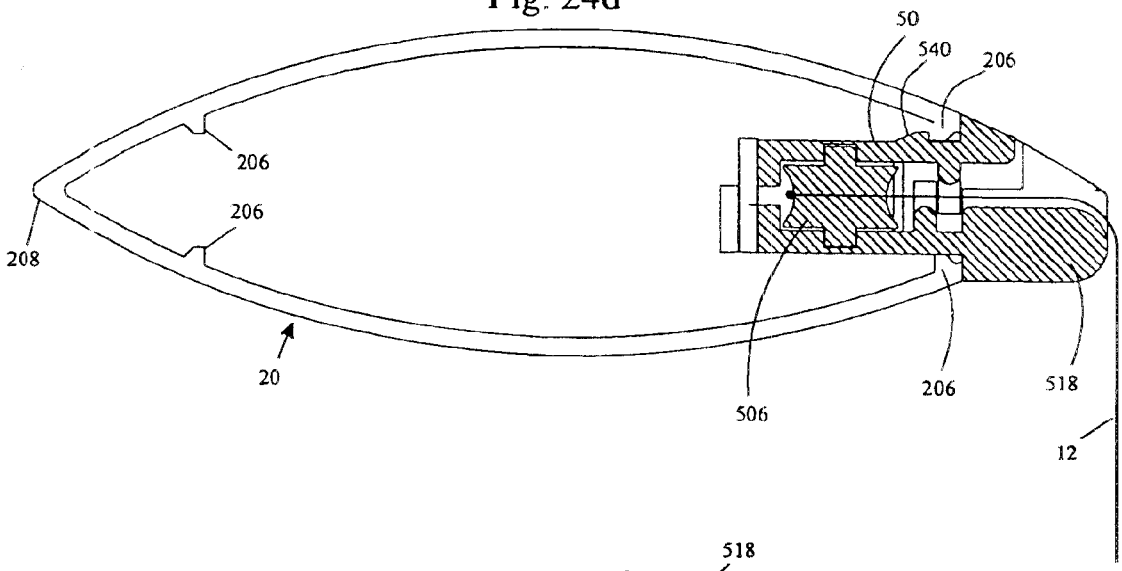
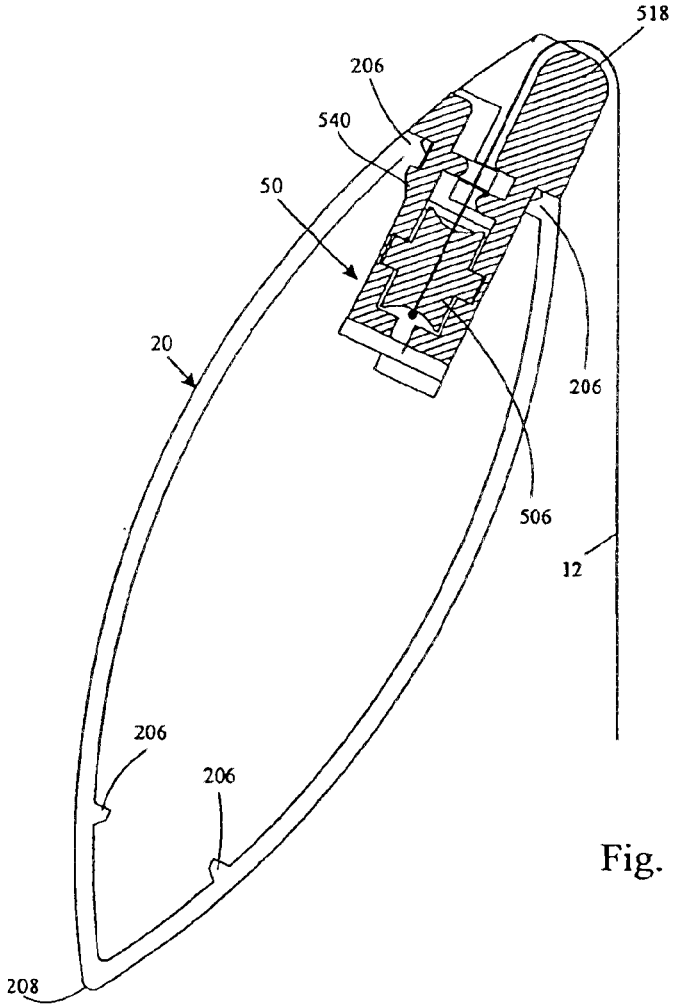
Fig. 24e

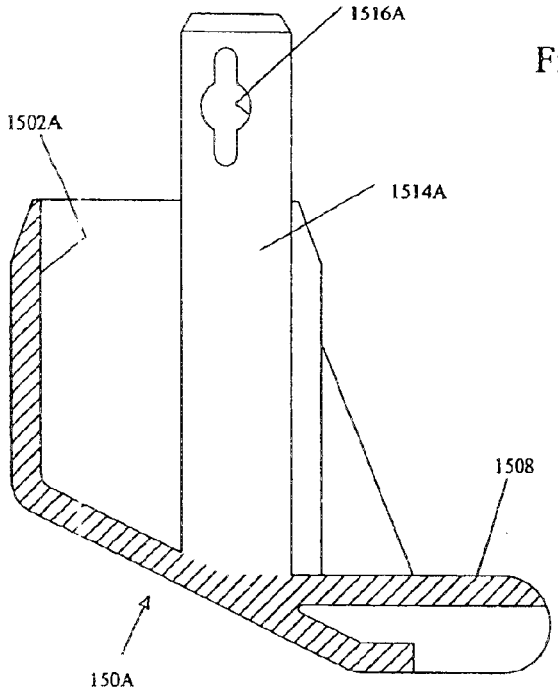
Fig. 42c
Fig. 42d
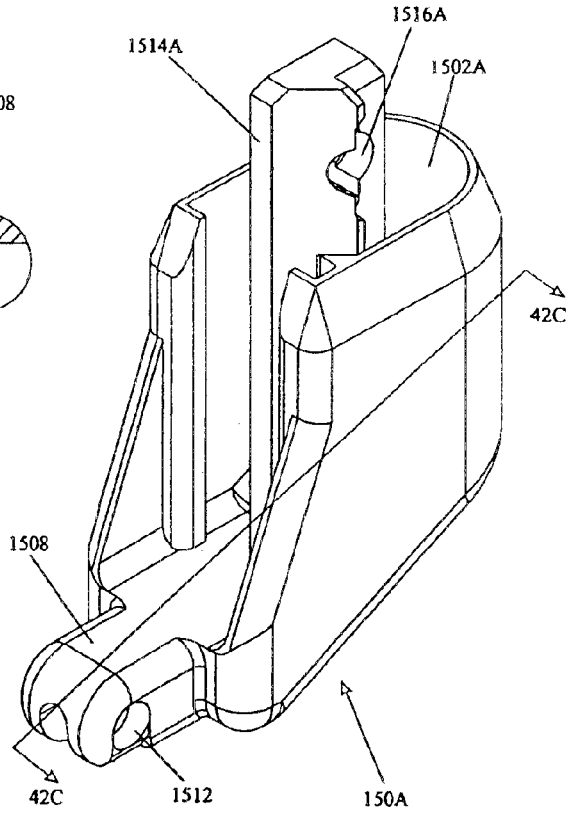
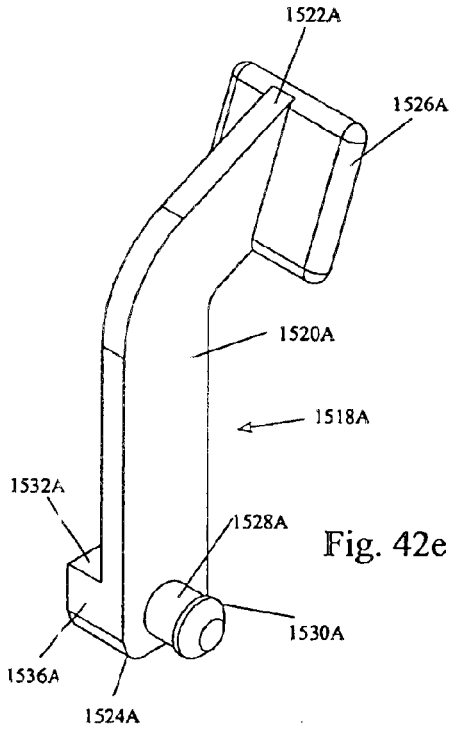
Fig. 42e

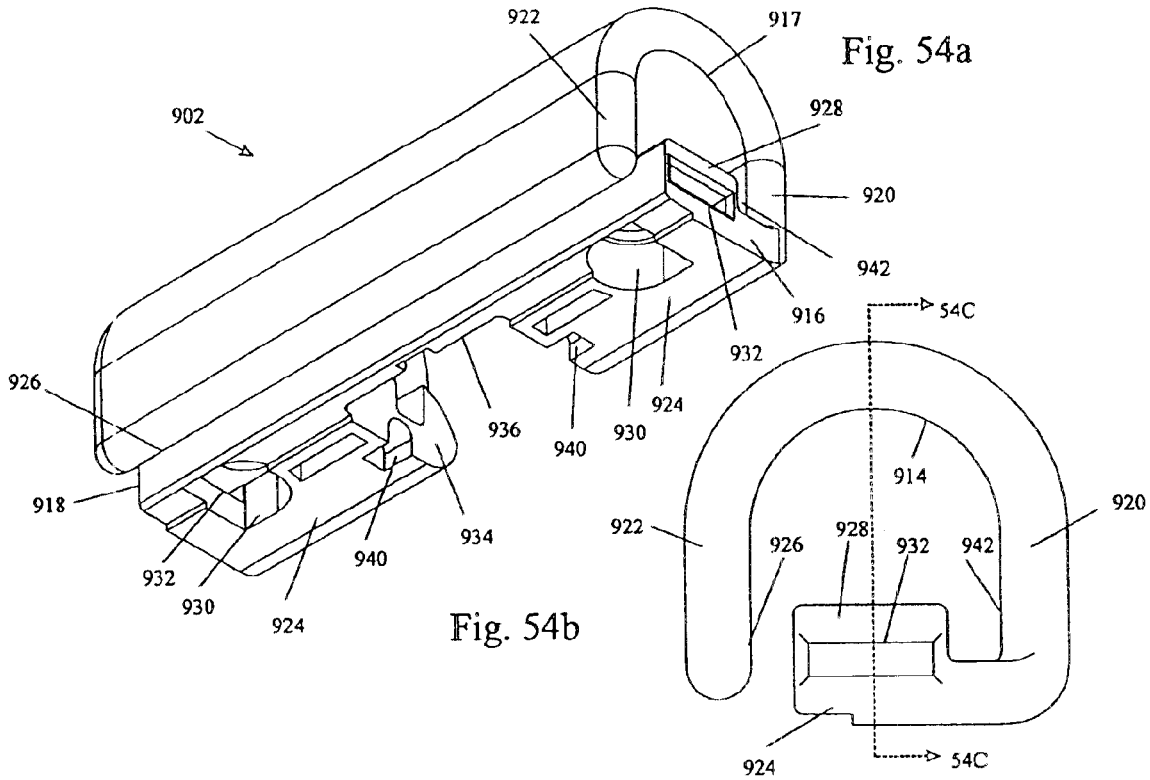
Fig. 54a
Fig. 54b
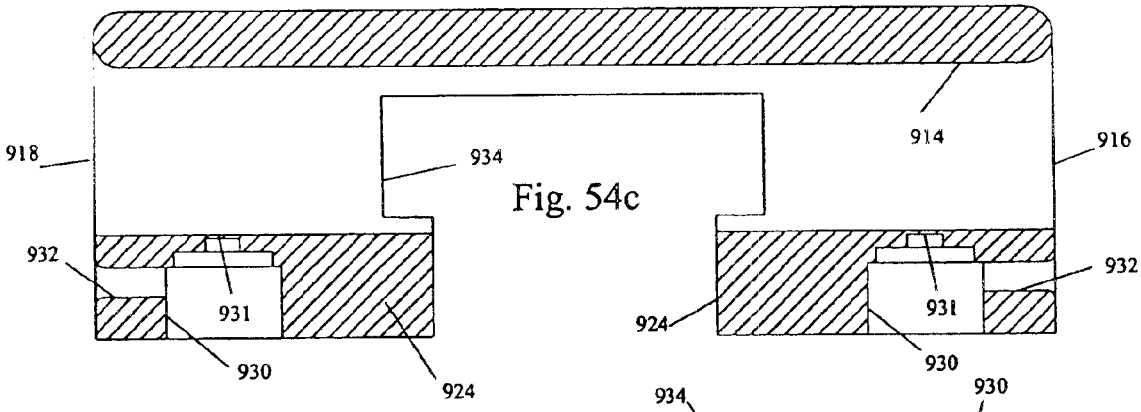
Fig. 54c
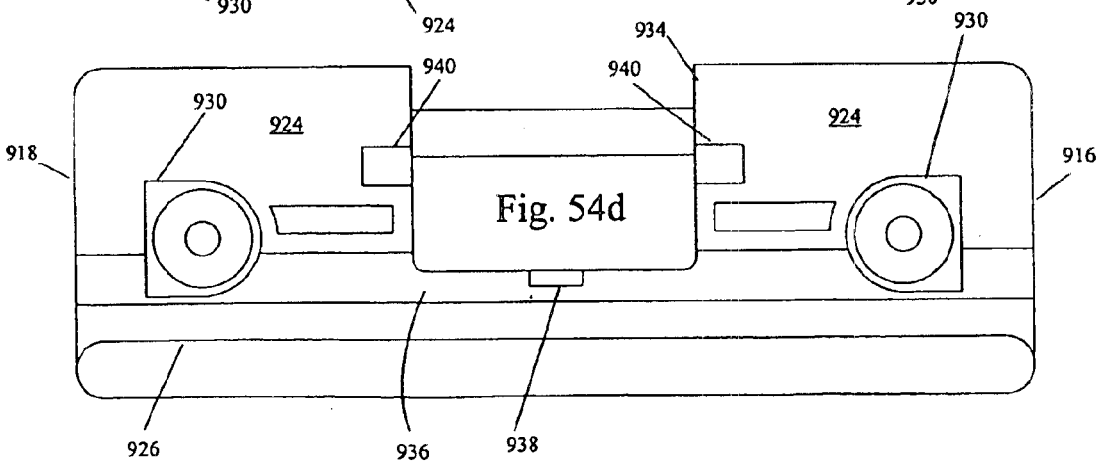
Fig. 54d

Fig. 68a
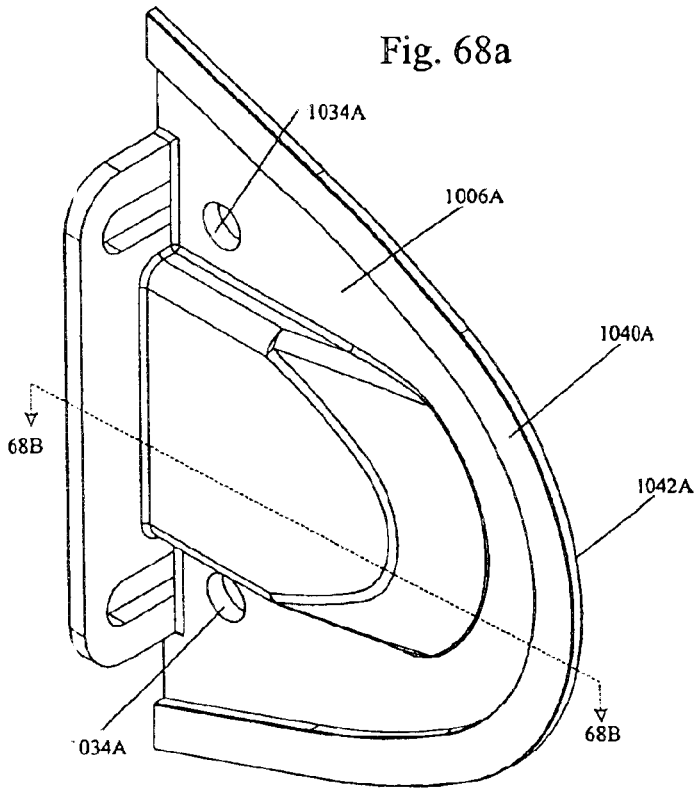
Fig. 68b
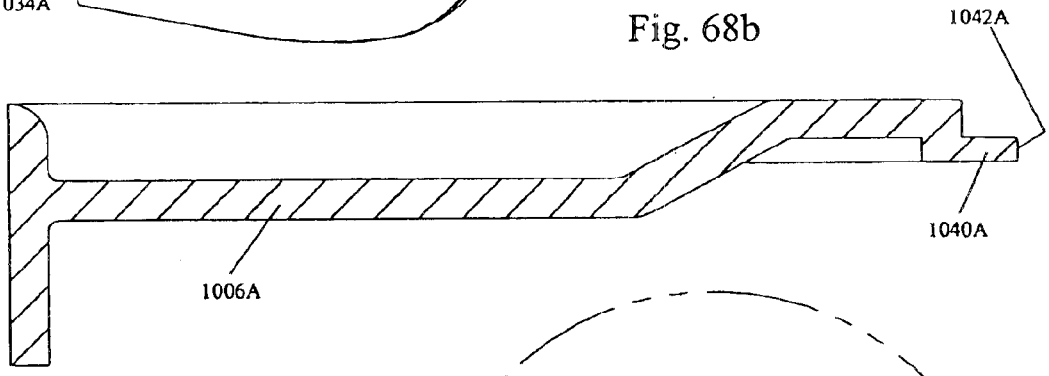
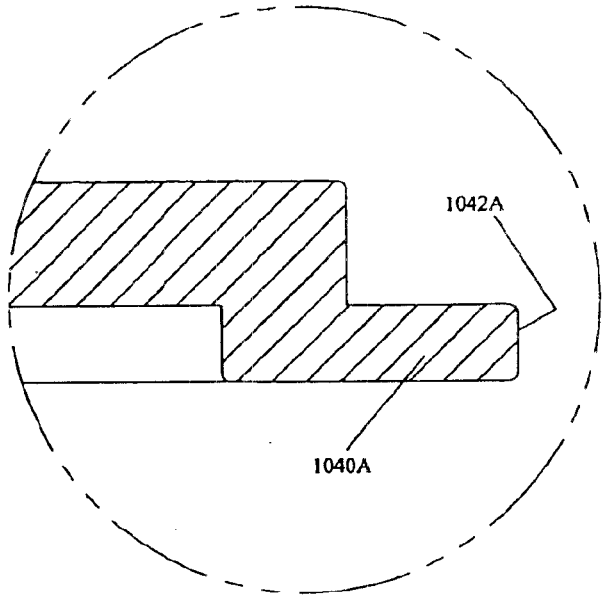
Fig. 68c

Fig. 75a
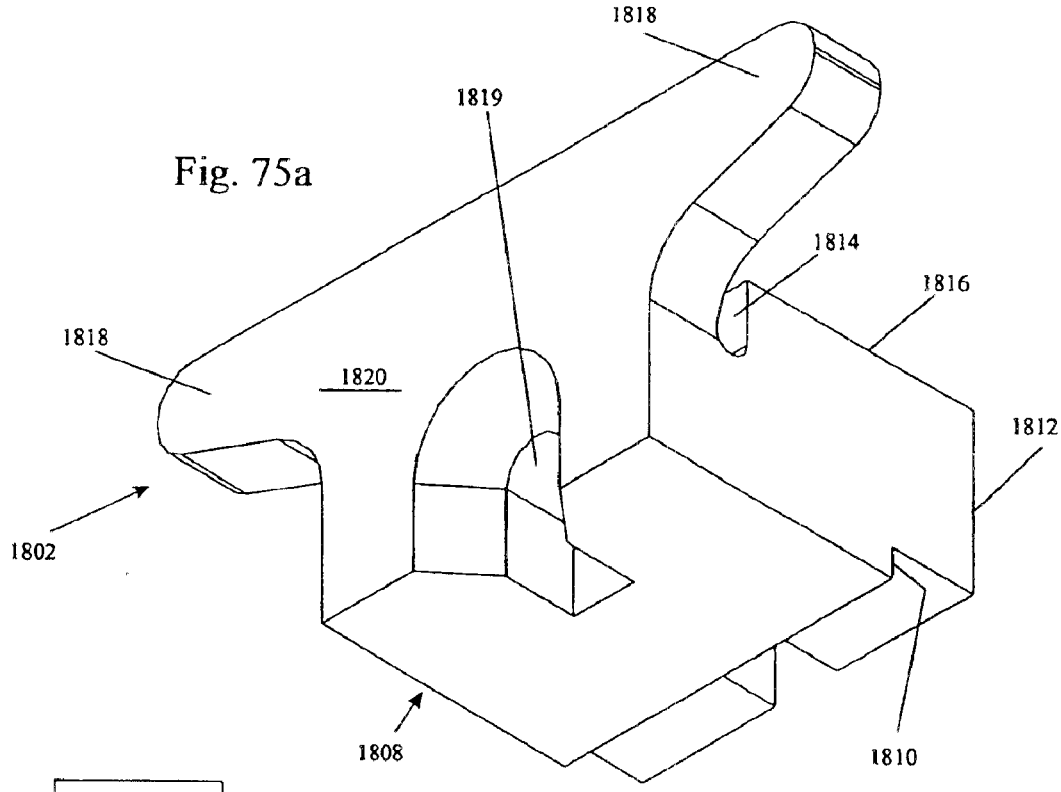
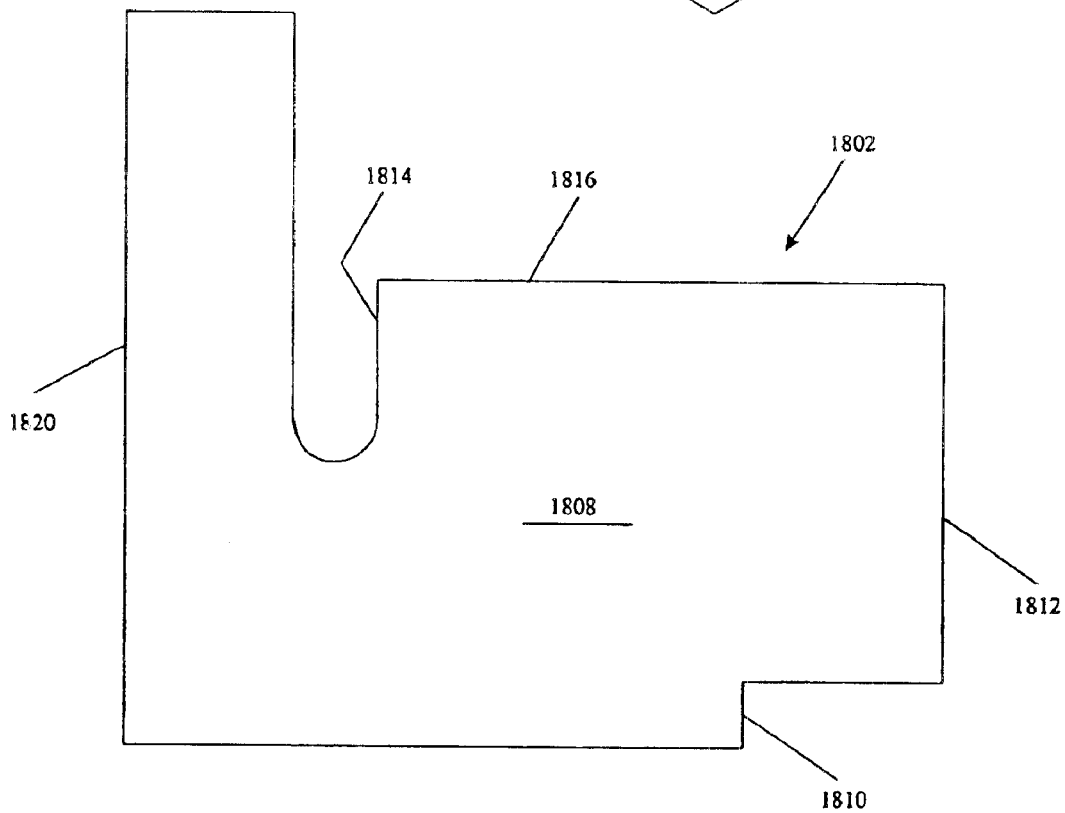
Fig. 75b

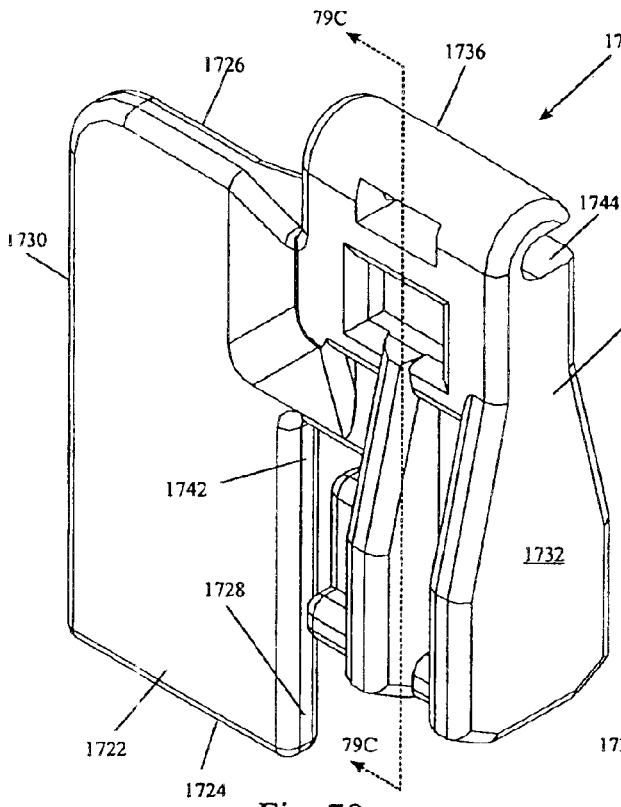
Fig. 79a
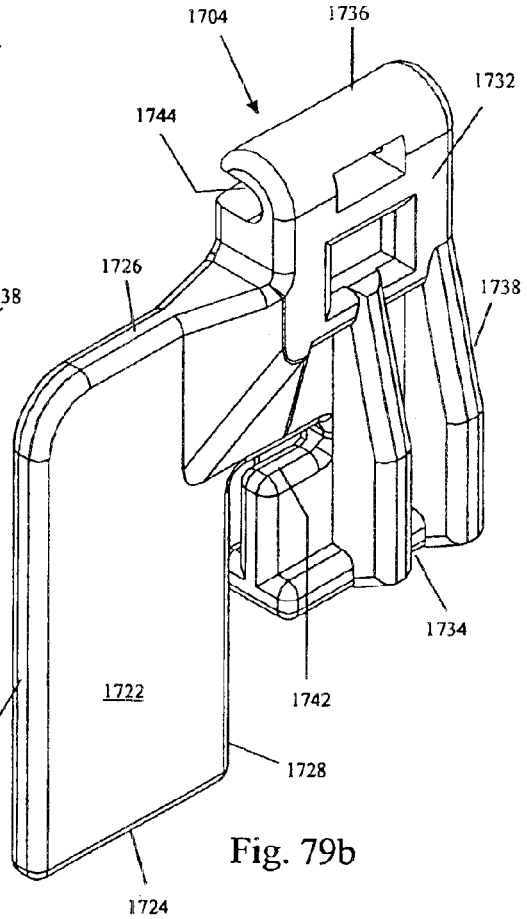
Fig. 79b
Fig. 79c
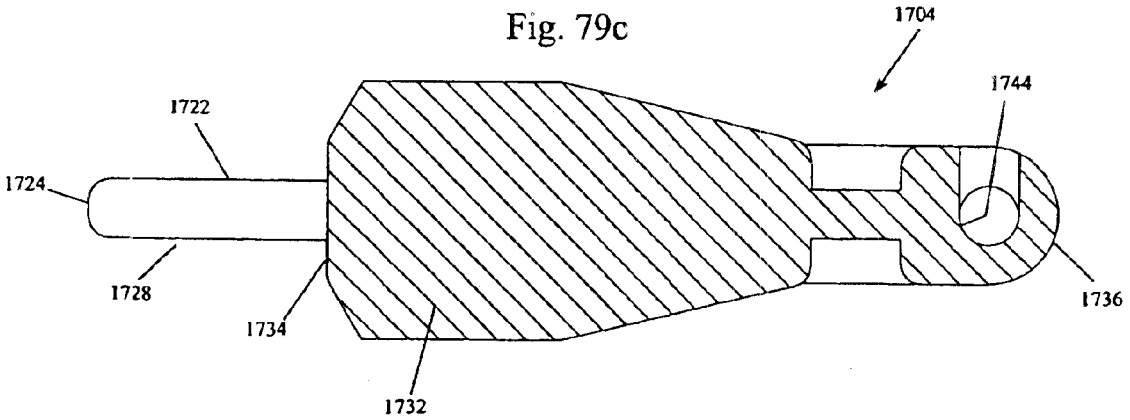

SHUTTER-LIKE COVERING AND HARDWARE FOR ARCHITECTURAL OPENING

CROSS REFERENCE TO RELATED APPLICATIONS

This utility application claims priority to U.S. provisional patent application No. 60/306,049, filed 16 Jul. 2001. This application is also related to a PCT patent application No. PCT/US02/22577, filed on 16 Jul. 2002, for A Shutter-Like Covering for Architectural Openings, which claims priority to U.S. provisional patent application No. 60/305,947, filed 16 Jul. 2001 and is hereby incorporated by reference in its entirety.

BACKGROUND OF THE INVENTION

The present invention relates to coverings for architectural openings, and more specifically to horizontal blinds, such as Venetian blinds designed to emulate the look of window shutters.

Venetian Blinds

Typically, a Venetian blind has a fixed top head rail which both supports the blind and hides the mechanisms used to raise and lower or open and close the blind. The raising and lowering is done by a lift cord attached to the bottom rail (or bottom slat). Thus, when raising a blind, at first only the bottom rail is being raised and the amount of force required is small. As the bottom rail is raised further, more of the slats are stacked on top of the bottom rail and thus progressively more force is required to continue to raise the blind. The largest amount of force will be required at the very top when literally the entire blind is being raised. In contrast, when the blind is fully lowered, only the bottom rail is supported by the lift cord. The rest of the weight of the blind is supported by the ladder tape which has tilt cables running to, and supported by, the head rail.

The slats that are supported from the head rail may be allowed to tilt so as to open the blind to allow a maximum of light through the blind, or to close the blind with the room side down (the edge of the slats which is closest to the room is facing down, which means that the other edge of the slats, the edge which is closest to the window or the wall, will be facing up), or close the blind with the room side up. In some of the prior art, such as U.S. Pat. No. 2,116,356 □Laborda□, U.S. Pat. No. 2,218,508 □Gentile□, U.S. Pat. No. 2,244,094 □Wread□, U.S. Pat. No. 1,952,739 □Weisfeld□, and U.S. Pat. No. 2,105,082 □Johnson□, the head rail of the blind does pivot in order to tilt the blind. However, in these designs, the head rail does not hide the mechanisms used to raise and lower or open and close the blind. Also, as will be discussed later, in these references in which the head rail pivots, it pivots along a fixed axis, typically along the centroid of the head rail.

In order to accommodate the raising and lowering of the blind, lift cords are generally present in a Venetian blind, hanging off of one end of the head rail. In order to facilitate the raising of the blind stack, the lift cords generally have at least a 1-1 ratio of travel of the lift cord to travel of the blind stack. A higher ratio may be used (such as a 2-1 ratio) so that the lift cord travels twice as far as the blind stack so that the effort required to raise the blind stack is approximately one half the effort that would be required if the ratio were 1-1. Ratios lower than 1-1 are not generally used, because the effort required to raise the stack becomes too large to be comfortable and convenient for the user. Tilt cables or tilt wands may also be present to accommodate the tilting open or tilting closed of the blind stack.

Shutters

Shutters typically have louvers (which are the equivalent of the slats in a blind), but these louvers cannot be raised or lowered. They can only be tilted open or closed. In many instances, the shutter frame may be hinged so that the entire shutter may be swung open or closed. There are no cables or cords hanging off a shutter. The tilting of the louvers is typically accomplished by a tilt bar which is pivotally connected to every louver. Each of the louvers tilts along a fixed axis, typically along the centroid of the louver. In shutters, the louvers are mounted on a frame. The horizontal pieces of the frame are called rails, and the vertical pieces of the frame are called stiles. The stiles attach to the rails to enclose the louvers. There is a clearance requirement between the shutter and the window in order for the louvers to have room to tilt open. This clearance is not noticeable, even when the shutter is tilted closed, because the stiles are always framing the louvers.

SUMMARY OF THE INVENTION

The 'louvers' of the blind of the present invention are of similar shape to the louvers of a shutter. Even the head rail and the bottom rail of this blind are very similar to the balance of the louvers of this shutter blind. However, the shutter blind of this present invention does not have the stiles of a shutter. Thus, what really completes the illusion to help make this shutter blind system look like a shutter is the fact that all the louvers of this shutter blind, including the head rail and the bottom rail, look essentially the same, and that the entire blind stack (including the pivoting head rail and the pivoting bottom rail) pivots in unison along the elongated pivot at the centroid of each of the louvers. In addition, the mounting arrangement provides for the elongated pivot axis of each louver to traverse inwardly toward the window when the louvers tilt closed, and outwardly, away from the window, when the louvers tilt open, so that the window frame itself creates the appearance of the frame that would be provided by the rails and stiles of a traditional shutter. Thus, even without traditional shutter rails and stiles, the shutter blind system of the present invention is effectively able to give the illusion that the blind is a shutter, with the window frame taking the place of the shutter frame.

The louvers tilt by virtue of the fact that they are suspended off of a tilting head rail, which, in some of the embodiments described, tilts by means of a tilt bar. The lift cords are hidden inside the head rail, and they are hidden within and terminate inside of the tilt bar, so they are not visible to the user. In the event that a lift cord is visible and accessible to the user in an embodiment of the present invention, this is a single lift cord rather than the multiple cords usually available in the prior art.

Another objective of the present invention is to provide a shutter blind system which is so light that the raising or lowering of the blind stack may be readily accomplished even at less than a 1-1 ratio of travel of the lift cord to travel of the blind stack. However, the same shutter blind system may be readily modified, (by means of springs or spring motors, or even by using transmissions and/or lift stations as described in our U.S. patent application Ser. No. 60/125,776 □Counterbalanced Transport System for Blinds□, which is hereby incorporated by reference) to work even when using much heavier shutter blind louvers which would otherwise necessitate a higher than 1-1 ratio of travel of the lift cord to travel of the blind stack.

Thus, the present invention puts forth a complete 'shutter blind'□ system with a number of components working together to make this complete shutter blind system. However, a particular embodiment of a shutter blind system made in accordance with the present invention may not necessarily incorporate all the components disclosed in this application. For instance, one embodiment may have the capability to both tilt the blind open and closed and to raise and lower the blind, while another embodiment may only allow tilting of the blind, with no capability to raise or lower the blind. Furthermore, individual components disclosed in this application may be useful and may be used individually or in combination with other components when putting together a blind other than the shutter blind disclosed in this application. By the same token, individual components disclosed in our previous U.S. patent application Ser. No. 60/125,776 'Counterbalanced Transport System for Blinds' may be incorporated to enhance the performance of the shutter blind of the present invention, as discussed earlier.

In an effort to logically and methodically cover the material of this invention, typical preferred embodiments of complete shutter blind systems made in accordance with this invention are first described in general terms in order to identify the components which make up these embodiments. Then, each component of the preferred embodiment is described in detail. Then, different embodiments of the various particular components are described.

BRIEF DESCRIPTION OF THE DRAWINGS

FIG. 5A is a partially broken away perspective view of a fifth embodiment of a shutter blind made in accordance with the present invention, including double tilt bars where the tilt bars conceal the lift cords and the tilt cables, and a provisional manual lift for raising or lowering the blind;

FIG. 5B is an exploded view of the shutter blind of FIG. 5A;

FIG. 24D is a section view of the cord glide of FIG. 23A mounted on the head rail as shown in FIG. 1A, showing the routing of the lift cord when the louver is in the tilted open position;

FIG. 24E is a section view, identical to that of FIG. 24D but showing the routing of the lift cord when the louver is in the tilted closed position;

FIG. 42C is a sectional view along the line 42C—42C of FIG. 42D;

FIG. 42D is a perspective view of the bottom end cap housing of the operator bottom bar, adjustable attachment assembly of FIG. 42A;

FIG. 42E is a perspective view of the lever of the operator bottom bar, adjustable attachment assembly of FIG. 42A;

FIG. 47A is a perspective view of a mounting bracket as shown in FIG. 2B;

FIG. 47B is the same mounting bracket as FIG. 47A but showing the back side of the bracket;

FIG. 47C is a side view of the mounting bracket of FIG. 47A;

FIG. 48A is an exploded perspective view of a two-piece mounting bracket which may be used instead of the mounting bracket shown in FIG. 47A;

FIG. 48B is an assembled perspective view of the two-piece mounting bracket of FIG. 48A;

FIG. 49 is an enlarged perspective view of another two-piece mounting bracket that could be used instead of the bracket of FIG. 47A, the bracket having an open slot in front to insert a fixed-end end cap;

FIG. 50A is a perspective view of a sliding-slot mounting bracket as shown in FIG. 1B, with the sliding slot in the extended position, corresponding to when the louvers are in the open position;

FIG. 50B is the same view as in FIG. 50A, but with the sliding slot in the retracted position, corresponding to when the louvers are in the tilted closed position;

FIG. 50C is an exploded perspective view of the sliding-slot mounting bracket of FIG. 50A;

FIG. 50D is a detailed perspective view showing a slight modification of one of the slotted openings of the mounting bracket of FIG. 50A;

FIG. 50E is a broken away schematic of the position of the head rail relative to modification of the slotted opening shown in FIG. 50D;

FIG. 50F is a cut away, enlarged, section view along line 50F—50F of FIG. 50E;

Figure 1A:
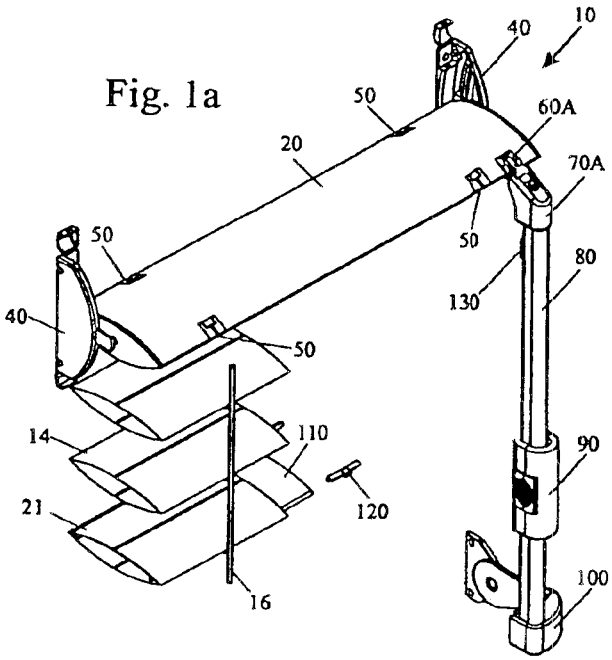
FIG. 1A is a partially broken away perspective view of a first embodiment of a shutter blind made in accordance with the present invention, including spring loaded end caps on the head rail, sliding slot mounting brackets, ball and socket attachment of the tilt bar to the head rail, a hand control for raising of the louvers, and a single tilt bar.
Figure 1B:
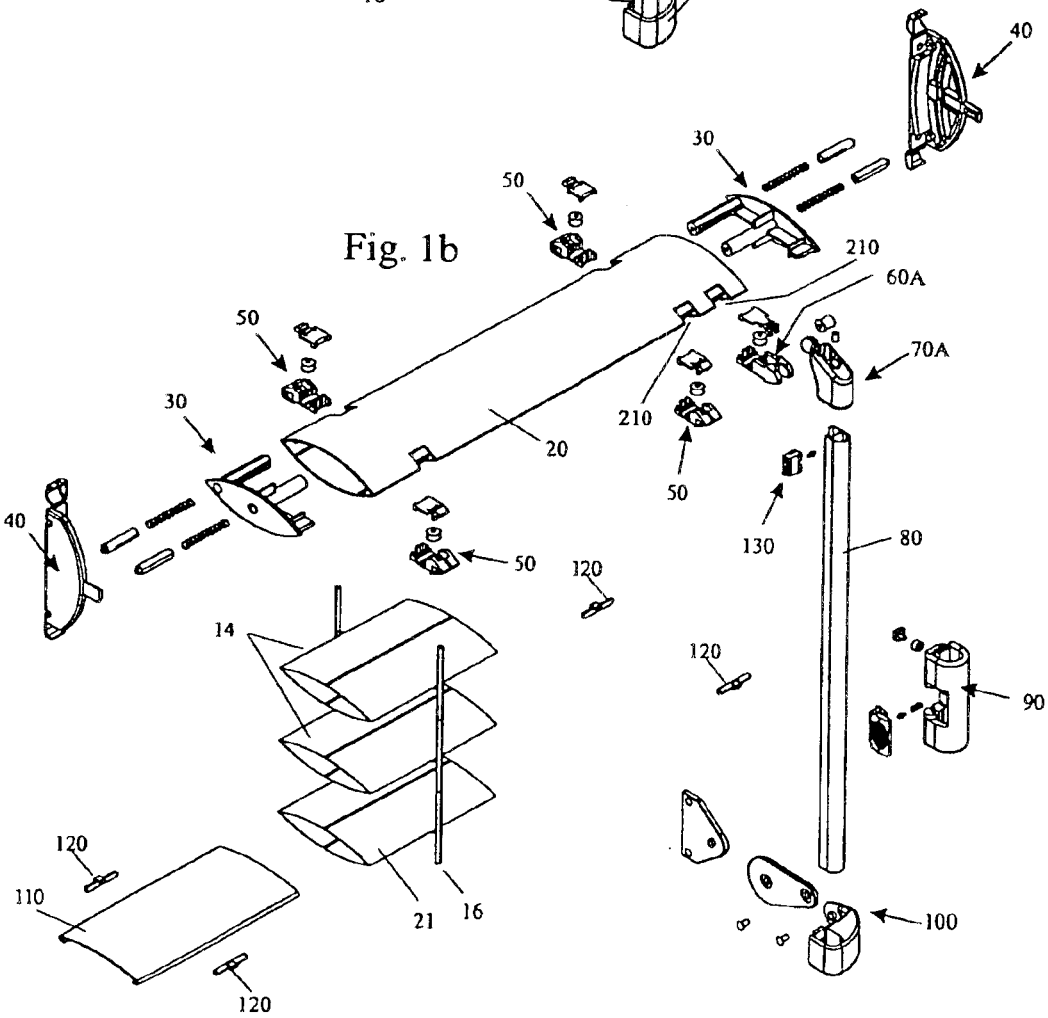
FIG. 1B is an exploded view of the shutter blind of FIG. 1A.
Figure 2A:
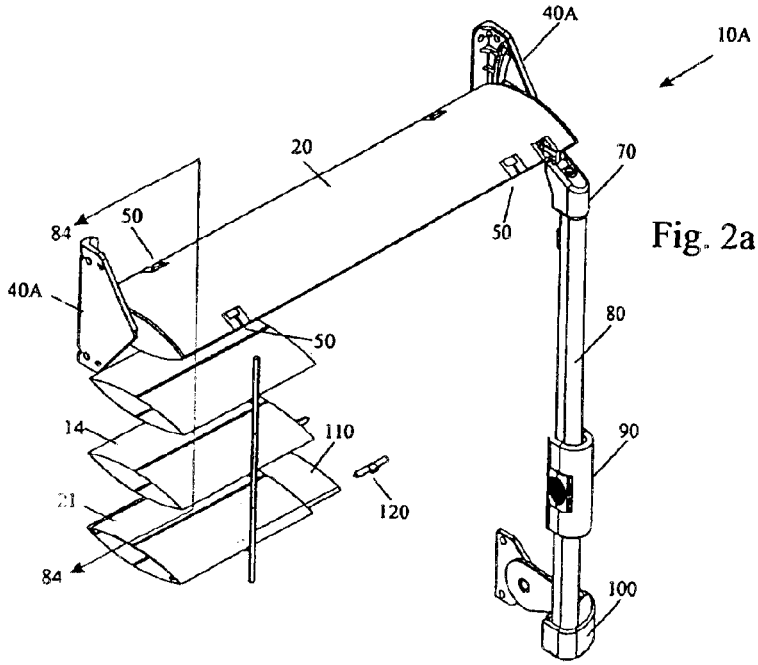
FIG. 2A is a partially broken away perspective view of a second embodiment of a shutter blind made in accordance with the present invention, including a different type of mounting bracket.
Figures 3A, 3B:
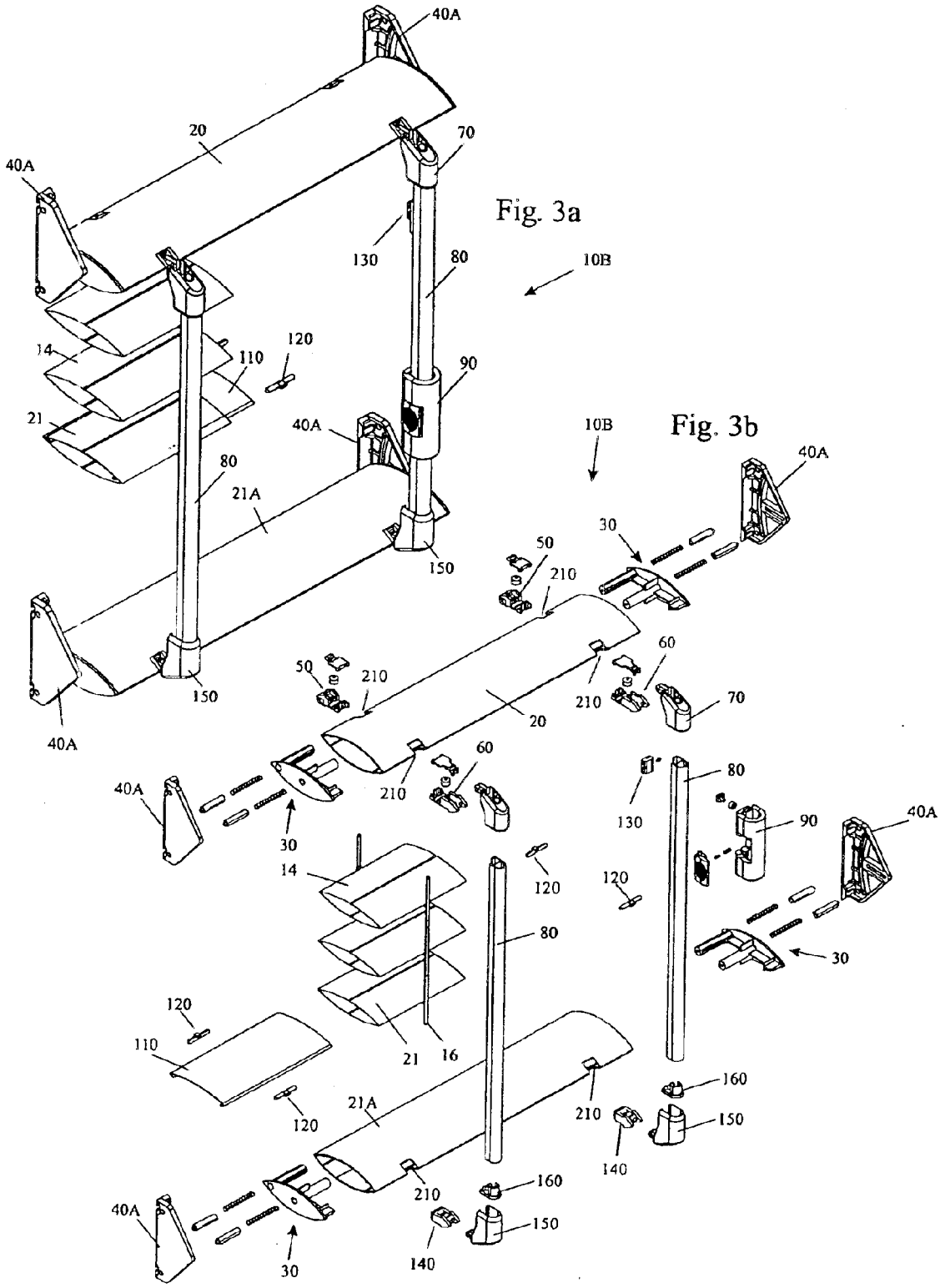
FIG. 3A is a partially broken away perspective view of a third embodiment of a shutter blind made in accordance with the present invention, including double tilt bars where the tilt bars conceal the lift cords and the tilt cables.
FIG. 3B is an exploded view of the shutter blind of FIG. 3A.
Figures 4A, 4B:
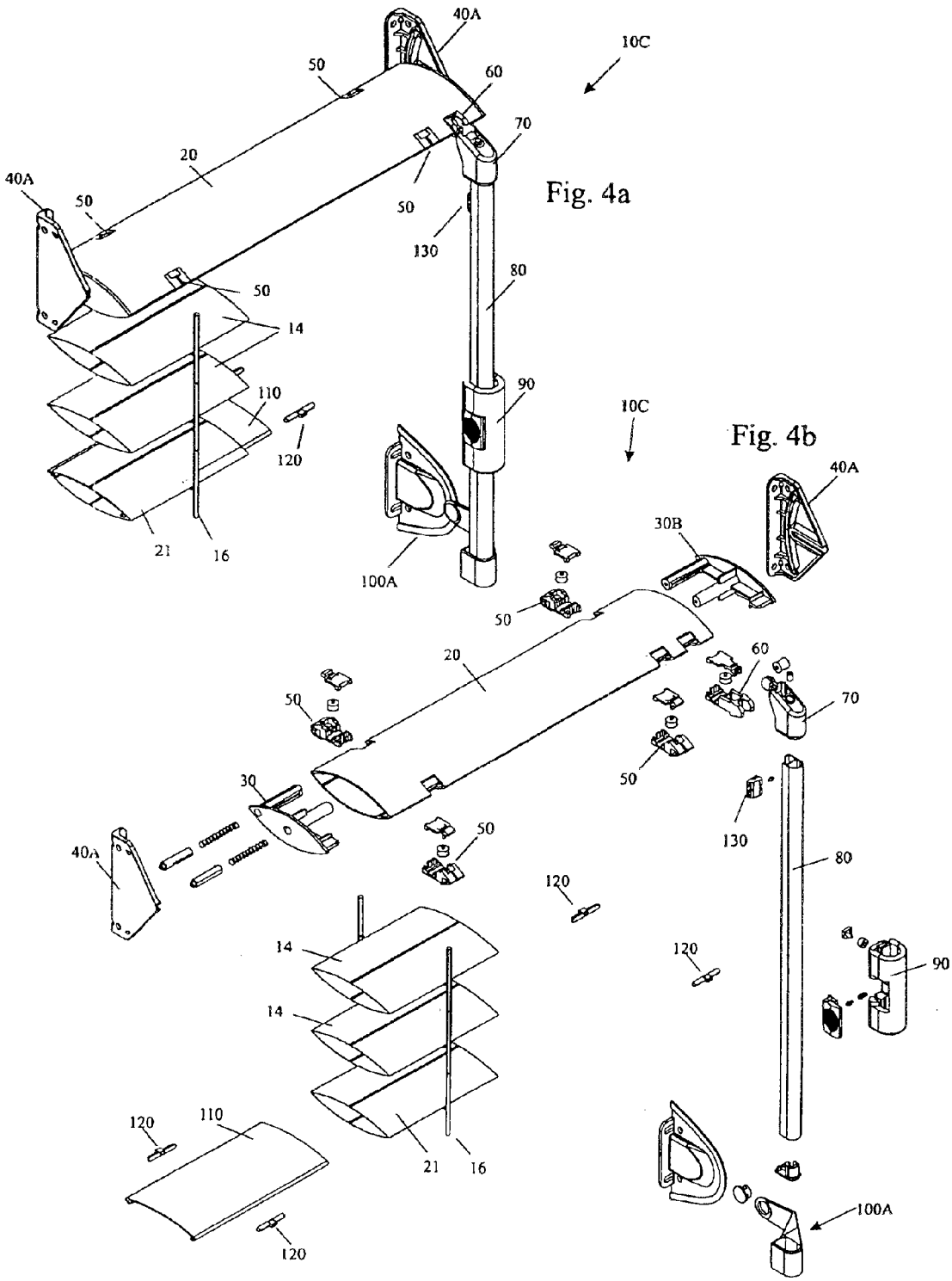
FIG. 4A is a partially broken away perspective view of a fourth embodiment of a shutter blind made in accordance with the present invention, including a different type of pivot linkage, and a different type of end cap.
FIG. 4B is an exploded view of the shutter blind of FIG. 4A.
Figure 5C:
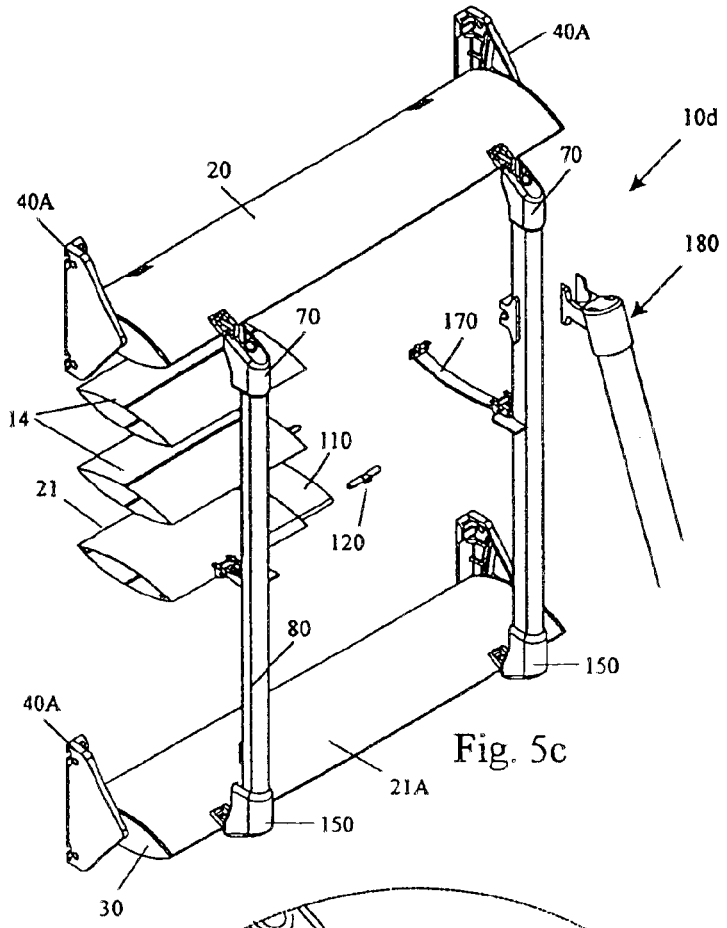
FIG. 5C is a partially broken away perspective view of the same shutter blind as FIG. 5A but including a custodial wand.
Figure 5D:
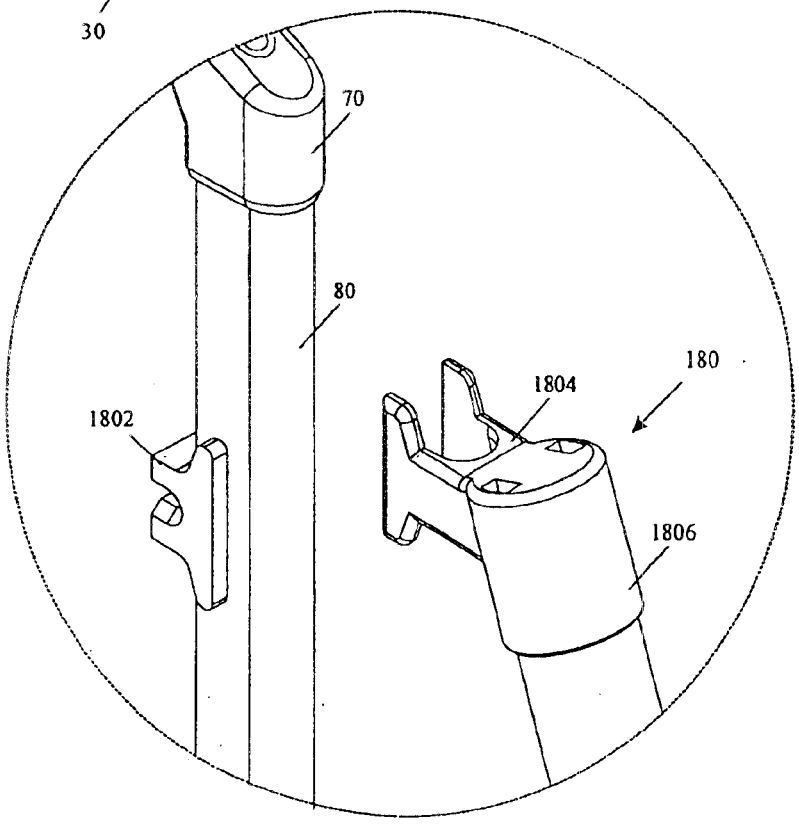
FIG. 5D is an expanded close-up view of the custodial wand of FIG. 5C.
Figure 5E:
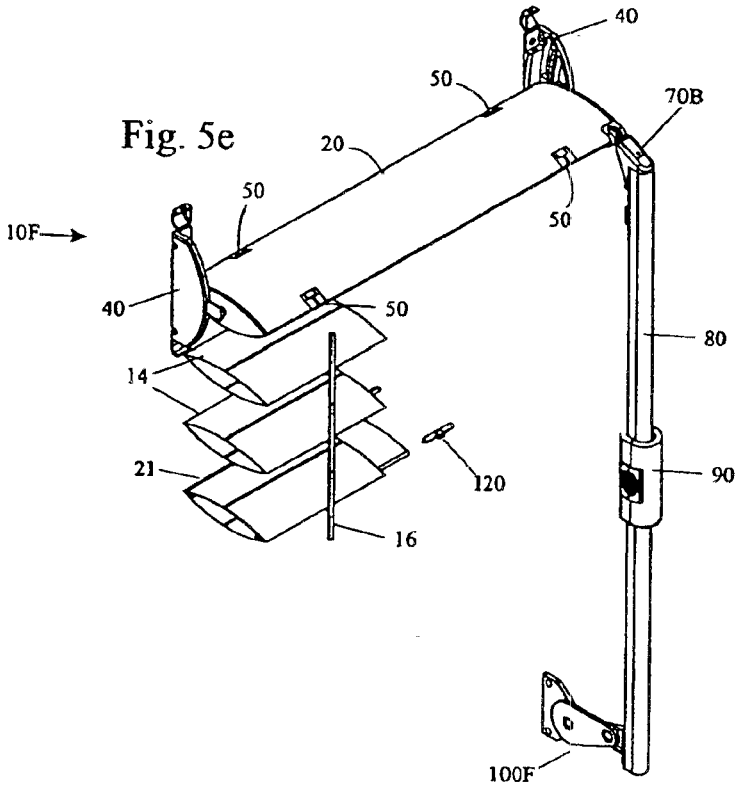
FIG. 5E is a partially broken away perspective view of a sixth embodiment of a shutter blind made in accordance with the present invention, which is very similar to the first embodiment of FIG. 1A except the tilt bar 80 is shifted to the very end of the head rail so that a slightly different end cap, top bar attachment, top end cap, and bottom pivot bracket are used.
Figure 5F:
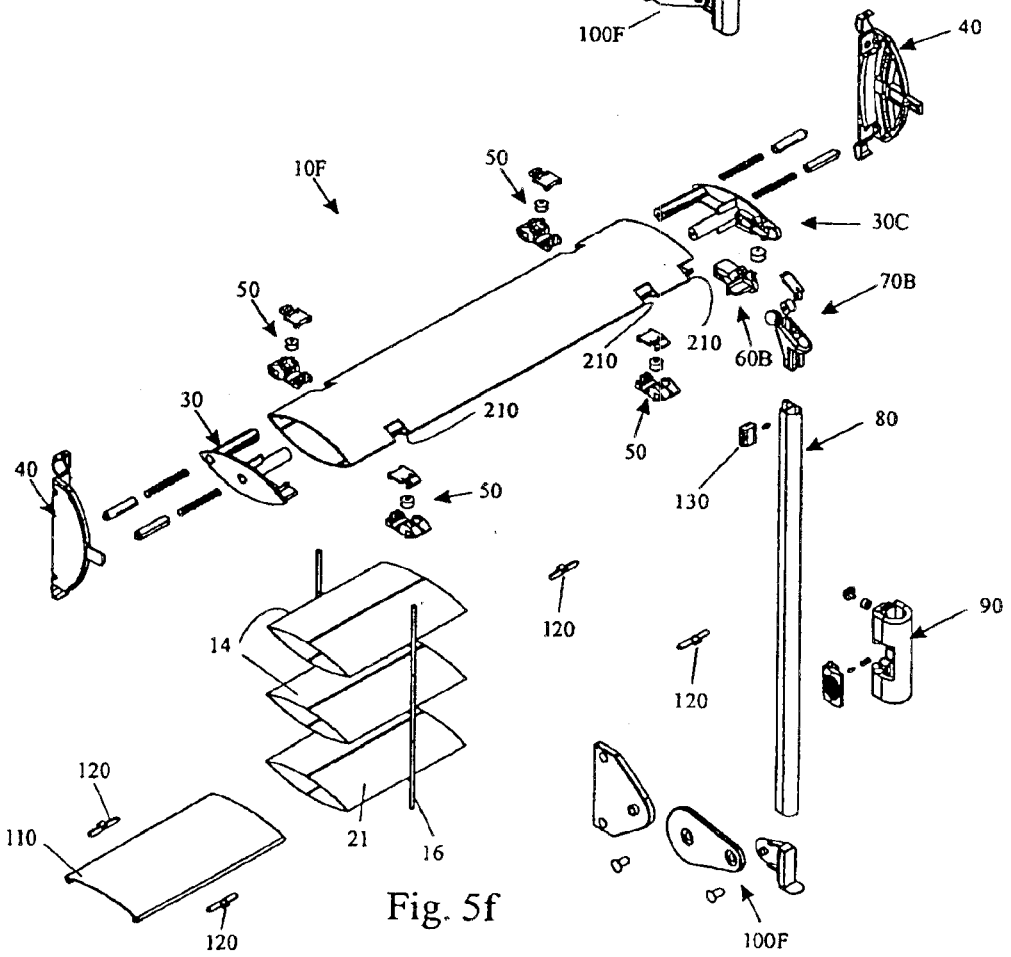
FIG. 5F is an exploded perspective view of the shutter blind of FIG. 5E.
Figure 51:
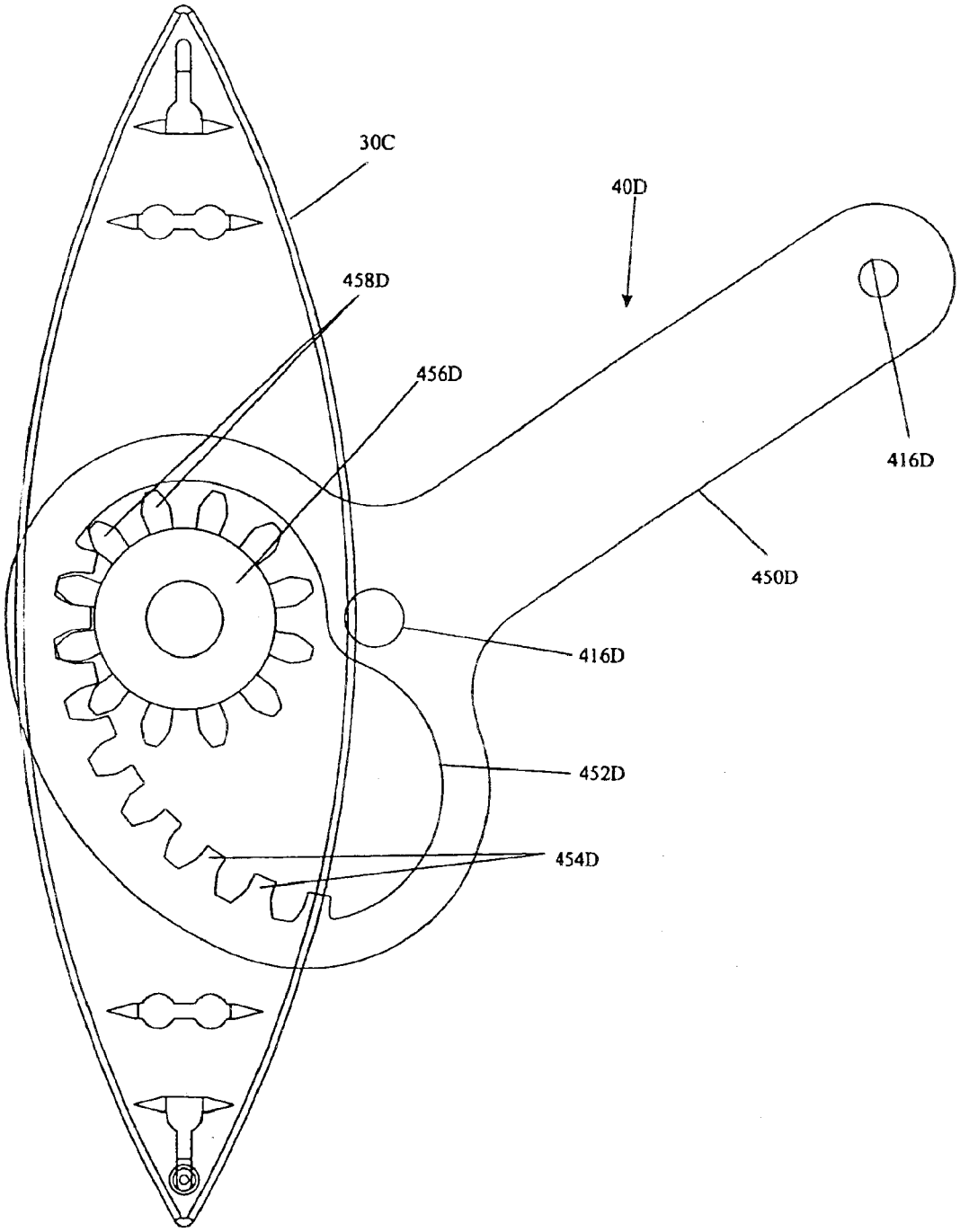
Figure 51A:
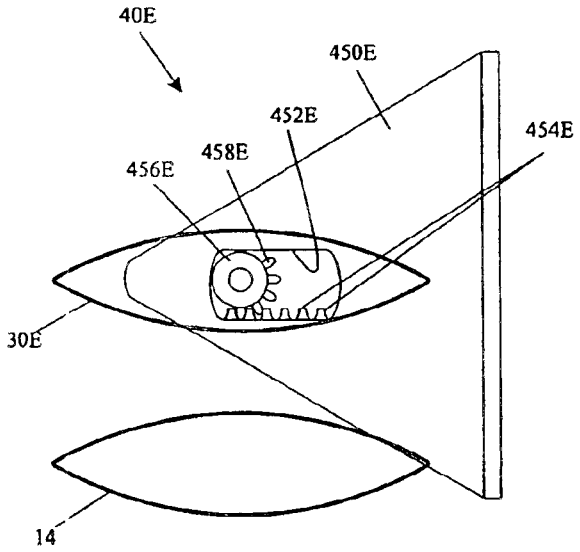
Figure 51B:
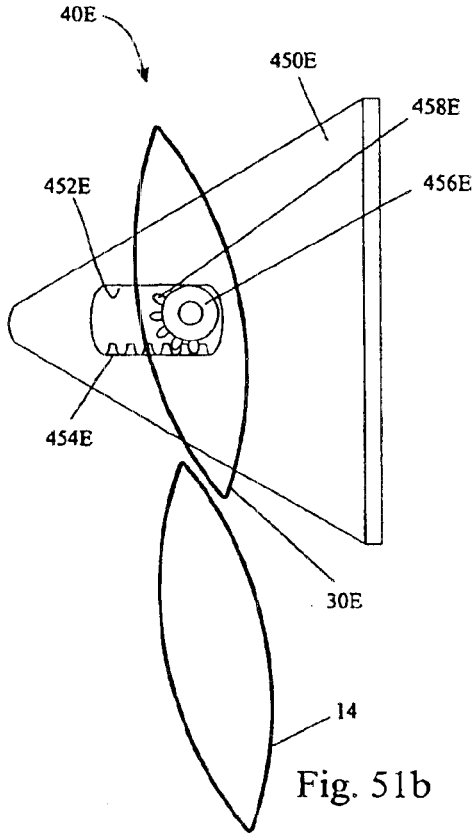
Figure 51C:
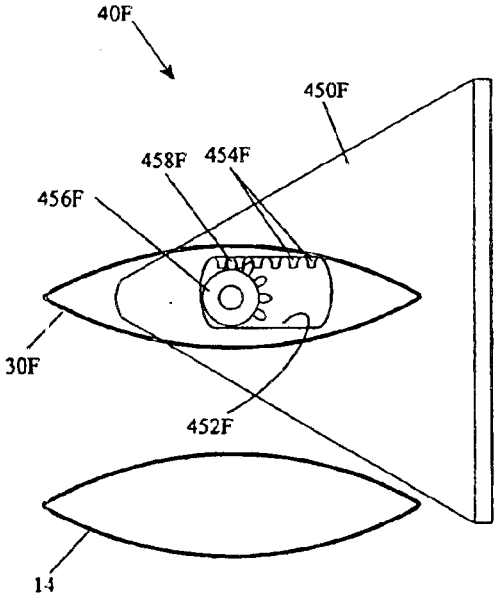
Figure 51D:
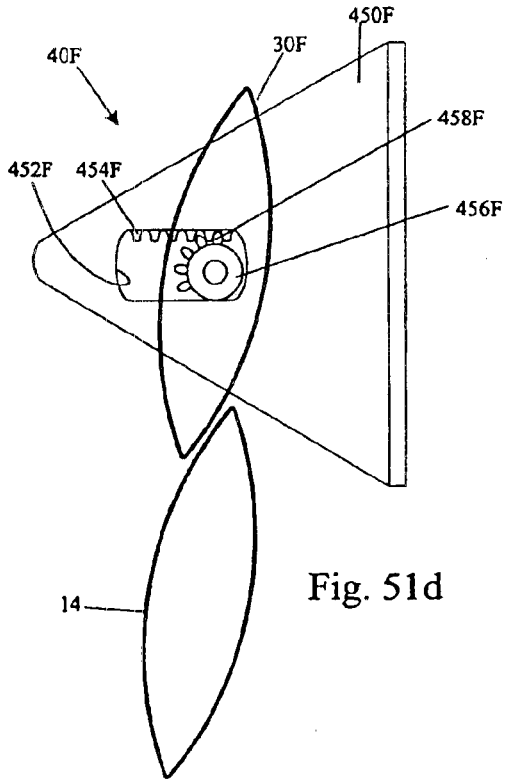
Figure 51E:
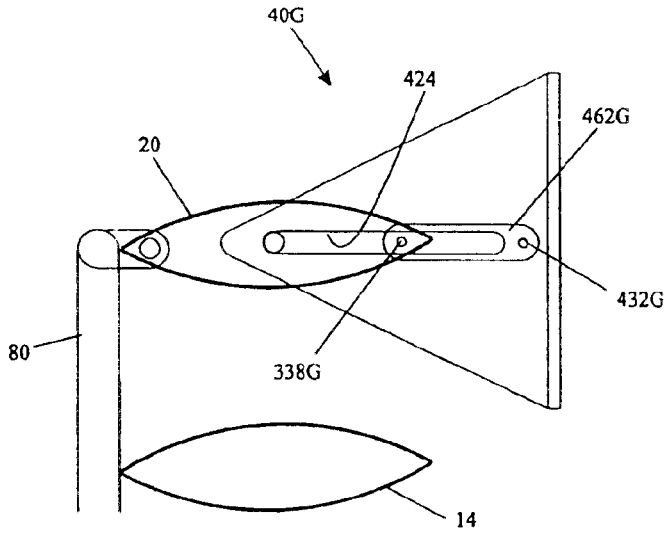
Figure 51F:
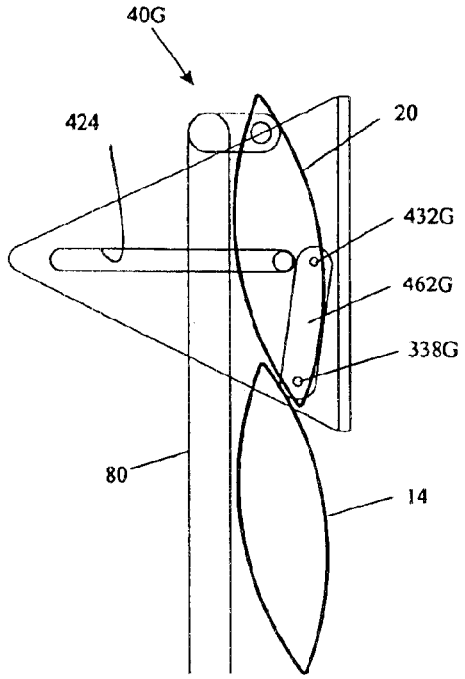
Figure 51G:
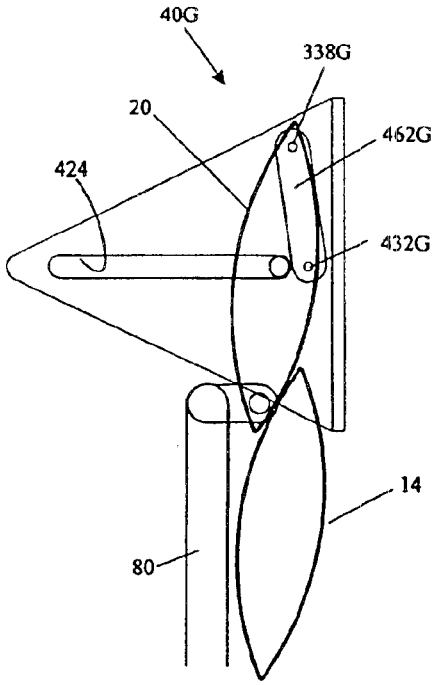
Figures 52, 53A, 53B:
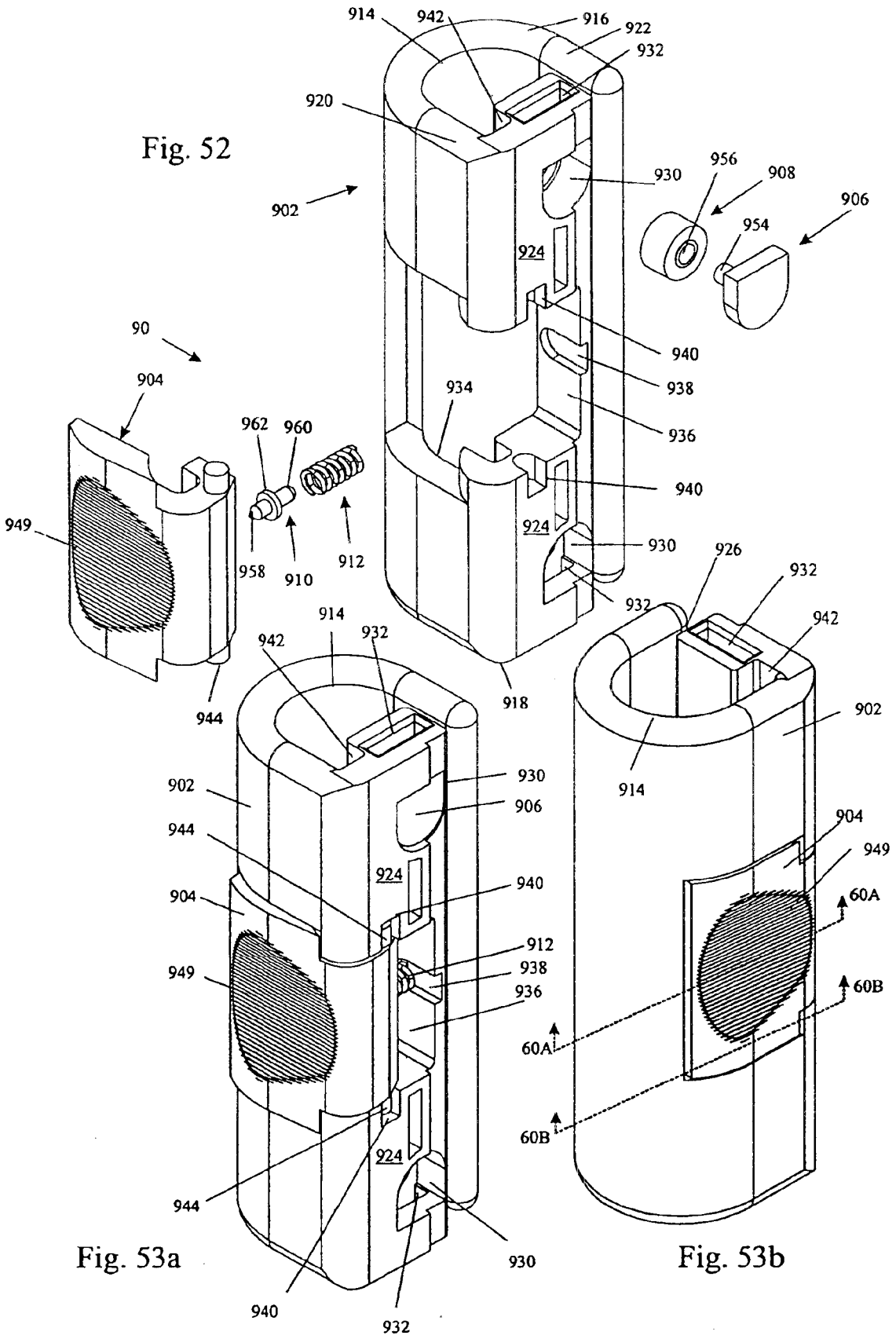
Figure 55A:
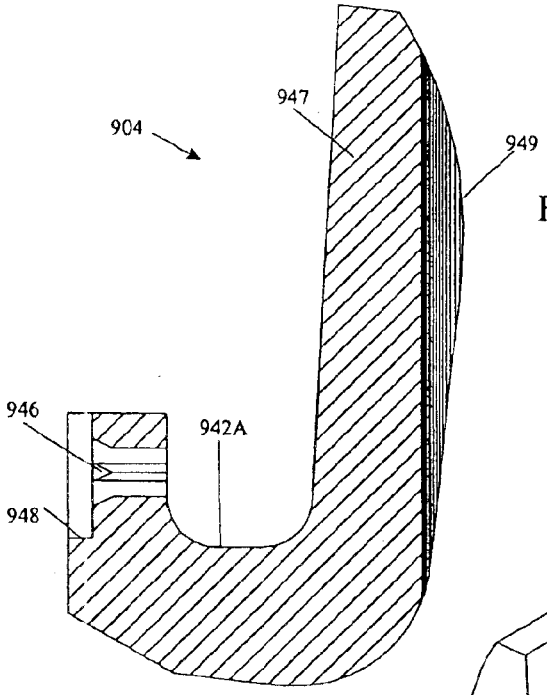
Figure 55B:
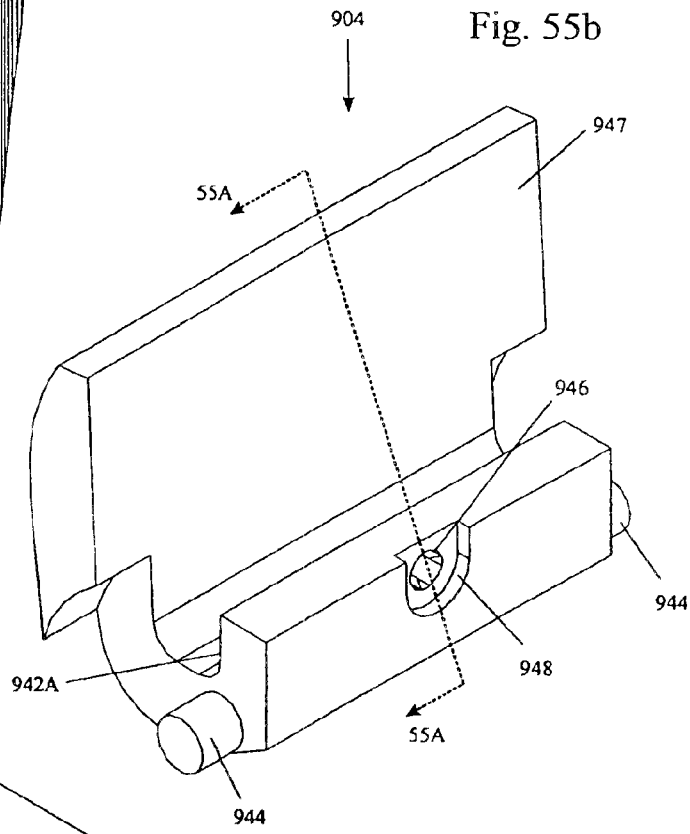
Figure 56:
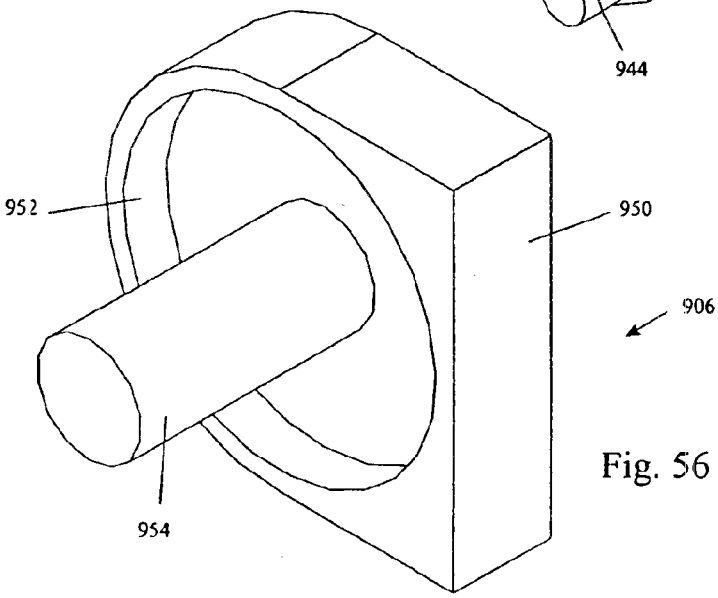
Figure 57A:
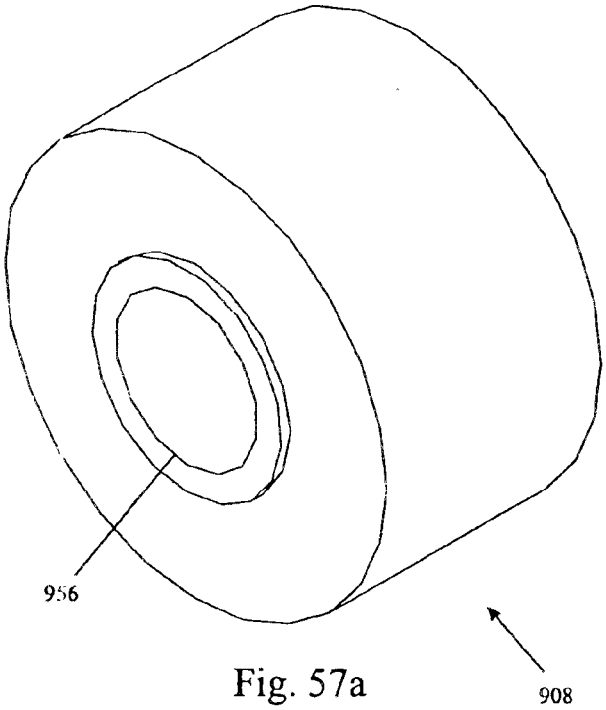
Figure 57B:
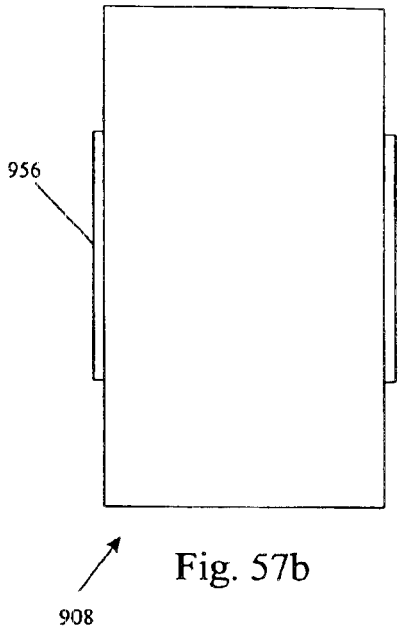
Figure 58A:
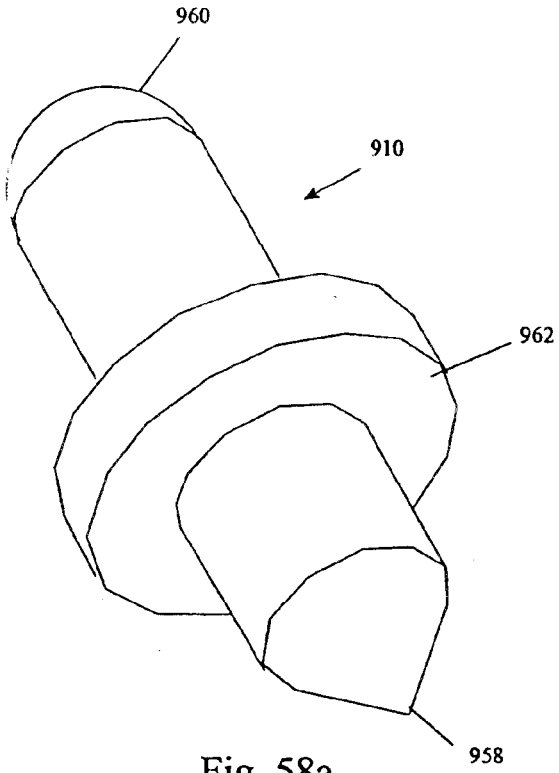
Figure 58B:
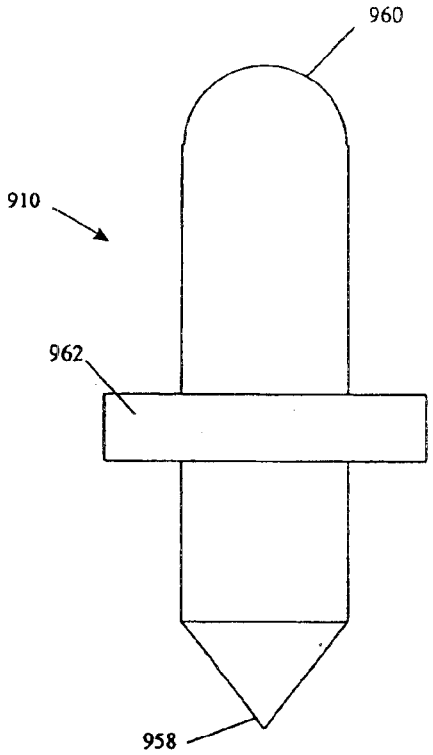
Figure 59:
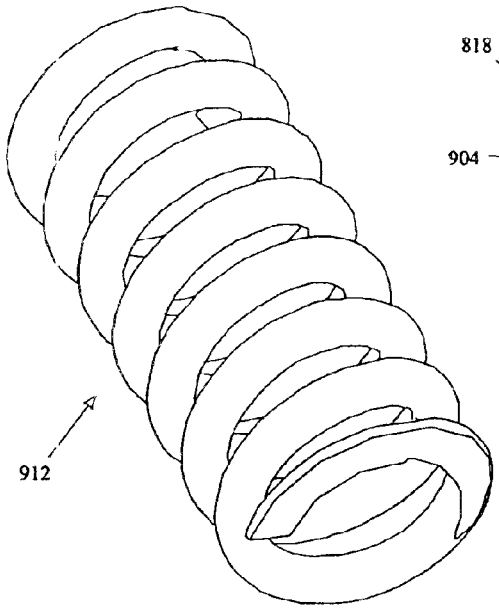
Figure 60A:
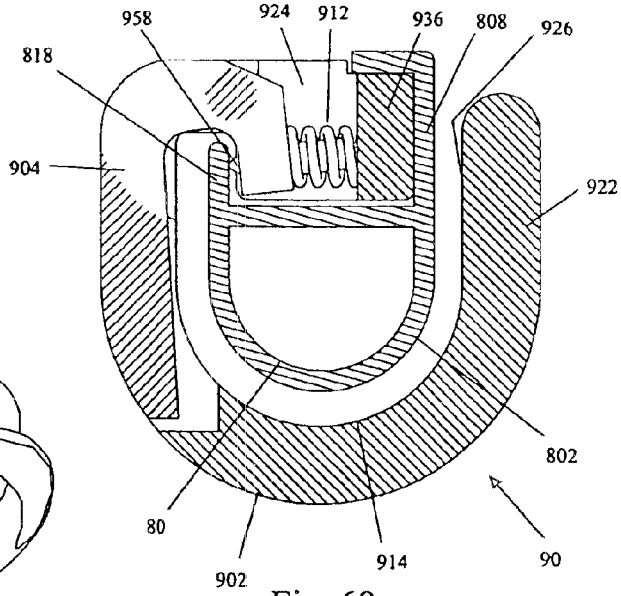
Figure 60B:
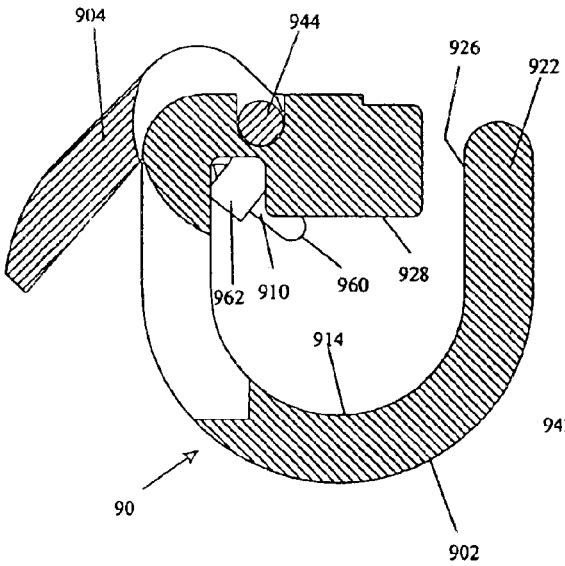
Figure 60C:
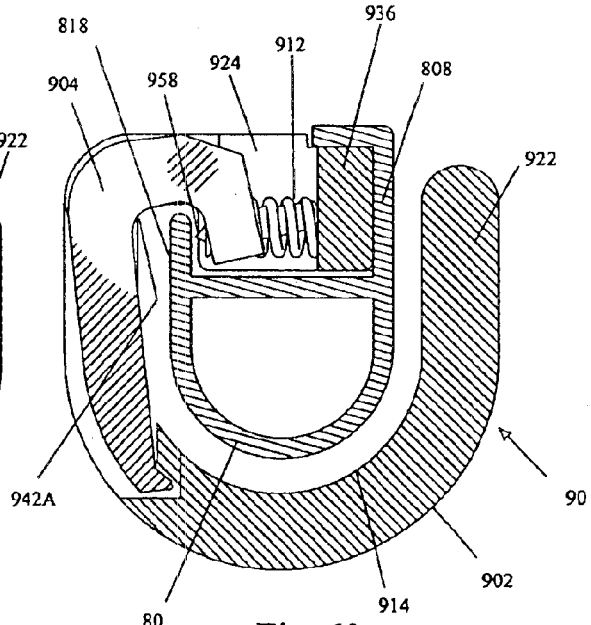
Figure 61A:
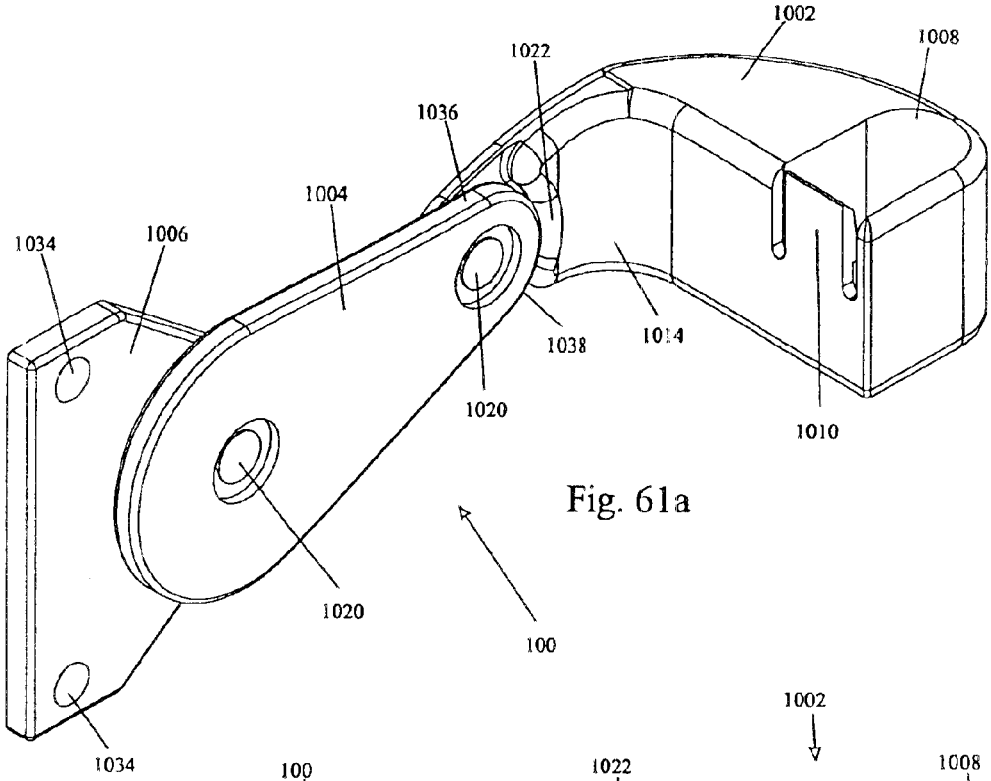
Figure 61B:
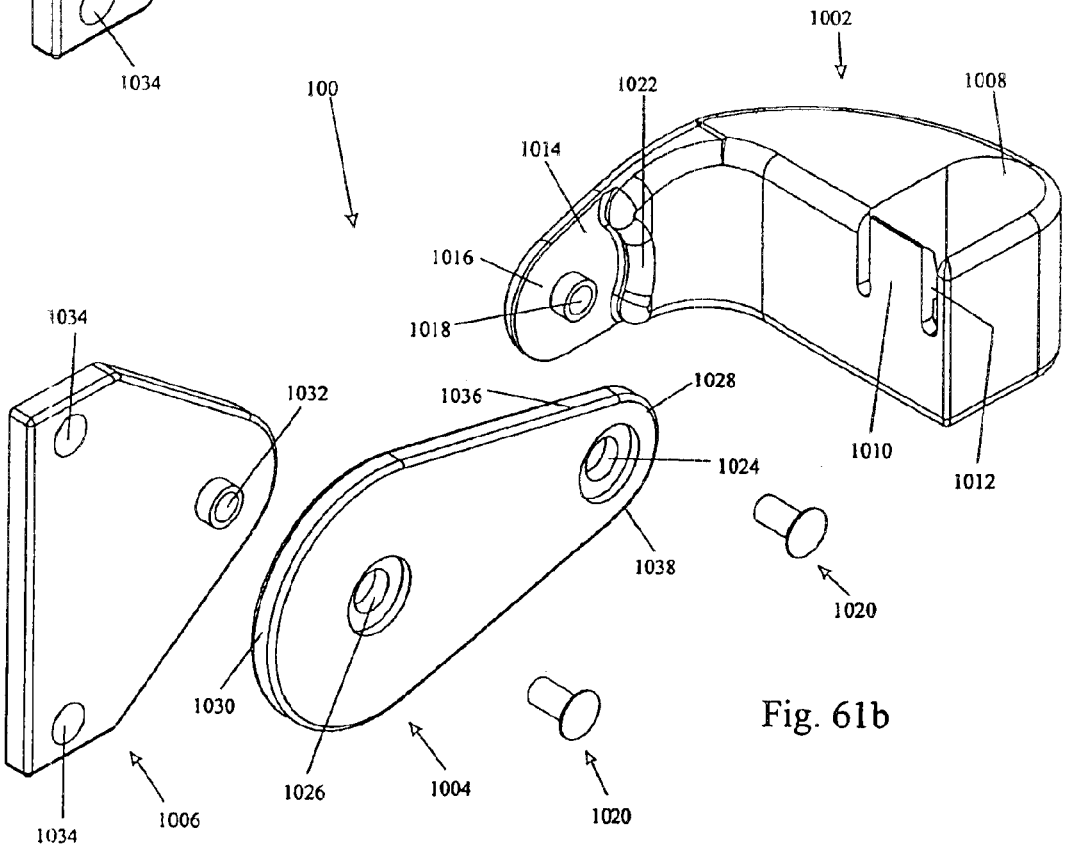
Figure 62A:
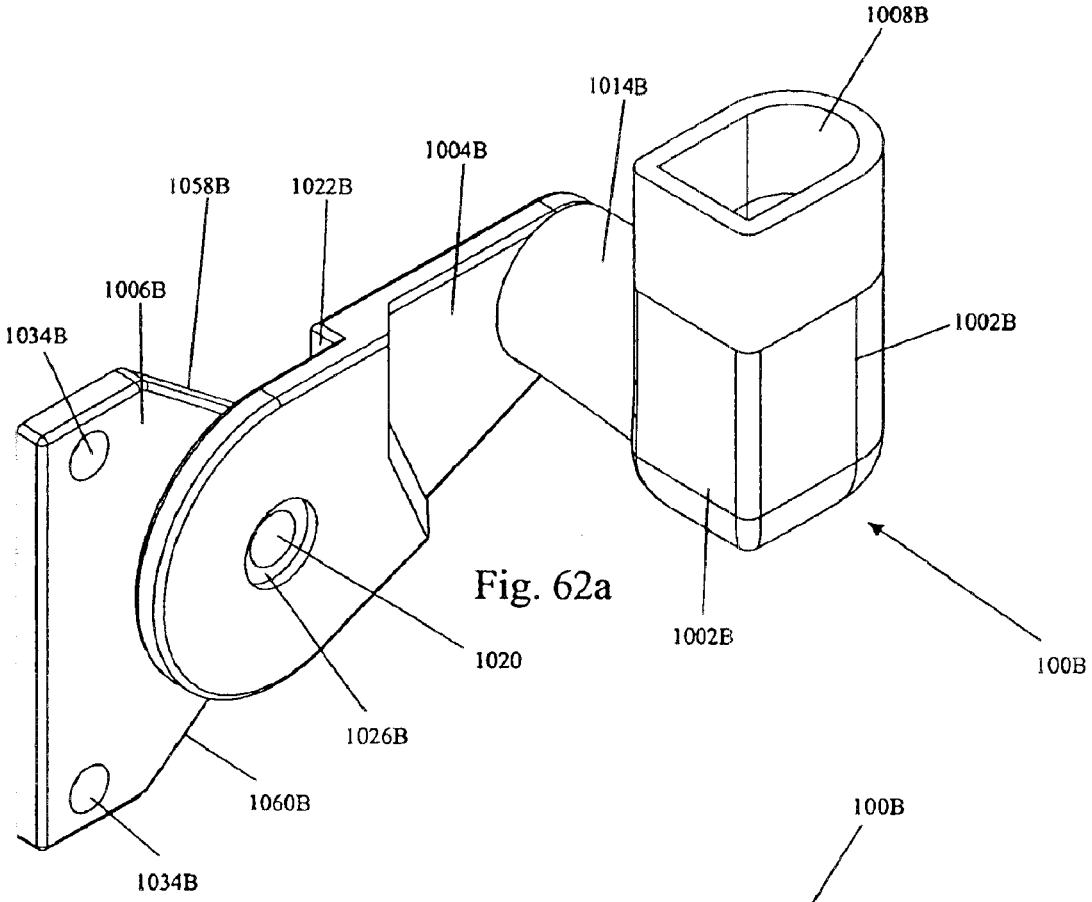
Figure 62B:
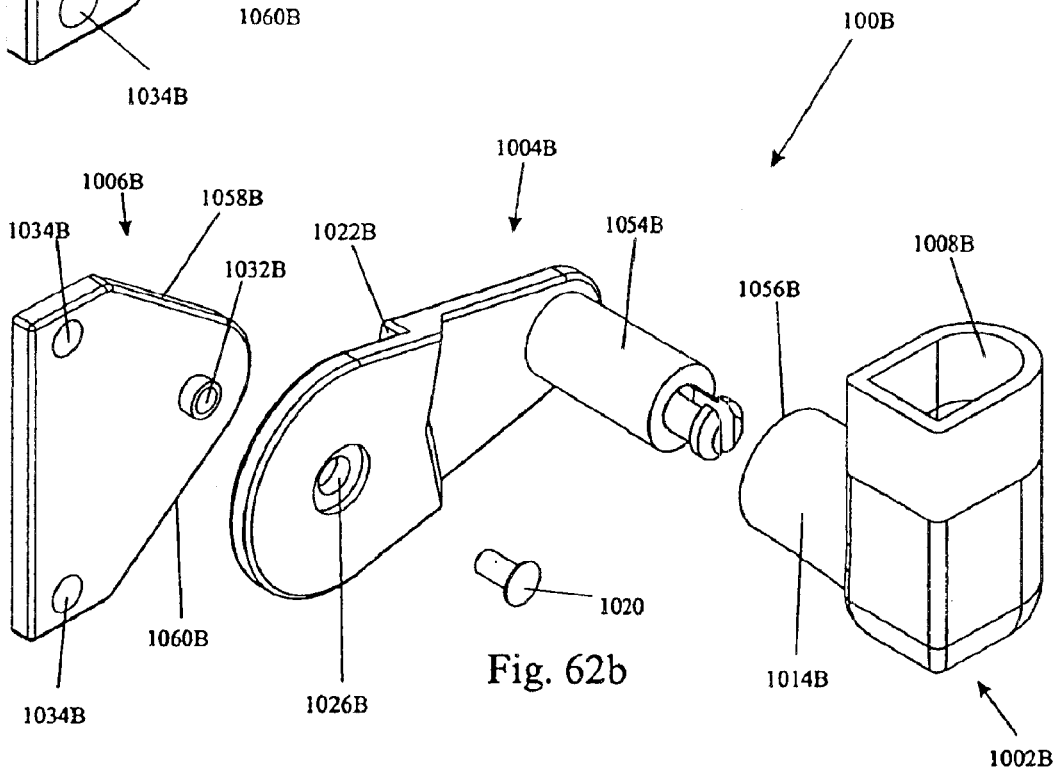
Figure 63A:
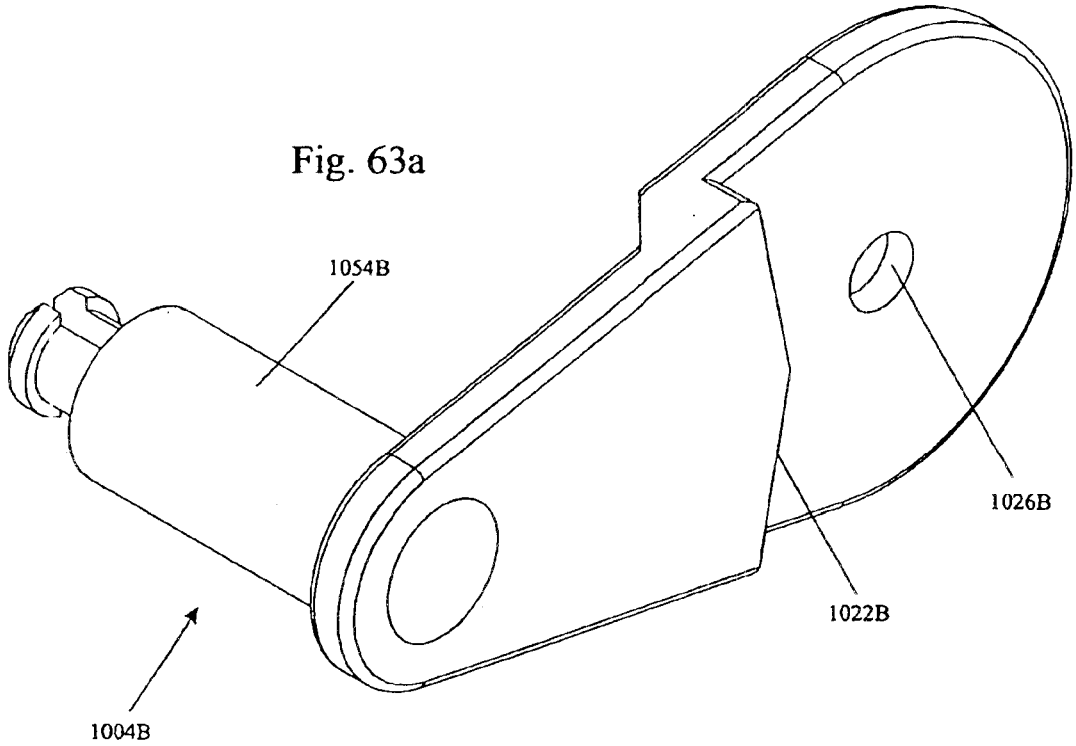
Figure 64A:
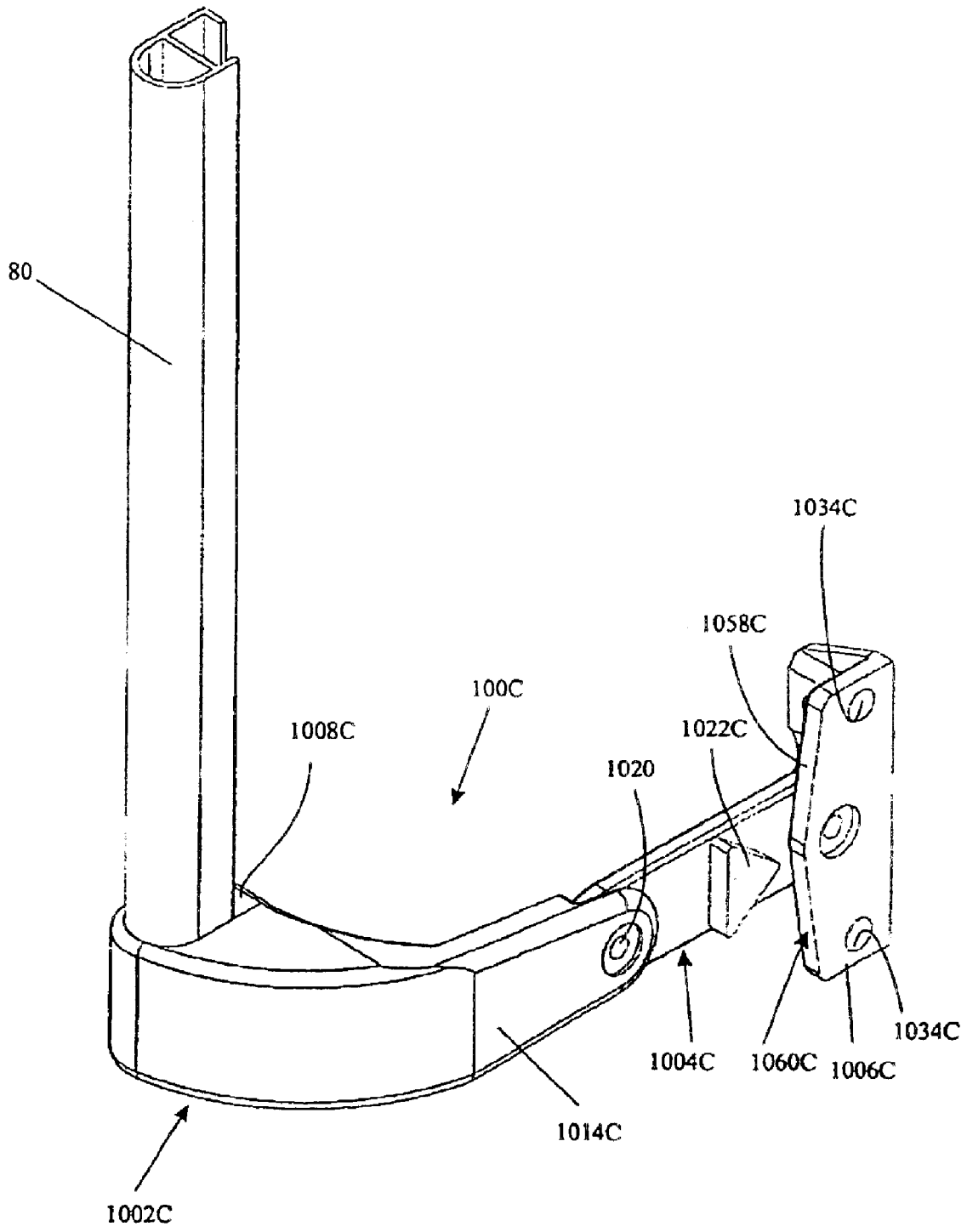
Figure 64B:
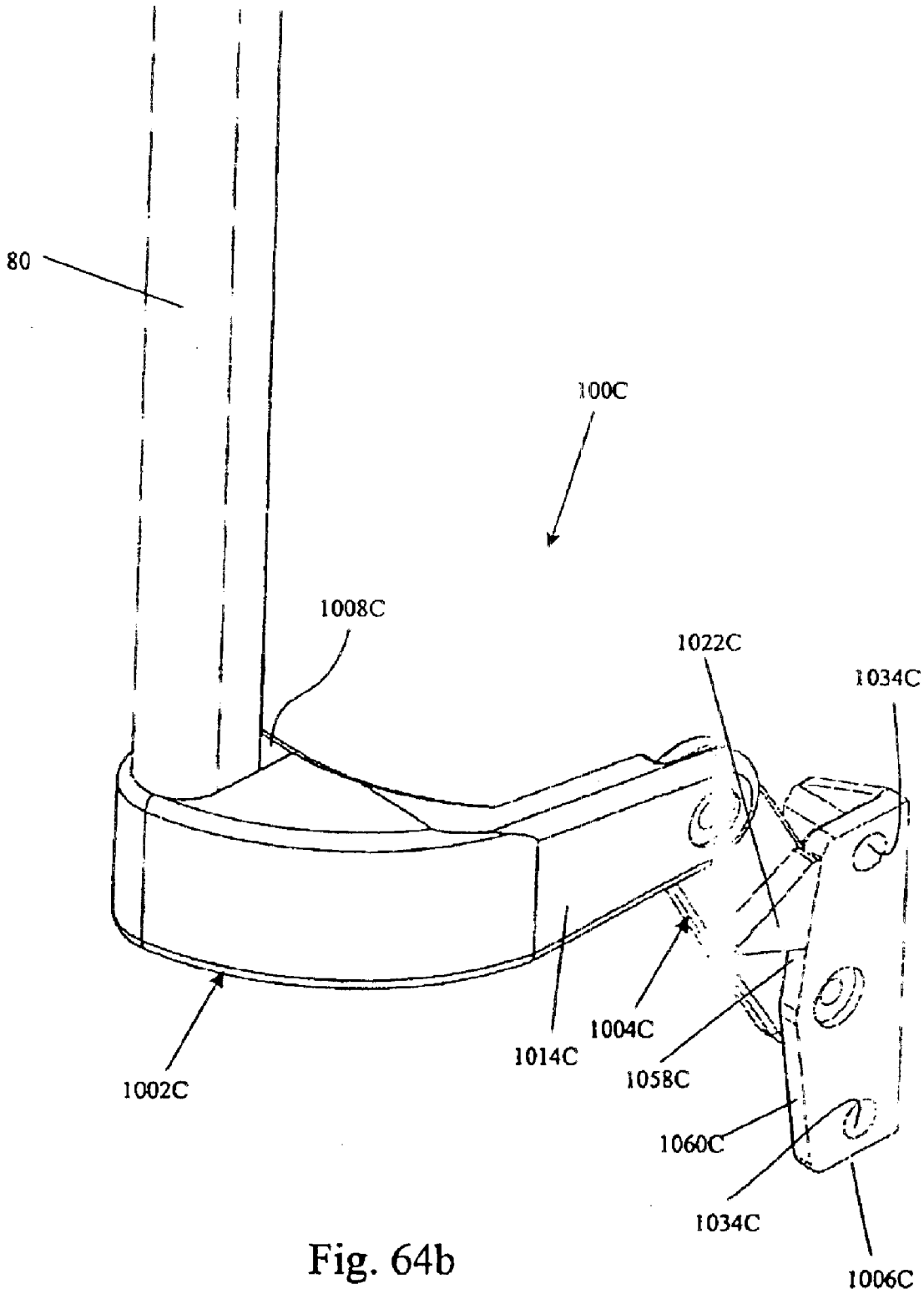
Figure 65:
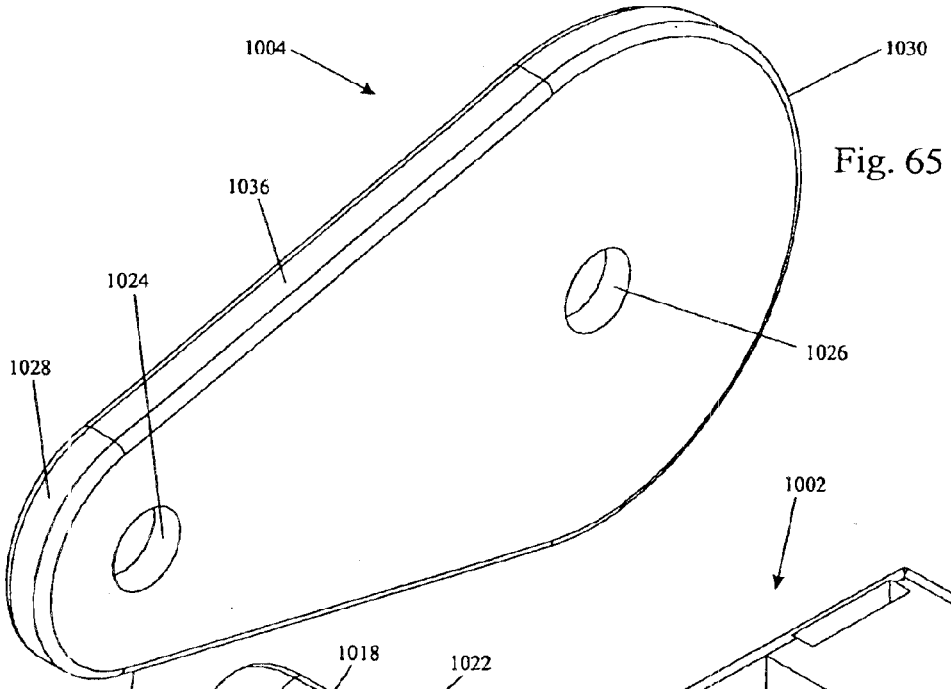
Figure 66A:
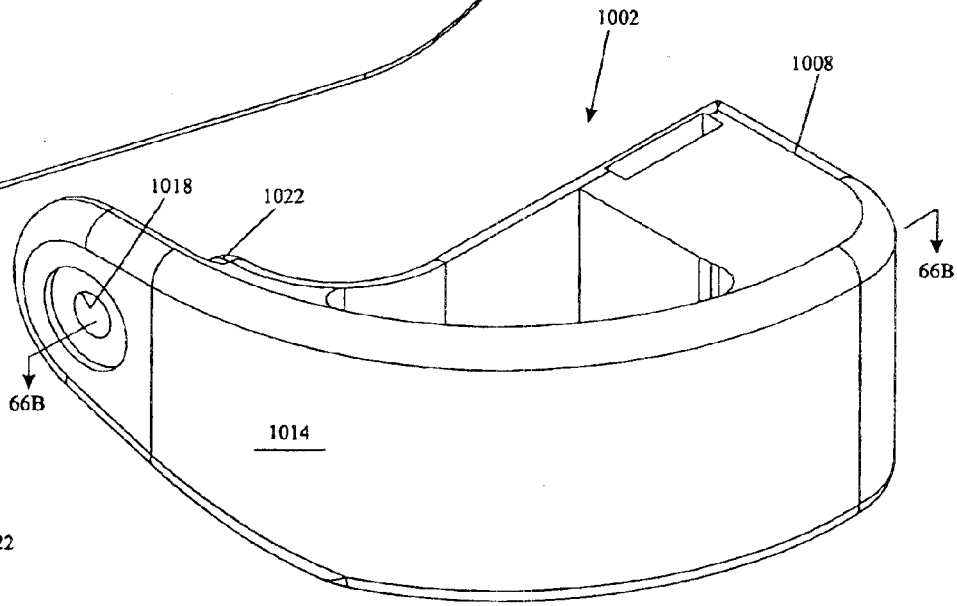
Figure 66B:
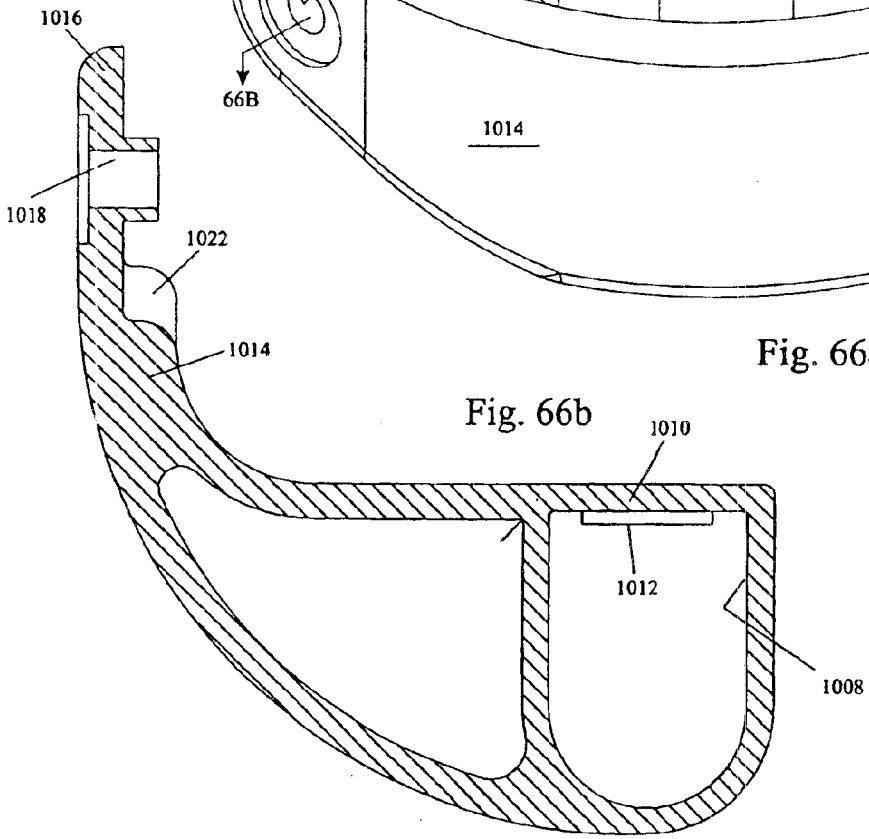
Figure 67A:
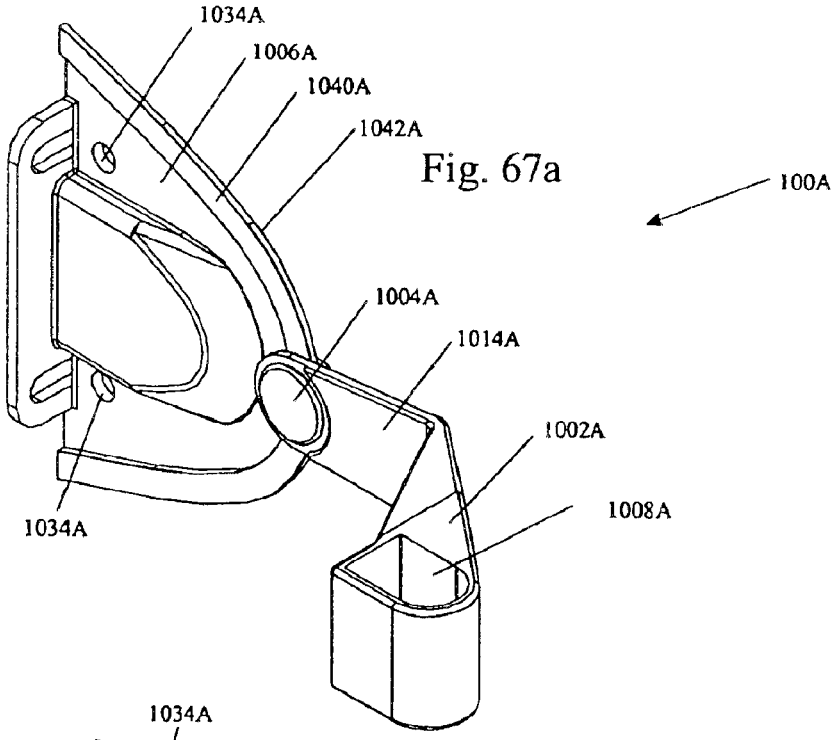
Figure 67B:
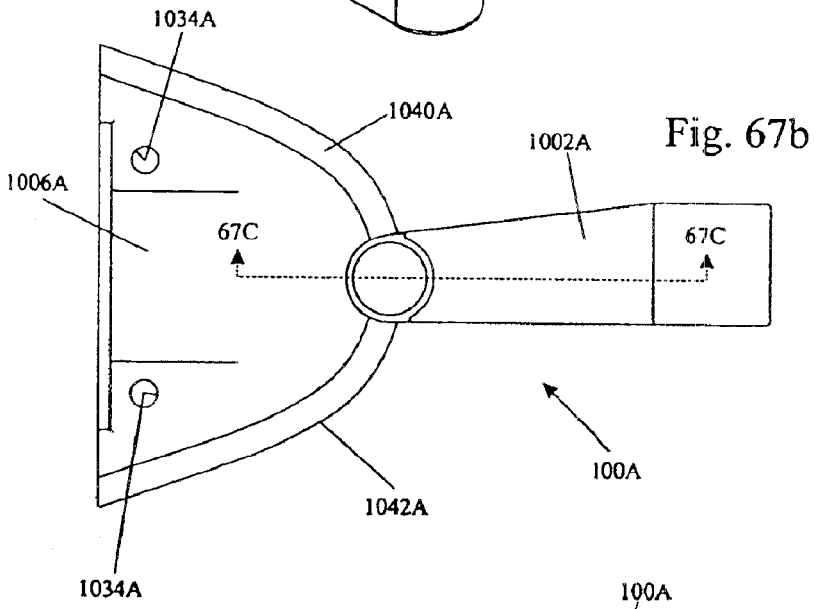
Figure 67C:
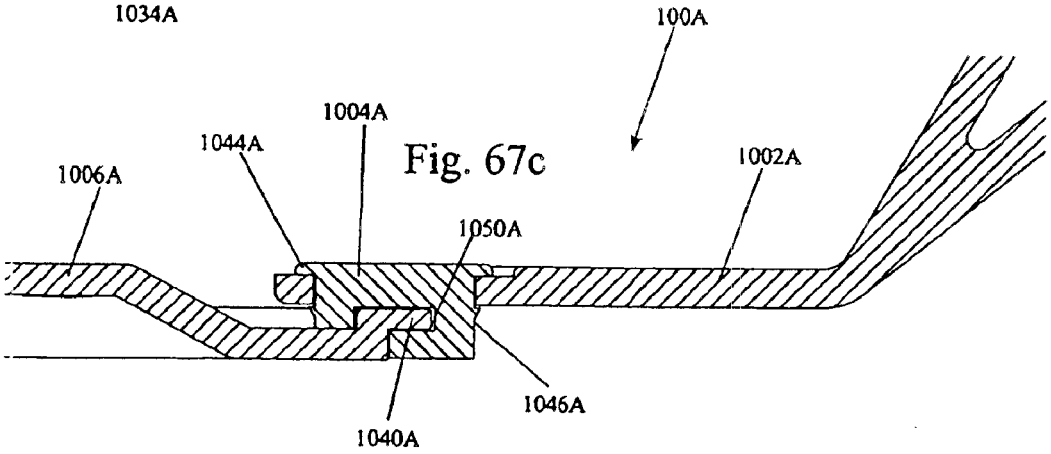
Figure 69A:
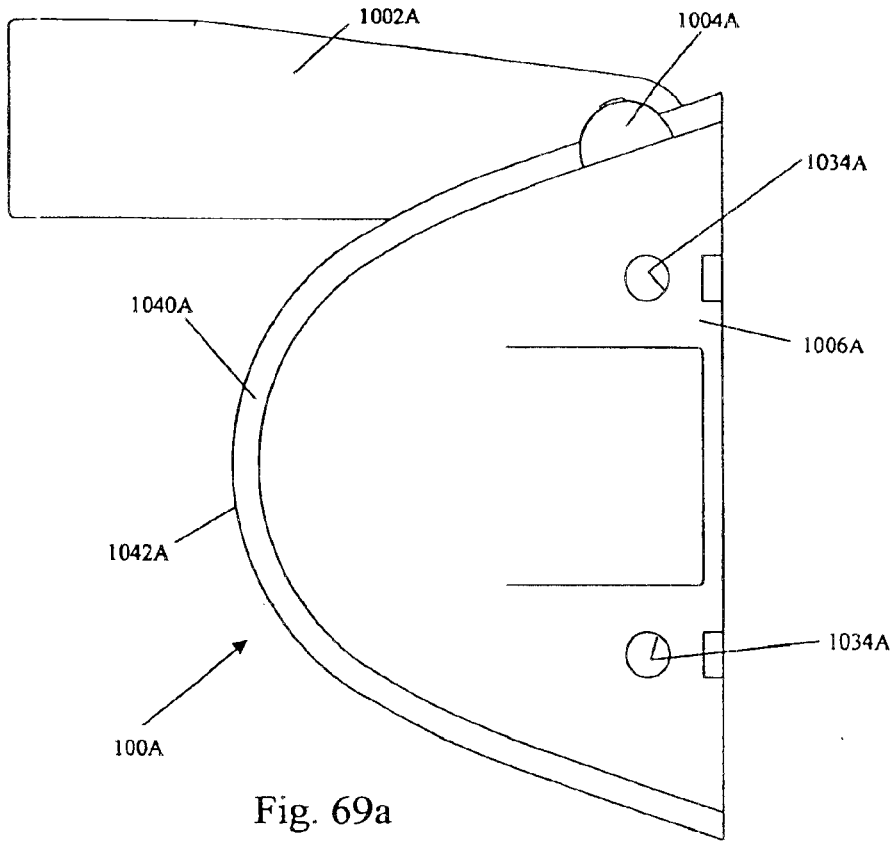
Figure 69B:
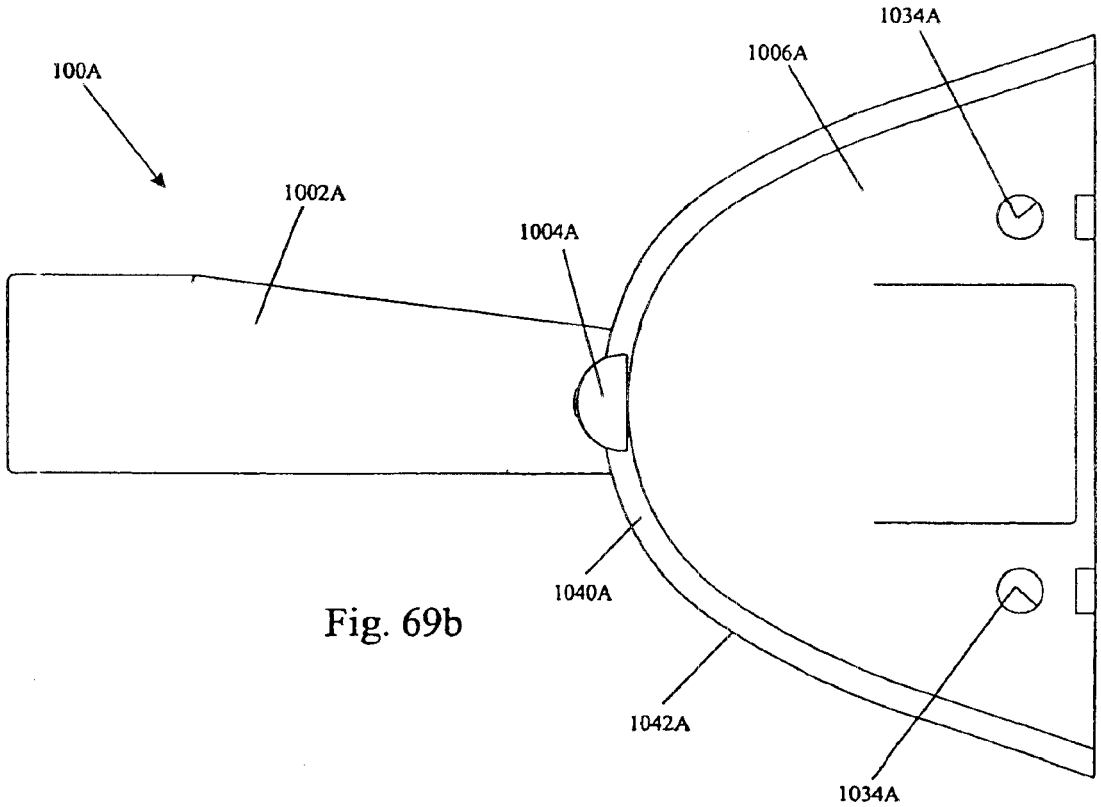
Figure 70A:
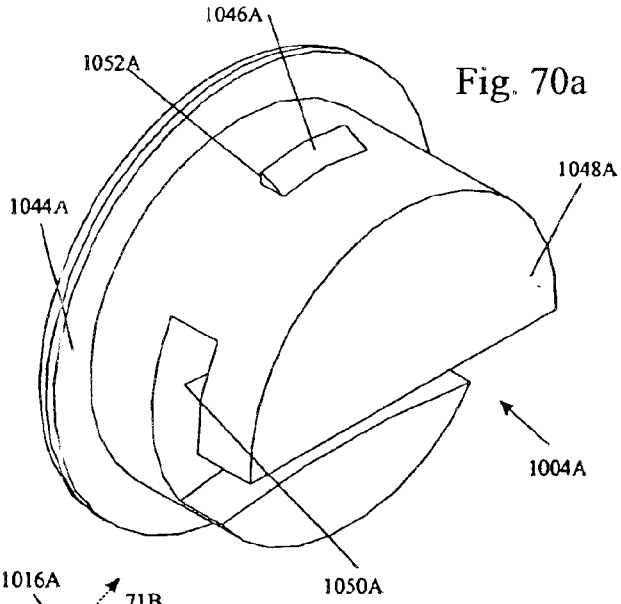
Figure 70B:
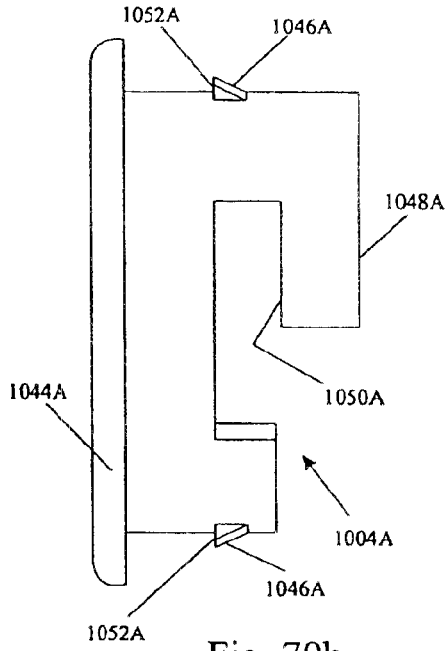
Figure 71A:
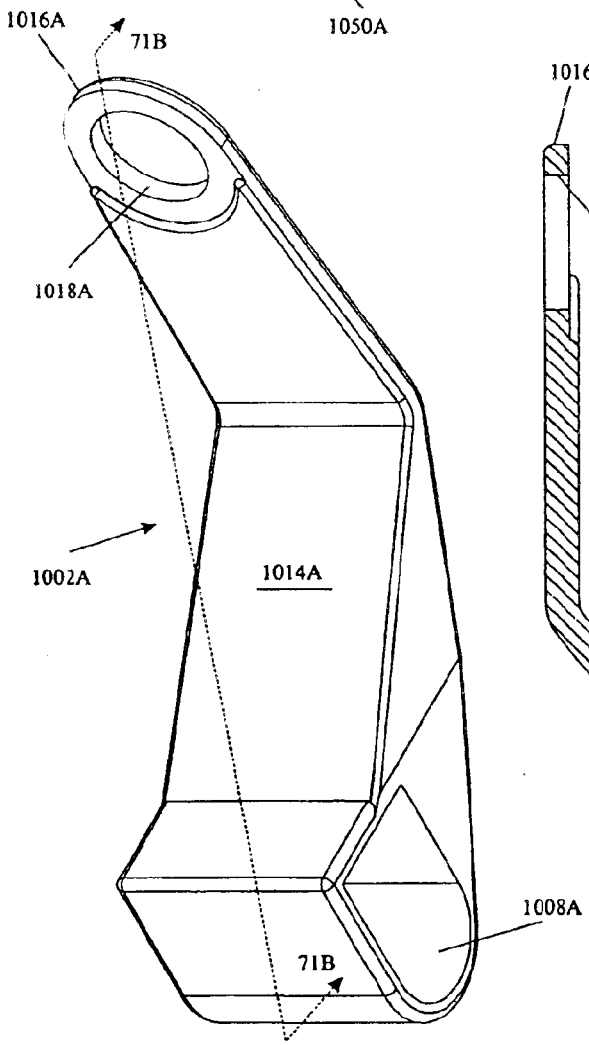
Figure 71B:
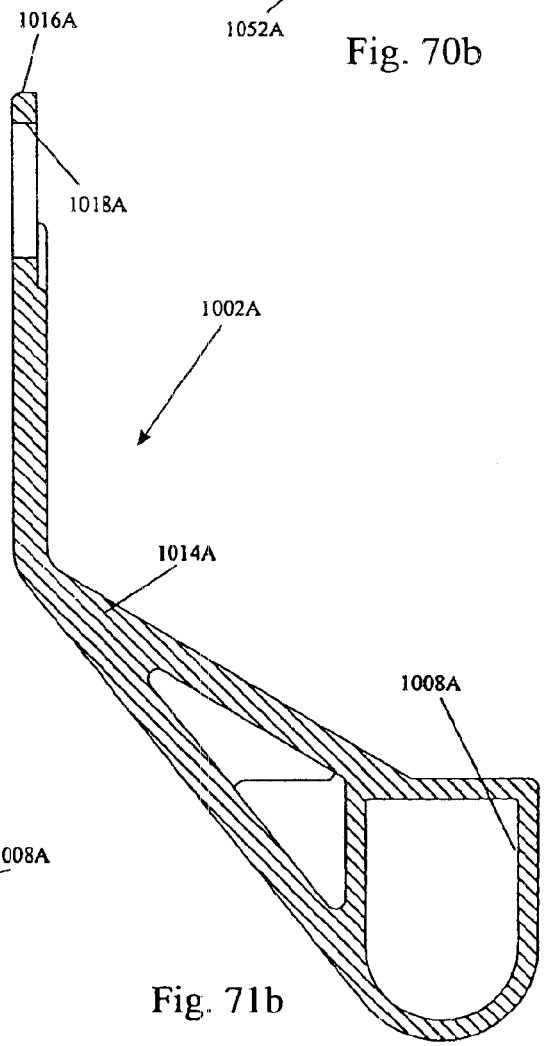
Figure 72A:
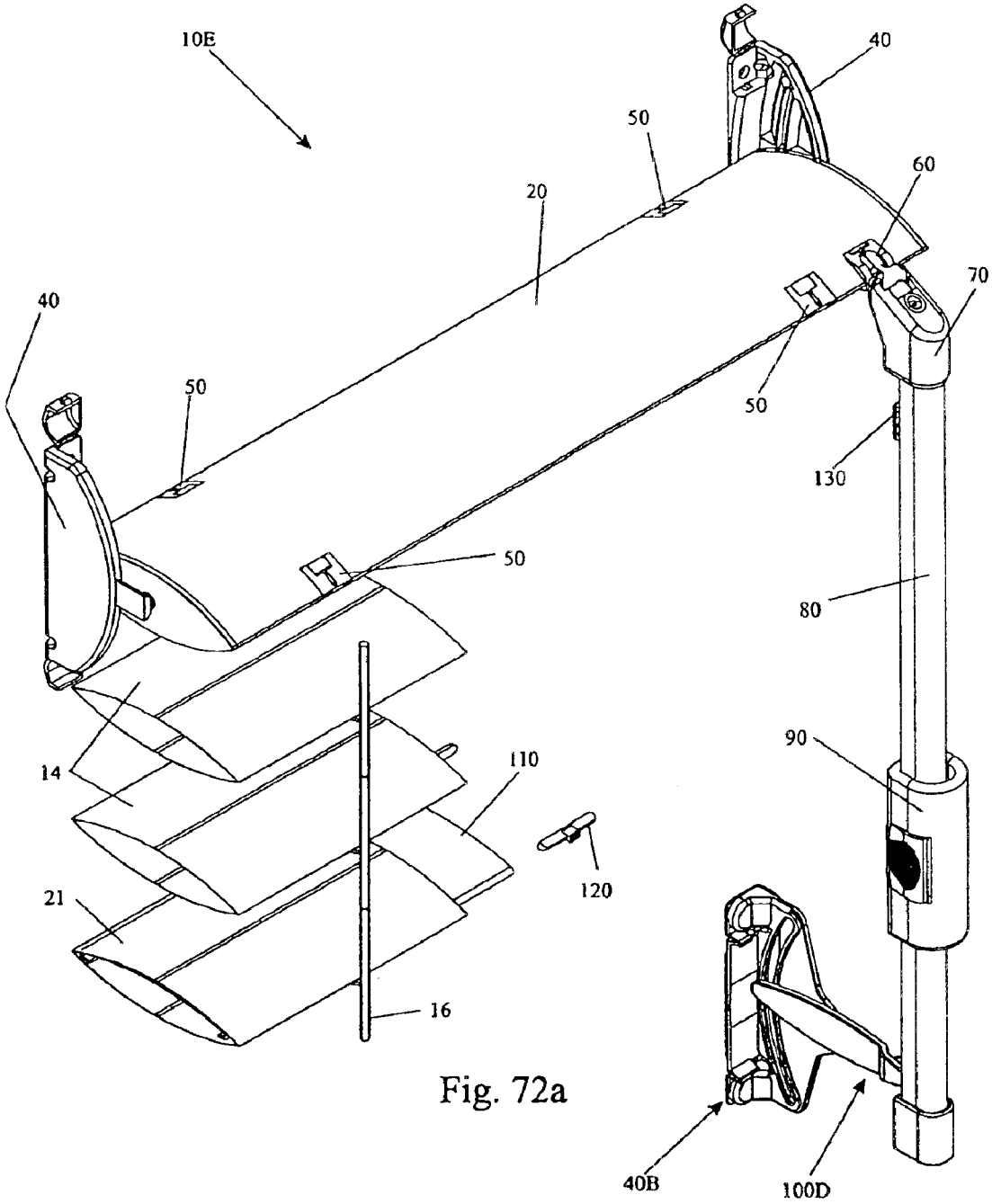
Figure 72B:
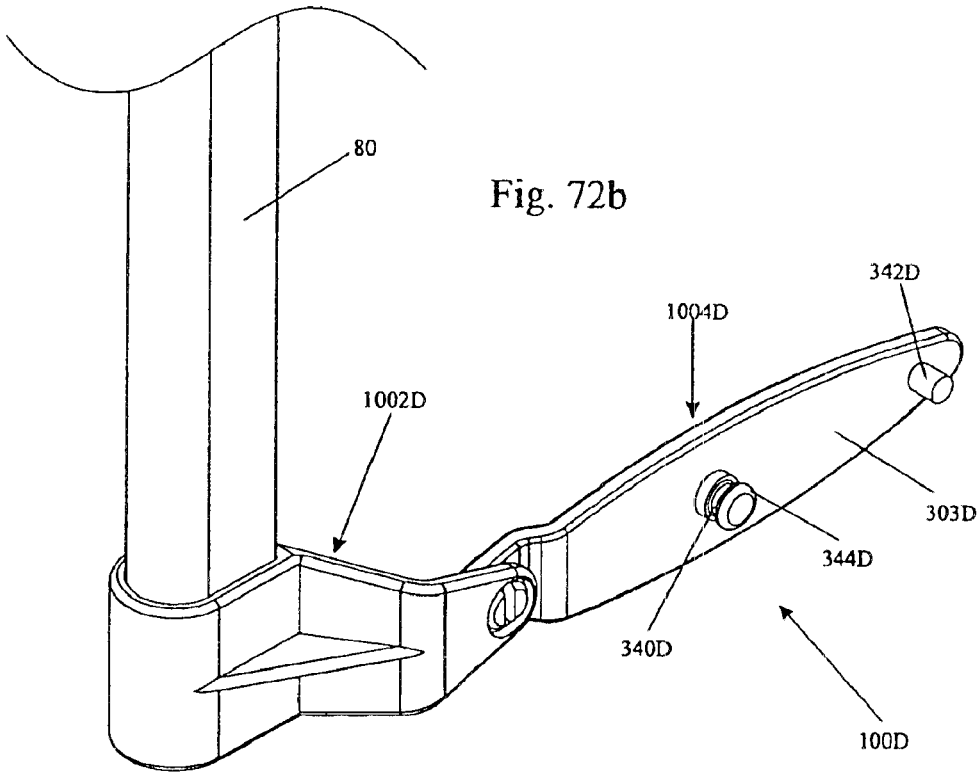
Figure 73A:
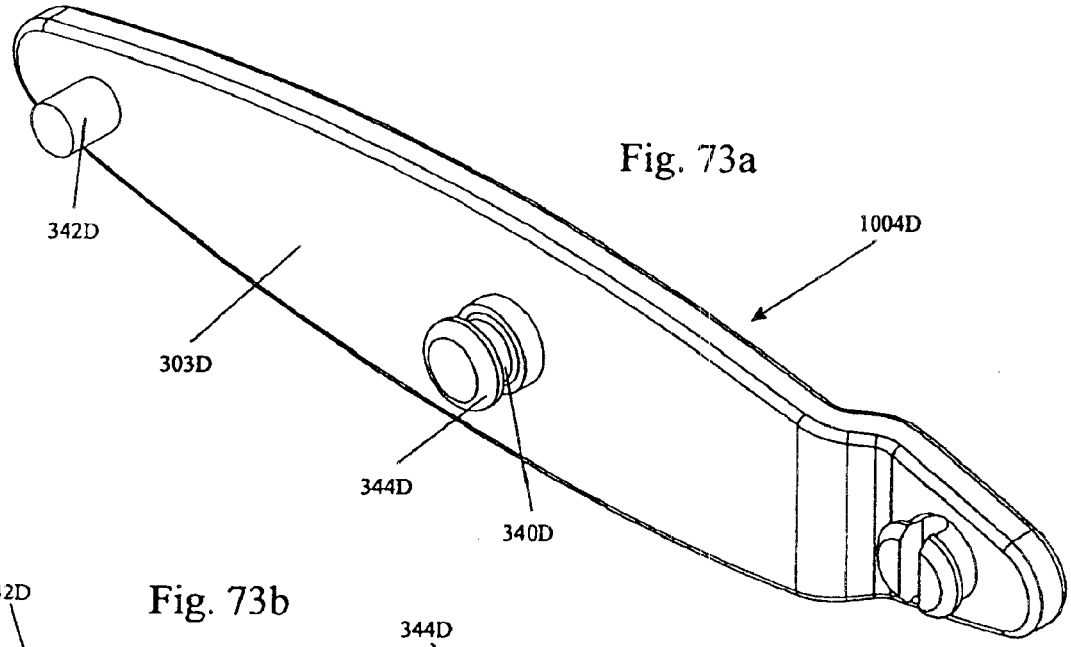
Figure 73B:
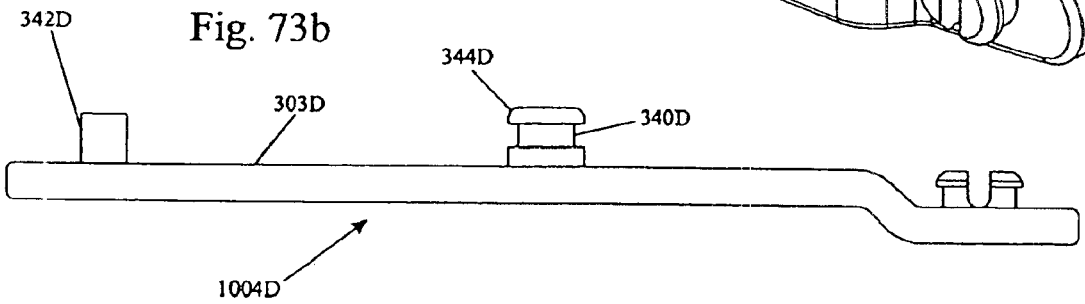
Figure 73C:
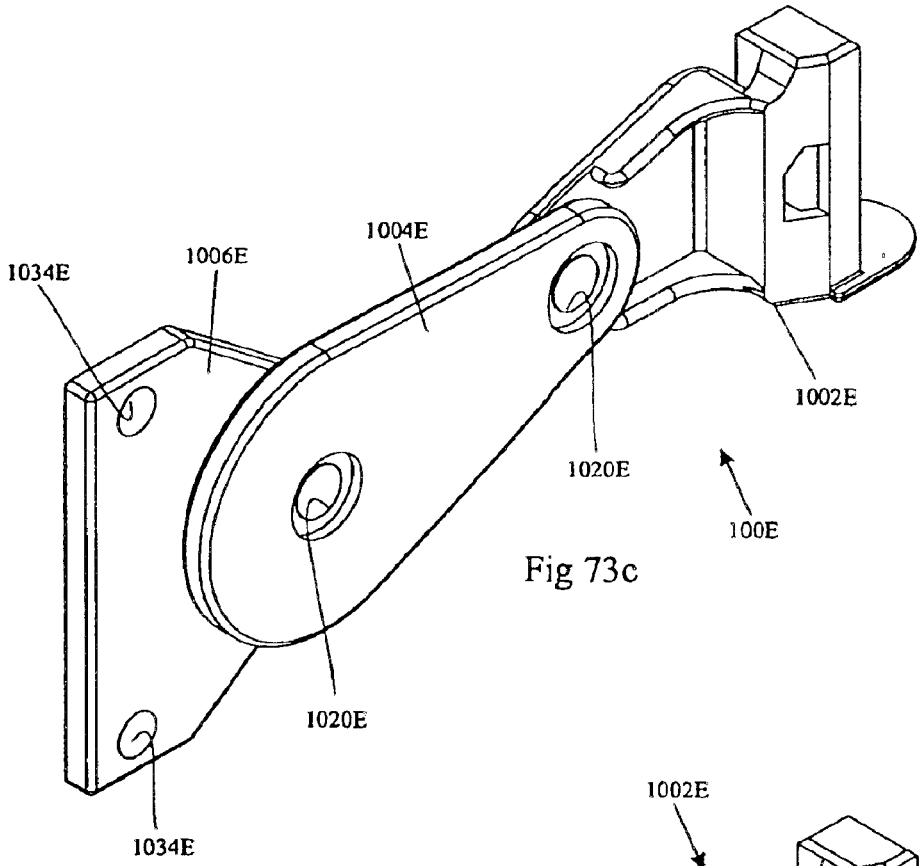
Figure 73D:
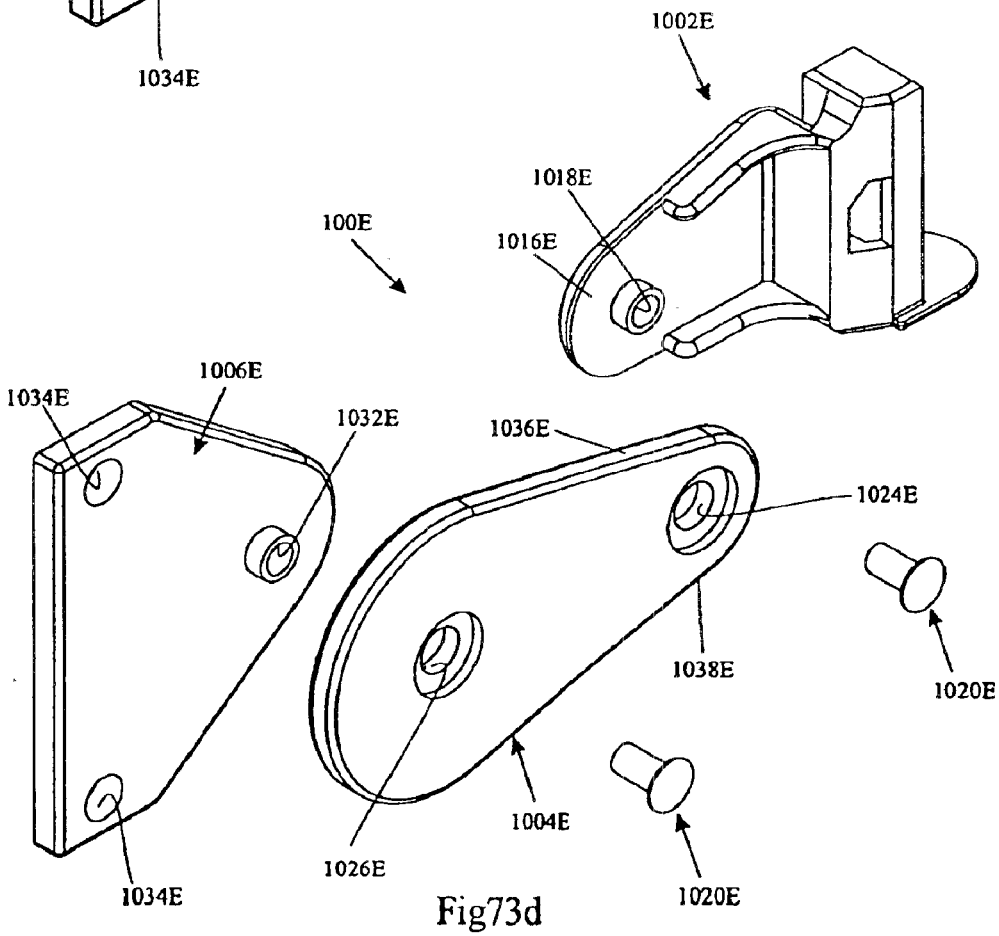
Figure 74:
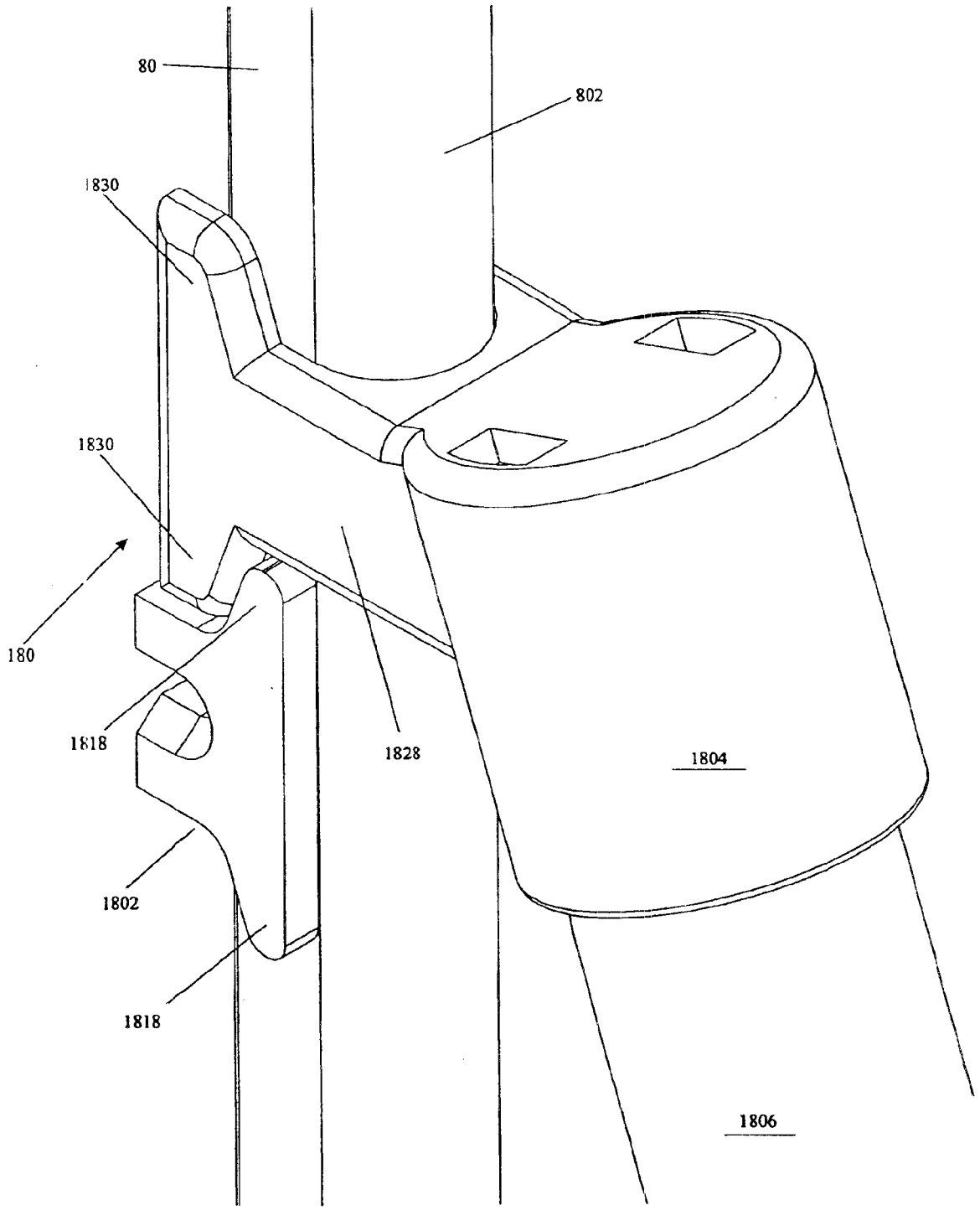
Figure 76A:
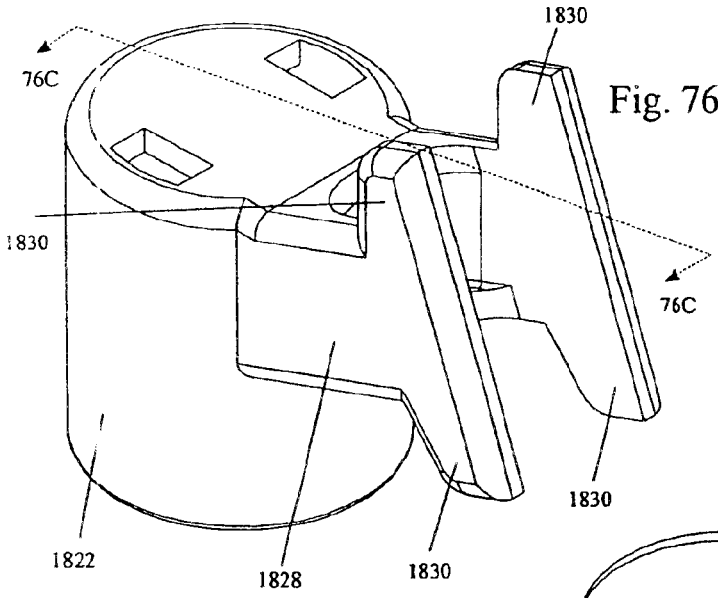
Figure 76B:
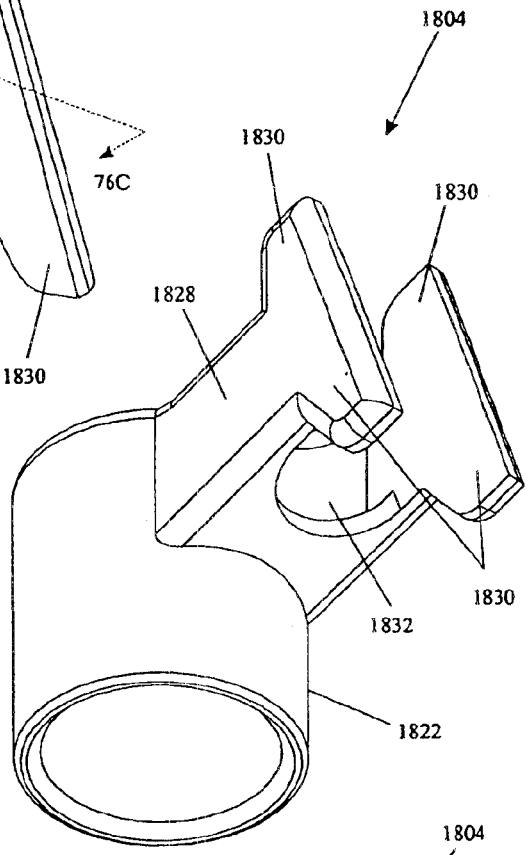
Figure 76C:
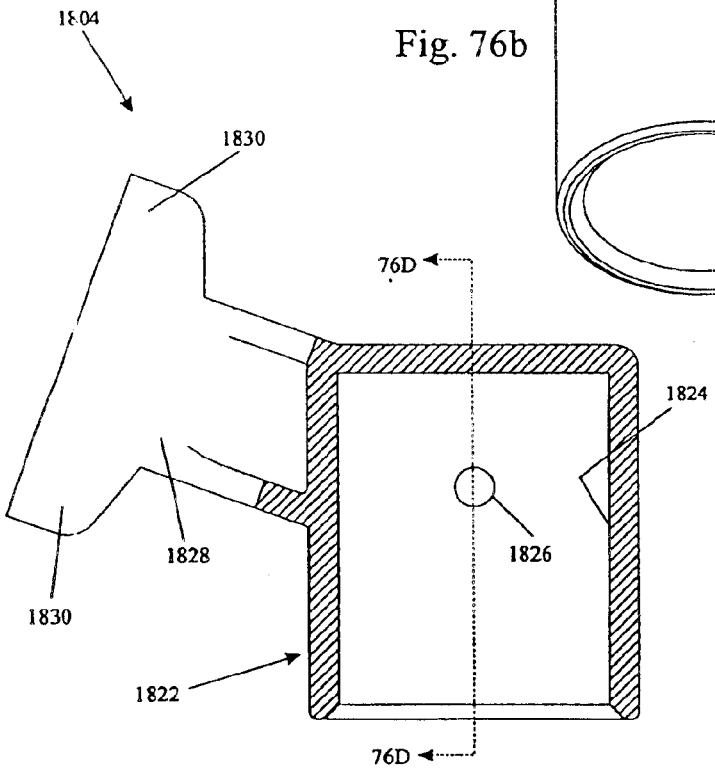
Figure 76D:
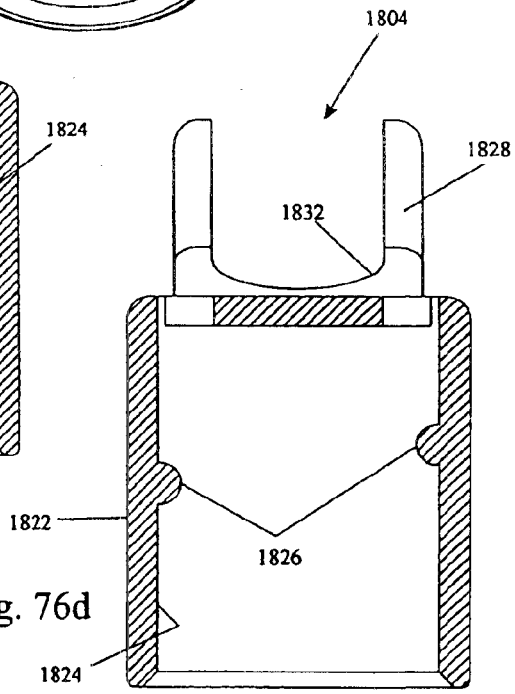
Figure 77A:
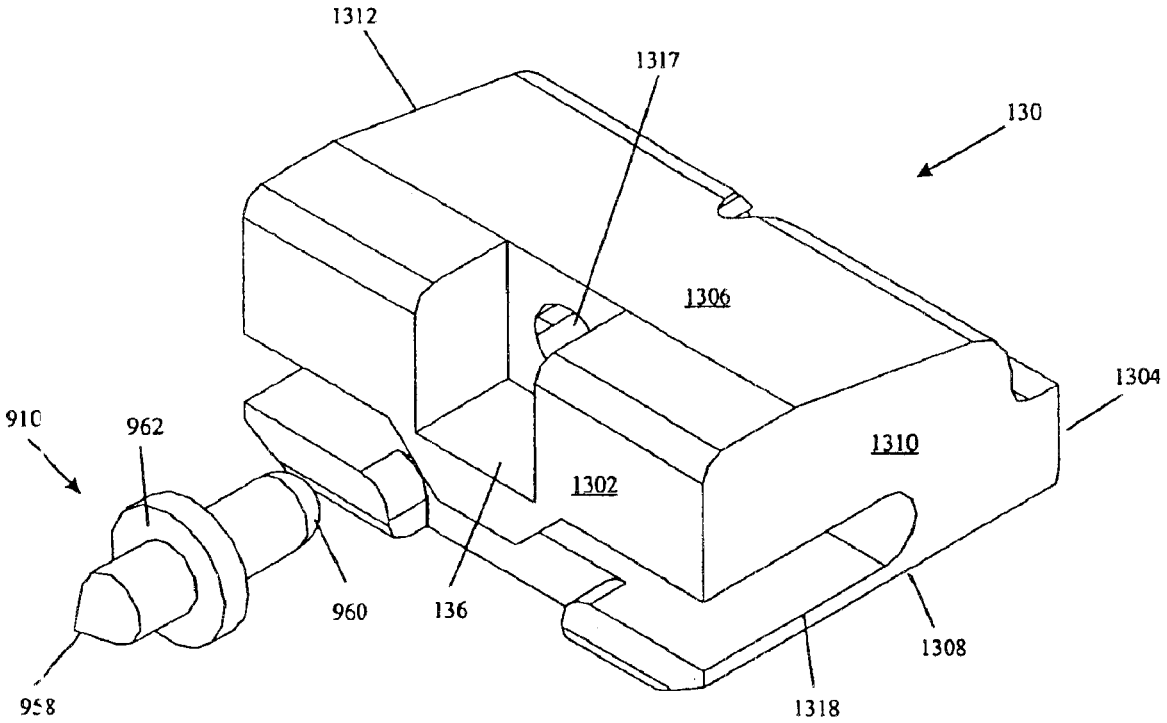
Figure 77B:
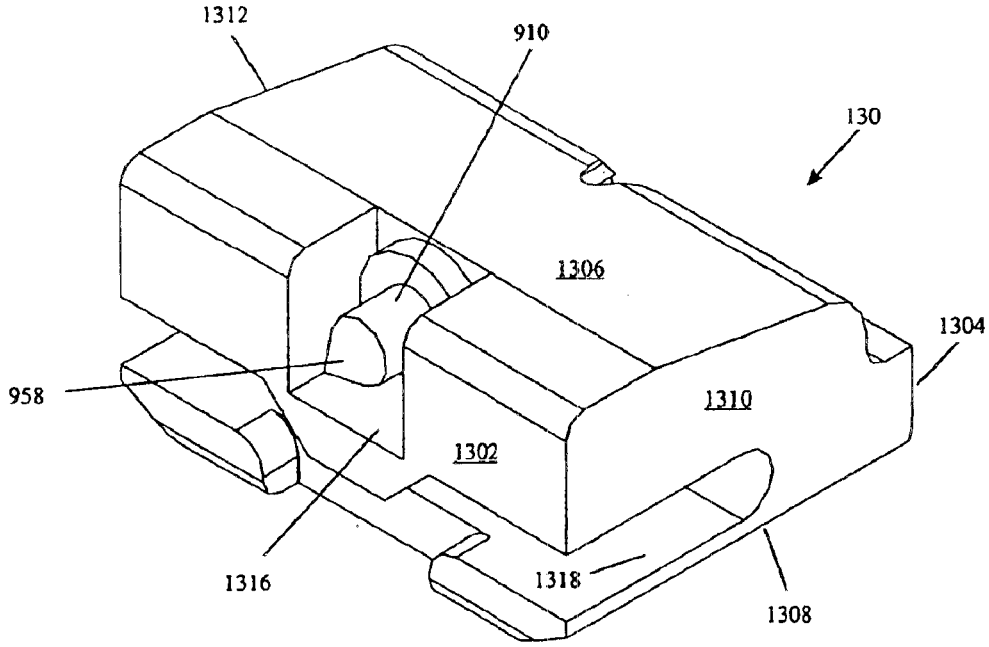
Figure 77C:
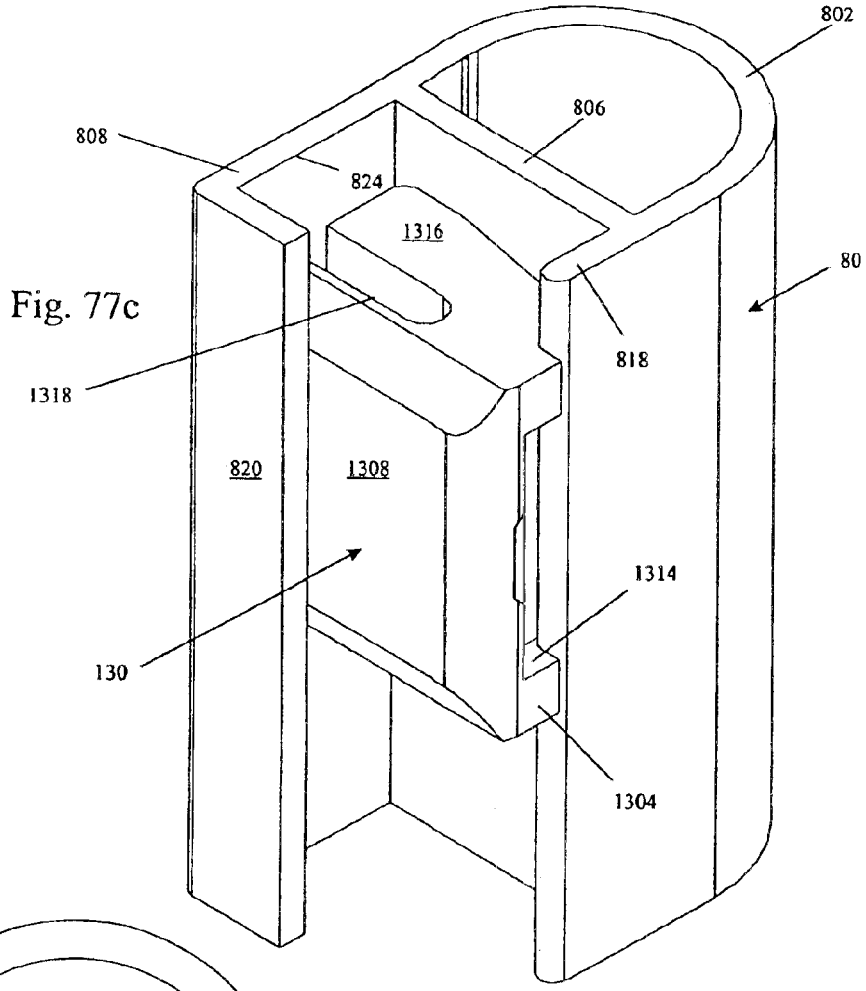
Figure 77D:
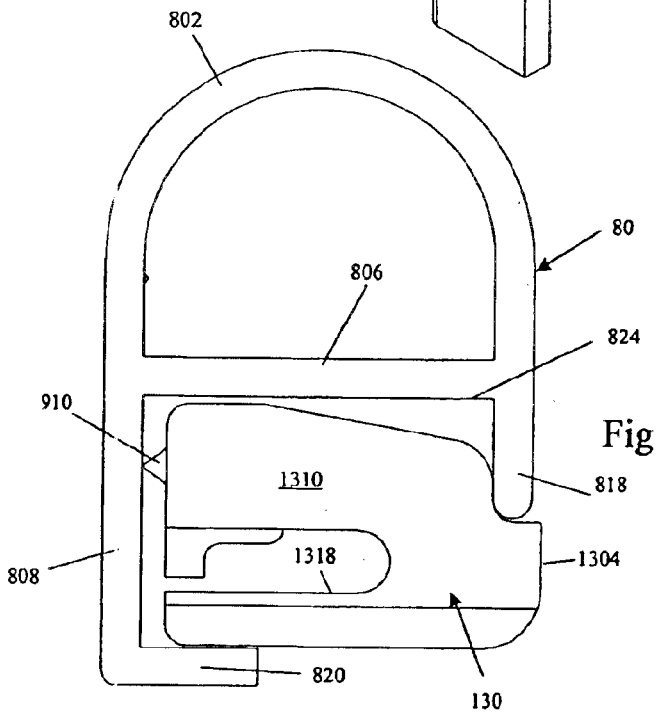
Figure 78A:
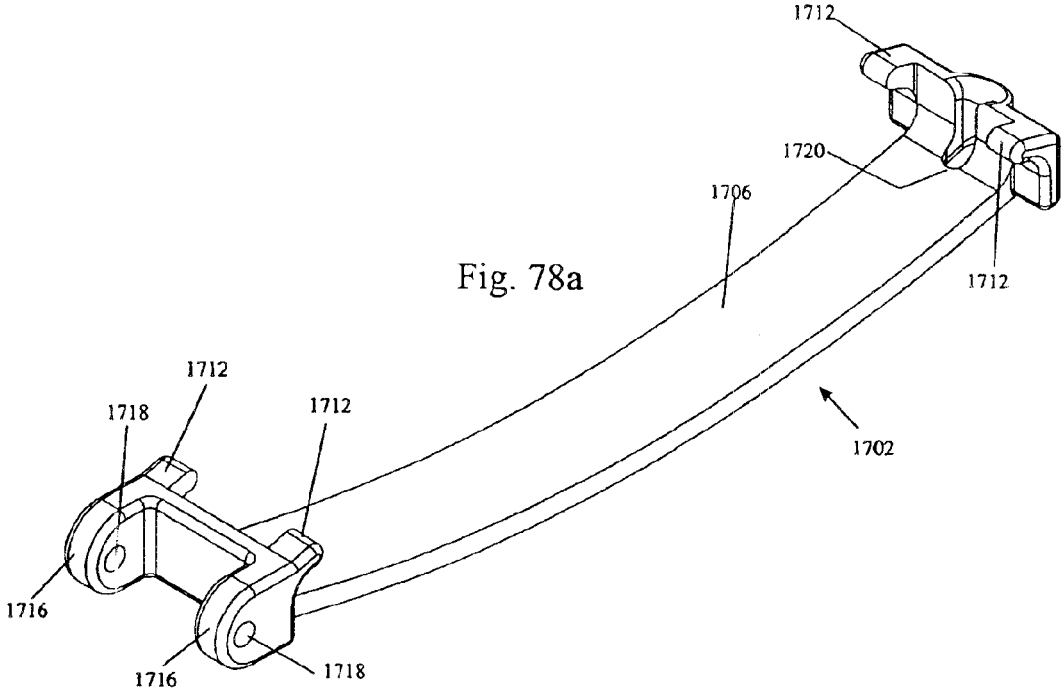
Figure 78B:
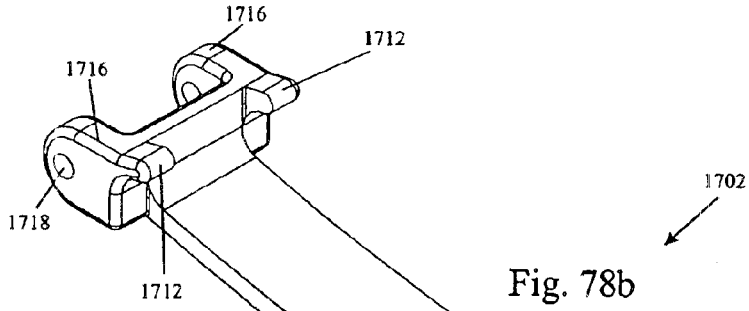
Figure 78C:
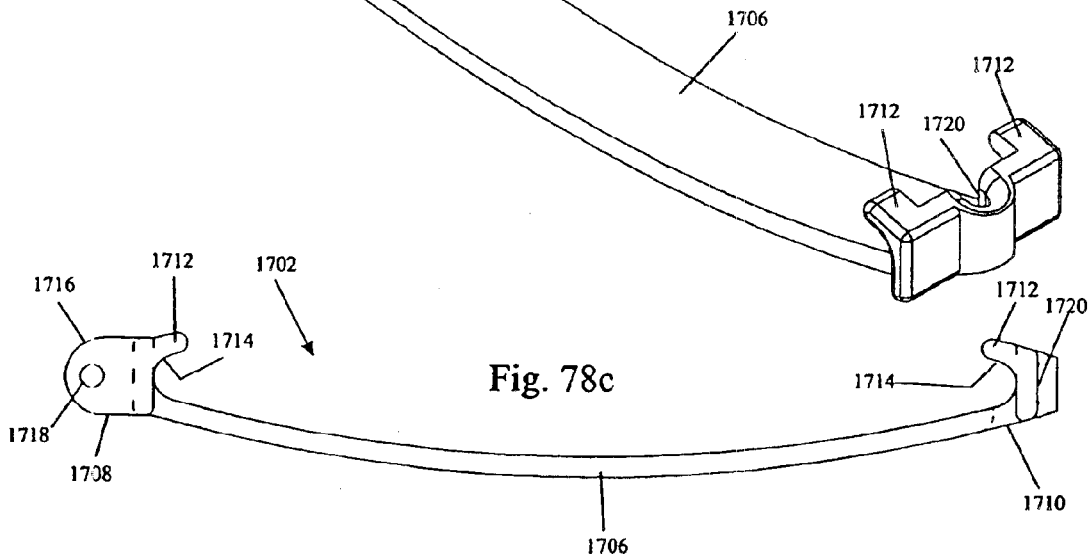
Figure 79D:
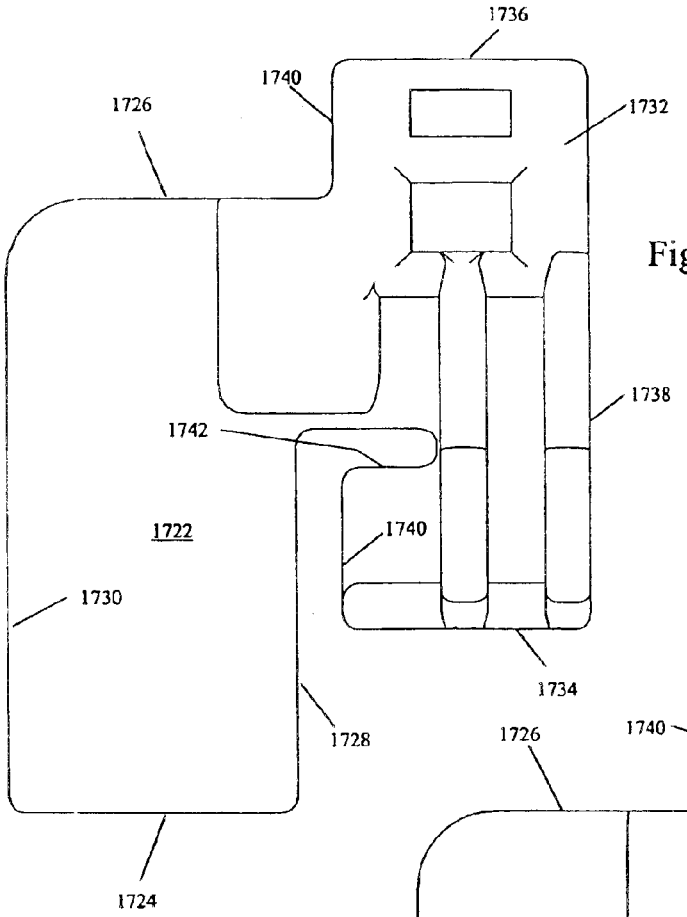
Figure 79E:
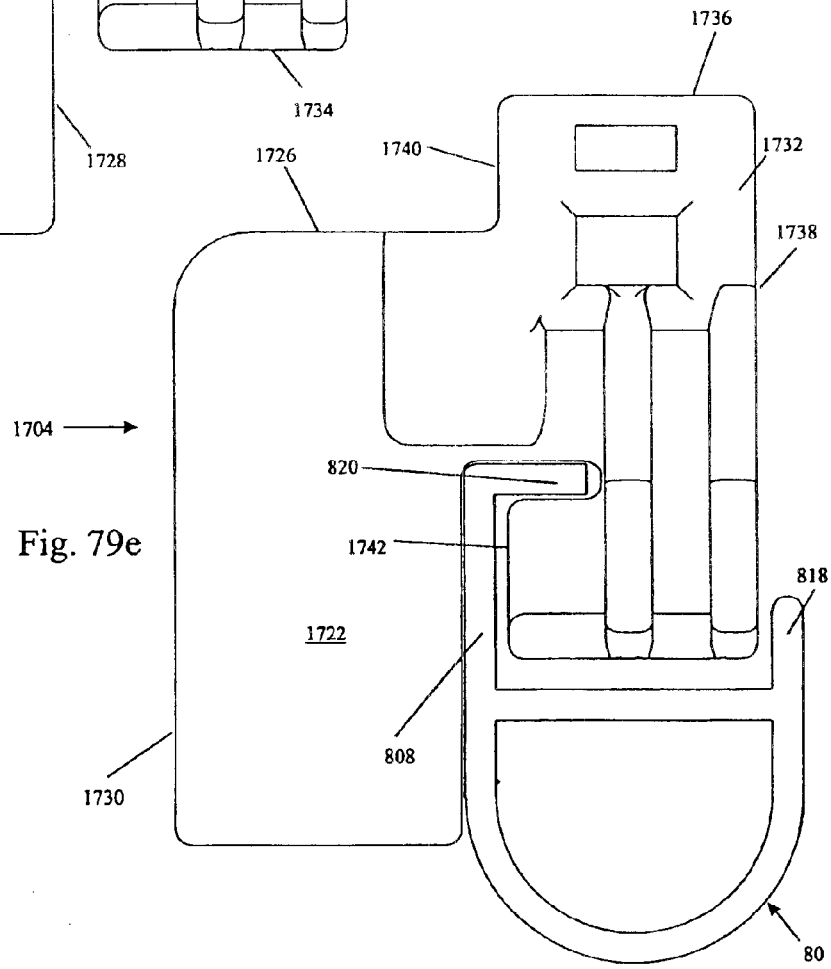
Figure 79F:
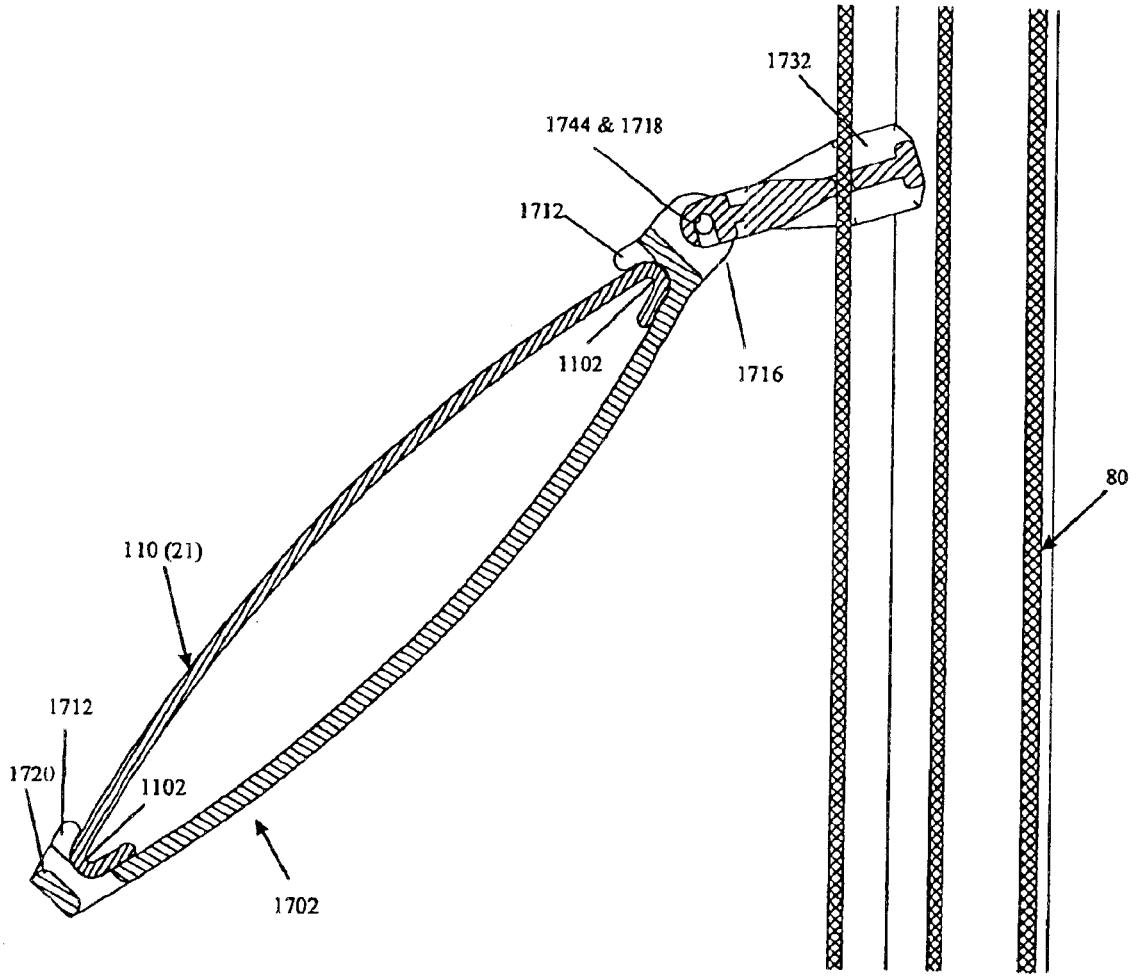
Figure 80:
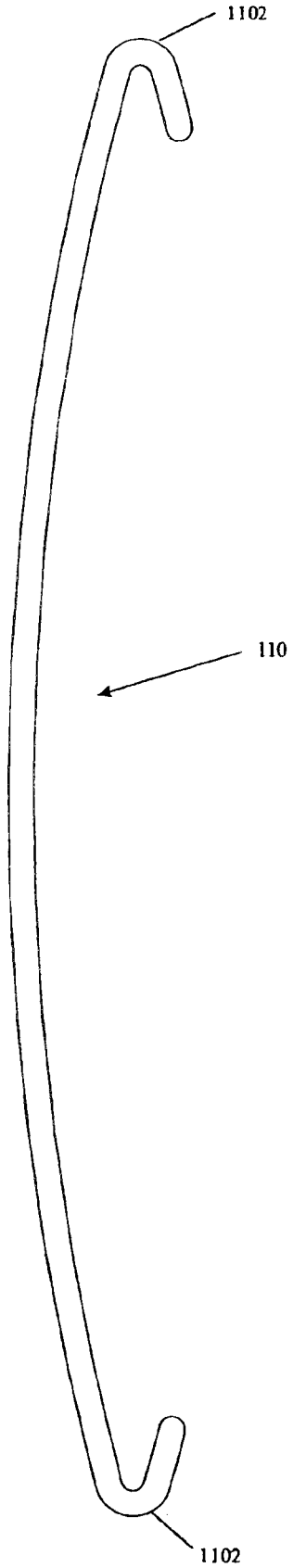
Figure 80A:
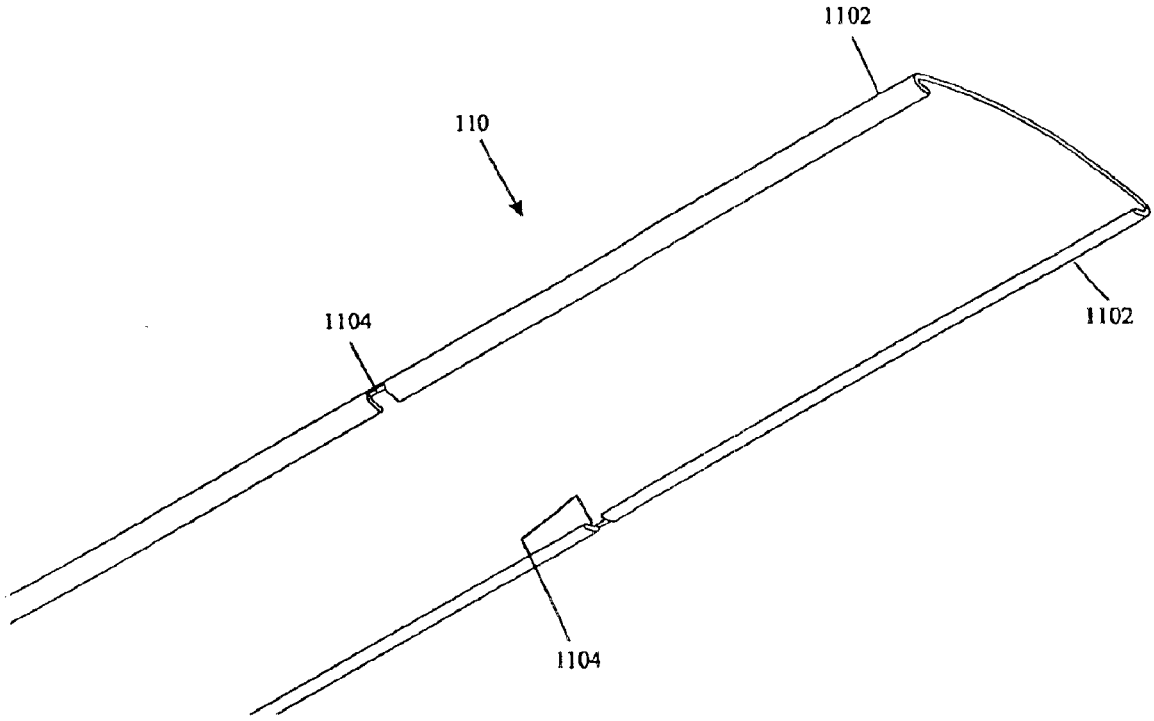
Figure 81A:
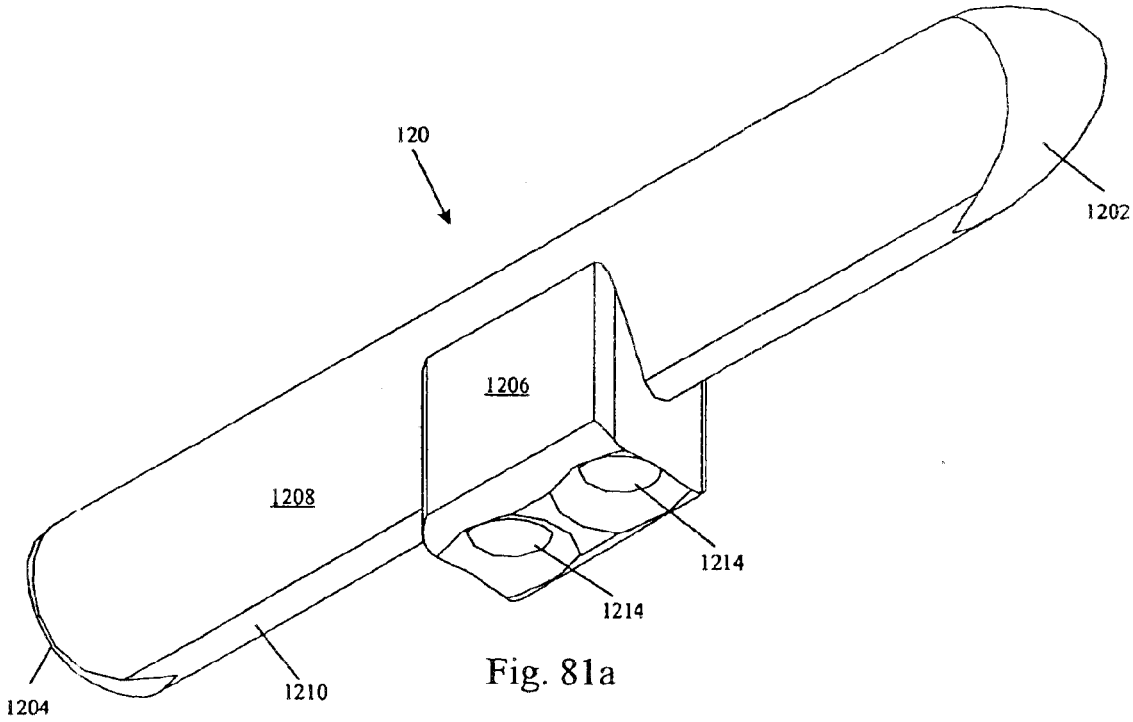
Figure 81B:
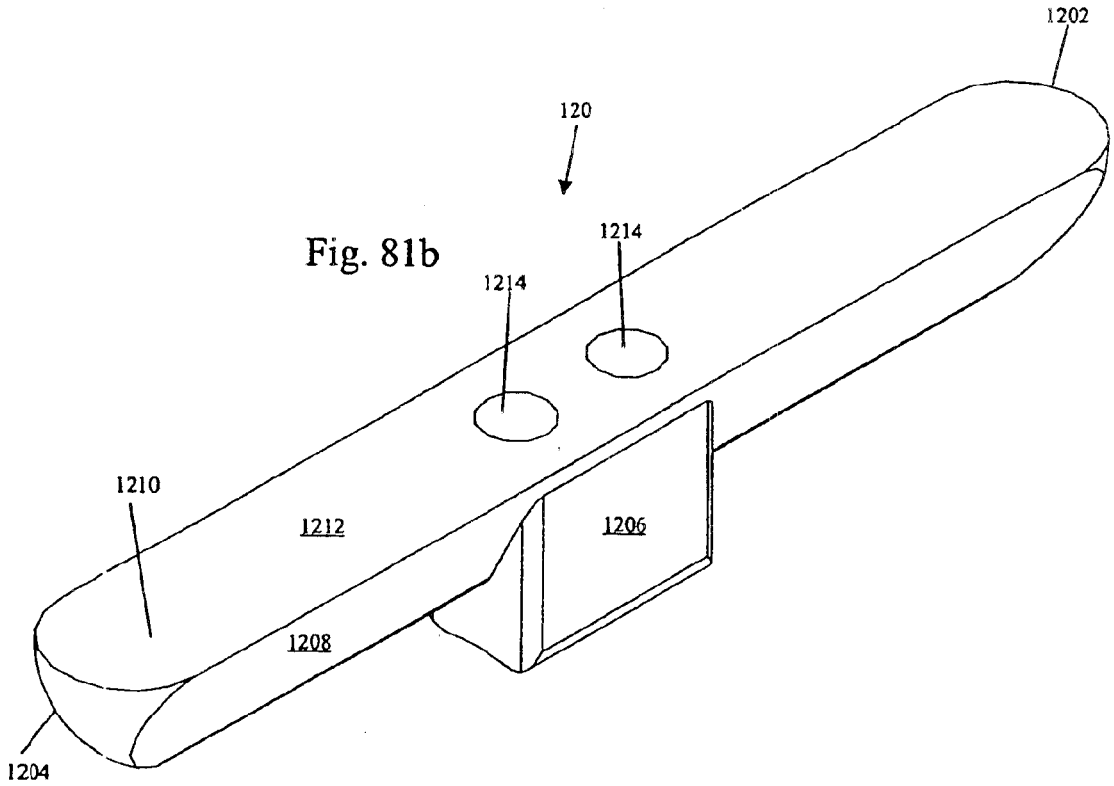
Figure 83:
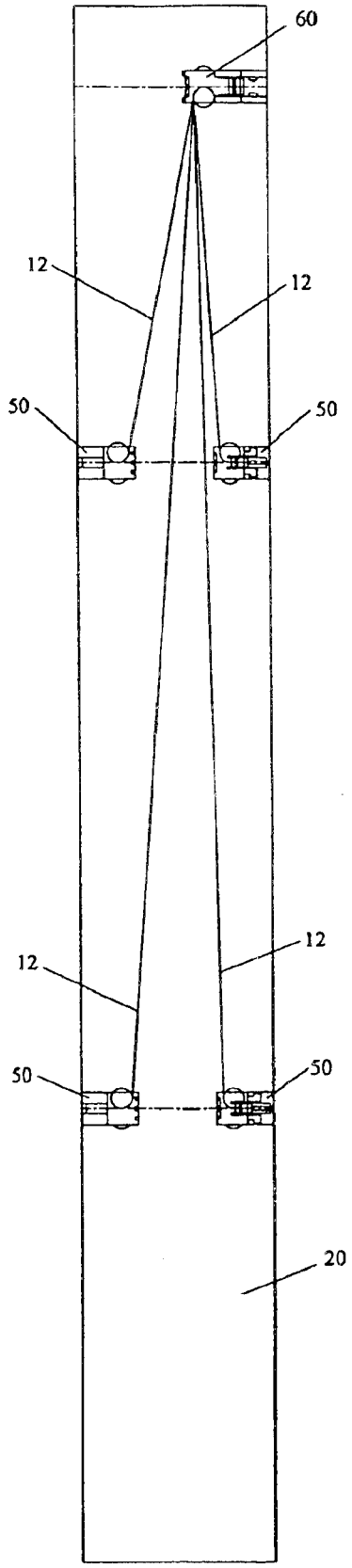
Figure 83A:
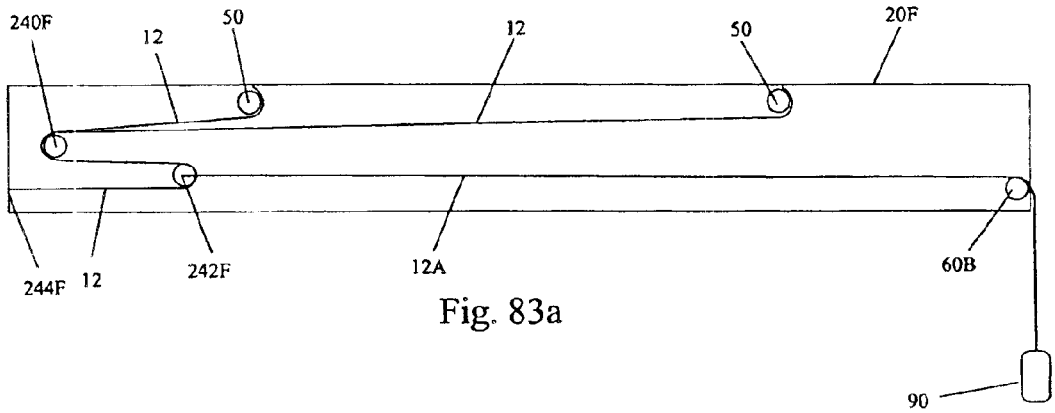
Figure 83B:
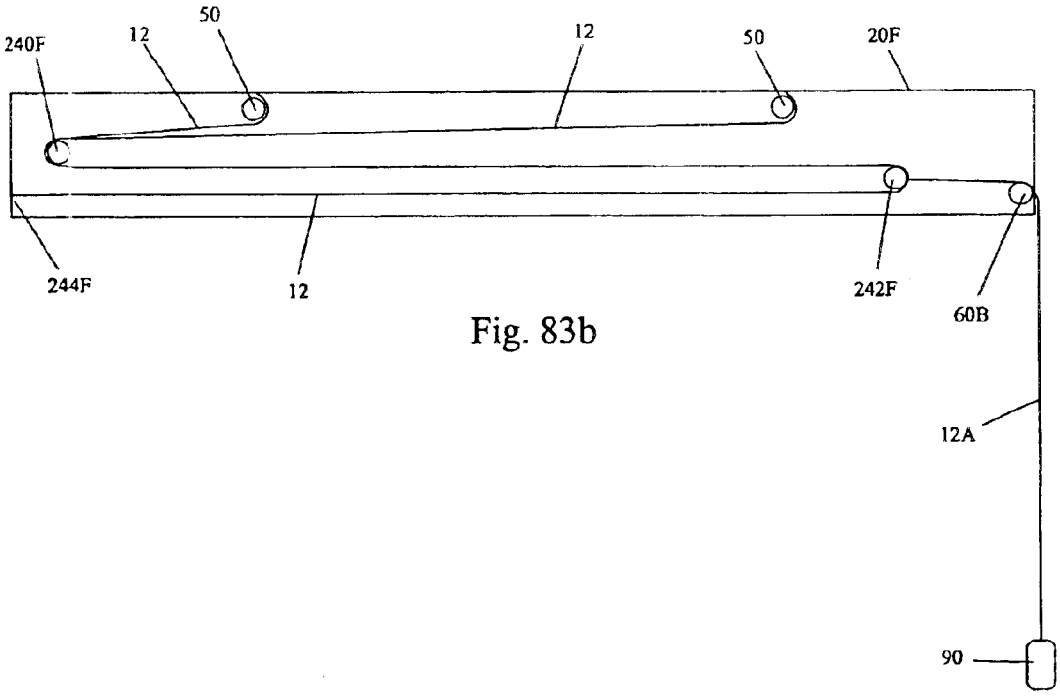
Figure 84A:
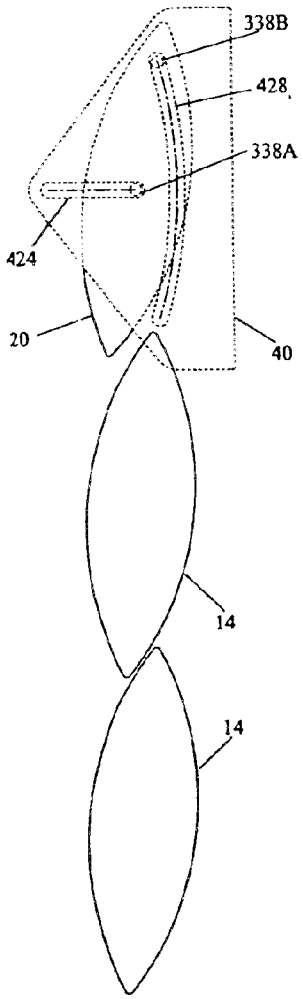
Figure 84B:
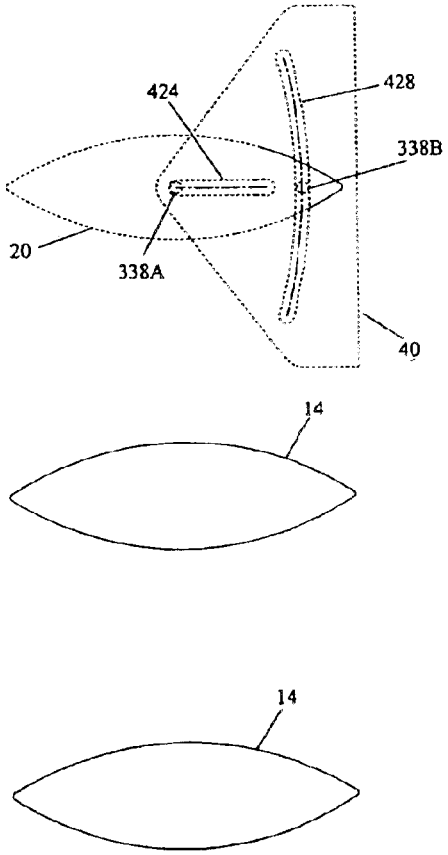
Figure 84C:
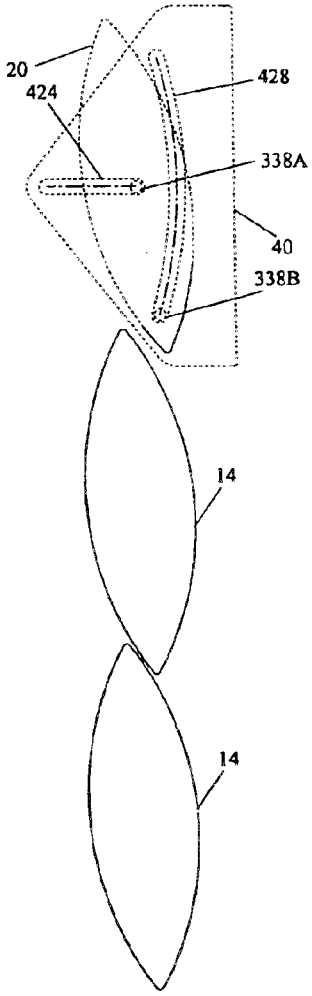
Figure 85:
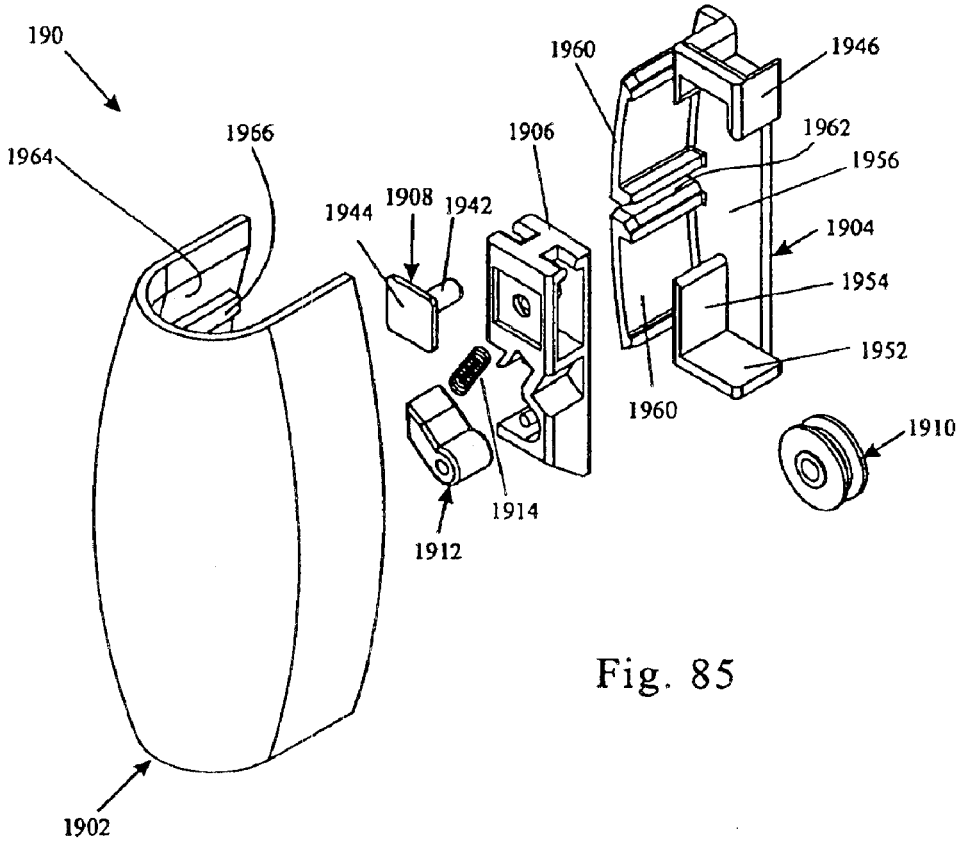
Figure 86A:
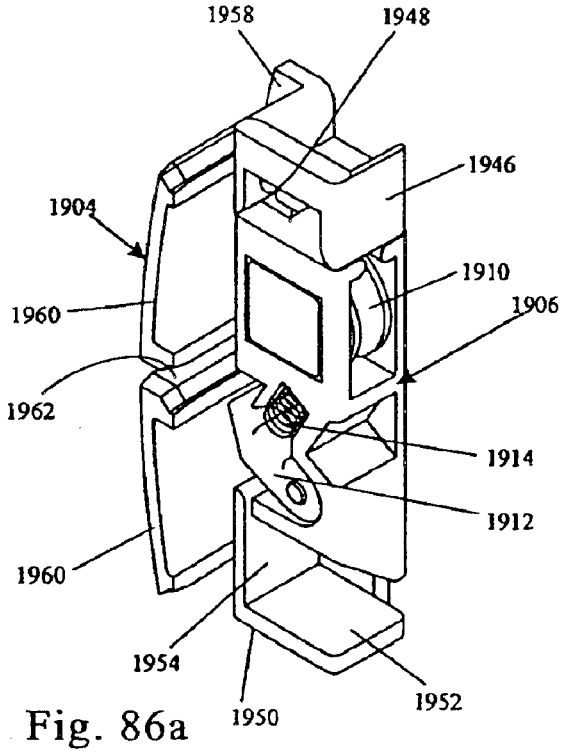
Figure 85A:
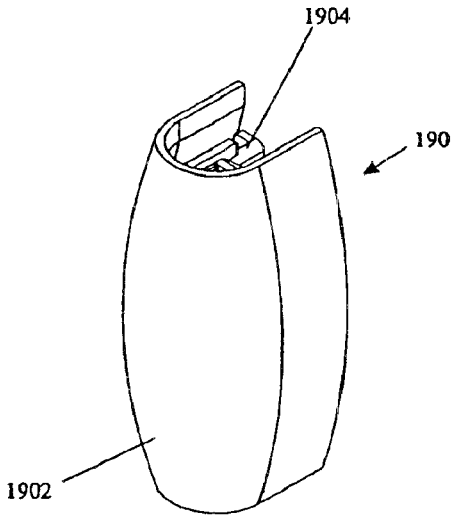
Figure 85B:
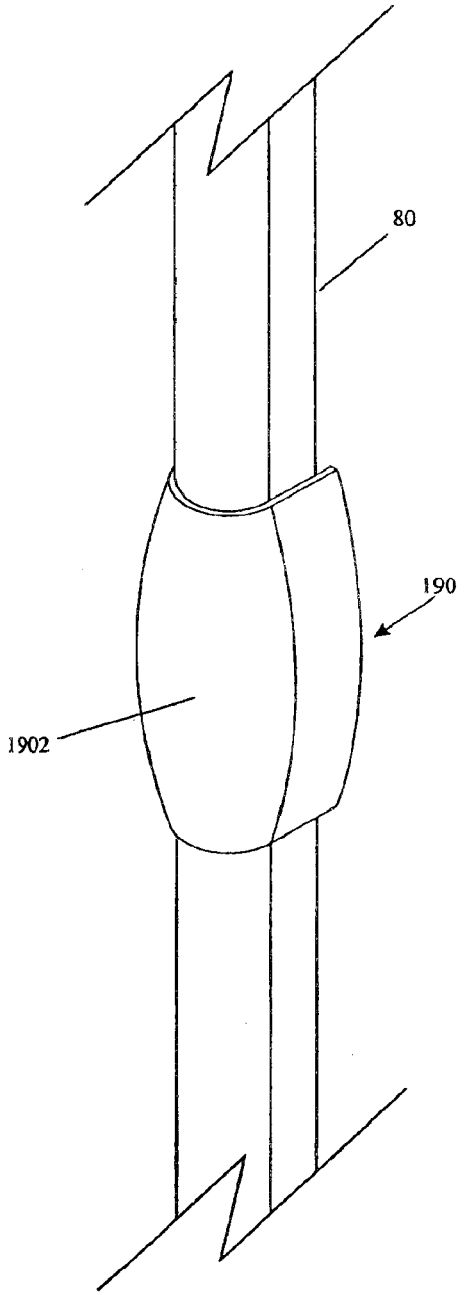
Figure 86:
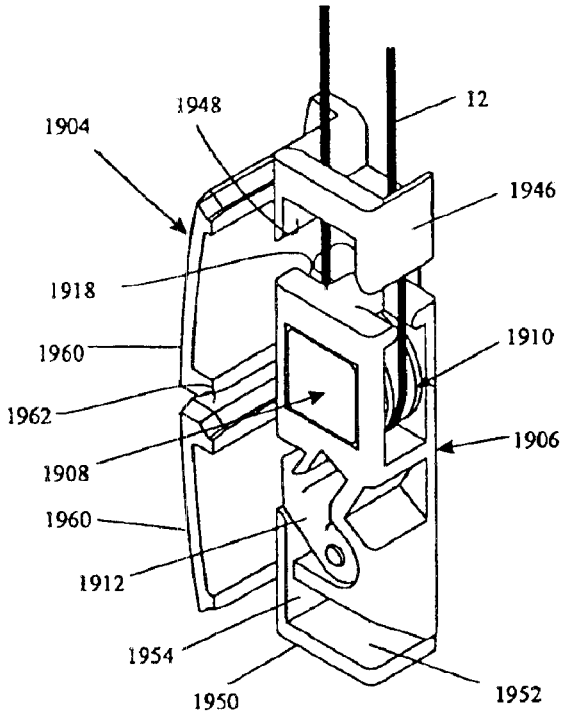
Figure 85C:
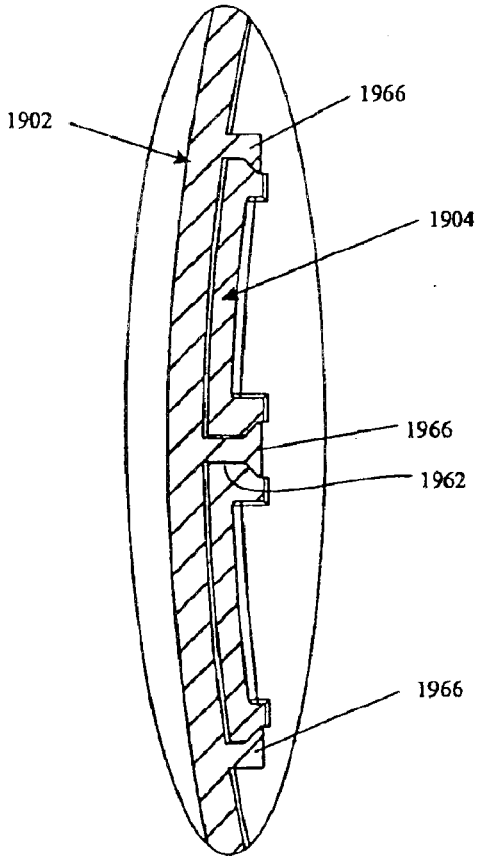
Figure 86B:
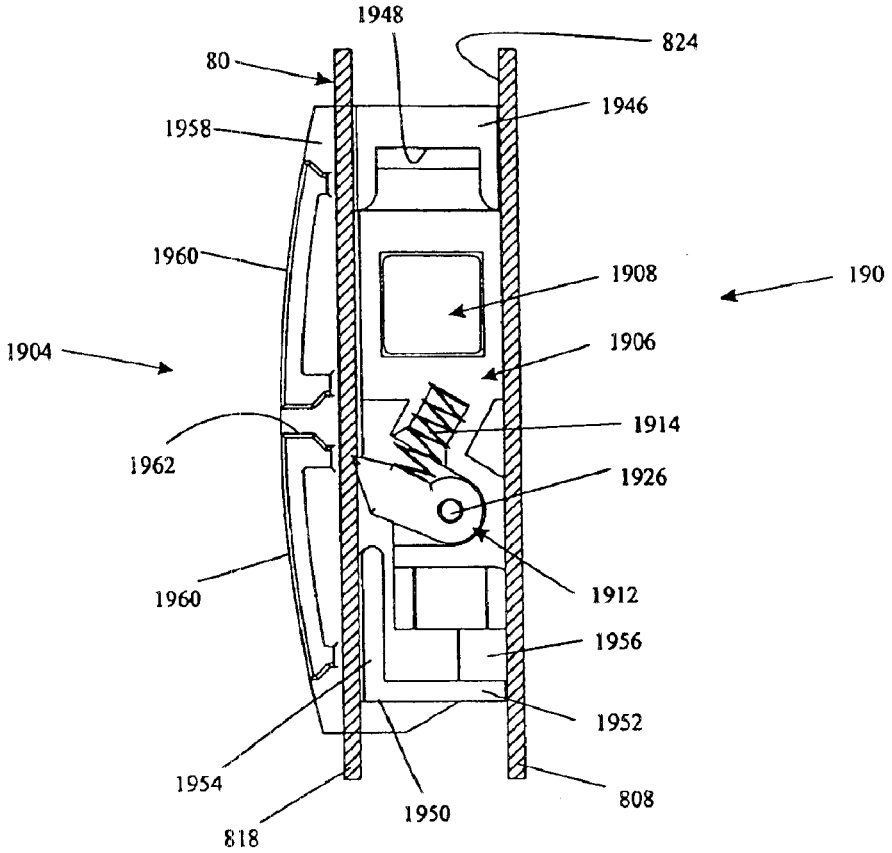
Figure 87A:
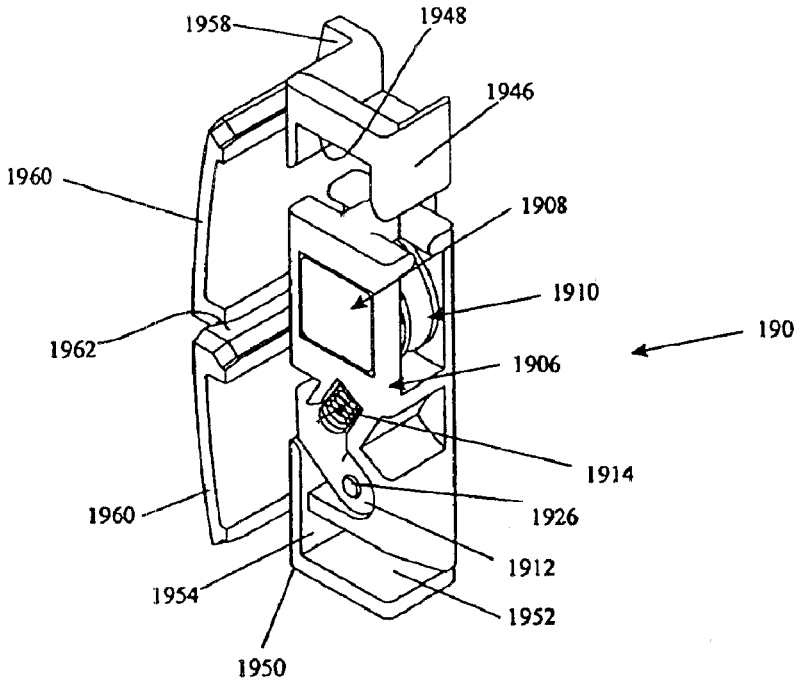
Figure 87B:
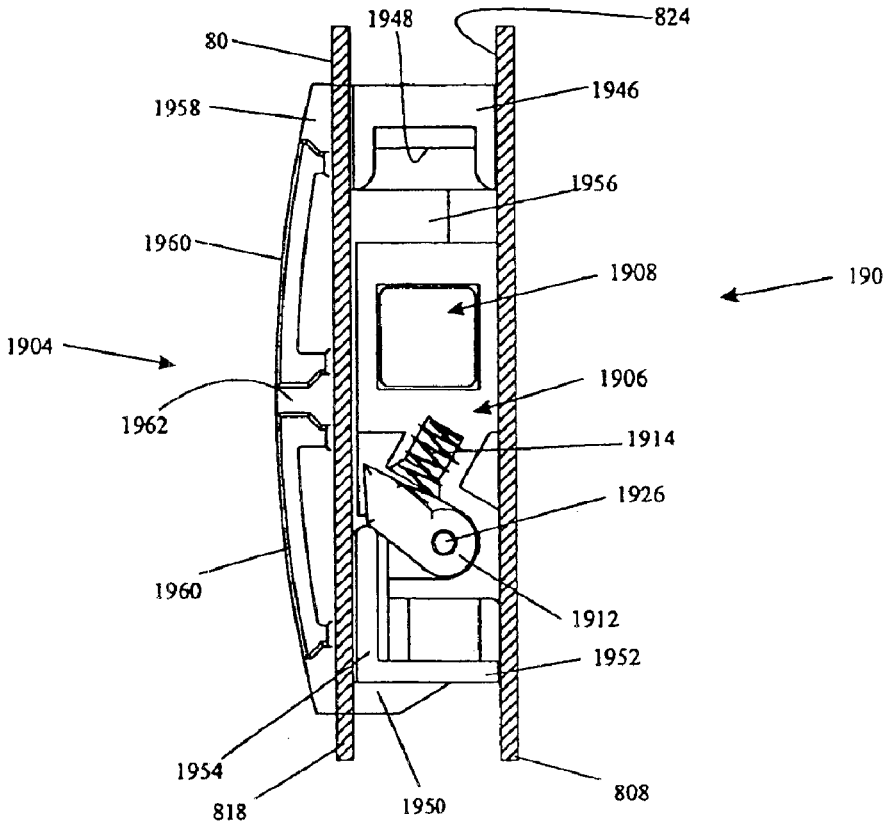
Figure 88A:
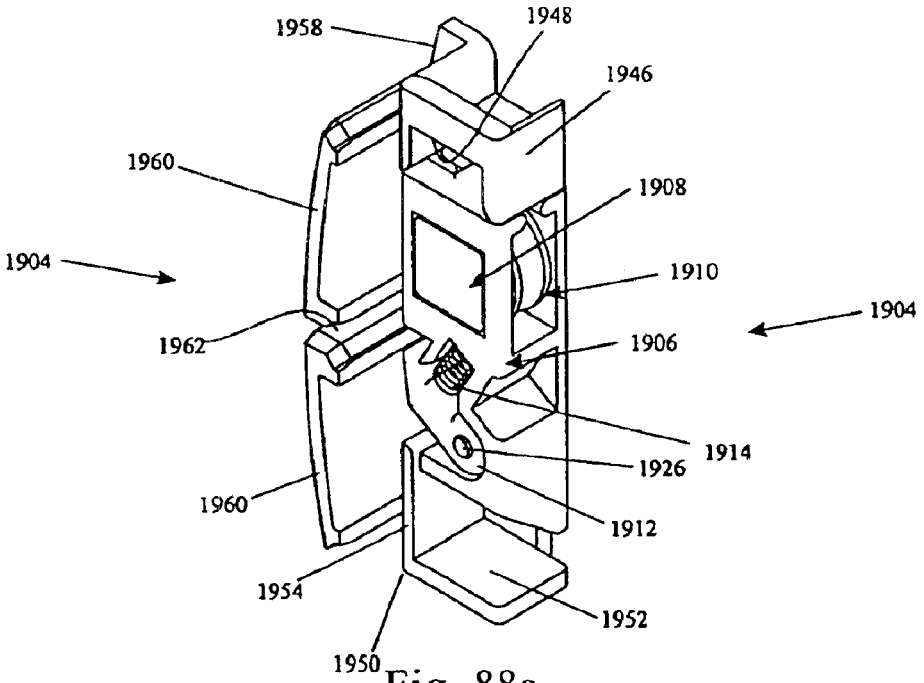
Figure 88B:
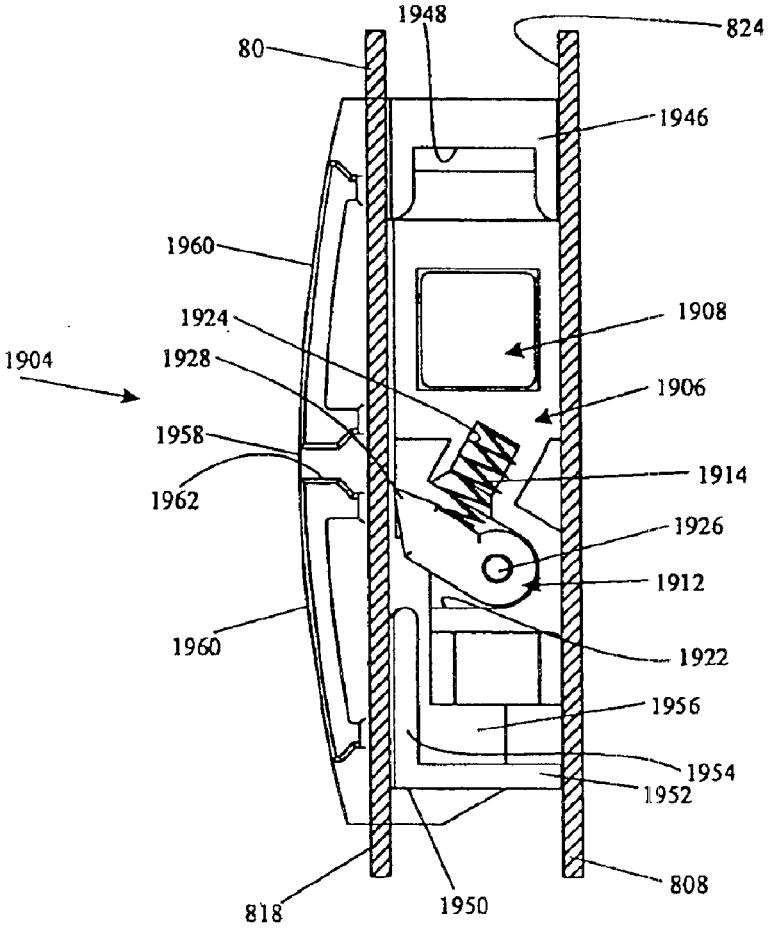
Figure 89A:
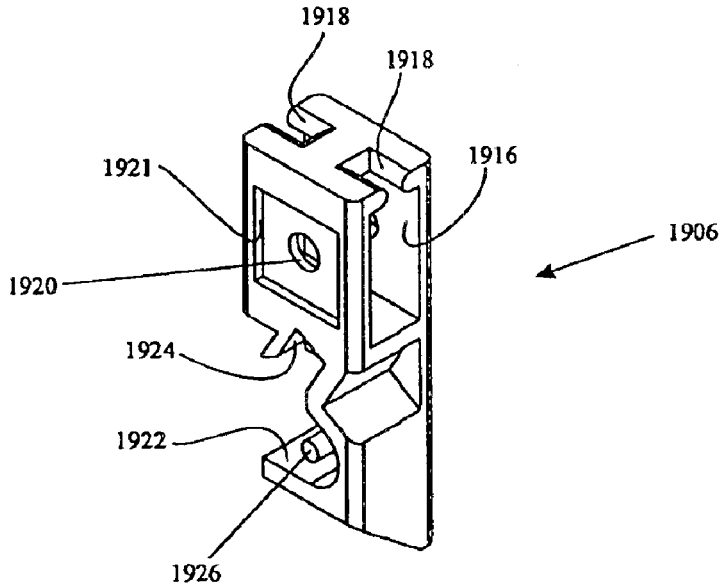
Figure 89B:
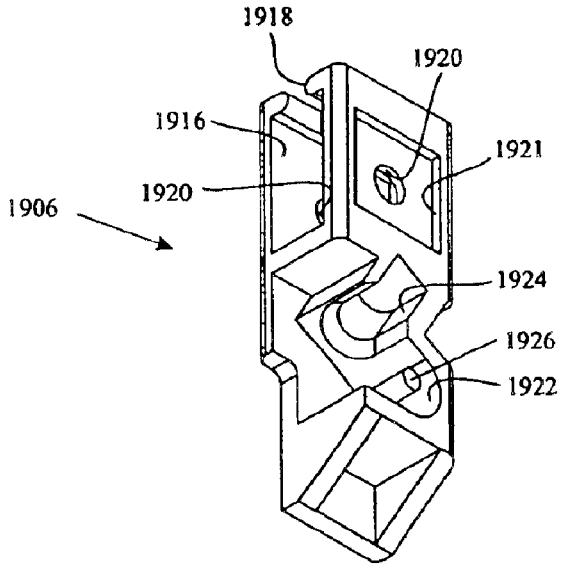
Figure 89C:
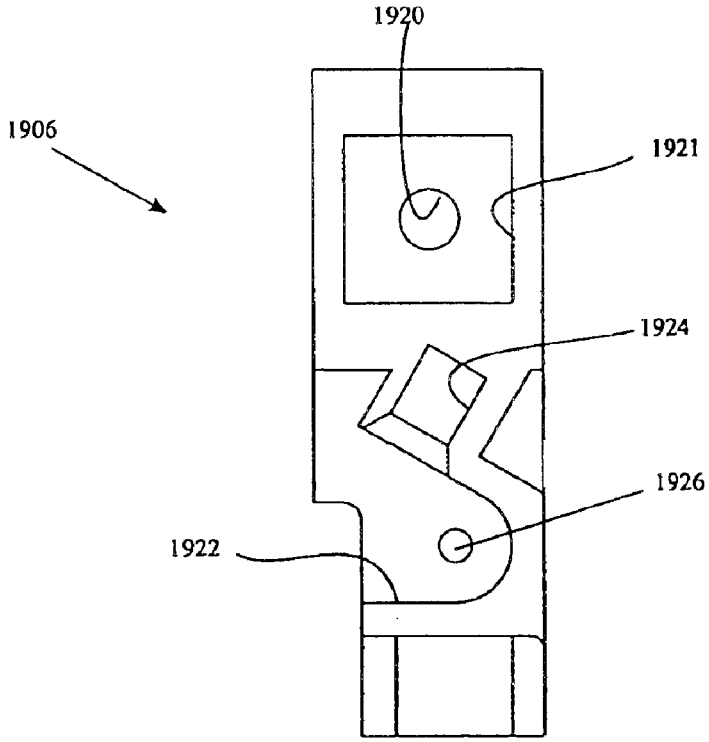
Figure 90A:
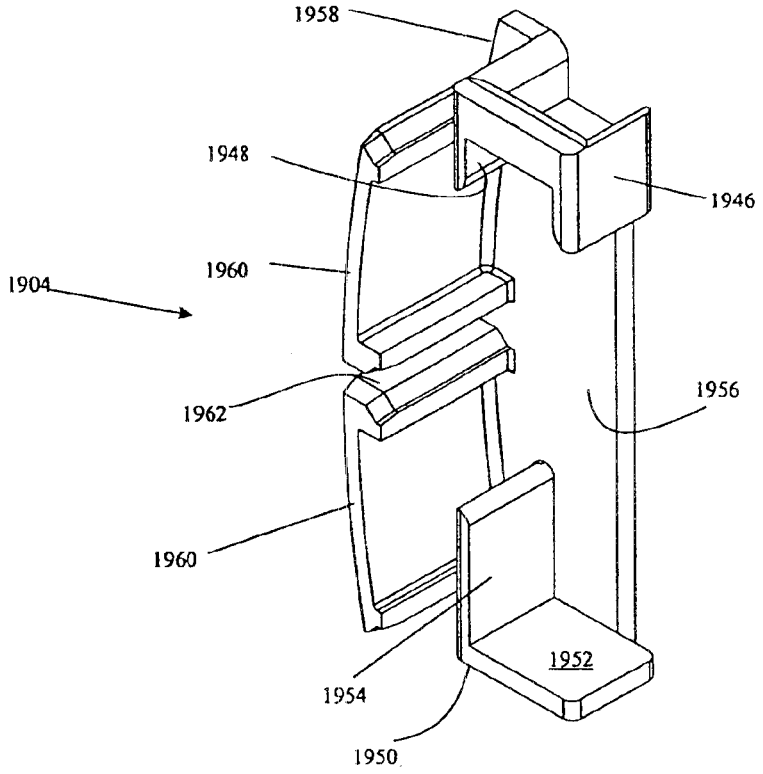
Figure 90B:
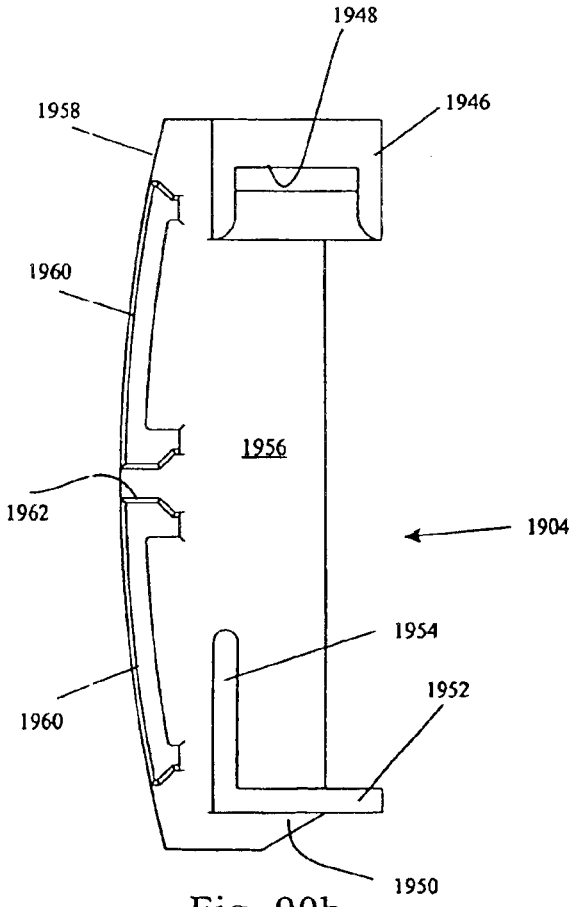
Figure 91A:
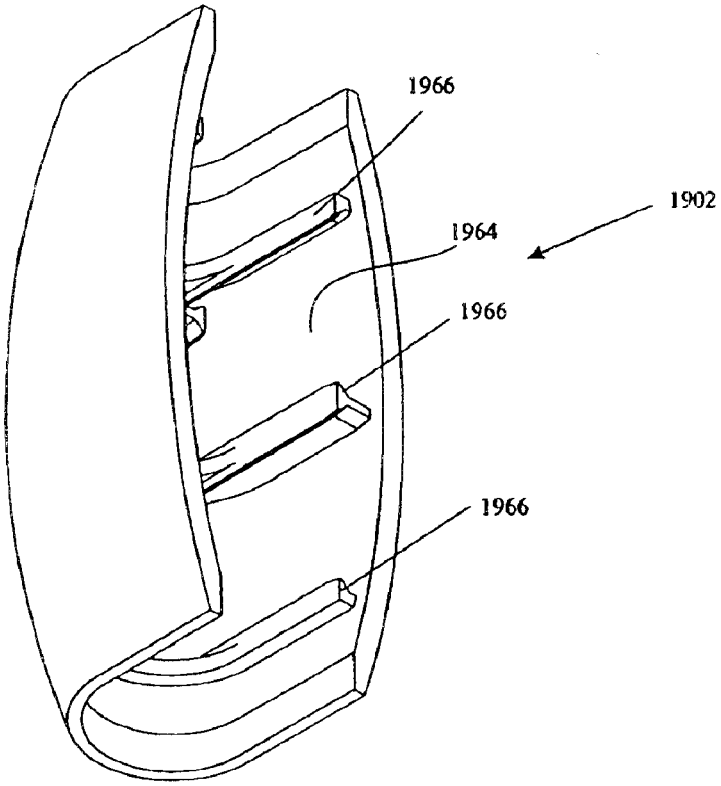
Figure 91B:
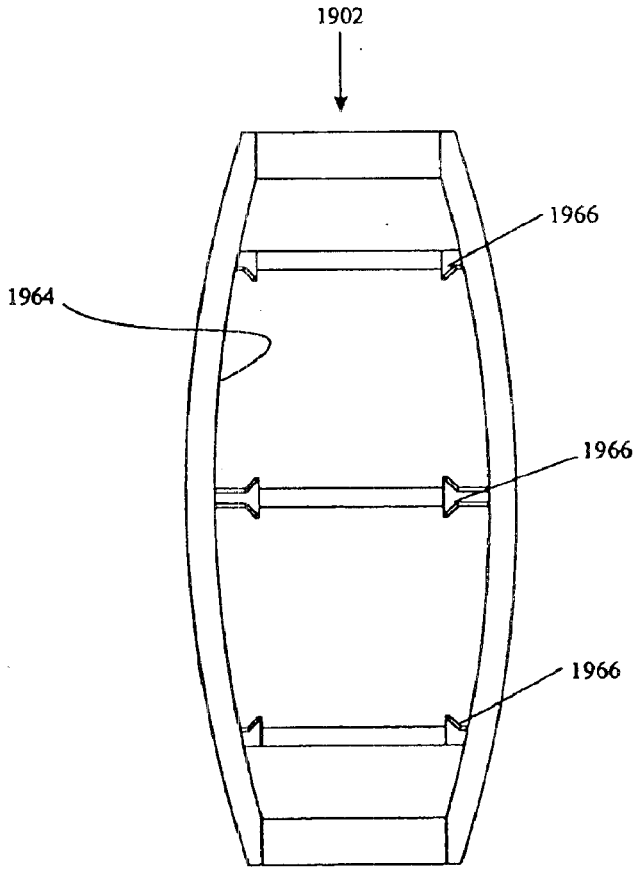
Figure 92A:
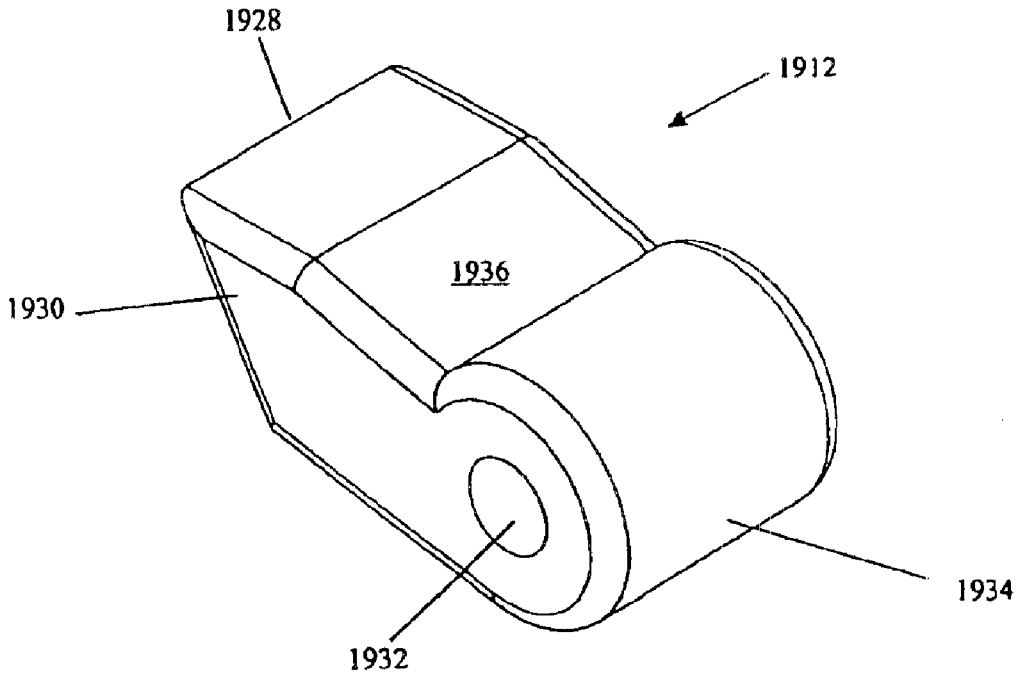
Figure 92B:
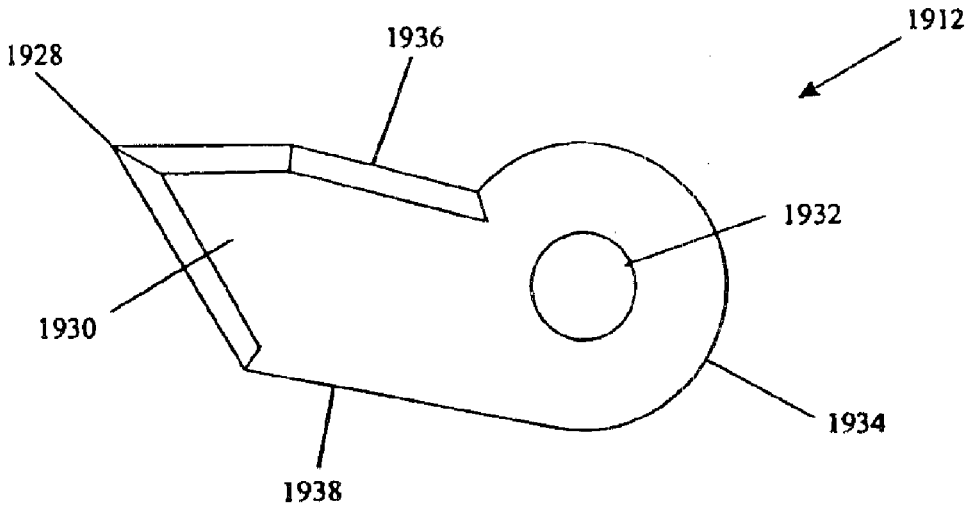
Figure 93A:
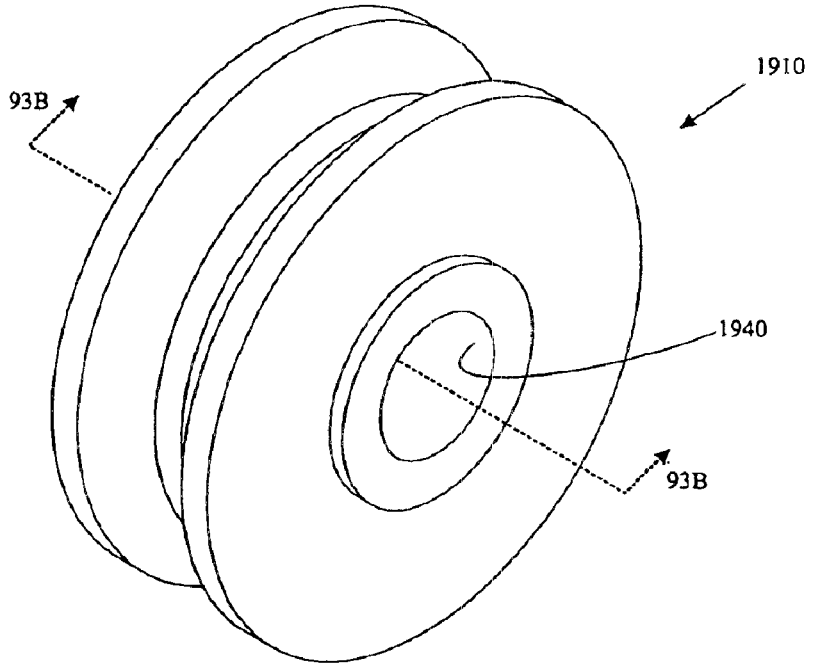
Figure 93B:
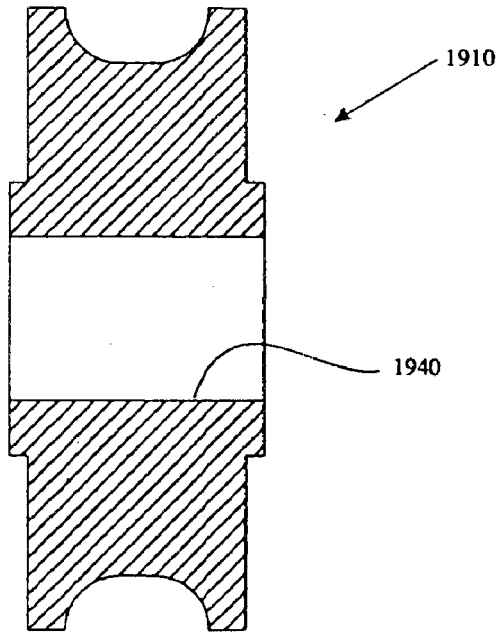
Figure 94:
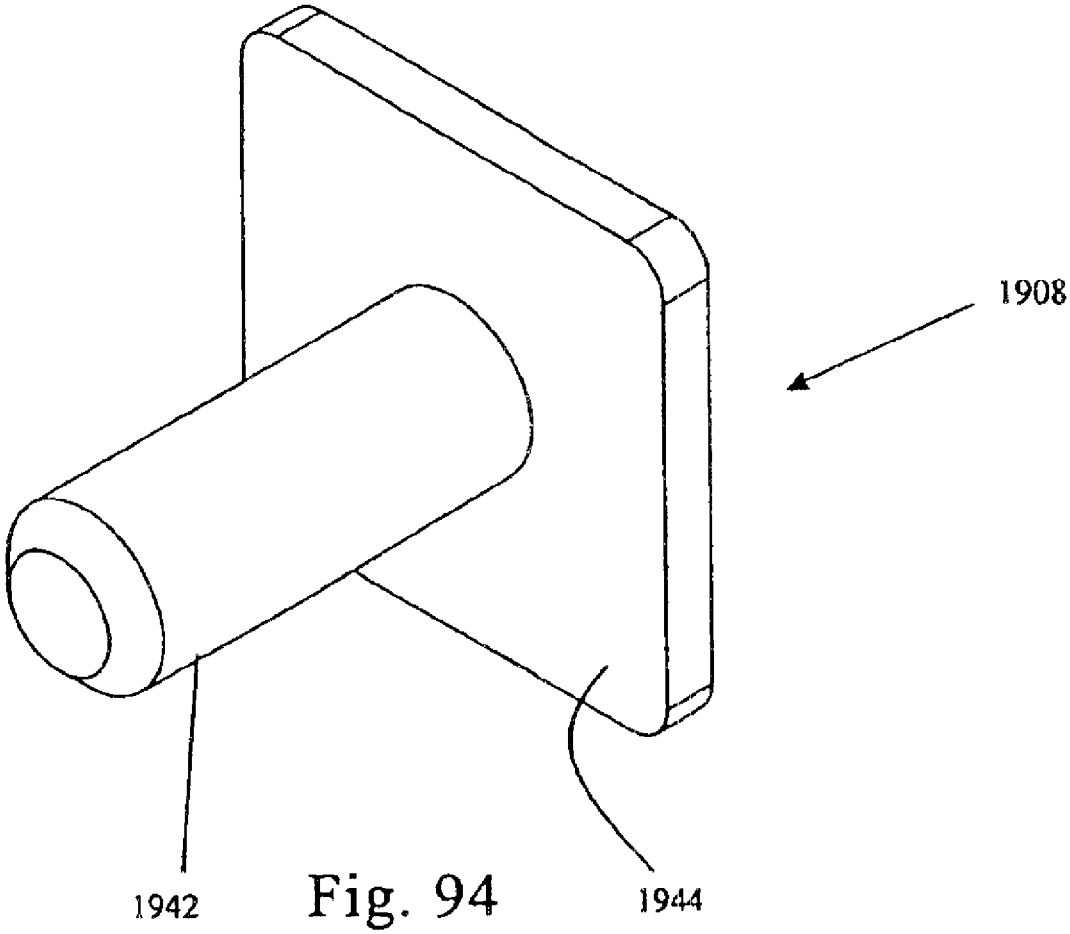
Figure 95A:
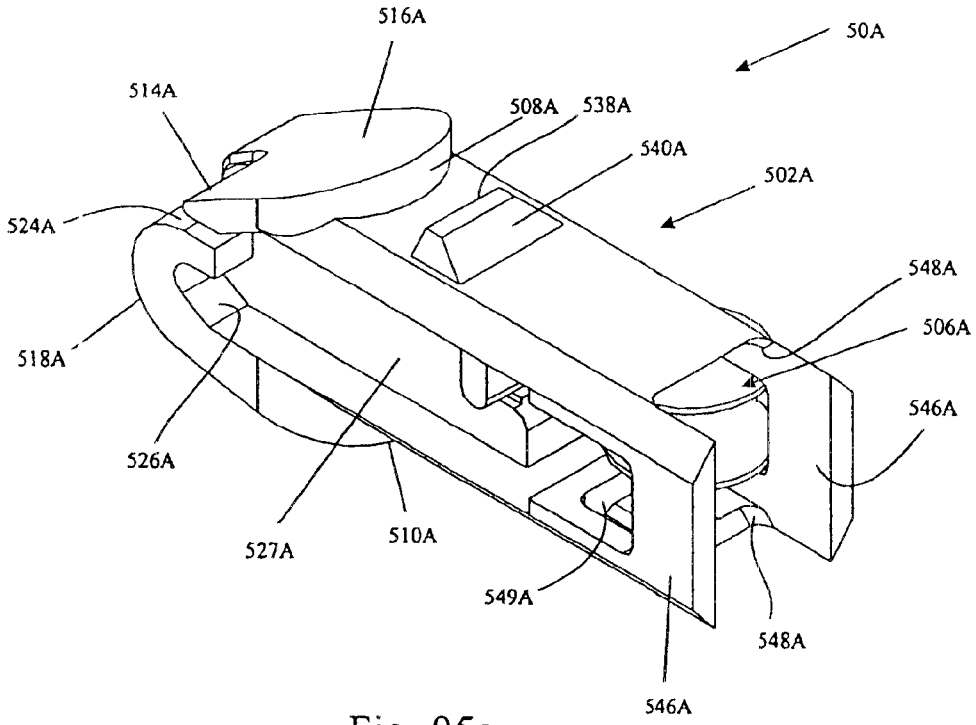
Figure 95B:
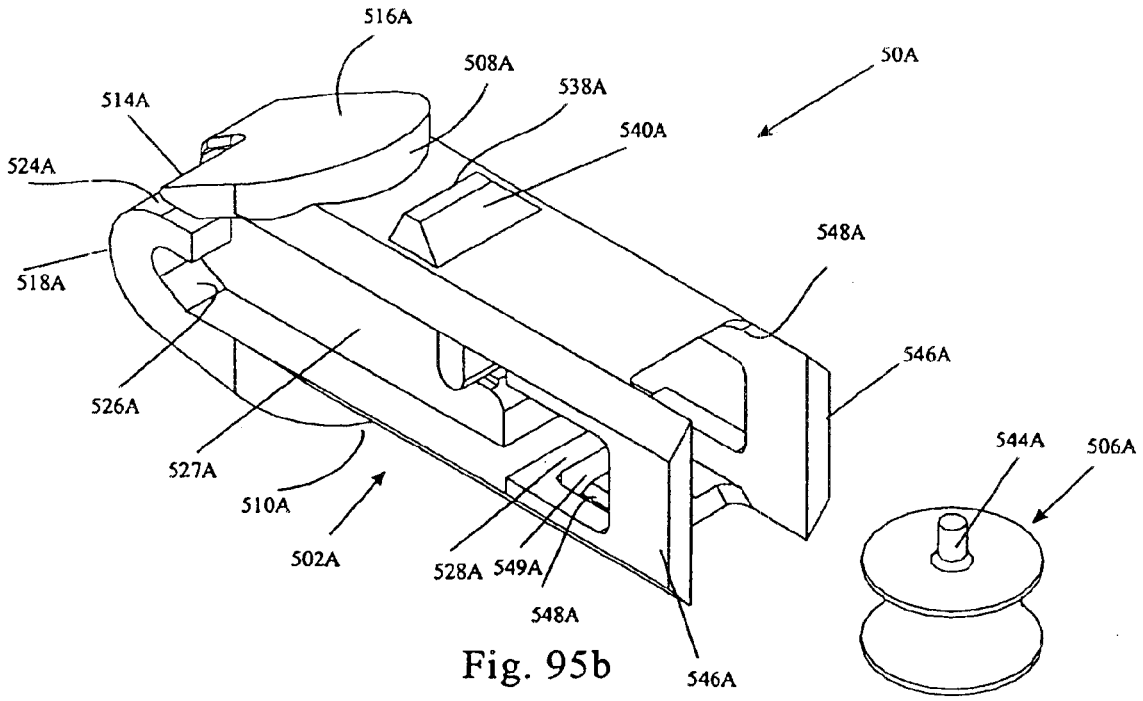

FIG. 51 is a schematic end view of an alternate mounting bracket and its corresponding head rail, which could be used instead of the end cap and bracket of FIG. 3A;

FIG. 51A is a schematic end view, similar to that of FIG. 51, of an alternate mounting bracket and its corresponding head rail which could be used instead of the mounting bracket of FIG. 51;

FIG. 51B is the same view as in FIG. 51A, except showing the louvers tilted closed, room side up;

FIG. 51C is a schematic end view, similar to that of FIG. 51A, of an alternate mounting bracket and its corresponding head rail which could be used instead of the mounting bracket of FIG. 51;

FIG. 51D is the same view as in FIG. 51C, except showing the louvers tilted closed, room side down;

FIG. 51E is a schematic end view, similar to that of FIG. 51, of an alternate mounting bracket and its corresponding head rail which could be used instead of the mounting bracket of FIG. 3A, in this case the room side is to the left of the blind;

FIG. 51F is the same view as in FIG. 51E, except showing the louvers tilted closed, room side up;

FIG. 51G is the same view as in FIG. 51F, except showing the louvers tilted closed, room side down;

FIG. 52 is an exploded perspective view of the cam-lock hand control shown in FIG. 1B, for raising and lowering the blind;

FIG. 53A is a perspective view of the assembled cam-lock hand control of FIG. 52;

FIG. 53B is a perspective view of the same cam-lock hand control of FIG. 53A, but seen from another side;

FIG. 54A is a perspective view of the housing for the cam-lock hand control of FIG. 52;

FIG. 54B is an end view of the cam-lock hand control housing of FIG. 54A;

FIG. 54C is a section view along the line 54C—54C of FIG. 54B;

FIG. 54D is a plan view of the right side of the cam-lock hand control housing of FIG. 54C;

FIG. 55A is a section view along the line 55A—55A of FIG. 55B;

FIG. 55B is a perspective view of the control button of the cam-lock hand control assembly of FIG. 52;

FIG. 56 is a perspective view of the pulley pin of the cam-lock hand control assembly of FIG. 52;

FIG. 57A is a perspective view of the pulley of the cam-lock hand control assembly of FIG. 52;

FIG. 57B is a front view of the pulley of FIG. 57A;

FIG. 58A is a perspective view of the locking pin of the cam-lock hand control assembly of FIG. 52;

FIG. 58B is a top view of the locking pin of FIG. 52;

FIG. 59 is a perspective view of the spring of the cam-lock hand control assembly of FIG. 52;

FIG. 60A is section view along the line 60A—60A of FIG. 53B but with the hand control of FIG. 53B mounted on a tilt bar extrusion and in the "locked" position as shown in FIG. 1A;

FIG. 60B is a section through the hand control of FIG. 53B taken along the line 60B—60B, but with the control button in the "open" position before mounting the hand control on the operator bar;

FIG. 60C is the same view as in FIG. 60A but showing the control button depressed for sliding the hand control along the operator bar;

FIG. 61A is a perspective view of the bottom pivot bracket assembly of FIG. 1A, FIG. 61B is an exploded view of the bottom pivot bracket assembly of FIG. 61A;

FIG. 62A is a perspective view of an alternate bottom pivot bracket assembly which may be used instead of the bottom pivot bracket assembly shown in FIG. 1A;

FIG. 62B is an exploded view of the bottom pivot bracket assembly of FIG. 62A;

FIG. 63A is a perspective view of the pivot arm of the bottom pivot bracket assembly of FIG. 62A;

FIG. 64A is perspective view of another alternative bottom pivot bracket assembly which may be used instead of the bottom pivot bracket assembly shown in FIG. 1A;

FIG. 64B is the same view as that in FIG. 64A, but showing the pivot bracket assembly in the fully retracted position, corresponding to the louvers being in the fully tilted closed position;

FIG. 65 is a perspective view of the pivot arm of the bottom pivot bracket assembly of FIG. 61A;

FIG. 66A is a perspective view of the pivot attachment of the bottom pivot bracket assembly of FIG. 61A;

FIG. 66B is a section view along the line 66B—66B of FIG. 66A;

FIG. 67A is a perspective view of another alternative bottom pivot bracket assembly which may be used instead of the bottom pivot bracket assembly of FIG. 4B;

FIG. 67B is a side view of the bottom pivot bracket assembly of FIG. 67A;

FIG. 67C is a partially broken away section along the line 67C—67C of FIG. 67B;

FIG. 68A is an enlarged perspective view of the mounting bracket of FIG. 67A;

FIG. 68B is a section along the line 68B—68B of FIG. 68A;

FIG. 68C is an enlarged view of the right end portion of FIG. 68B;

FIG. 69A is a side view of the bottom pivot bracket assembly of FIG. 67A, but when the arm is in the retracted position, corresponding to the louvers being in the fully tilted closed position;

FIG. 69B is the same view as that in FIG. 69A, but when the arm is in the extended position, corresponding to the louvers being in the fully open position;

FIG. 70A is a perspective view of the link button which ties together the mounting bracket and the pivot arm of the bottom pivot bracket assembly of FIG. 67A;

FIG. 70B is a front view of the link button of FIG. 70A;

FIG. 71A is a perspective view of the pivot arm of the bottom pivot bracket assembly of FIG. 67A;

FIG. 71B is a section view along the line 71B—71B of FIG. 71A;

FIG. 72A is a partially broken away, partially exploded, perspective view of an alternate shutter blind with a bottom pivot bracket assembly designed to look like the profile of the bottom rail;

FIG. 72B is a partially broken away perspective view of the bottom pivot bracket assembly of FIG. 72A, shown when in the fully extended position, corresponding to the louvers being in the open position;

FIG. 73A is a perspective view of the pivot arm which is part of the bottom pivot bracket assembly of FIG. 72A;

FIG. 73B is a top view of the pivot arm of FIG. 73A;

FIG. 73C is a perspective view of the bottom pivot bracket assembly of FIG. 5F;

FIG. 73D is an exploded, perspective view of the bottom pivot bracket assembly of FIG. 73C;

FIG. 74 is an enlarged, partially broken away perspective view of the assembly of FIG. 5C;

FIG. 75A is a perspective view of the custodial wand clip of FIG. 74;

FIG. 75B is a side view of the custodial wand clip of FIG. 75A;

FIG. 76A is a perspective view of the custodial wand tip of FIG. 74;

FIG. 76B is a bottom perspective view of the custodial wand tip, of FIG. 76A;

FIG. 76C is a section view along the line 76C—76C of FIG. 76A;

FIG. 76D is a section view along the line 76D—76D of FIG. 76C;

FIG. 77A is an exploded perspective view of the stop block which is mounted on the tilt bar as shown in FIG. 1B;

FIG. 77B is a perspective view of the assembled stop block of FIG. 77A;

FIG. 77C is a perspective view of the stop block of FIG. 77B mounted on the tilt bar extrusion;

FIG. 77D is a top view of the stop block and tilt bar extrusion of FIG. 77C;

FIG. 78A is a perspective view of the provisional lift clip shown in FIG. 5B;

FIG. 78B is another perspective view of the same provisional lift clip of FIG. 78A, but seen from an opposite end;

FIG. 78C is a side view of the provisional lift clip of FIG. 78A;

FIG. 79A is a perspective view of one of the provisional lift finger tabs shown in FIG. 5B;

FIG. 79B is another perspective view of the same provisional lift finger tab of FIG. 79A, but seen from another direction;

FIG. 79C is a section view along the line 79C—79C of FIG. 79A;

FIG. 79D is a top view of the provisional finger lift tab of FIG. 79A;

FIG. 79E is the same view as FIG. 79D but with the tab mounted on the operator bar;

FIG. 79F is a section view showing the provisional lift of FIG. 5B, depicting the lift clip attached to the bottom rail at one end, and the finger tab locked onto the operator bar at the other end;

FIG. 80 is a side view of the bottom rail insert shown in FIG. 1B;

FIG. 80A is a partially broken away, perspective view of the bottom rail insert of FIG. 80;

FIG. 81A is an enlarged perspective view of the bottom rail cord anchor shown in FIG. 1B;

FIG. 81B is an enlarged perspective view of the bottom rail cord anchor of FIG. 81A, but seen from the bottom;

FIGS. 82A through 82F are perspective views showing the sequence of installation of the lift cords and tilt cables to the bottom rail anchor of FIG. 81A, and the installation of the bottom rail anchor to the bottom rail of FIG. 1B;

FIG. 83 is a schematic view of the inside of the head rail of FIG. 1A, showing the routing of the lift cords through the cord guides and through the operator bar top attachment;

FIG. 83A is a schematic view of the inside of the head rail, similar to FIG. 83, but modified to provide a multiplier effect of the lift cord as it raises or lowers the blind of FIG. 1:

FIG. 83B is the same view as FIG. 83A but corresponding to the blind being in the raised position;

FIG. 84A is a schematic view along the line 84—84 of FIG. 2A (with the end caps removed for drawing clarity) when the louvers are fully closed in the tilted down position (room side tilted down);

FIG. 84B is the same view as FIG. 84A but when the louvers are fully tilted open;

FIG. 84C is the same view as in FIG. 84A but when the louvers are fully closed in the tilted up position (room side tilted up);

FIG. 85 is an exploded view of a slide-lock hand control which may be used instead of the cam-lock hand control of FIG. 52;

FIG. 85A is a perspective view of the slide-lock hand control of FIG. 85;

FIG. 85B is the same view as in FIG. 85A, but with the slide-lock hand control mounted onto the operator bar;

FIG. 85C is a broken away, enlarged, sectional view showing the interconnection of the grip cover and the cover housing of the slide-lock hand control of FIG. 85;

FIG. 86 is a perspective view of the slide-lock hand control of FIG. 85, with the grip cover removed for clarity, showing the routing of the lift cord 12 through the slide-lock hand control;

FIG. 86A is an enlarged perspective view of the slide-lock hand control assembly of FIG. 85, but with the grip cover removed for clarity, shown in the locked position;

FIG. 86B is a side sectional view through an operator bar, showing the slide-lock hand control assembly of FIG. 86A, indicating how the lock arm grips the operator bar extrusion to lock the slide-lock hand control assembly in place;

FIG. 87A is a perspective view of the slide-lock hand control assembly of FIG. 86A, but shown in the unlocked raising position (for lowering the louver stack);

FIG. 87B is a side sectional view through an operator bar showing the slide-lock hand control assembly of FIG. 87A, with the lock arm lifted up to unlock it from the operator bar extrusion to permit raising of the hand control (and thus lowering of the louver stack);

FIG. 88A is a perspective view of the slide-lock hand control assembly of FIG. 86A, shown in the lowering position;

FIG. 88B is a side sectional view through an operator bar showing the slide-lock hand control assembly of FIG. 88A, in the position that permits the slide-lock hand control assembly to be lowered (thus raising the louver stack);

FIG. 89A is an enlarged perspective view of the slide-lock pulley housing of the slide-lock hand control assembly of FIG. 85;

FIG. 89B is another perspective view of the slide-lock pulley housing of FIG. 89A;

FIG. 89C is a side view of the slide-lock pulley housing of FIG. 89B;

FIG. 90A is an enlarged perspective view of the slide-lock housing of FIG. 85;

FIG. 90B is a plan view of the slide-lock housing of FIG. 90A;

FIG. 91A is an enlarged perspective view of the slide-lock grip cover of FIG. 85;

FIG. 91B is a plan view looking into the slide-lock grip cover of FIG. 91A;

FIG. 92A is an enlarged perspective view of the lock arm of FIG. 85;

FIG. 92B is a plan view of the lock arm of FIG. 92A;

FIG. 93A is an enlarged perspective view of the pulley of FIG. 85;

FIG. 93B is a section view along the line 93B—93B of FIG. 93A;

FIG. 94 is an enlarged perspective view of the pulley axle of FIG. 85;

FIG. 95A is a perspective view of a two-piece cord glide which may be used instead of the three-piece cord glide shown in FIG. 1B;

FIG. 95B is an exploded view of the cord glide of FIG. 95A

Figure 96A:
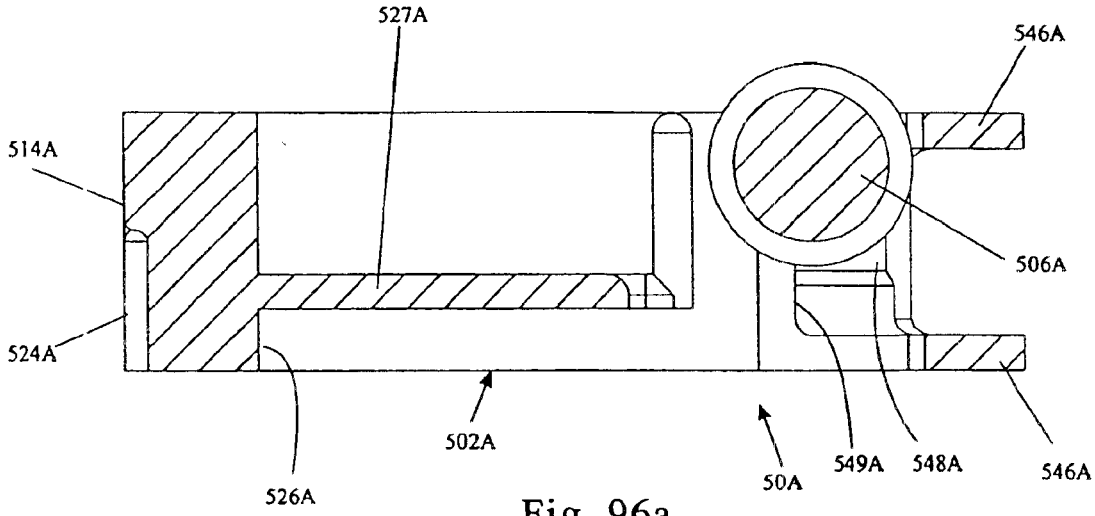
Figure 96B:
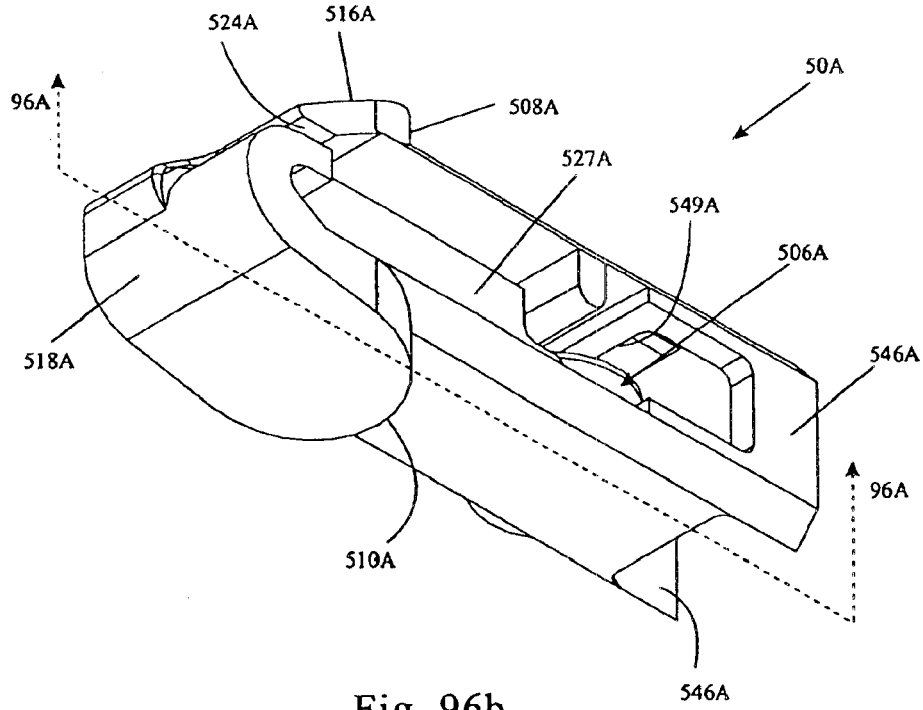
Figure 97:
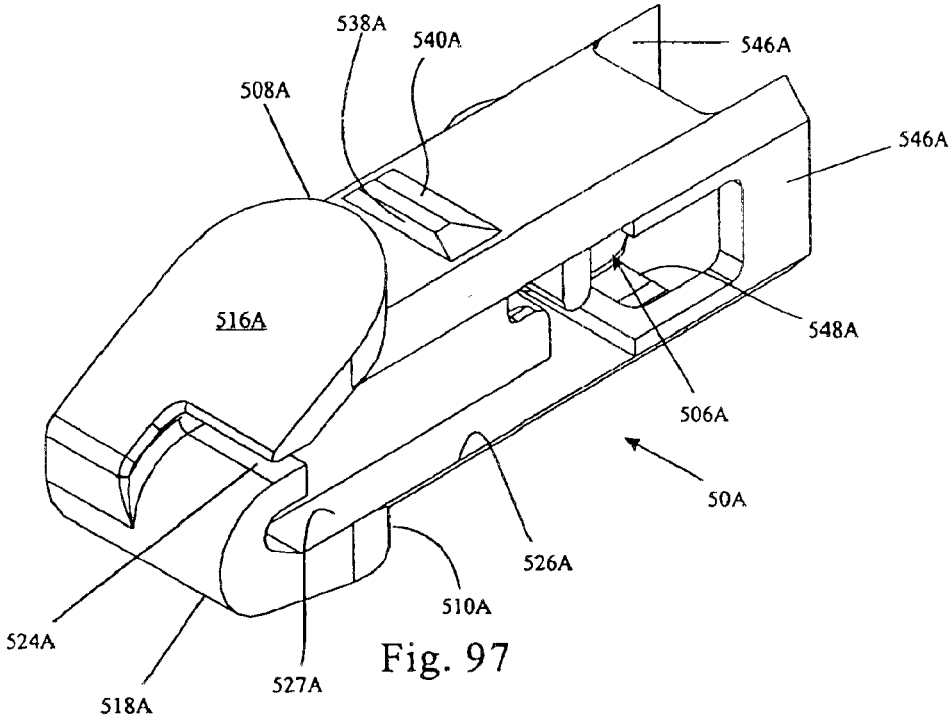
Figure 97A:
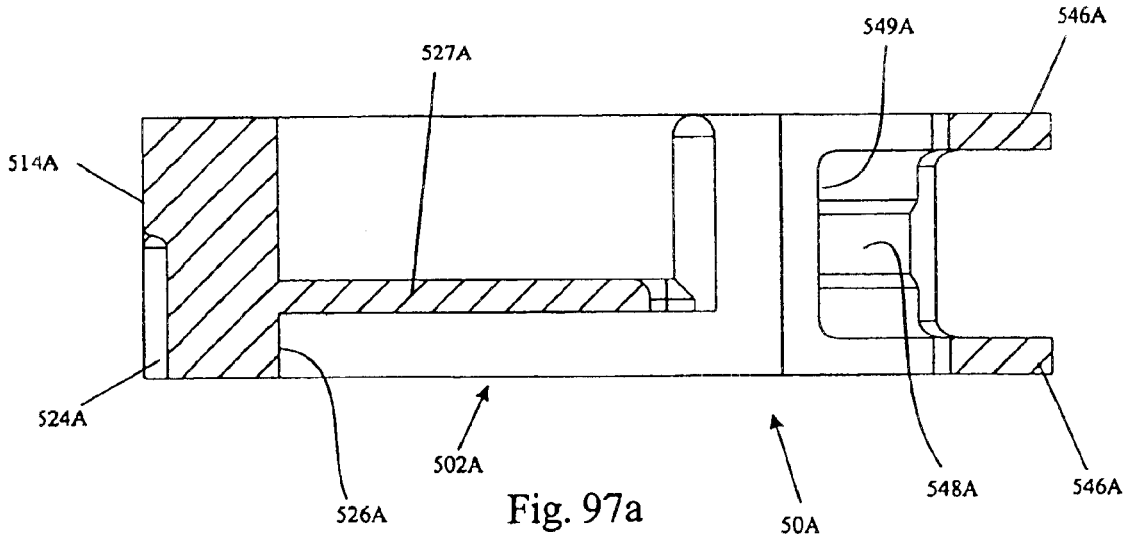

FIG. 96A is a section view along the line 96A—96A of FIG. 96B;

FIG. 96B is a bottom perspective view of the cord glide of FIG. 95A;

FIG. 97 is another perspective view of the cord glide of FIG. 95A, but seen from the opposite end: and, FIG. 97A is the same view as FIG. 96A but with the pulley removed to show the flange which supports the pulley.

DESCRIPTION OF THE PREFERRED EMBODIMENTS:

Referring now to FIGS. 1A and 1B, the shutter blind 10 includes a head rail 20 and a plurality of slats or louvers 14 suspended from the head rail 20 by means of tilt cables 16 and their associated cross cords which together comprise the ladder tapes. Two lift cords 12 (not shown in these Figures) are fastened at the bottom of the bottom slat (or bottom rail)

21, which is heavier than the other louvers 14. The head rail 20 includes end caps 30 which pivotably mount the head rail 20 to mounting brackets 40 which secure the shutter blind 10 to the window frame. The tilt cables 16 are secured to the head rail 20 by means of cord glides 50 which also serve to guide the lift cords 12 into the head rail 20 (as seen in FIG. 83). The lift cords 12 travel within the head rail 20 until they exit the head rail 20 toward one end of the head rail 20 via the tilt bar top attachment 60A, through the top end cap 70A, down the tilt bar 80, around a doubler pulley in the hand control 90, and back up to be tied off at the top end cap 70A. The bottom of the tilt bar 80 is pivotably secured to the window frame by means of a bottom pivot bracket 100. The bottom rail 21 could be formed by placing a rail insert 110 into the bottom-most louver 14. Cord anchors 120 are used to attach the lift cords 12 and the tilt cables 16 to the bottom rail 21. A stop block 130 is secured to the tilt bar 80 to limit the upward travel of the hand control 90 on the tilt bar 80 so that the hand control 90 is not pushed up beyond the point where the shutter blind 10 is fully lowered.

Figure 2B:
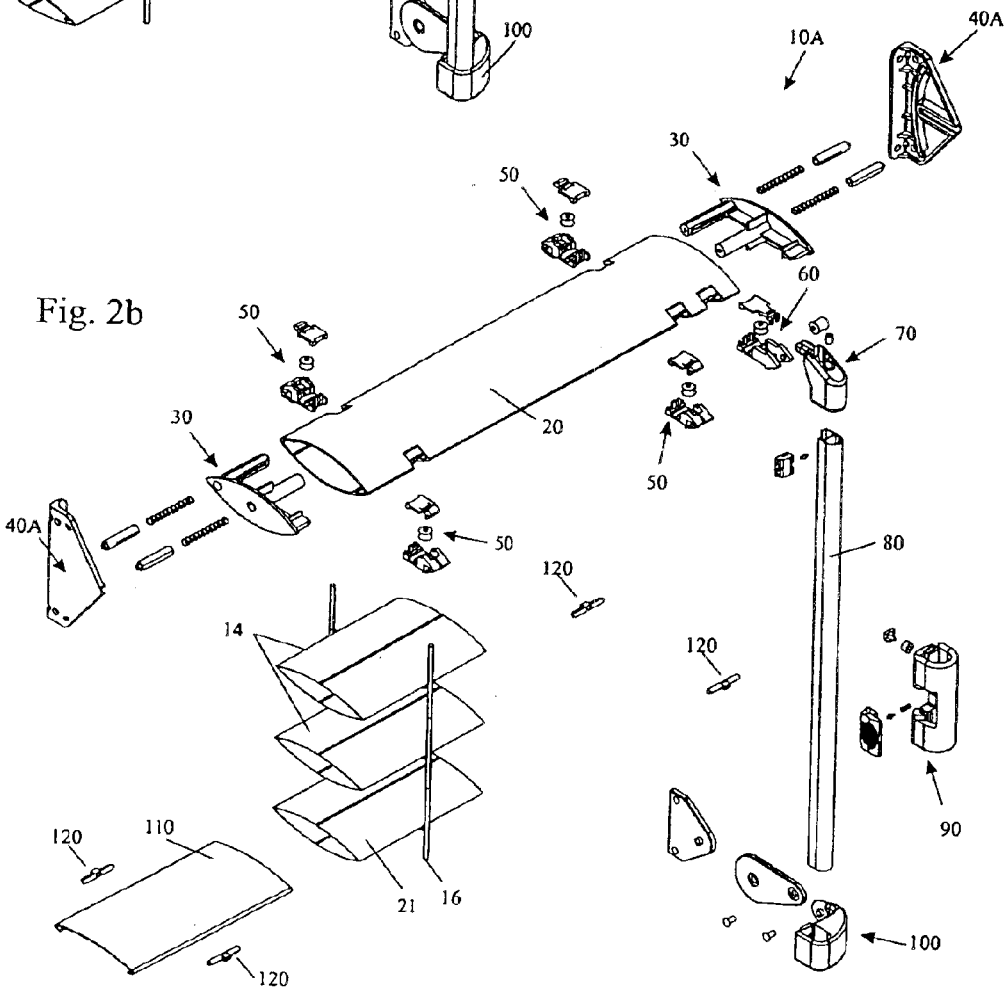
FIG. 2B is an exploded view of the shutter blind of FIG. 2A.

FIGS. 2A and 2B depict a second embodiment of a shutter blind 10A made in accordance with the present invention. This second embodiment 10A is similar to the first embodiment 10. One difference is the mounting bracket 40A, which has a bullet shaped nose instead of the slide-slot design of the mounting bracket 40. Also, the connection of the tilt bar 80 to the head rail 20 is via a buttons-and-holes connection 60 instead of the ball and socket connection 60A of FIGS. 1A and 1B.

FIGS. 3A and 3B depict a third embodiment of a shutter blind 10B made in accordance with the present invention. This third embodiment 10B is similar to the second embodiment 10A. One difference is that there are now two tilt bars 80 and a bottom rail 21A, which is very similar to the top rail 20, instead of being a louver 14 with a rail insert 110 as in the first and second embodiments. In this embodiment, the bottom rail tilts, but it does not raise or lower. Instead, it is secured to the window frame with mounting brackets 40A like those securing the head rail 20. The two tilt bars 80 are secured not only to the head rail 20 via the tilt bar top attachment 60 and the top end cap 70, but they are also secured to the bottom rail 21A, via a multi-bar bottom attachment 140, an adjustable bottom end cap 150, and bottom plug 160. This assembly is height adjustable to compensate in case the distance between the head rail 20 and the bottom rail 21A does not exactly match the connection points on the tilt bars 80. A bottom pivot bracket 100, as in the previous embodiments, is no longer required. Also, the tilt bars 80 in this embodiment of the shutter blind are located directly in front of and conceal the tilt cables 16 and the lift cords 12, and the cord glides 50 (of the previous embodiments) in the front (room side) of the head rail 20 are replaced by the tilt bar top attachments 60, which serve the same function. It should be noted that this embodiment 10B allows for the shutter blind 10B to be raised and lowered from the bottom up (as is typically the case) or from the top down. To raise and lower from the top down, the lift cords 12 would be routed through the bottom rail 21A.

FIGS. 4A and 4B depict a fourth embodiment of a shutter blind 10C made in accordance with the present invention. This fourth embodiment 10C is similar to the first embodiment 10, except that it uses a different version of the bottom pivot bracket 100A.

FIGS. 5A and 5B depict a fifth embodiment of a shutter blind 10D made in accordance with the present invention. This fifth embodiment 10D is similar to the third embodiment 10B, except that it has no hand control mechanism 90 for raising and lowering the shutter blind. This shutter blind 10D has no lift cords 12. Instead, a provisional lift attachment 170 is used on each tilt bar 80 to manually raise and lower the bottom louver 21A via a finger tab, which automatically locks this bottom louver 21A in place as soon as the finger tab is released, as will be explained later. Since there are no lift cords 12, there is no need for the pulleys in the cord glides 50 or in the tilt bar top attachment 60. Never-the-less, these same components 50, 60 may be used either with or without their respective pulleys. A stop block 130 limits the downward travel of the bottom louver 21A.

FIG. 72A depicts a sixth embodiment of a shutter blind 10E made in accordance with the present invention. This sixth embodiment 10E is similar to the first embodiment 10, except that it uses a different version of the bottom pivot bracket 100D.

The Head Rail

Figure 6A:
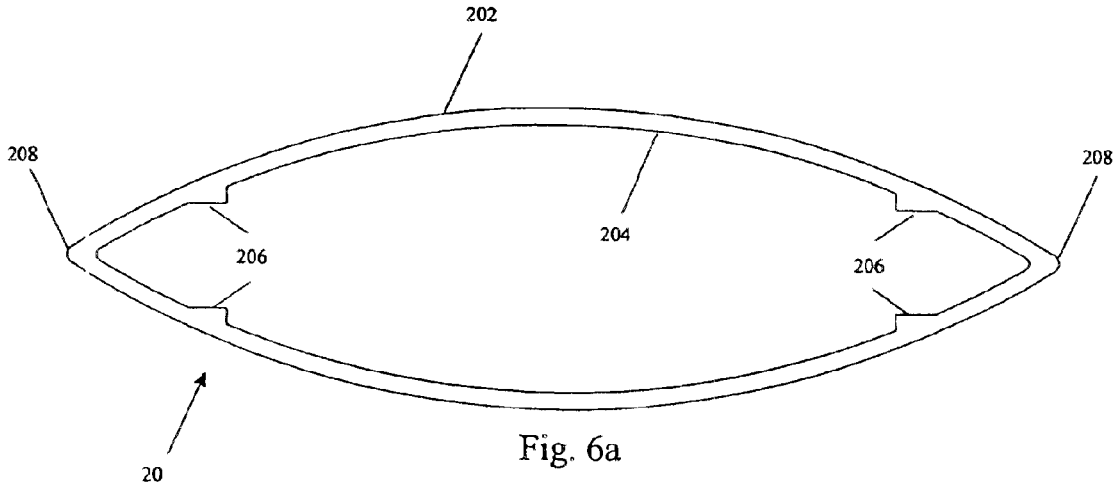
FIG. 6A is an end view of the head rail shown in FIGS. 1 through 5.
Figure 6B:
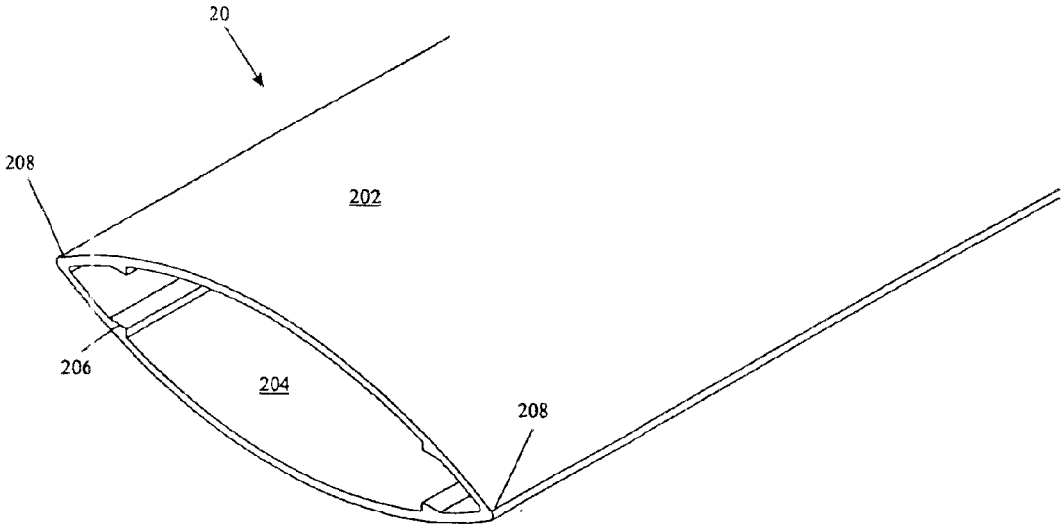
FIG. 6B is a broken away perspective view of the head rail of FIG. 6A.

FIGS. 6A and 6B show the head rail 20 of FIG. 1A. This head rail 20 has an airfoil profile, with the cross-section defining two congruent convex arcs, which meet at their ends to define pointed edges 208, an outer surface 202, and an inner surface 204. The inner surface 204 has four ribs 206 running axially the entire length of the head rail 20. These ribs 206 are close to the sharp edges 208 of the airfoil profile, and the purpose of these ribs 206 is to provide a stop which may be used for retaining various components, such as cord glides 50, tilt bar top attachments 60, and end caps 30, as will be explained later. The head rail 20 has a profile which is very similar to the profile of the rest of the louvers 14 of the shutter blind 10. Thus, from a distance, it is almost impossible to tell that the head rail 20 is any different than the rest of the louvers 14.

Alternate Embodiments of the Head Rail

Figure 7A:
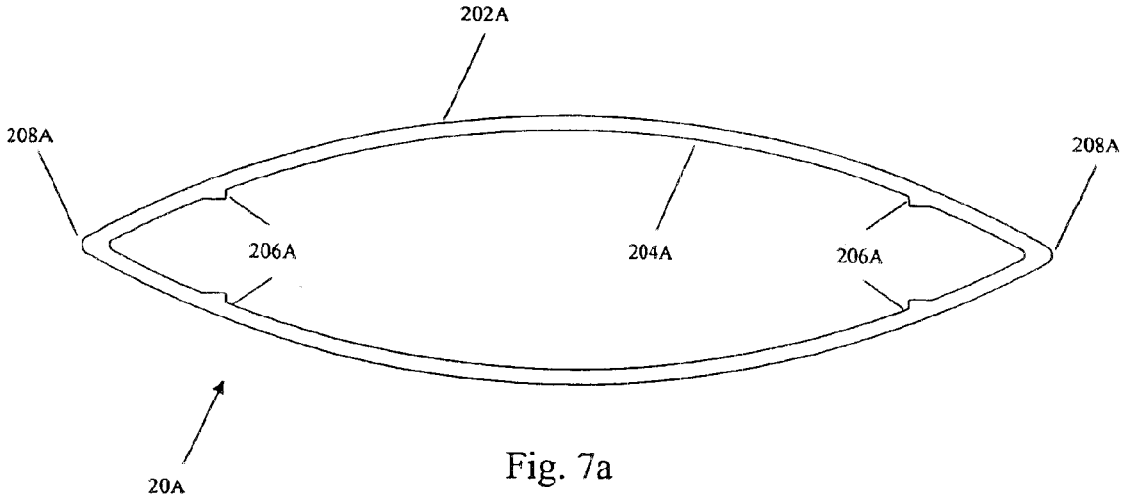
FIG. 7A is an end view of an alternate head rail which may be used in any of the shutter blind system embodiments of FIGS. 1–5.
Figure 7B:
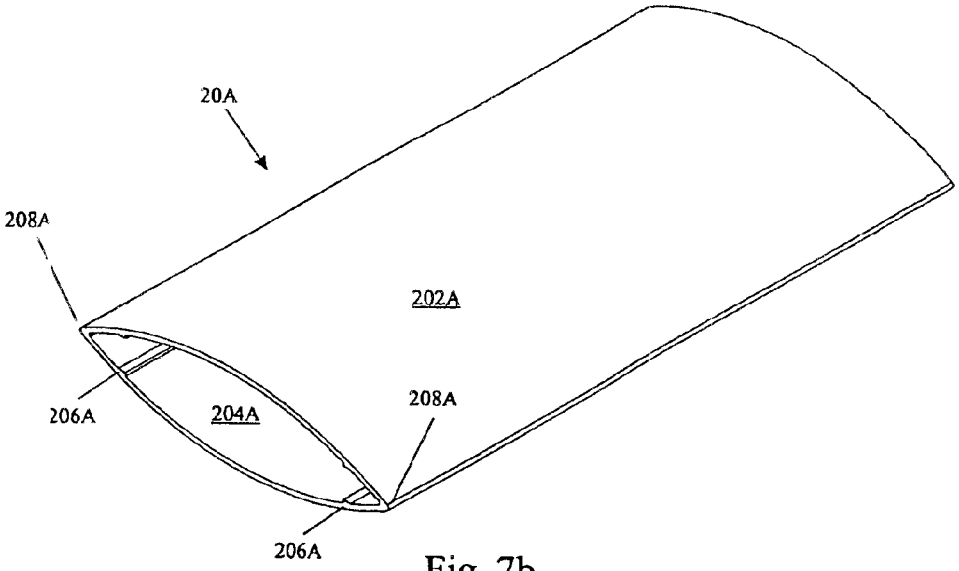
FIG. 7B is a broken away perspective of the head rail of FIG. 7A.

FIG. 7A and 7B show a head rail 20A, which may be used instead of the head rail 20 of FIG. 1A. This head rail 20A is very similar to the head rail 20, except that it is wider, meaning that the distance between the two sharp edges 208A of this head rail 20A is greater than the distance between the sharp edges 208 of the head rail 20. The reason for this wider head rail 20A is that, in most Venetian blinds, it is difficult to ensure full closure of all the slats in the blind when the blind is tilted closed. This problem worsens as one moves down the stack, such that the last few louvers 14 in the stack may show a definite gap, even as the stack is intended to be fully tilted closed. This wider head rail 20A solves that problem. Since the tilt cables 16 are attached to and are supported from the sharp ends 208A of the head rail 20A, if the head rail 20A is a bit wider than the balance of the slats (or louvers) 14, then, as the head rail 20A tilts to the fully closed position, the tilt cables 16 must travel a slightly longer distance than the tilt cables 16 would travel with a regular width head rail 20. This extra amount of travel of the tilt cables 16 is enough to pull the tilt cables 16 up just enough to ensure full closure of the stack of louvers 14. Thus, the wider head rail 20A provides one solution to the problem of poor closure of the louver stack by slightly increasing the travel distance of the tilt cables 16 as they tilt closed. It should be noted that, while the points of connection of the tilt cables 16 to the head rail 20A would be farther apart than the width of the louvers 14, it is important to know how much farther apart than the width of the louvers 14 they should be. Too wide, and the size difference between the head rail 20A and the louvers 14 becomes obvious and spoils the uniformity of appearance in the closed position. Not wide enough, and the effect is not significant enough to ensure complete closure of the blind. The preferred range is for the connection points of the tilt cables 16 to the head rail 20A to be between 5% and 10% further apart than the width of the louvers 14, so the head rail 20A preferably is 5–10% wider than the louvers 14.

Figure 8:
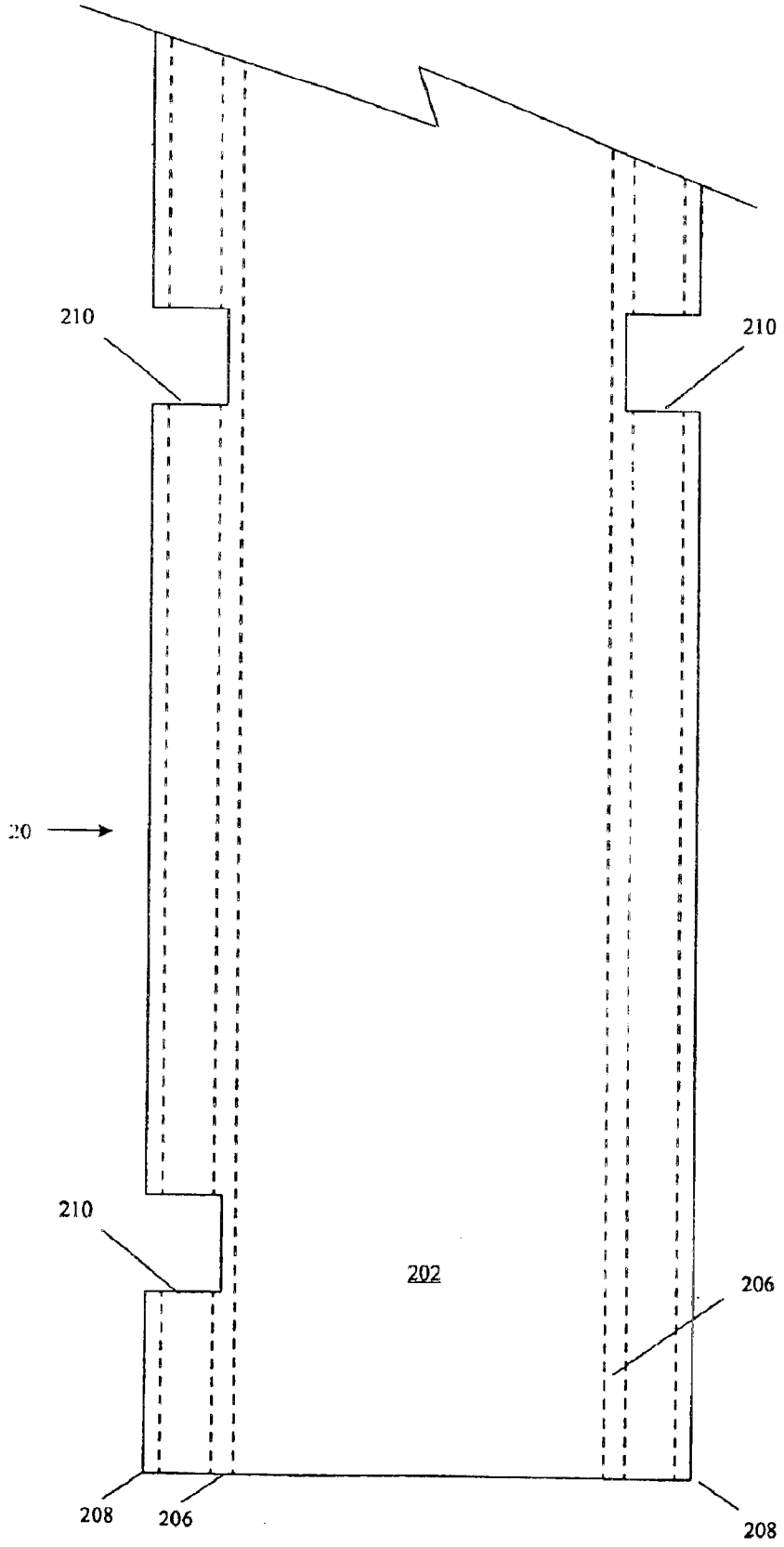
FIG. 8 is a broken away plan view of the head rail of FIGS. 1–5.

As indicated earlier, the ribs 206 in the head rail 20 provide a stop for securing components of the shutter blind 10. FIG. 8 shows notches 210, cut into the sharp edges 208 of the hear rail 20. These notches 210 are used to locate and mount some of these components onto the head rail 20, as shown in FIG. 1B. These notches 210 preferably extend into the head rail 20 only as far as the ribs 206. As the various components are mounted onto the head rail 20, they may snap and lock in place by grabbing onto the ribs 206.

Figure 9A:
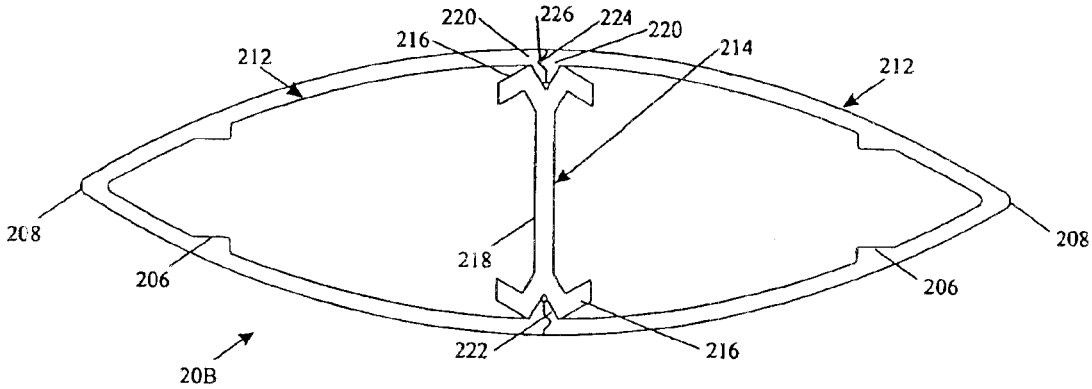
FIG. 9A is an end view of an alternate three-piece head rail which may be used instead of the one piece head rail shown in FIGS. 1–5.
Figure 9B:
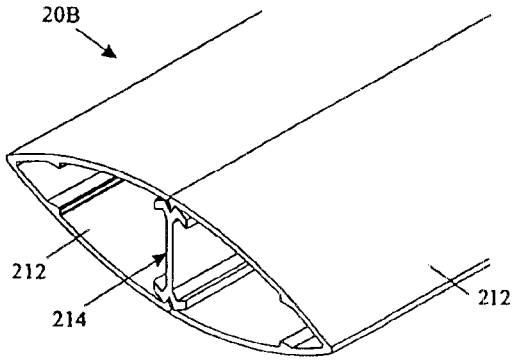
FIG. 9B is a broken away perspective view of the three-piece head rail of FIG. 9A.
Figure 9C:
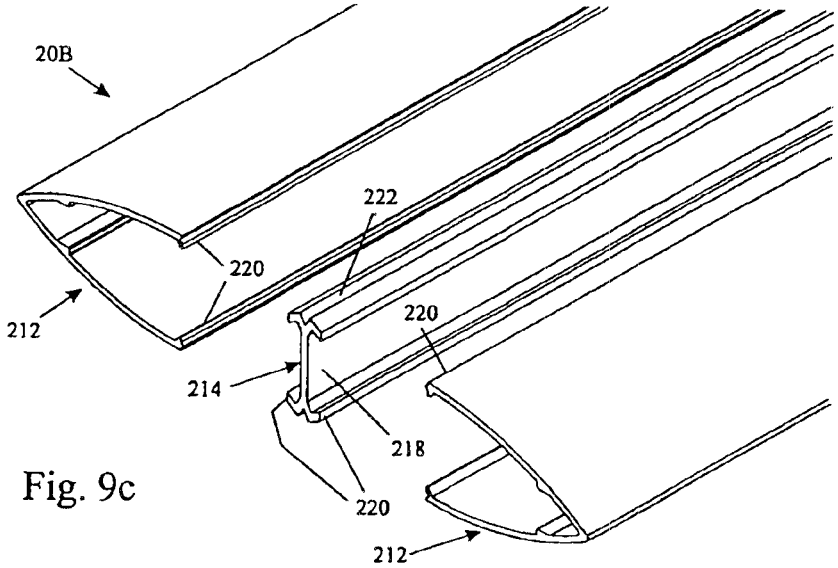
FIG. 9C is a broken away, exploded view of the head rail of FIG. 9B.
Figure 10A:
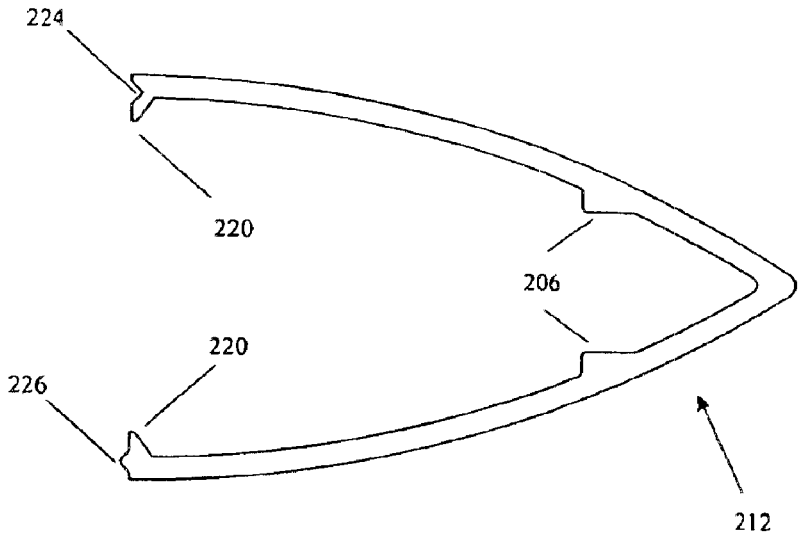
FIG. 10A is an enlarged end view of one of the pieces of the three-piece head rail of FIG. 9C.
Figure 10B:
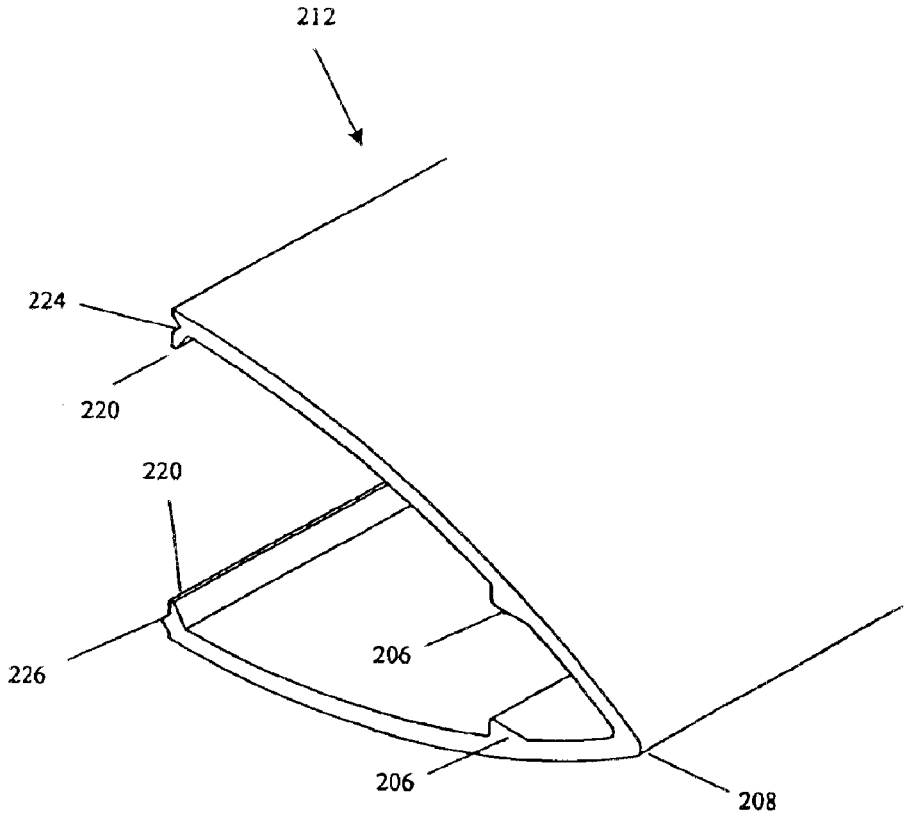
FIG. 10B is a broken away perspective view of the head rail piece of FIG. 10A.
Figure 11A:
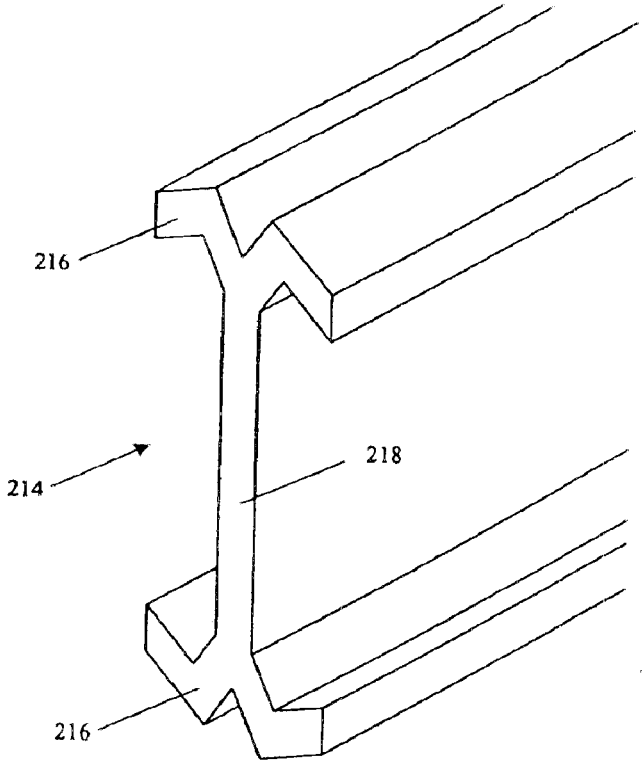
FIG. 11A is an enlarged broken away perspective view of the connecting channel of the three-piece head rail of FIG. 9A.
Figure 11B:
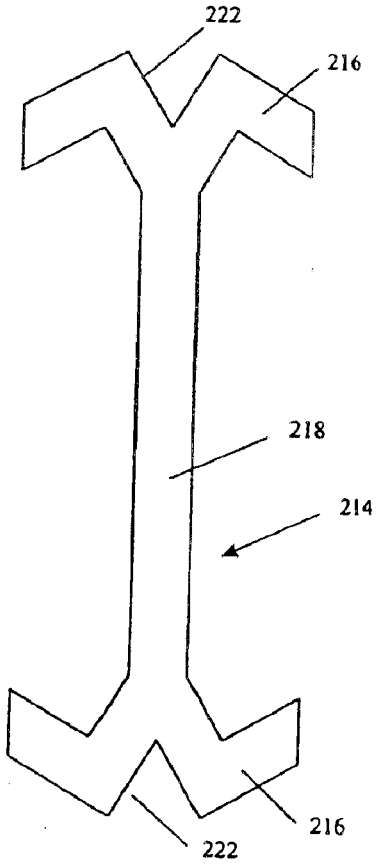
FIG. 11B is an enlarged end view of one of the connecting channels of FIG. 11A.

In the single-piece head rail 20, these notches 210 would likely have to be machined, as it would be very difficult to reach into the head rail 20 with a backer to help in punching out these notches 210. In order to alleviate this problem, a three piece head rail 20B is proposed, as shown in FIGS. 9A, 9B, and 9C. This three-piece head rail 20B, which may be used instead of the single piece head rail 20, includes two identical halves 212 having a substantially V-shaped cross-section (See FIGS. 10A and 10B) and an interconnecting channel 214 (See FIGS. 11A and 11B), which connects the V's together.

The interconnecting channel 214 has a cross-section that resembles two "W"'s 216, which are themselves connected together by a straight web 218. When the halves 212 are jointed together, the resulting head rail 20B looks very much like a standard head rail 20 which has been bisected lengthwise at the mid-point between the two sharp edges 208. Thus, each of the head rail halves 212 resembles a "V" lying on its side. Each of the legs of the "V" terminates in a finger 220 designed to fit into the valley 222 in the middle of each of the "W"'s of the interconnecting channel 214. Each of the V's also has one leg that ends in a small valley 224, while the other leg ends in a corresponding small peak 226 designed to mate with the valley 224 on the mating leg of the other half 212.

To assemble the three-piece head rail 20B of FIGS. 9A–C, the two identical head rail halves 212 are placed longitudinally side-by-side so that the peak 226 of one head rail half 212 mates up with the valley 224 of the other head rail half 212. The interconnecting channel 214 is then slid longitudinally between the two halves 212 so that the fingers 220 fit inside the valleys 222 of the interconnecting channel 214, thus forming the head rail assembly 20B. Alternatively, the two identical head rail halves 212 may be snapped directly onto the interconnecting channel 214 instead of sliding the channel 214 longitudinally between the two halves 212. It is also important to note that the interconnecting channel 214 need not be a single piece extending the entire length of the head rail 20. Instead, it may be a plurality of shorter interconnecting channels 214 spaced along the length of the head rail 20. This plurality of shorter channels 214 has the advantage that it results in a lighter head rail 20, and it opens up passageways within the head rail 20 for the routing of the lift cords from the cord glides 50 to the tilt bar top attachment 60, as shown in FIG. 83. It is a simple matter to insert a backer into each of the head rail halves 212 before the halves are assembled together in order to punch out the notches 210 required for mounting some of the components of the shutter blind.

Figure 12A:
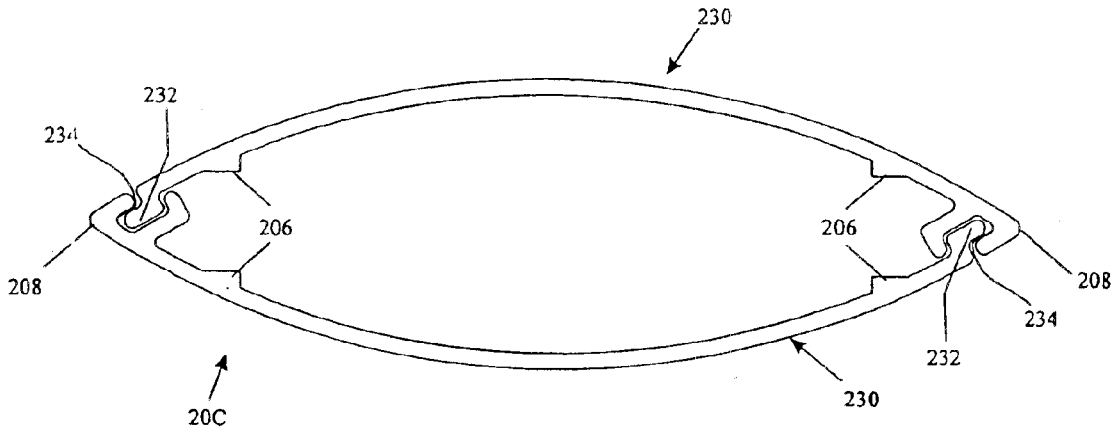
FIG. 12A is an end view of a second alternate two-piece head rail which may be used instead of the one piece head rail shown in FIGS. 1 through 5.
Figure 12B:
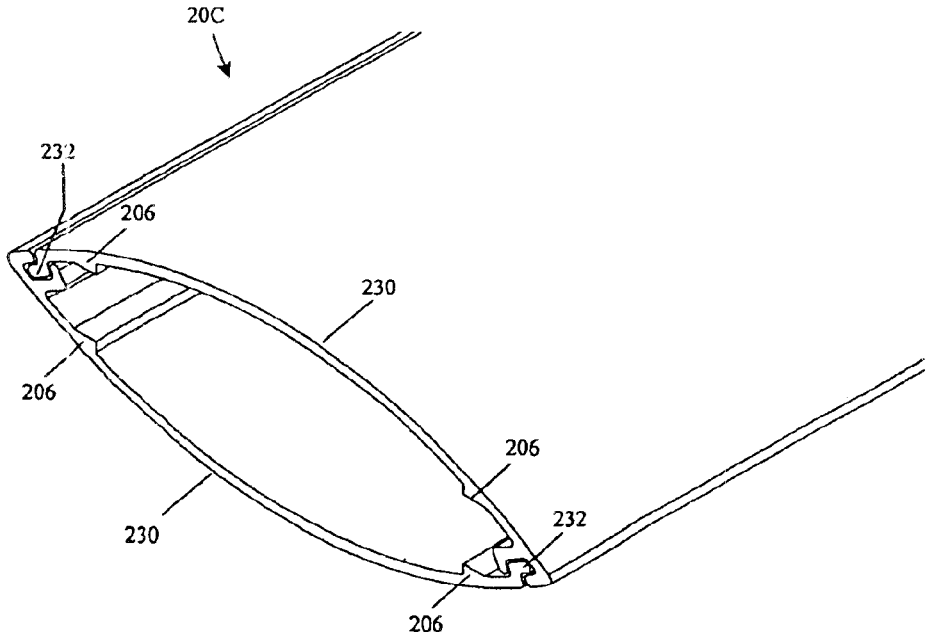
FIG. 12B is a broken away perspective view of the two-piece head rail of FIG. 12A.

FIGS. 12A and 12B show a two-piece head rail 20C, which may be used instead of the single piece head rail 20 or the three-piece head rail 20B. In this design, the head rail 20C includes two identical halves 230, but, unlike the two halves 212 of the three-piece head rail 20B, these two halves 230 split the standard head rail 20 lengthwise along the sharp edges 208 instead of along the mid point of these two sharp edges 208. One end of the head rail halves 230 ends in an L-shaped notch 234, and the opposite end ends in an L-shaped finger 232, designed to mate with the notch 234. To assemble this two-piece head rail 20C, the two halves 230 are slid together lengthwise, with the finger 232 of one piece 230 sliding into the corresponding notch 234 of the other piece 230.

Figure 13A:
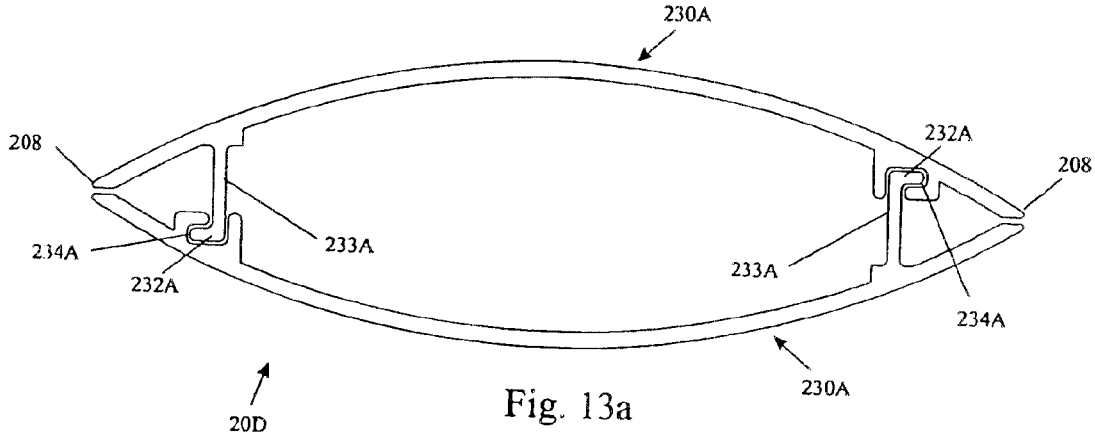
FIG. 13A is an end view of a third alternate two-piece head rail which may be used instead of the one piece head rail shown in FIGS. 1 through 5.
Figure 13B:
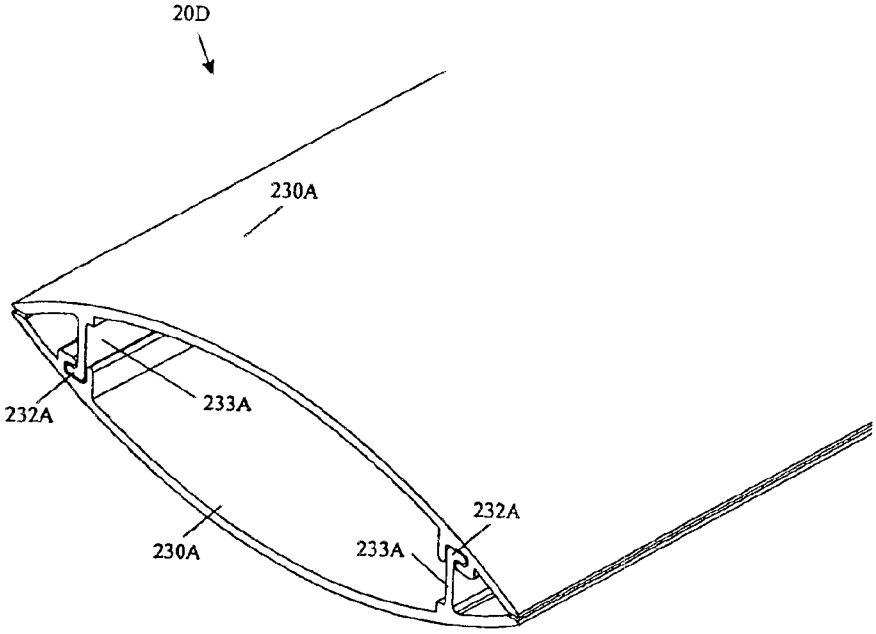
FIG. 13B is a broken away perspective view of the two-piece head rail of FIG. 13A.

FIGS. 13A and 13B show another alternate embodiment of a two-piece head rail 20D, which is very similar to the two-piece head rail 20C described earlier. The two identical halves 230A also split the standard head rail 20 lengthwise along the sharp edges 208. In this design, the mating portions that hold the two halves 230A together are further recessed from the edges 208. A finger 232A projects from its half 230A by and arm 233A. A notch 234A is shaped to engage the finger 232A, as in the case of the previous embodiment 20C, so that the assembly of this embodiment 20D is done in the same manner as for the head rail 20C.

Figure 15A:
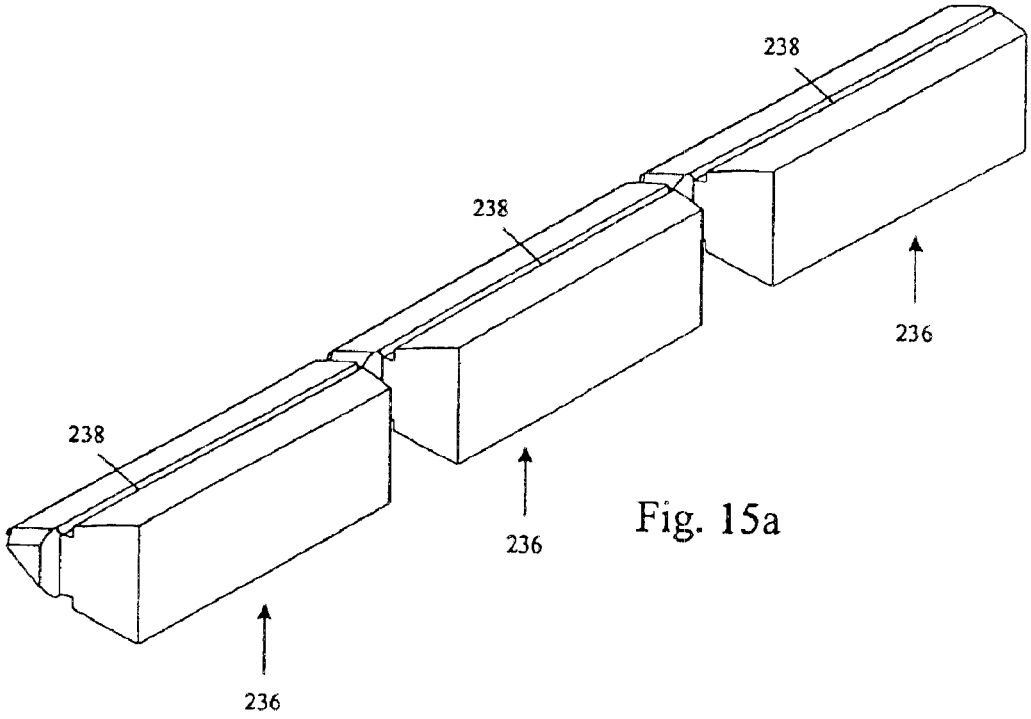
FIG. 15A is a perspective view of unitary weights which may be used in the head rail of FIGS. 14A and 14B.
Figure 15B:
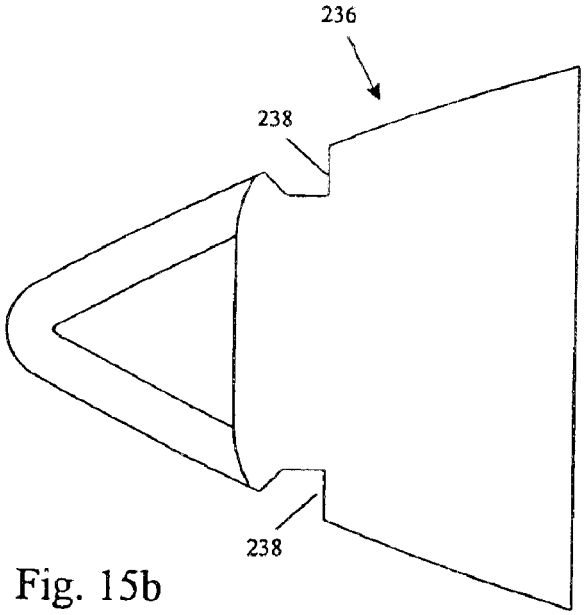
FIG. 15B is an enlarged end view of one of the unitary weights of FIG. 15A.

As will be discussed later in more detail, there are several components which may be mounted to the head rail 20–20D. Some of these components, such as the cord glides 50, may be added in pairs, or are symmetrical along the axis of rotation of the head rail 20–20D (such as the louvers 14 and the bottom rail insert 110), so that these components add very little if any imbalance to the head rail. However, there are other components, such as the tilt bar 80, the hand control 90, the tilt bar top attachment 60, the top end cap 70, the bottom pivot linkage 100, the stop block 130, and the multi-bar attachment 140 which hang from one side (normally the room side) of the head rail and thus contribute to an imbalance of the head rail, which will tend to tilt down toward the side of the additional appended weight. To ameliorate this condition, weights 236 (See FIGS. 15A and 15B) may be added to the side (normally the wall side) opposite the weighted down side of the head rail. In this particular embodiment, the weights 236 are made so that one weight 236 approximately compensates for the weight of all the unbalanced hardware hanging from the head rail 20 (except for the tilt bar 80 itself), and each additional weight 236 compensates for every linear foot of tilt bar 80 length. Thus, a shutter blind system 10 may be custom made, and yet the weights may still be fine-tuned so that the head rail is approximately in equilibrium, requiring only a very small motive force in either direction to accomplish tilting of the entire shutter blind 10, and requiring a very small frictional resistance to maintain the shutter blind 10 in the selected tilt position.

Figure 14A:
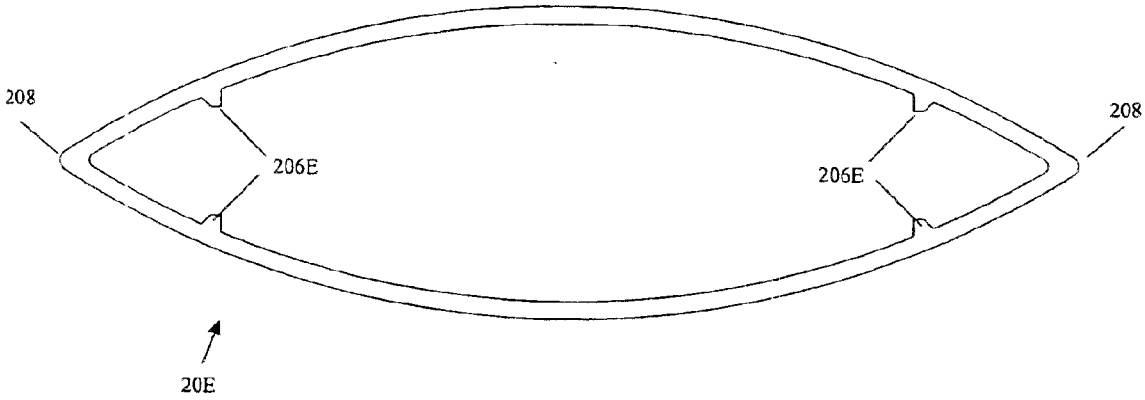
FIG. 14A is an end view of a fourth alternate head rail, designed to hold weights for making a weighted head rail, which may be used instead of the one piece head rail shown in FIGS. 1 through 5.
Figure 14B:
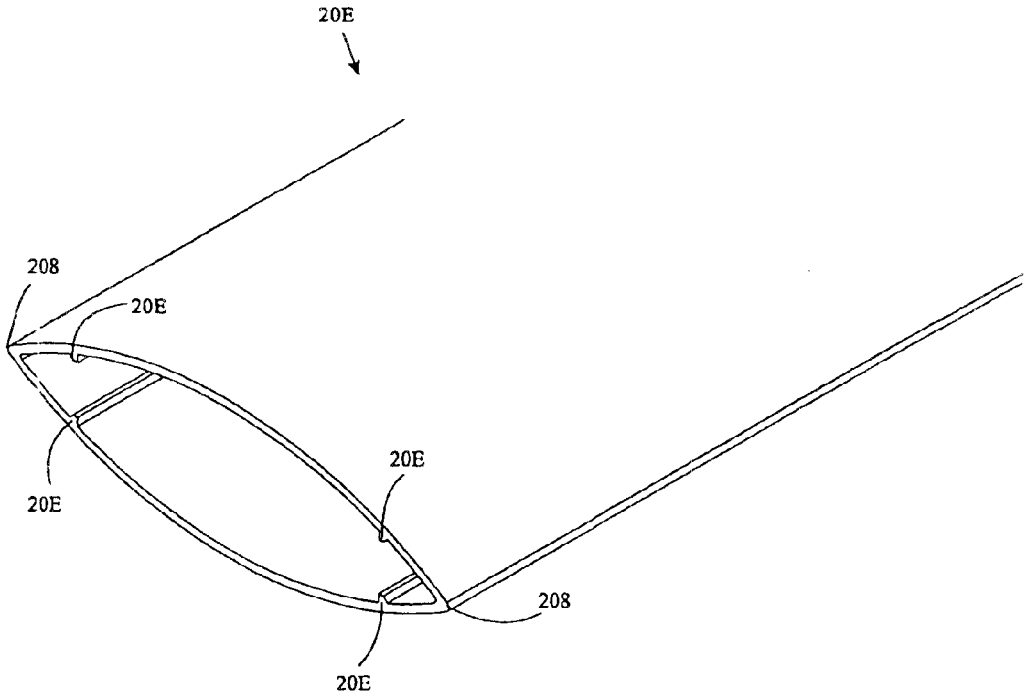
FIG. 14B is a broken away perspective view of the head rail of FIG. 14A.

The standard head rail 20 preferably is modified slightly to accommodate the weights 236. The modified head rail 20E (See FIGS. 14A and 14B) has modified ribs 206E to engage the notches 238 in the roughly triangular-shaped profile of the weights 236, so that the weights 236 may slide into the head rail 20E between one of the sharp edges 208 and the adjacent ribs 206E. The ribs 206E, received in the notches 238 of the weights 263, hold the weights 236 in place so they do not shift as the head rail 20E is tilted.

The End Caps

Figure 16A:
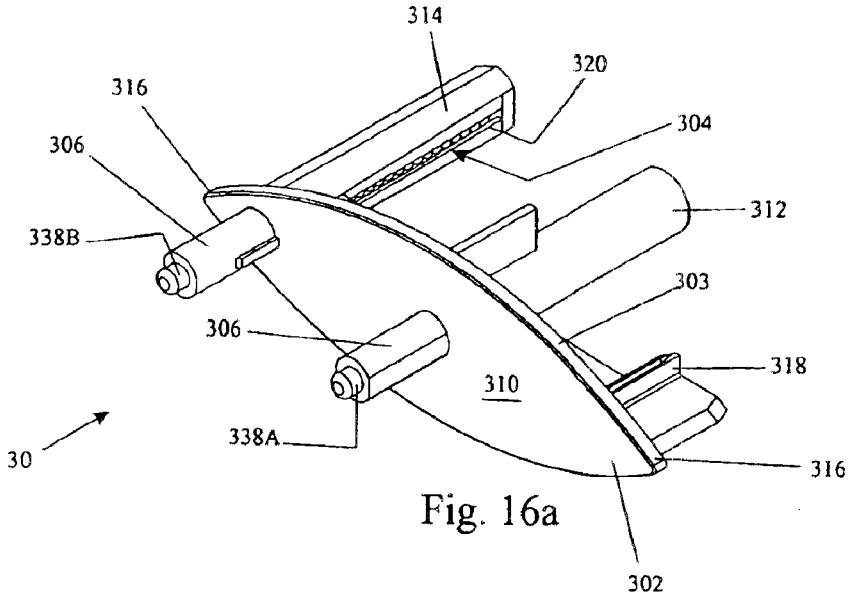
FIG. 16A is a perspective view of the spring loaded head rail end cap shown in FIG. 1.
Figure 16B:
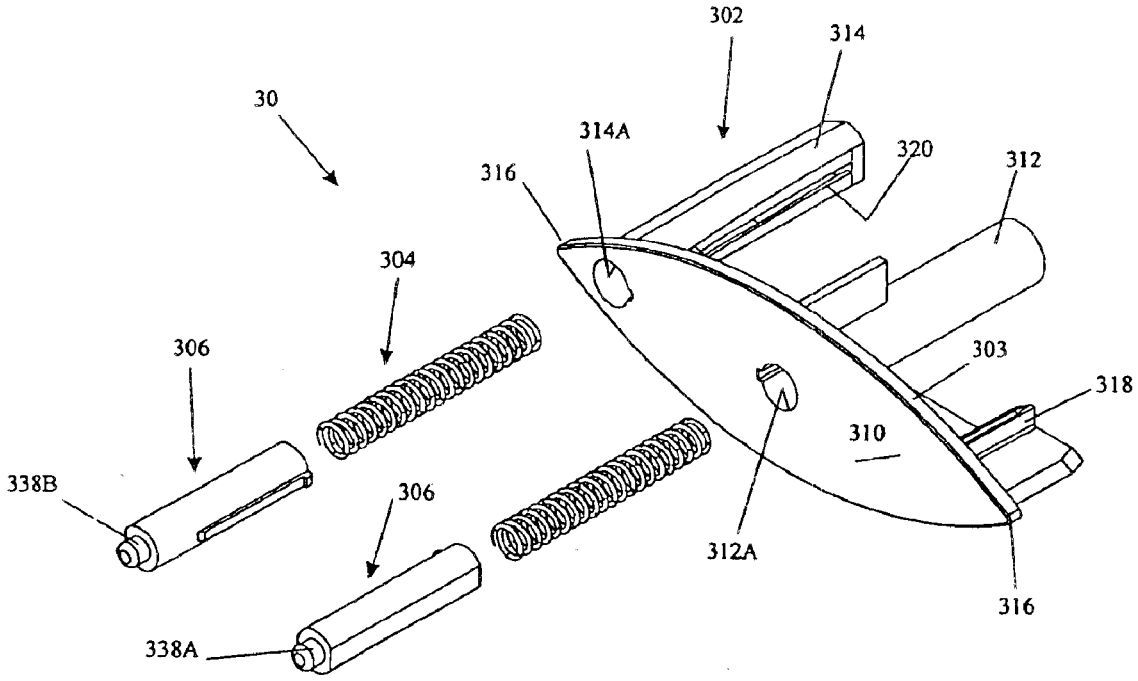
FIG. 16B is an exploded view of the end cap of FIG. 16A.
Figure 17A:
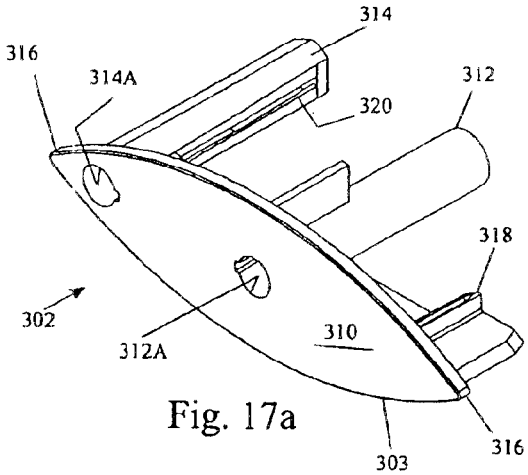
FIG. 17A is a perspective view of the end cap housing of the end cap of FIG. 16A.
Figure 17B:
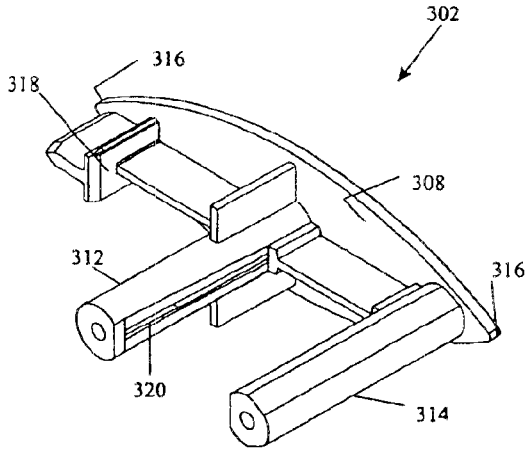
FIG. 17B is a perspective view of the opposite side of the end cap housing of FIG. 17A.
Figure 17C:
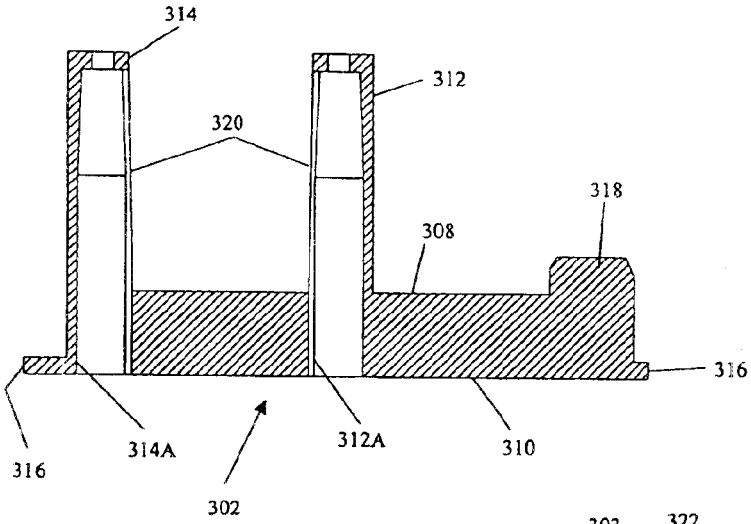
FIG. 17C is a section view along the line 17C—17C of FIG. 17D.
Figure 17D:
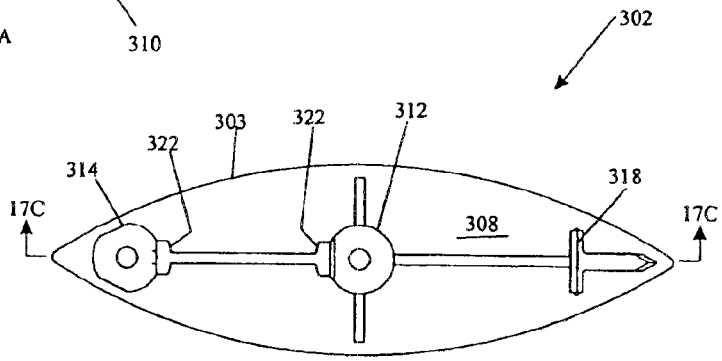
FIG. 17D is an end view of the end cap housing shown in FIG. 17B, but rotated 180 degrees.
Figure 17E:
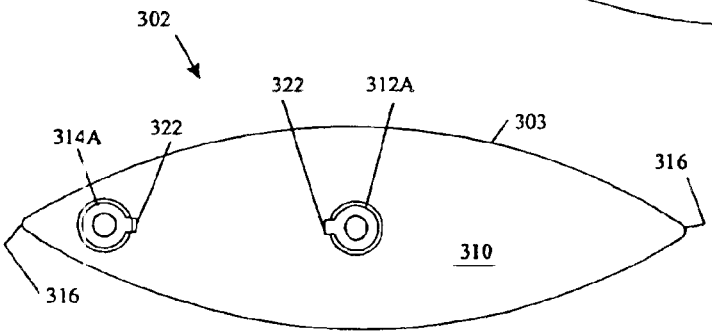
FIG. 17E is an end view of the end cap housing of FIG. 17A.

The ends of the head rail 20 are terminated with end caps 30, which are used to mount the head rail to the mounting brackets 40, as shown in FIG. 1B. FIGS. 16A and 16B show the spring-loaded end cap 30, which includes an end cap housing 302, two springs 304, and two pins 306. FIGS. 17A through 17E show the end cap housing 302. The housing 302 has an airfoil shaped profile 303, which closely matches the profile of the head rail 20. This airfoil profile 303 has an inside surface 308 and an outside surface 310. The inside surface 308 has two hollow tube projections 312, 314. The first hollow tube projection 312 is located in the center of the airfoil shaped profile 303, and the second hollow tube projection 314 is also located along the central axis of the end cap 302 but very close to the end of the end cap 302, close to one of the pointed ends 316. These two hollow tubes 312, 314 define openings that extend from the inside surface 308, through the airfoil shaped profile 303, to the outside surface 310. On the other end 316 of the airfoil profile 303 (the end 316 opposite the location of the hollow tube projection 314), there is a tab 318 projecting from the inside surface 308. This tab 318 is designed to engage with the ribs 206 of the head rail 20 so as to lock the end cap 30 in place onto the head rail 20. The two hollow tubes 312, 314 are open at their ends 312A, 314A, respectively, which are defined by the outside surface 310, but the tubes 312, 314 are closed (except for small holes present only for manufacturing purposes) on the opposite end. The hollow tubes 312, 314 define longitudinal slotted openings 320 extending from the closed end of the tubes 312, 314, to the inside surface 308 of the airfoil profile 303, and these slotted openings 320 become notched out key ways 322 (See FIG. 17E) as they extend through the airfoil profile 303 and to the outside surface 310.

Figure 18A:
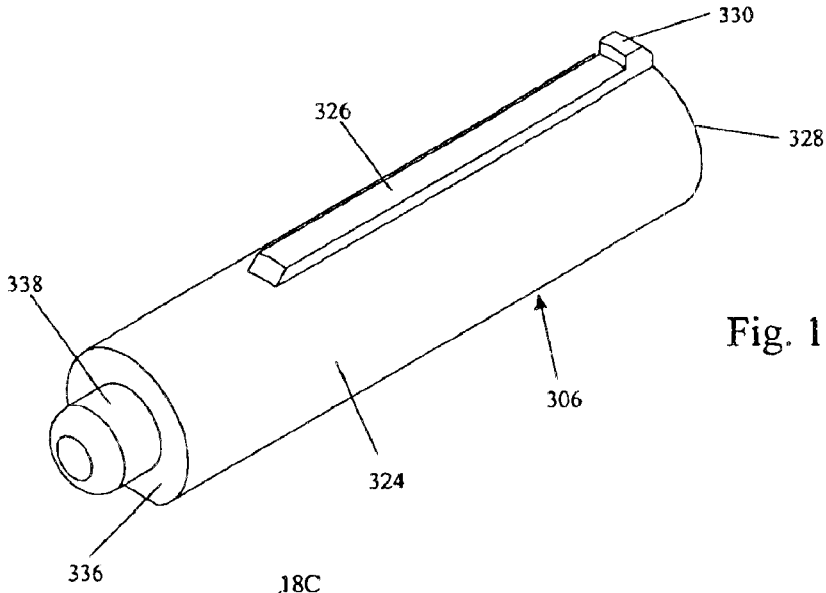
FIG. 18A is a perspective view of one of the spring loaded pins of the end cap of FIG. 16A.
Figure 18B:
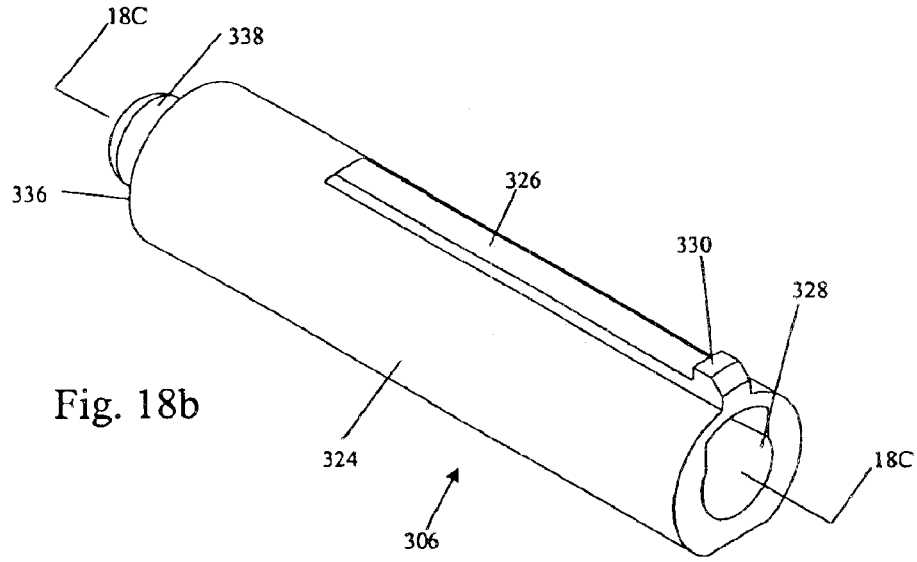
FIG. 18B is an opposite end perspective view of the spring loaded pin of FIG. 18A.
Figure 18C:
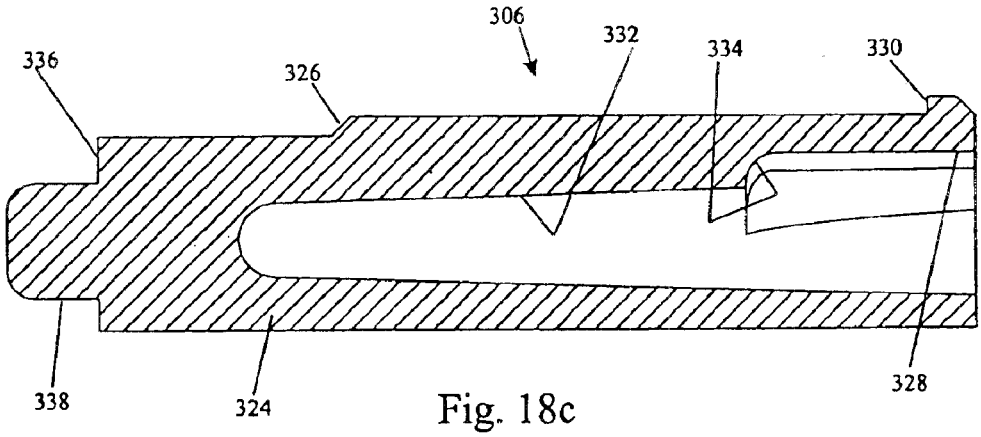
FIG. 18C is a section view along the line 18C—18C of FIG. 18B.
Figure 19:
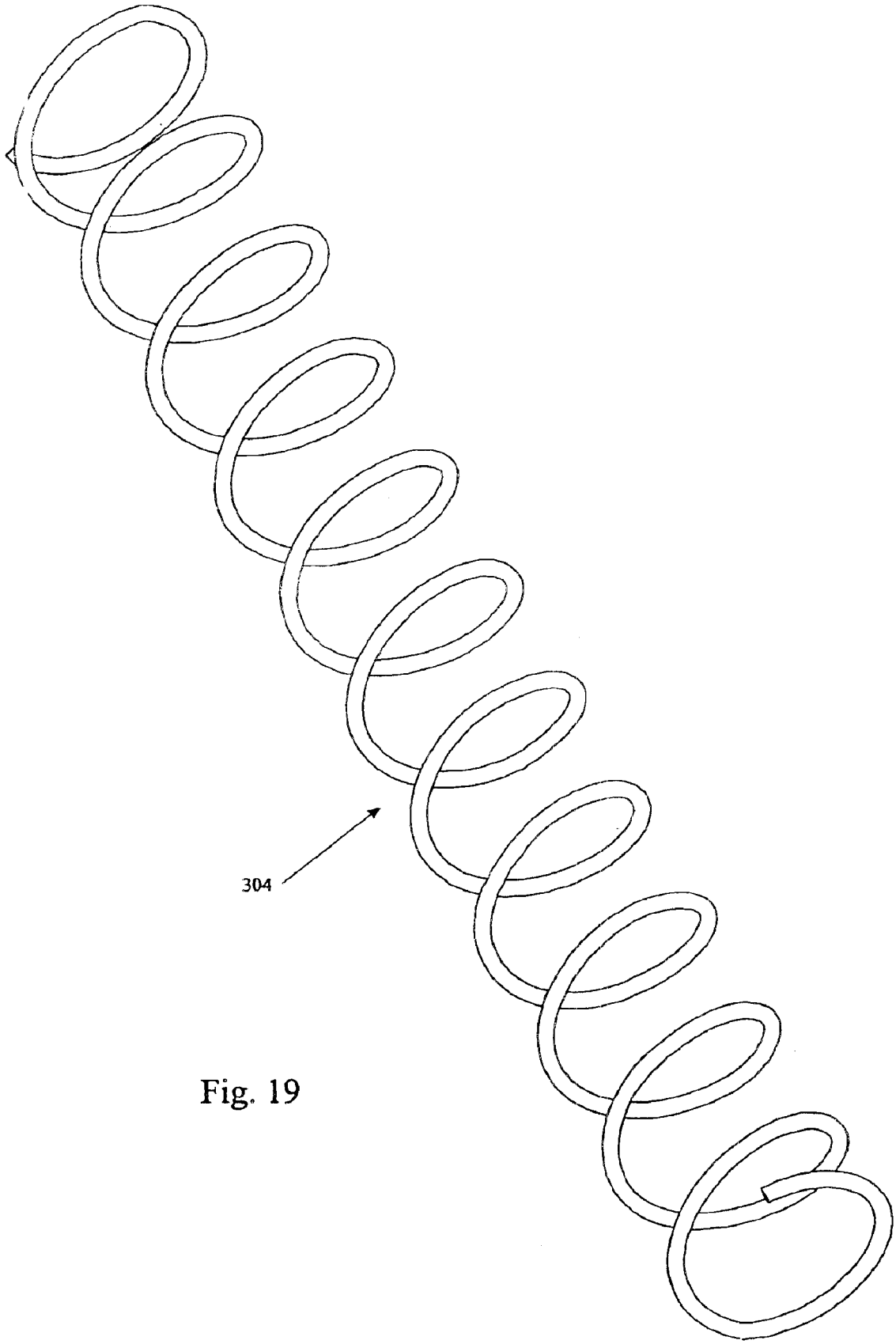
FIG. 19 is a perspective view of one of the springs of the end cap of FIG. 16A.
Figure 20A:
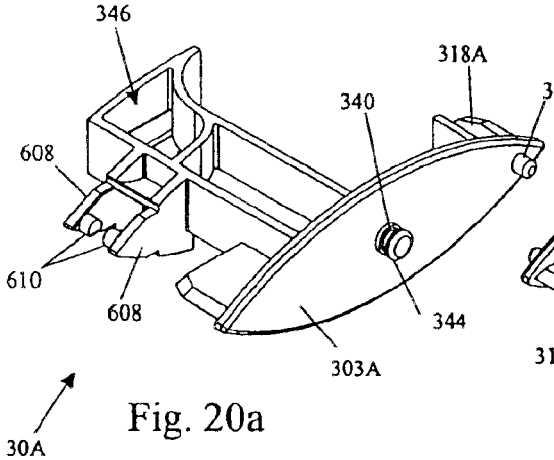
FIG. 20A is a perspective view of a fixed pin end cap which may be used instead of one of the spring loaded end caps in a shutter blind system such as the system shown in FIG. 1.
Figure 20B:
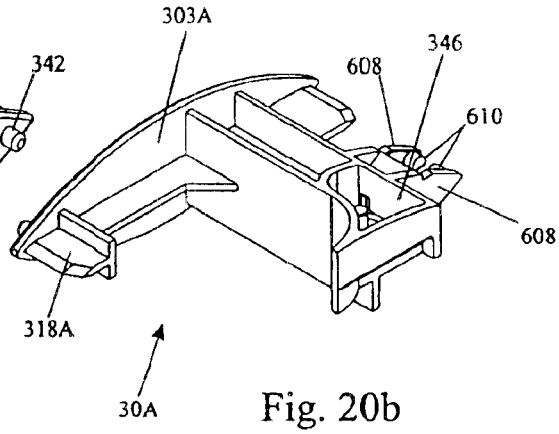
FIG. 20B is an opposite end perspective view of the fixed pin end cap of FIG. 20A.
Figure 20C:
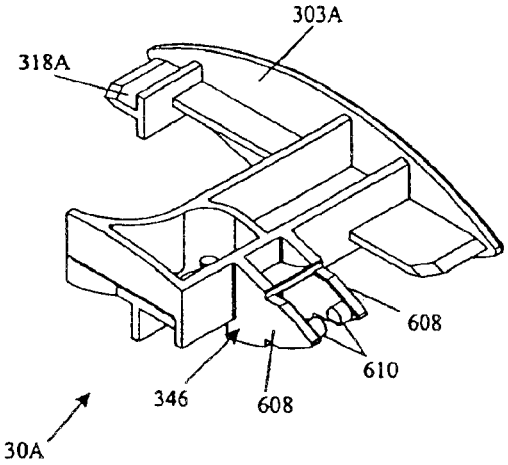
FIG. 20C is a perspective view of the fixed pin end cap of FIG. 20B but rotated 90 degrees.
Figure 20D:
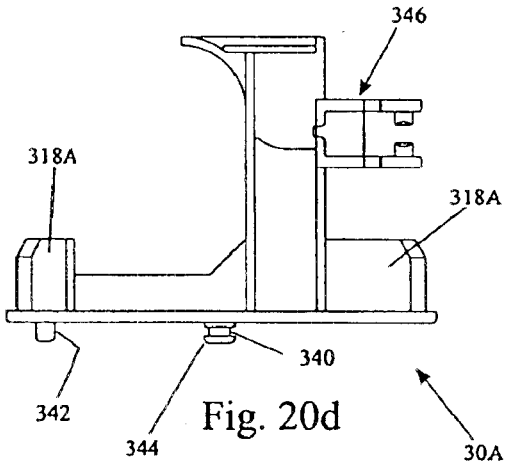
FIG. 20D is a bottom view of the fixed pin end cap of FIG. 20A.
Figure 20E:
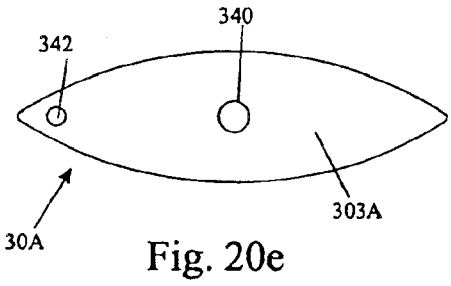
FIG. 20E is an end view of the end cap of FIG. 20A.
Figure 20F:
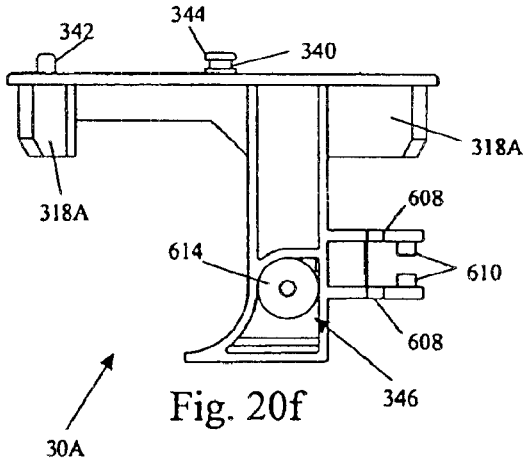
FIG. 20F is a top view of the fixed pin end cap of FIG. 20A.

The pins 306 (See FIGS. 18A, 18B, and 18C) are partially hollowed out cylinders 324 designed to fit inside the hollow tube projections 312, 314 of the end cap housing 302. These cylinders 324 have an external longitudinal ridge or key 326 starting at an open end 328 of the cylinder and extending for most of the length of the cylinder 324. At the end of the key 326 which is closer to the open end 328 of the cylinder 324 there is a projection 330. The key 326 and the projection 330 fit through the notched key way 322 in the end cap housing 302 and, once the projection 330 is into the slotted opening 320 area of the hollow tubes 312, 314, the projection 330 springs out through these slotted openings 320 to provide a guide and a stop for the travel of the pins 306 inside the hollow tubes 312, 314.

The hollowed out interior surface 332 of the cylinders 324 has an internal shoulder 334. This shoulder becomes a stop for the spring 304, as will be explained shortly. The end 336 opposite the open end 328 of the pin 306 terminates in a stub shaft 338, which engages with the mounting bracket 40, as will be explained later.

The springs 304 are designed to fit inside the hollow tubes 312, 314, as well as inside the pins 306 up to the point where the inside diameter of the pin 306 necks down at the previously described shoulder 334. Thus, to assemble the end cap 30, the springs 304 are inserted in the hollow tubes 312, 314, and the pins 306 are inserted into the hollow tubes 312, 314, making sure that the projection 330 and the key 326 coincide with the notched out key ways 322 of the hollow tubes 312, 314. As soon as each projection 330 clears the airfoil profile 303, it snaps into the slotted opening 320 in its respective hollow tube 312 or 314. The end cap assembly 30 is now ready to be mounted onto the head rail 20, making sure that the hollow tube 314 is oriented toward the rear of the head rail 20 (the wall side) and that the tab 318 is oriented toward the front of the head rail 20 (the room side).

Alternate Embodiments of the End Caps

FIGS. 20A through 20F depict a fixed-end embodiment of an end cap 30A, which may be used instead of the spring-loaded end cap 30 of FIG. 1B. This fixed-end end cap 30A is similar in many ways to the spring-loaded end cap 30 described earlier. It includes an airfoil shaped profile 303A and the same tab 318A as the tab 318 found in the spring-loaded end cap 30. The hollow pins 306 with stub shafts 338A, 338B are replaced by an integral nub 340 located in the same central location where the stub shaft 338A (corresponding to the hollow tube 312) would have been located, and a nub 342 located closer to the edge of the cap, in the same location where the stub shaft 338B (corresponding to the hollow tube 314) would have been located. The nub 340 has a small flange 344 (See FIG. 20F) to help it engage the mounting bracket 40, as will be explained later. Also shown in this embodiment 30A is a generally □T□-shaped extension 346 with a shape which closely resembles that of the tilt bar top attachment 60, since they both serve the same purpose. This general shape and function will be explained later in the description of the tilt bar top attachment 60.

Some of the advantages of the single-piece fixed-end end cap 30A include the fact that it is a single piece (less expensive to manufacture), and it may be a stronger component over the spring-loaded end cap 30, since the nubs 340, 342 are integral to the end cap 30A. The stronger end cap permits the use of heavier blinds suspended off of the head rail 20. One disadvantage is that this end cap 30A has very little leeway in the axial direction. The mounting brackets 40 must be mounted very precisely for these single piece end caps 30A to fit correctly. One way to alleviate this constraint is to mount a single-piece end cap 30A at one end of the head rail 20 (especially advantageous to do so at the end where the tilt bar 80 is located which is where vertical forces are exerted on the head rail 20 by the lift cords 12 connected to the hand control 90, as will be described later), and a spring-loaded end cap 30 at the other end of the head rail 20 to allow for some leeway in the mounting of the brackets 40 onto the window frame.

Figure 21:
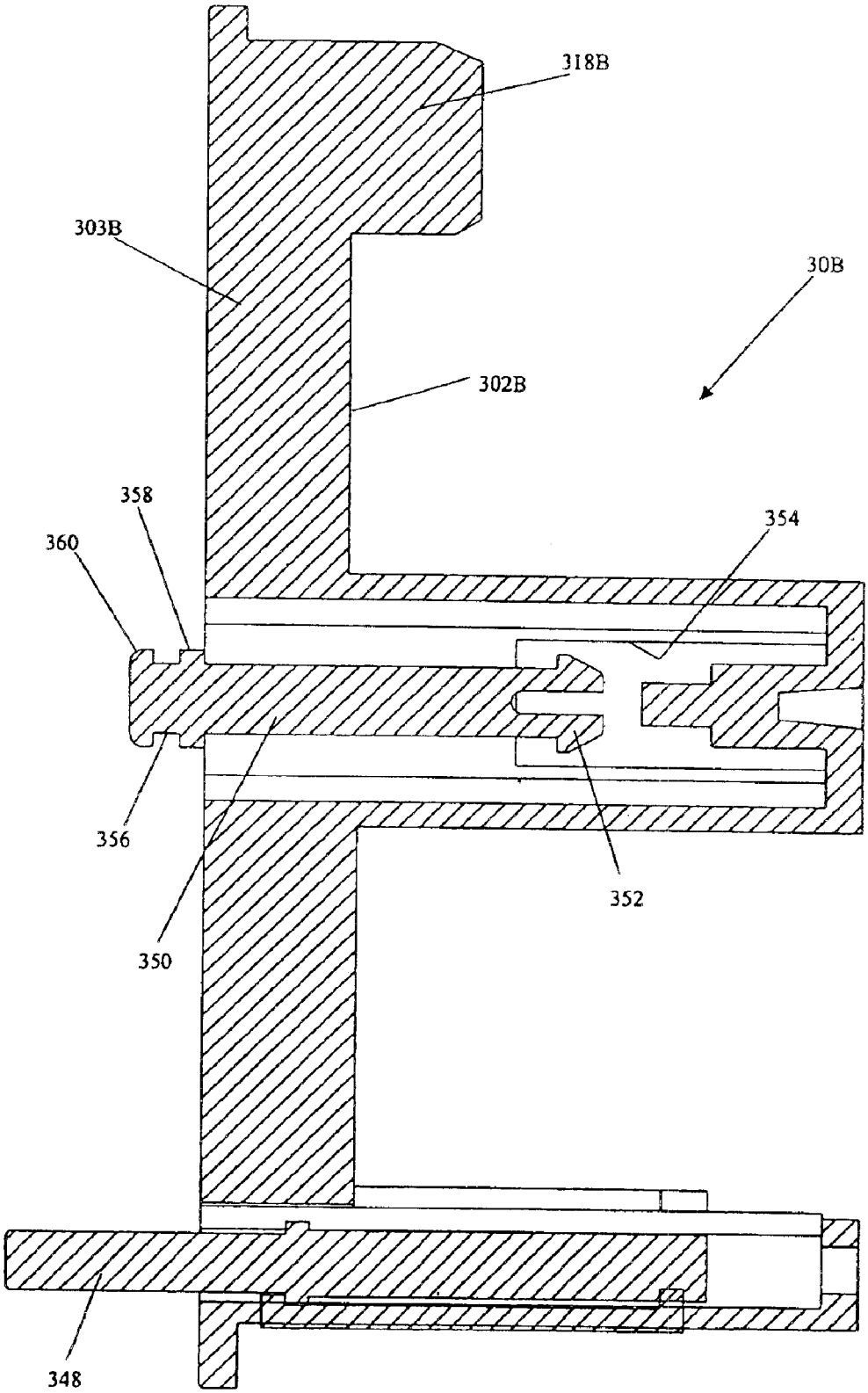
FIG. 21 is a section view of an alternate, floating pin end cap which may be used instead of the spring loaded end caps in a shutter blind system such as the system shown in FIG. 1.
Figure 22A:
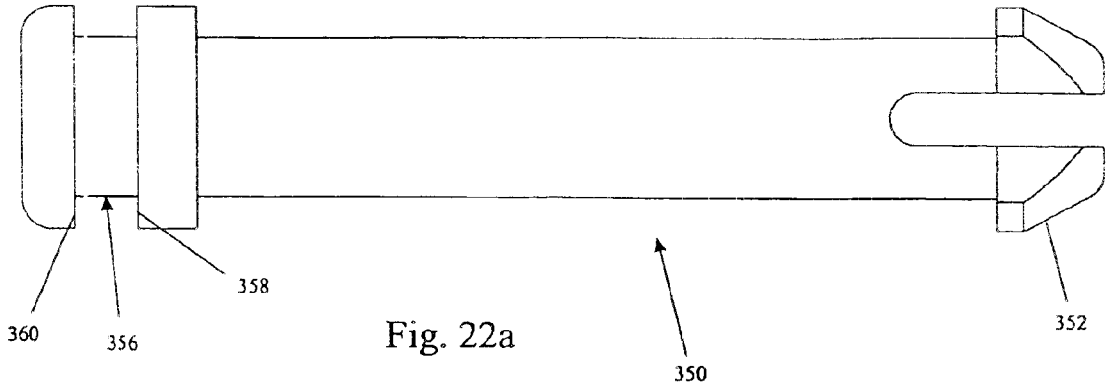
FIG. 22A is a plan view of the floating pin of the floating pin end cap of FIG. 21.
Figure 22B:
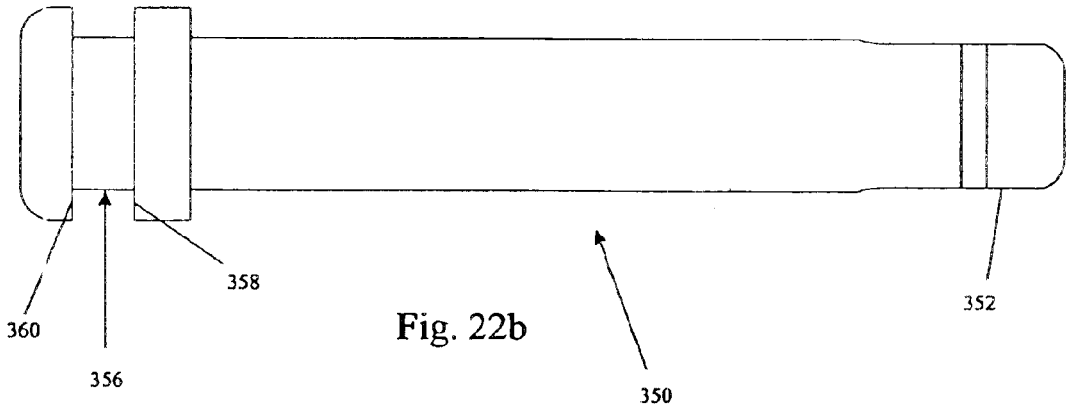
FIG. 22B is the same view as FIG. 22A but with the floating pin rotated 90 degrees.
Figure 23A:
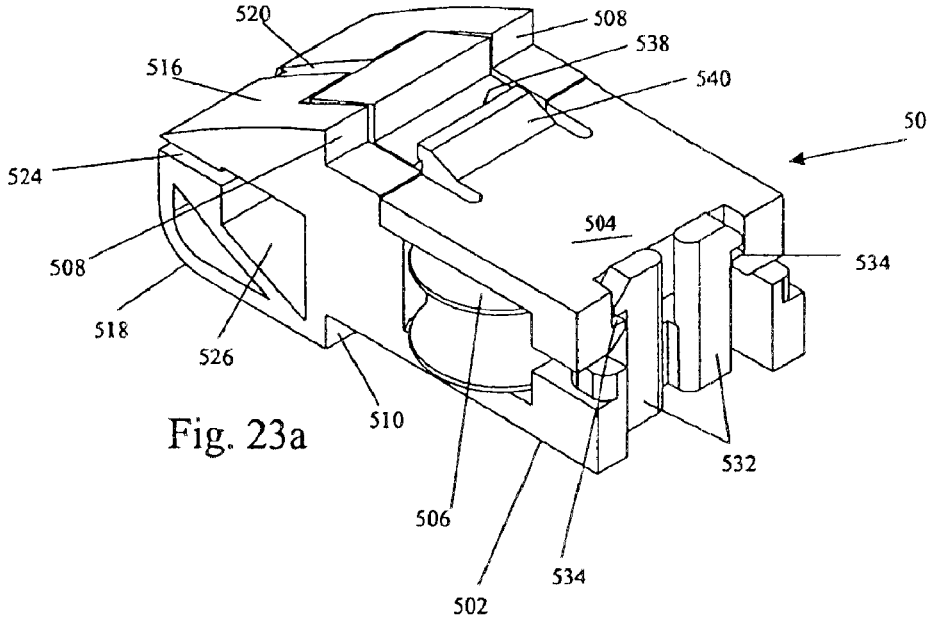
FIG. 23A is a perspective view of the cord glide shown in FIG. 1B.
Figure 23B:
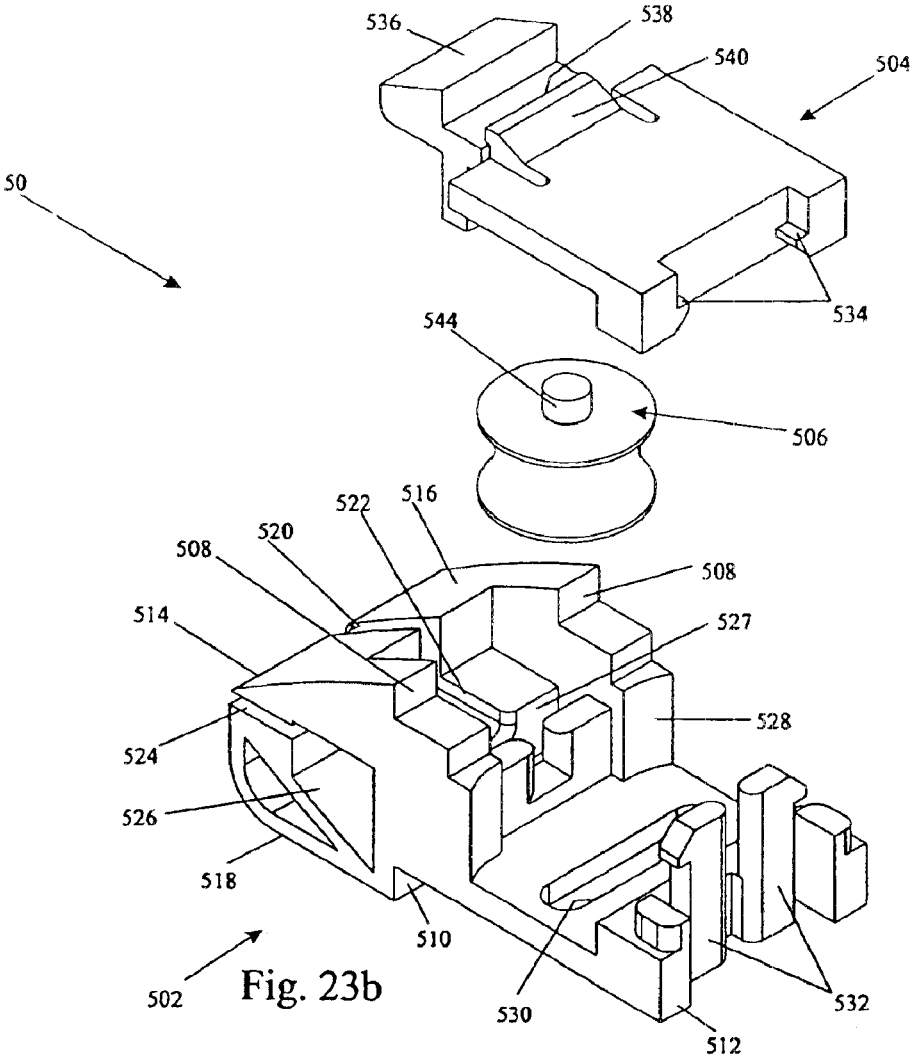
FIG. 23B is an exploded view of the cord glide of FIG. 23A.

FIG. 21 depicts a floating-pin embodiment of an end cap 30B, which may be used instead of the spring-loaded end cap 30 of FIG. 1B. This floating-pin end cap 30B is quite similar to the spring-loaded end cap 30 described earlier. Functionally, the difference is that this floating-pin embodiment 30B has a fixed pin 348 very much like the nub 342 on the fixed-end end cap 30A, and a floating pin 350 for the second pin which corresponds to the pin which goes through the axis of rotation of the centroid of the head rail 20 once the end cap 30B is installed onto the head rail 20. This floating pin 350 is not spring loaded. Instead, its first end 352 has a barbed configuration which is able to squeeze through an opening in the housing 302B and then snaps out to slidably lock the floating pin 350 within the cavity 354. A second end 356 of the floating pin 350 includes two spaced apart shoulders 358, 360 to help it engage the mounting bracket 40, as will be explained later. Thus, this floating-pin end cap 30B is a compromise between the fixed-end end cap 30A and the spring-loaded end cap 30. The floating pin 350 engages the mounting bracket 40 instead of simply pushing against it with springs. However, it has some slack, as the floating pin 350 is able to axially slide in and out of the housing 302B to account for some imprecision in the installation of the mounting brackets 40.

The Cord Glide

The cord glides 50 (shown in FIGS. 23A–25B) serve several functions. First, they guide and support the lift cords 12 within the head rail 20, as shown in FIG. 83. Second, they guide and support the tilt cables 16. By guiding the tilt cables 16, the cord glides 50 also can provide an alternative mechanism for solving the problem of incomplete closure of the blind, in that they can be made to provide a longer path for the tilt cables 16 to follow when lifting the tilt cables to close the blind, thereby serving the same function as the wider head rail that was described earlier. This benefit will be explained later.

Figure 24A:
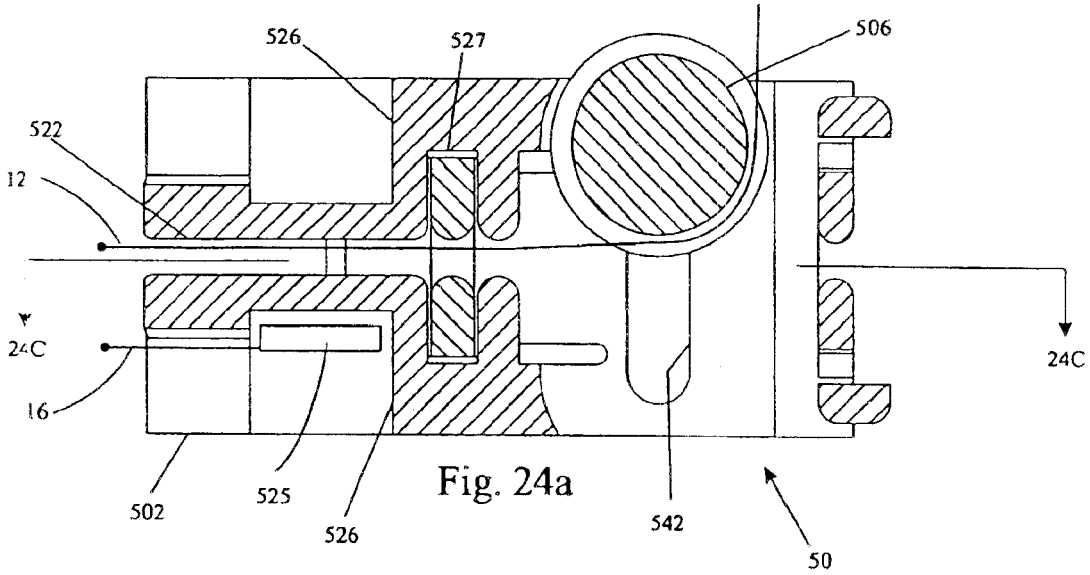
FIG. 24A is a section view along the line 24A—24A of FIG. 24B, but with the routing of the lift cord and the tilt cable shown.
Figure 24B:
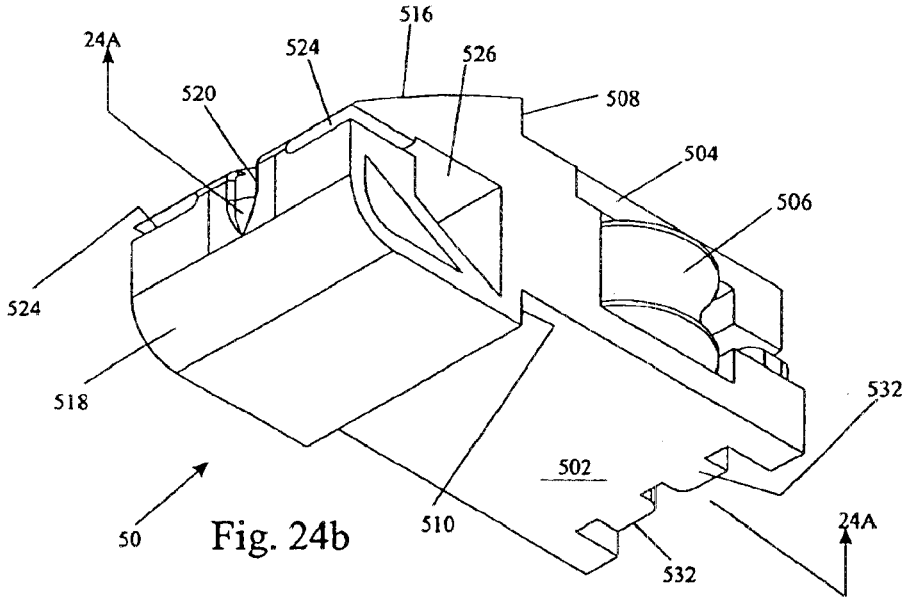
FIG. 24B is a bottom view of the cord glide of FIG. 23A.
Figure 30:
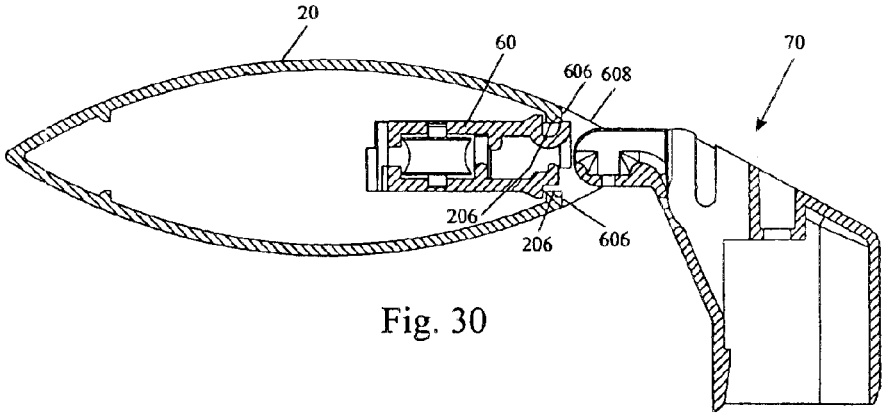
FIG. 30 is a section view of the head rail, operator bar top attachment, and top end cap of FIG. 2A.
Figure 31:
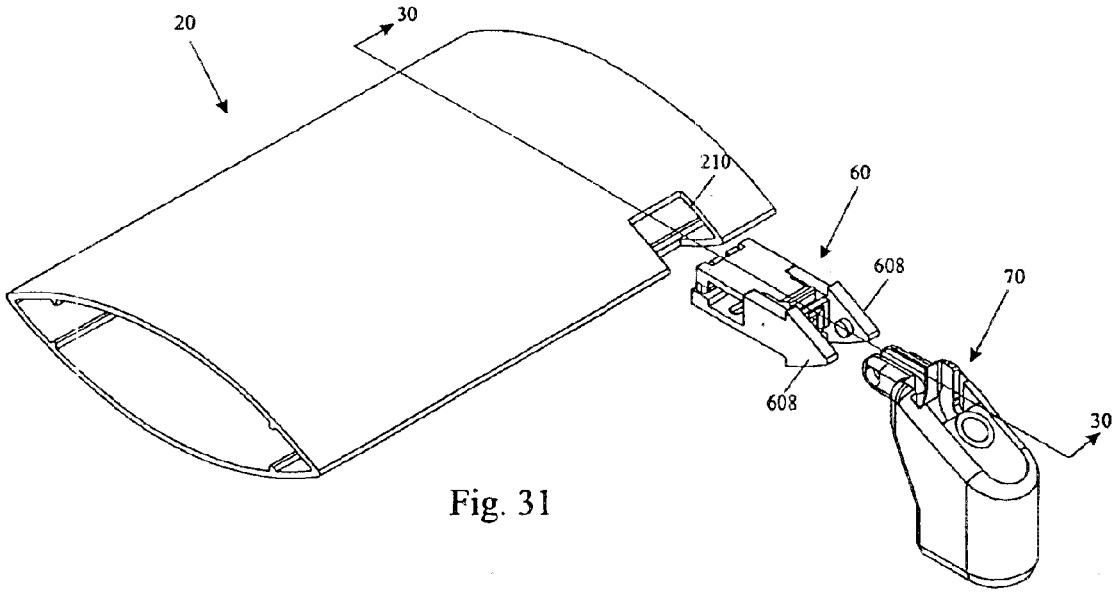
FIG. 31 is an exploded, perspective view of the components of FIG. 30.

Each cord guide 50 includes a cord glide housing 502, a cord glide cover 504, and a pulley 506. The housing 502 and cover 504 snap together, locking the pulley 506 between them. The cords 12, 16 are routed through the cord glides 50 (as seen in FIG. 24A, as well as in FIGS. 24D and 24E, where the tilt cable 16 is hidden behind the lift cord 12), and the cord glides 50 are mounted in the notched out openings 210 in the head rail 20 as shown in FIGS. 1A and 1B. FIGS. 30 and 31 show the manner in which the tilt bar top attachment 60 mounts into the head rail 20, with the rear portion of the attachment recessed into the head rail 20 and the front portion of the attachment following the contour of the edge portion of the head rail 20. The cord glides 50 mount into the head rail 20 in substantially the same manner (as can be seen in FIGS. 24D and 24E), at intervals along the head rail 20 as shown in FIG. 83.

Figure 24C:
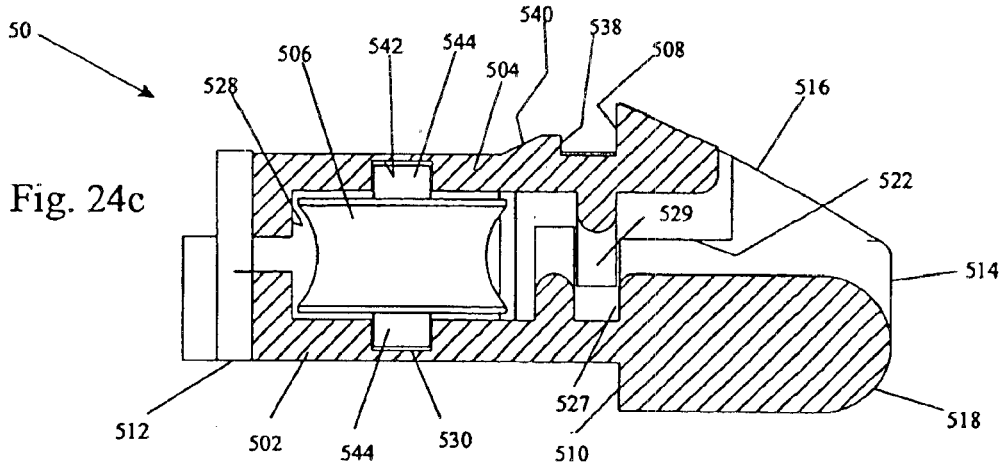
FIG. 24C is a section view along the line 24C—24C of FIG. 24A.
Figure 25A:
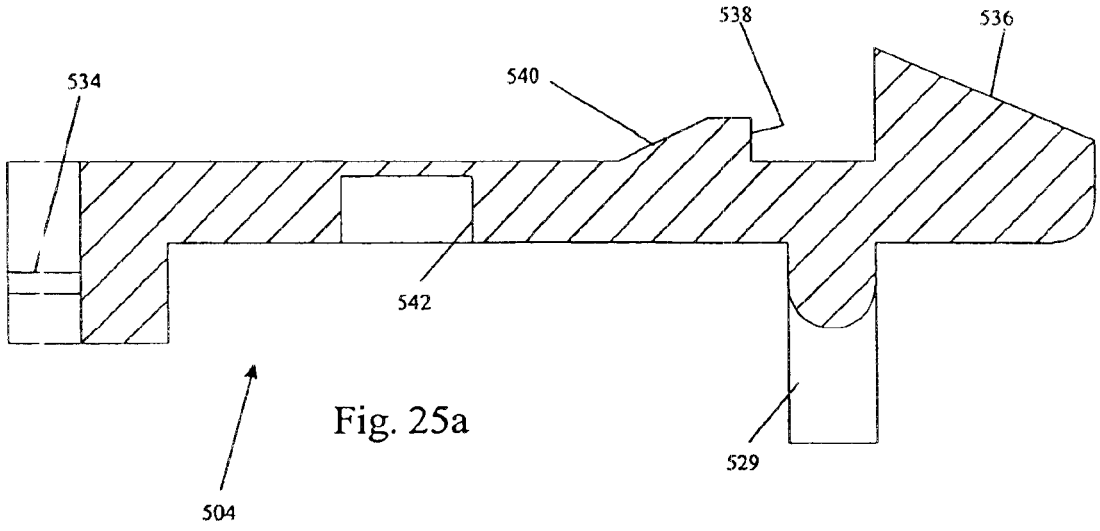
FIG. 25A is a section view along the line 25A—25A of FIG. 25B, but rotated 180 degrees.
Figure 25B:
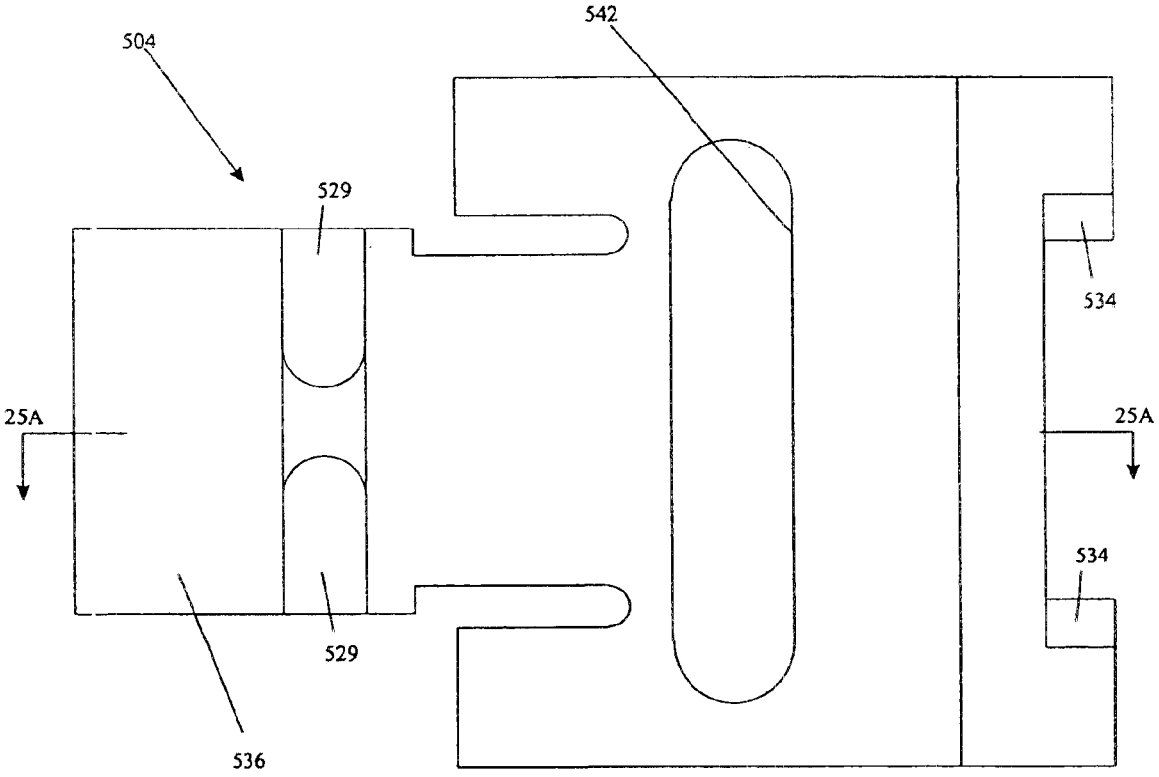
FIG. 25B is a bottom view of the glide cord housing cover of FIG. 23B.
Figure 26A:
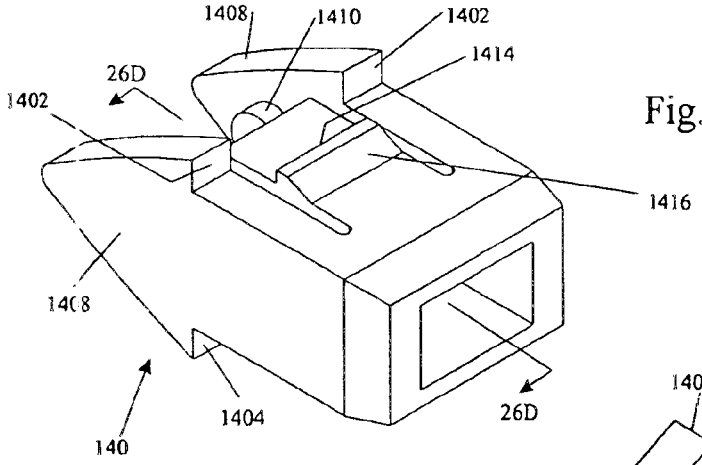
FIG. 26A is a perspective view of the multi-bar bottom rail attachment of FIG. 3B.
Figure 26B:
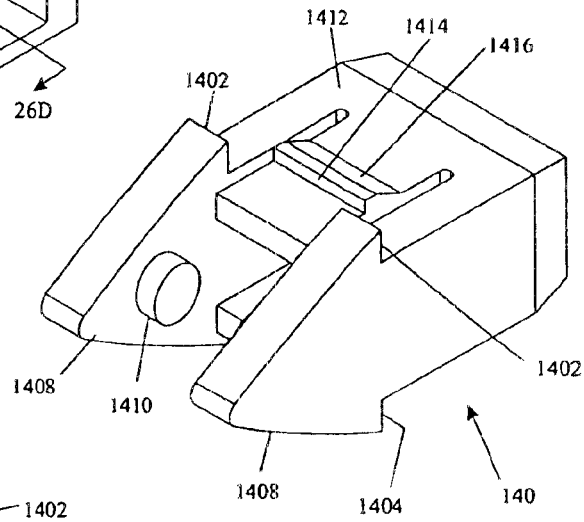
FIG. 26B is a perspective view of the multi-bar bottom rail attachment of FIG. 26A, but rotated 90 degrees.
Figure 26C:
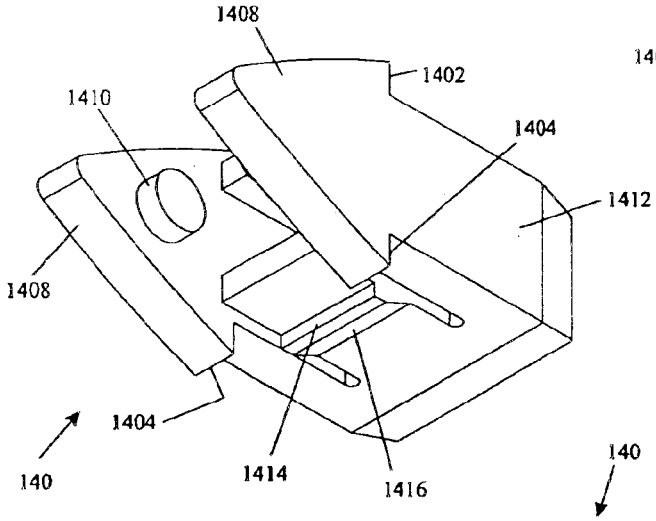
FIG. 26C is a bottom perspective view of the multi-bar bottom rail attachment of FIG. 26B.
Figure 26D:
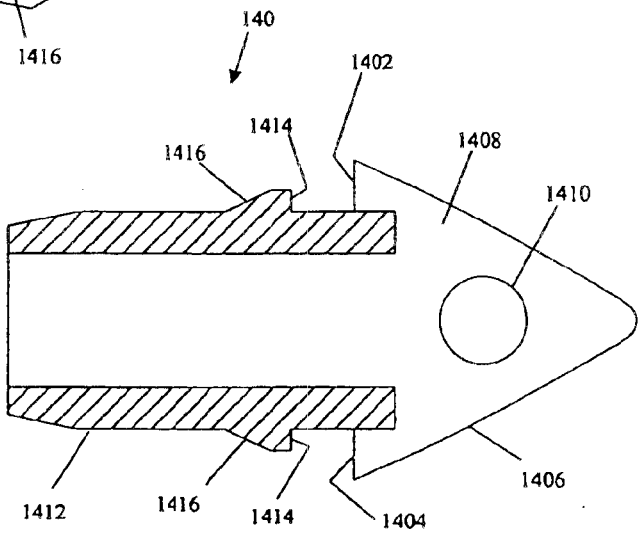
FIG. 26D is section view, along the line 26D—26D of FIG. 26A.

Referring particularly to FIG. 24C, the cord glide 50 is a slightly elongate piece with vertically aligned upper and lower shoulders 508, 510. When the rear portion 512 of the cord glide 50 is inserted into the notched out opening 210 in the head rail 20, the shoulders 508, 510 abut the outer surface of the head rail 20, so that the cord glide 50 cannot continue to slide in and ultimately fall into the head rail 20. The two shoulders 508, 510 define an imaginary vertical plane which divides the cord glide 50 into the rectangular rear end 512, which is mounted entirely within the head rail 20, and the roughly triangular front end 514, which projects through the opening 210 in the head rail 20 to the outside of the head rail 20.

The front end 514 has a wedge shaped upper section 516 with a "chin" or bump 518 protruding from its lower section. These bumps 518 provide the longer distance of travel for the tilt cables 16 in order to enhance the closure of the louvers 14, as was mentioned earlier, and as depicted in FIGS. 24D and 24E. FIG. 24E also shows that, when the head rail 20 is tilted closed, the lift cord 12 must make a tight turn (In this embodiment, a 135 degree turn when the head rail 20 is closed at a 45 degree angle). The bumps 518 on the cord glide 50 substantially reduce the frictional loss by increasing the size of the turning radius.

The cord glide housing 502 defines a vertically oriented notch 520 (See FIG. 24B) and a connecting channel 522 (See FIG. 24A), which form a path for the lift cord 12 to pass from outside of the head rail 20 to the pulley 506. The housing also defines horizontally-oriented notches 524 between the wedge shaped upper section 516 and the "chin" on the lower section 518, which extend rearwardly, providing a path to lateral cavities 526, which are also defined by the housing 502. To install a tilt cable 16 on the cord glide 50, the end of the tilt cable 16 is enlarged by forming it into a knot or by attaching an enlarged end such as a grommet 525, as is well known in the art (See FIG. 24A). The enlarged end is then inserted into one of the cavities 526, and the cord slides through the respective connecting notch 524 to the front of the cord glide 50. The housing 502 also defines a horizontal recess 527, which receives a projection 529 from the housing cover 504, when the housing 502 and cover 504 are snapped together.

The rear end 512 of the cord glide housing 502 defines an open-sided cavity 528 (See FIG. 23B), which houses the slidably supported pulley 506, and the bottom of this cavity 528 defines a slotted depression 530 which receives one of the stub shafts 544 of the pulley 506. At the rear end 512 of the cord glide housing 502, two vertically oriented barbs 532 project upwardly to engage two shoulders 534 on the housing cover 504 so as to secure the housing cover 504 to the housing 502.

The housing cover 504 (See FIGS. 25A and 25B) is a relatively flat, elongate piece with a wedge-shaped outer surface 536 on its forward end, which generally matches the wedge-shaped upper section 516 of the housing 502. A shoulder 538 with a sloping ramp 540 provides a stop to prevent the cord glide 50 from pulling out from the head rail 20 once it has been installed, as will be described shortly. The inner surface of the housing cover 504 defines a slotted depression 542, which lies directly opposite the slot 530 in the base 502, and which receives the other stub shaft 544 of the pulley 506. Forward of the depression 542 are two spaced-apart projections 529, which are received in the slot 527 of the housing 502. The space between the projections 529 is aligned with the channel 522 and forms part of the path for the lift cord 12. The shoulders 534, as already mentioned earlier, are in the rear end of the housing cover 504 and engage the barbs 532 of the housing 502 to lock the housing 502 and cover 504 together.

The pulley 506 has two stub shafts 544, which are received in the slotted depressions 530 and 542 of the housing 502 and cover 504, respectively. Since the cavity 528 which houses the pulley 506 is an open sided cavity 528, the side of the pulley 506 is able to extend beyond the side of the cord glide housing assembly 50 (as shown in FIG. 24A) in order to provide a straight run for the lift cord 12 to come in through the vertical notch 520 and through the longitudinal channel 522 of the housing 502, and tangentially wrap around the pulley 506 for approximately one-quarter turn before the lift cord 12 exits the cord glide 50 via the open side of the housing cavity 528. Furthermore, the pulley 506 can slide to either side of the cord glide 50, so that the same cord glide 50 may be used to route the lift cords 12 to the left side or to the right side. Also, the pulley 506 may slide along its respective upper and lower slots 542, 530 to a position in which it is fully inside the cord glide housing 50. This is important for installation of the cord glide 50 into the head rail 20, because it means that the slotted opening 210 in the head rail 20 need not be any wider than the width of the rear portion of the cord glide 50. The cord glide 50 is inserted into an opening 210 in the head rail 20, and then the pulley 506 is able to pop out through the open-sided cavity 528 once the cord glide 50 is installed in the head rail 20.

To assemble the cord glide 50, one of the stub shafts 544 of the pulley 506 is inserted into the slot 530 in the housing 502. Then, the lift cord 12 (See FIG. 24A) is routed through the vertically oriented notch 520 and along the channel 522, around the pulley 506 for approximately one quarter turn, and then exits the cord glide 50 through the open-sided cavity 528 of the cord glide housing 502. The housing cover 504 is then snapped over the housing 502 and pulley 506, so that the other stub shaft 544 of the pulley 506 rides in the slotted depression 542 of the housing cover 504, the projections 529 from the cover are received in the slot 527 of the housing 502, straddling the lift cord 12, and the barbs 532 of the housing 502 engage the shoulders 534 on the cover 504 to lock the housing 502 and the housing cover 504 together with the pulley 506 slidably engaged in the cavity 528 of the cord glide 50. The tilt cable 16 may be installed onto the cord glide 50 at any time before the cord glide 50 is installed onto the head rail 20, by inserting the enlarged end or grommet 525 of the tilt cable 16 into one of the cavities 526 and pulling the cord around through the slot 524 to the front of the cord glide 50. The entire assembly 50 is then inserted into a notched opening 210 of the head rail 20 so that the rear end 512 of the cord glide 50 is entirely inside the head rail 20. The rib 206 of the head rail 20 rides up over the ramp 540 of the housing cover 504 and then snaps into place in the valley formed between the shoulder 538 on the housing cover 504 and the shoulder 508 on the housing 502, locking the cord glide 50 in place on the head rail 20. The lift cords 12 may then be routed to the tilt bar top attachment 60, as shown in FIG. 83.

Operation of the Cord Glide

Referring now to FIGS. 1A and 1B, as the head rail 20 is tilted by pushing the tilt bar 80 up or down, the edge of head rail 20 that is tilted up has both the lift cord 12 and the tilt cable 16 extending out and around the "chin" 518 on the cord glide 50 (See FIG. 24E), while the other edge of the head rail 20 that is tilted down has both the lift cord 12 and the tilt cable 16 extending straight down out of the vertical notch 520. Thus, the lift cord 12 and the tilt cable 16 that are connected to the tilted-up edge of the head rail 20 have to travel a slightly longer upward distance to pass over the "chin" 518 than the lift cord 12 and the tilt cable 16 on the opposite edge of the head rail 20 must travel downwardly. The difference in the distances of travel is just enough to achieve complete closure of the stack of louvers 14 in the shutter blind system 10.

Alternate Embodiment of the Cord Glide

FIGS. 95A through 97A depict a two-piece cord glide 50A, which may be used instead of the three piece cord glide 50 shown in FIG. 1A. The two-piece cord glide 50A is quite similar to the three-piece cord glide 50 described earlier. The main difference is that the two-piece cord glide 50A unites the housing and the housing cover into a single piece housing 502A. Thus, rather than the pulley 506A being trapped between the housing and the housing cover, it now snaps into the housing 502A as will be described shortly. However, the installation of the cord glide 50A onto the head rail 20 and the use of the cord glide 50A, including the routing of the lift cord 12 and the tie-off of the tilt cable 16 remains the same as it was for the three-piece cord glide 50.

The two-piece cord glide 50A includes a housing 502A with upper and lower shoulders 508A, 510A to limit the travel of the cord glide 50A into the head rail 20. The front end 514A of the cord glide 50A has a wedge-shaped upper section 516A and a chin 518A on the lower section. A horizontal notch 524A connects the front end 514A to an open-sided, lateral cavity 526A so that the tilt cable 16 may be tied-off with an enlargement, such as a grommet, in the same manner as described for the three-piece cord glide 50. However, the horizontal notch 524A extends past an internal, longitudinal wall 527A to provide a pathway from the front end 514A of the cord glide 50A to the open-sided cavity 528A which houses the pulley 506A. A shoulder 538A and a ramp 540A serve to lock the cord glide 50A onto the ribs 206 of the head rail 20 as was described for the three-piece cord glide 50. Two relatively thin (and thus relatively flexible) arms 546A project rearwardly from the cord glide 50A, and these arms 546A are separated from each other by a distance which is slightly smaller than the outside diameter of the pulley 506A, such that the pulley 506A may be snapped into the cavity 528A by pressing it between these two arms 546A, and once in the cavity 528A, the arms 546A snap back and retain the pulley 506A in the cavity 528A. Referring briefly to FIG. 97A, recessed flanges 548A extend between the two arms 546A both at the top and at the bottom of the cord glide 50A, and these flanges 548A provide a ceiling and a floor support for the stub shafts 544 of the pulley 506A. Surrounding the front, left, and right sides of each of the flanges 548A is a U-shaped wall 549A, which serves as a stop that prevents the stub shafts 544 from moving too far forward, left, or right. The pulley itself 506A bumping into the legs 546A prevents the pulley from sliding out the back of the cord glide 50A.

The Multi-Bar Bottom Attachment

FIGS. 26A through 26D show the multi-bar bottom attachment 140 of FIG. 3B. The design of FIG. 3B has a bottom rail 21A which does not lift up and down with the louvers 14 of the blind 10B. The multi-bar bottom attachment 140 is used to connect the bottom of the tilt bar 80 to this bottom rail 21A. The bottom rail 21A is identical to the head rail 20, except that the bottom rail 21A usually does not need the notches along its rear edge (the edge closer to the wall), since neither lift cords 12 nor tilt cables 16 are attached to this bottom rail 21A. (However, if this blind is to open from the top down by means of lift cords, the lift cords would be routed through this bottom rail 21A instead of through the head rail 20.)

Unlike the rest of the louvers 14, including the bottom louver 21, the bottom rail 21A cannot be raised or lowered with the rest of the shutter blind system 10. Instead, this bottom rail 21A is mounted to the window's frame via brackets 40A, in the same manner that the head rail 20 is mounted to the window's frame via brackets 40A. In order to ensure that the bottom rail 21A tilts in unison with the head rail 20 and the rest of the louvers 14, the head rail 20 and the bottom rail 21A are connected by one or more tilt bars 80. These tilt bars 80 are connected to the bottom rail 21A by an adjustable bottom end cap 150 (described later), which is connected to the multi-bar bottom attachment 140 described below. Note that a single tilt bar 80 could be used to synchronize the tilting motion of the bottom rail 21A to that of the head rail 20, but it may be preferable to use as many tilt bars 80 as there are ladder tapes so that the tilt bars 80 may be placed in front of the tilt cords 16 of the ladder tapes and thus disguise their presence (See FIG. 3A), making an even stronger illusion of a shutter instead of a blind. When a single tilt bar 80 is used to connect the head rail 20 to the bottom rail 21A, an adjustable bottom end cap 150 may not be necessary, and an additional top end cap 70 and tilt bar top attachment 60 may be used at the bottom of the tilt bar 80 for connecting the tilt bar 80 to the bottom rail 21A.

The multi-bar bottom attachment 140 of FIGS. 26A through 26D is similar to the cord glide 50 described earlier, in that it attaches to the bottom rail 21A in a manner that is similar to the manner in which the cord glide 50 attaches to the head rail 20. The multi-bar bottom attachment 140 is an elongated piece, roughly divided in two halves by an imaginary plane defined by two upper stops 1402 and two lower stops 1404, which abut the outer surface of the bottom rail 21A, thereby preventing the multi-bar bottom attachment 140 from falling into the head rail. The front half 1406 has two triangular-shaped arms 1408, which are shaped to generally match the wedge-shaped profile of the bottom rail 21A. Facing inwardly from between these two arms 1408 are two opposed cylindrical buttons 1410, one on each arm 1408, which cooperate with two holes in the multi-bar bottom end cap 150 to pivotably lock the end cap 150 and bottom attachment 140 together. The arms 1408 are flexible enough to spread apart in order to permit the insertion of the appendage 1508 of the multi-bar bottom end cap 150 and then to snap back together, inserting the buttons 1410 into the holes 1512 of the appendage 1508 as will be described in more detail later.

The rear half 1412 of the multi-bar bottom attachment 140 is roughly rectangular, with its outer surface having shoulders 1414 which slope back down to the outer surface via the ramps 1416. The rear half 1412 of the multi-bar bottom attachment 140 is inserted into the notch 210 of the bottom rail 21A, until the rib 206 of the bottom rail 21A rides up the ramps 1416 and then snaps into locked position in the space formed between the shoulders 1402 and 1414 in the upper portion of the multi-bar bottom attachment 140, and between the shoulders 1404 and 1414 in the lower portion of the multi-bar bottom attachment 140.

The Tilt Bar Top Attachment

The tilt bar top attachment 60, depicted in FIGS. 27A through 31, is made up of three pieces—a housing 622, a cover 612, and a pulley 614. The housing 622 has two forwardly-extending, substantially triangular cross-section arms 608. The arms 608 define shoulders 606, which serve as stops, to prevent the tilt bar top attachment 60 from going too far into the head rail 20. FIG. 30 shows the top attachment 60 mounted in an opening 210 in the head rail 20, with the shoulders 606 abutting the head rail 20 and the arms 608 following the contour of the head rail edge. The arms 608 have inwardly facing buttons 610, which are used to pivotably connect the attachment 60 to the top end cap 70, as shown in FIGS. 1A, 30, and 31 and as will be described in more detail later.

The pulley 614 has stub shafts 616, which are received in slotted depressions 618, 620 in the housing 622 and in the housing cover 612, respectively, allowing the pulley 614 to slide left to right within the open-sided cavity 624 that is defined by the housing 622 and cover 612. Two upwardly projecting barbs 626 on the rear of the housing 622 engage shoulders 628 on the housing cover 612 to secure the cover 612 to the housing 622. A first downward projection 629 from the cover 612 lies just forward of the front wall of the cavity 624, and two additional downward projections 631 from the cover 612A together with the front wall of the cavity 624 define a passageway 630 (See FIG. 27B), between the open-sided cavity 624 and the space between the two arms 608, to permit the passage of the lift cords 12 from the inside of the head rail 20 to the outside of the head rail 20 and to the tilt bar 80, as will be described in more detail later. The stops 632 and ramps 634 on the outer surface of the attachment 60 permit the connector to snap into the head rail as shown in FIG. 30, with the ribs 206 received in the space between the shoulders 632 and the shoulders 606 of the attachment 60.

Figure 27A:
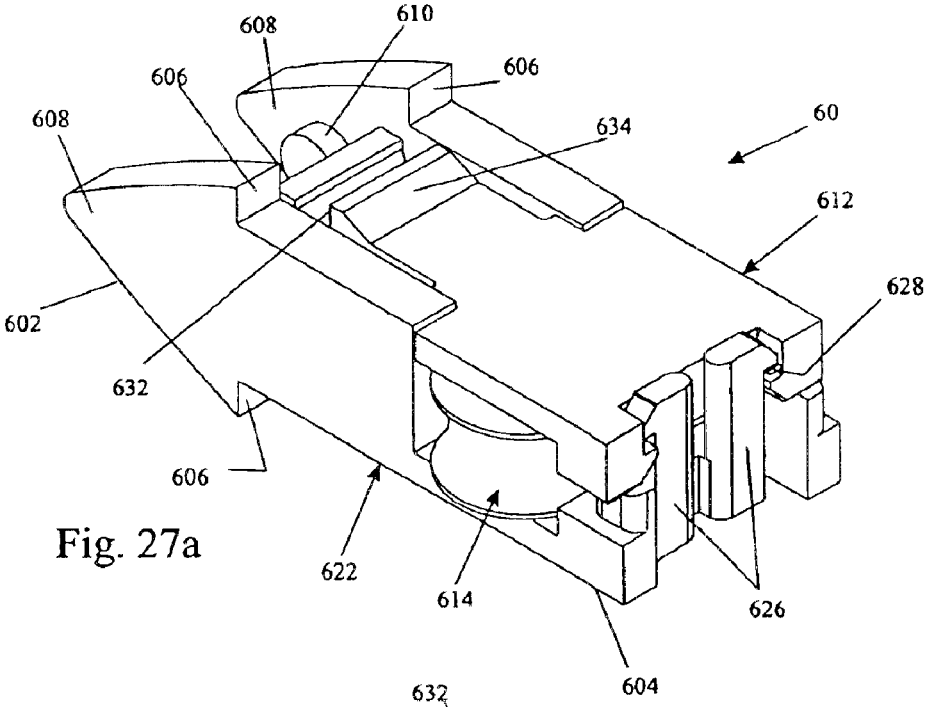
FIG. 27A is a perspective view of the operator bar top attachment assembly shown in FIG. 1B.
Figure 27B:
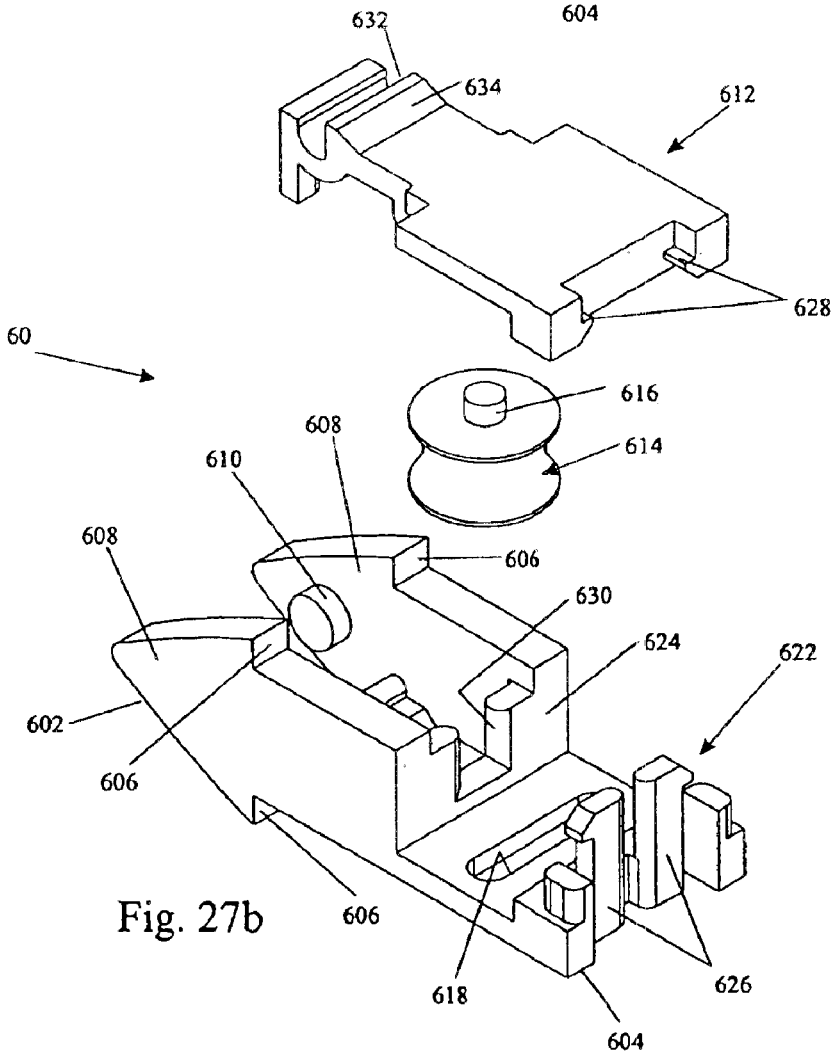
FIG. 27B is an exploded view of the operator bar top attachment assembly of FIG. 27A.
Figure 28A:
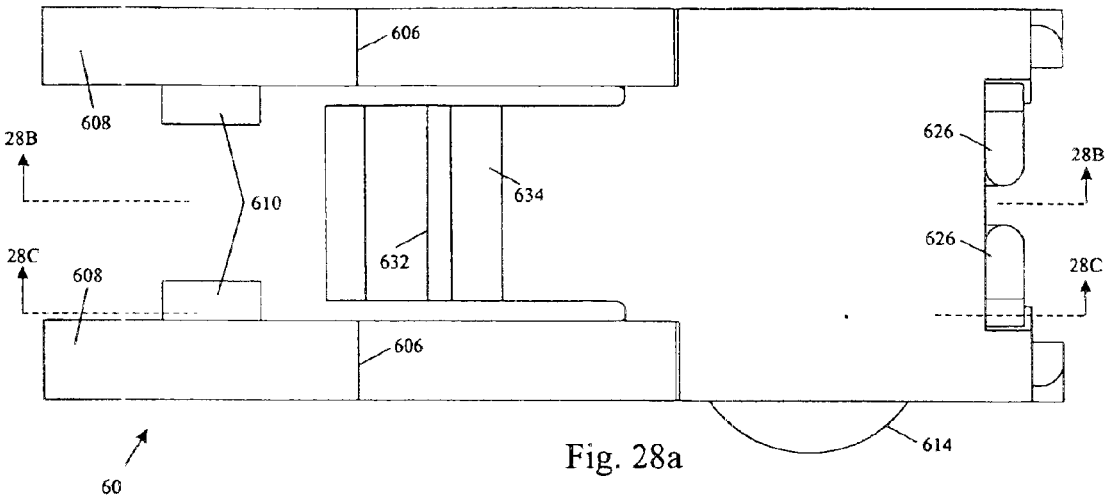
FIG. 28A is a plan view of the operator bar top attachment assembly of FIG. 27A.
Figure 28B:
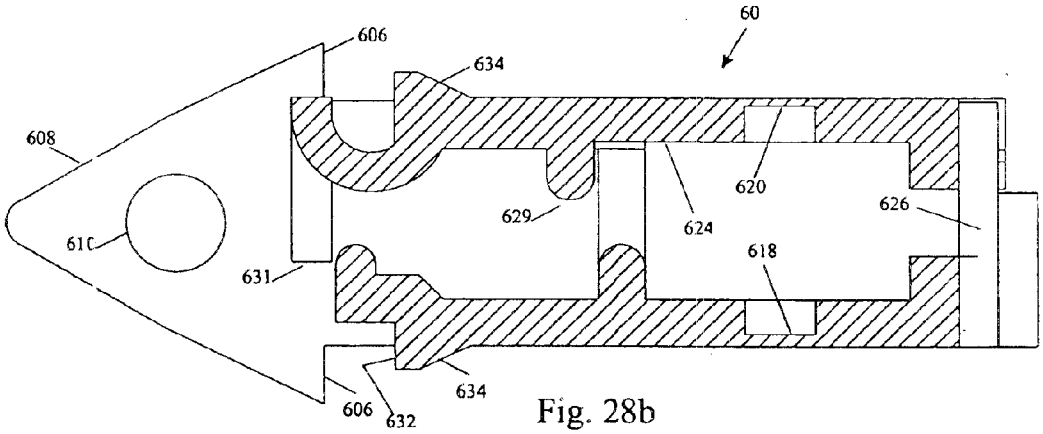
FIG. 28B is a section view along the line 28B—28B of FIG. 28A.
Figure 28C:
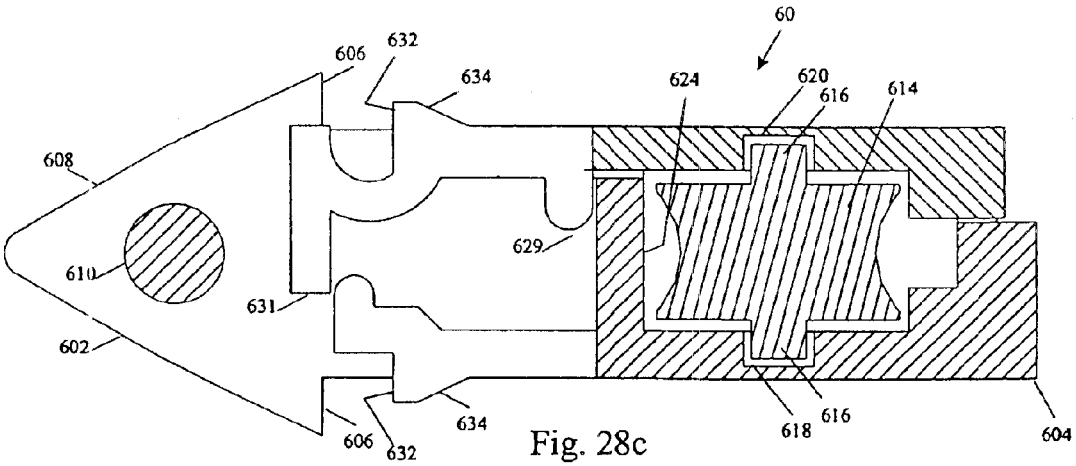
FIG. 28C is a section view along the line 28C—28C of FIG. 28A.
Figure 29A:
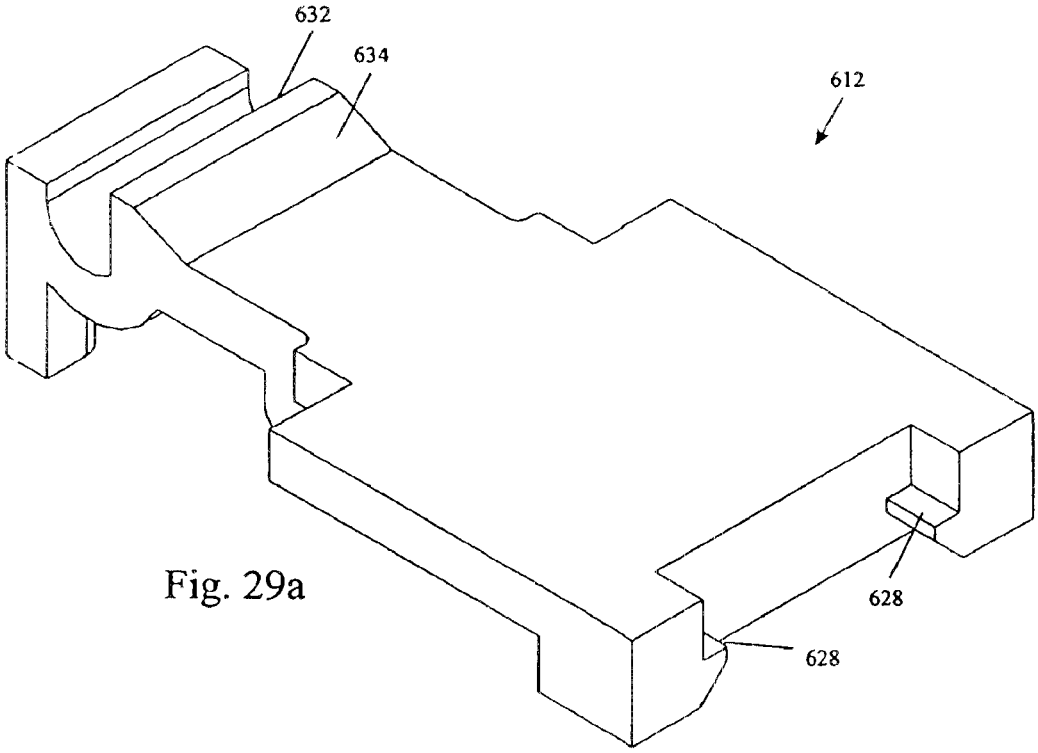
FIG. 29A is a perspective view of the operator bar top attachment assembly cover of FIG. 27B.
Figure 29B:
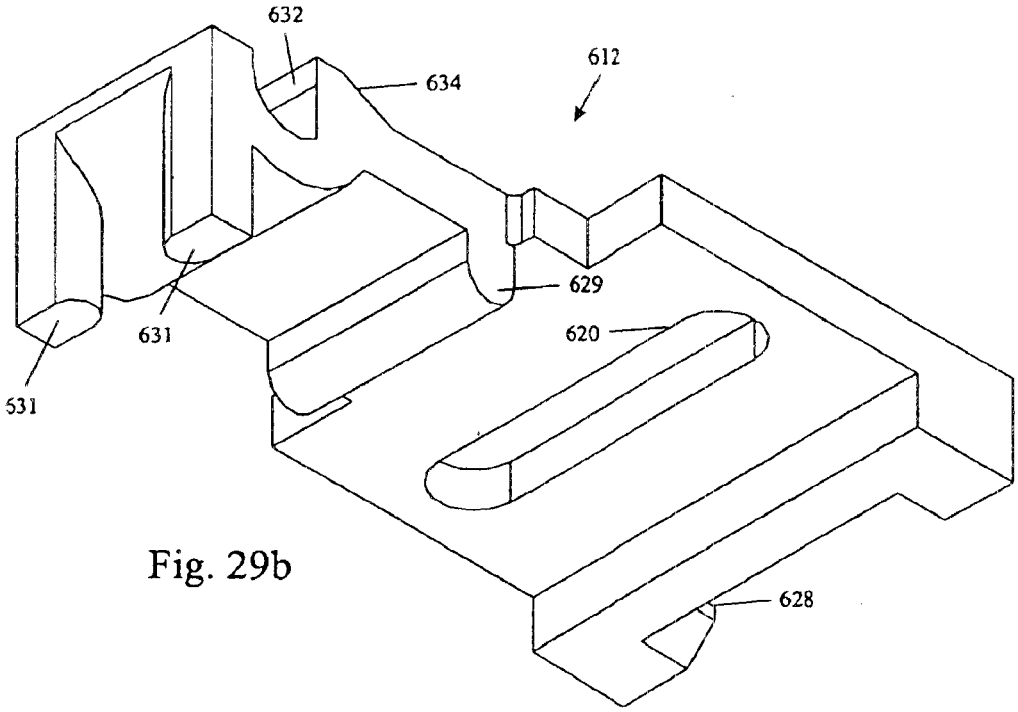
FIG. 29B is a bottom perspective view of the operator bar top attachment assembly cover of FIG. 29A.

To assemble the tilt bar top attachment 60 and install it onto the head rail 20, the stub shaft 616 of the pulley 614 is mounted in the slot 618 of the housing 622, and the lift cords 12 enter through the side of the cavity 624 and are wound around the pulley 614 and then out through the passageway 630, so the lift cords 12 exit the attachment 60 in the area between the two arms 608 (See FIG. 83). The housing cover 612 is then snapped onto the housing 622, with the other stub shaft of the pulley 614 received in the slot 620, and with the barbs 626 received by the portions 628. The tilt bar top attachment assembly 60 is then inserted into the notch 210 of the head rail 20 and is snapped into position between adjacent upper and lower ribs 206 as shown in FIGS. 1A and 1B, and as shown in greater detail in FIGS. 30 and 31. Once the assembly 60 is installed on the head rail 20, the pulley 614 will shift to one side or the other, depending upon the direction in which the lift cords 12 have been routed. FIGS. 27A shows the pulley 614 projecting out the left side of the attachment 60, which means that the lift cords 12 have been routed around the right side of the pulley 614.

Alternate Embodiments of the Tilt Bar Top Attachment

It should be noted that, under the description of the different embodiments of the end cap 30, one particular embodiment, 30A, shown in FIGS. 20A–F, was described as having "a generally "T" shaped extension 346 with a shape which closely resembles that of the tilt bar top attachment 60, since they both serve the same purpose". That end cap 30A essentially has the tilt bar top attachment built into it in the extension 346. The extension 346 is inserted into the end of the head rail 20, and the arms 608 project out through an opening 210 in the head rail. The pulley 614 supports the lift cords 12, and guides them out through the space between the arms 608.

The Tilt Bar

The tilt bar 80, also called the operator bar, of FIGS. 1 through 5 is shown in greater detail in FIGS. 45 and 46A–C. In this embodiment, the tilt bar is an aluminum extrusion with a cross-sectional profile which may be described as a "D" section 802 attached back-to-back to an "L" section 804. The "L" section 804 has a first leg 806, which is a common wall with the "D" section 802, and a second leg 808. The leg 808 and the leg 806 meet to form a corner 812, which in this embodiment is a substantially 90 degree angle. A wall extension 818 meets with the other end of the first leg 806 to form another corner 810, which is also a substantially 90 degree angle. Another wall extension 820 extends from the other end of the second leg 808 to form another corner 814, which is also a substantially 90 degree angle. The cavity 822 formed by the "D" section 802 of the tilt bar 80 is fully enclosed except at the ends of the tilt bar 80. The cavity 824 formed by the first leg 806, the second leg 808 and the two wall extensions 818, 820 is only partially enclosed. A notch 816 is located on the wall extension 820 a short distance away from the top end of the tilt bar 80, when required, in order to secure an attachment, such as the top end cap 70.

The Top End Cap

The tilt bar top attachment 60 attaches to the top end cap 70 as shown in FIGS. 1A and 1B, and shown in greater detail in FIGS. 30–33.

Figure 32A:
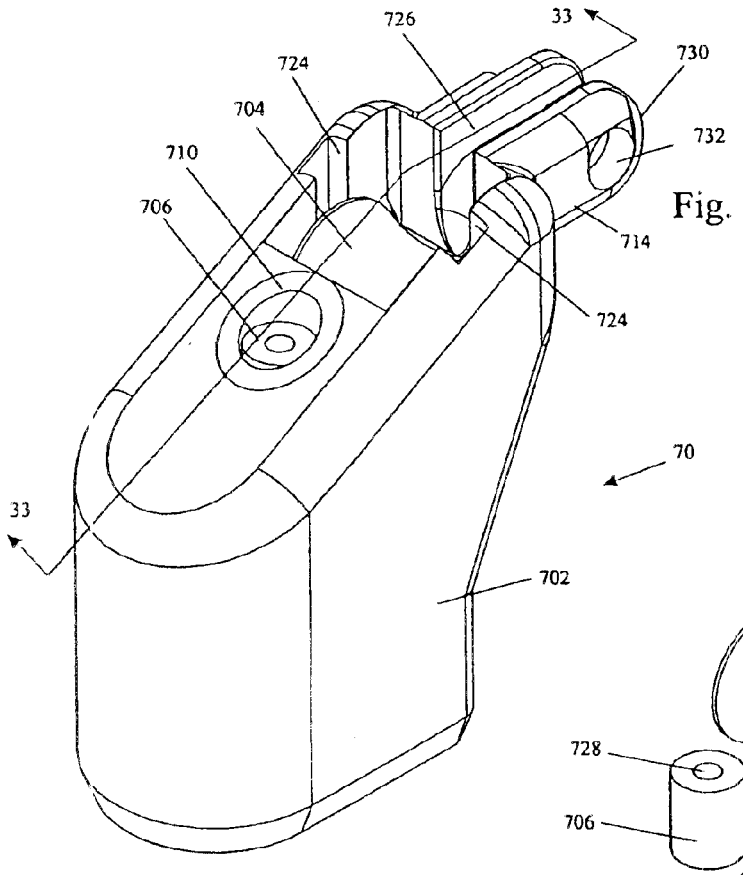
FIG. 32A is a perspective view of the operator bar top attachment assembly of FIG. 30.
Figure 32B:
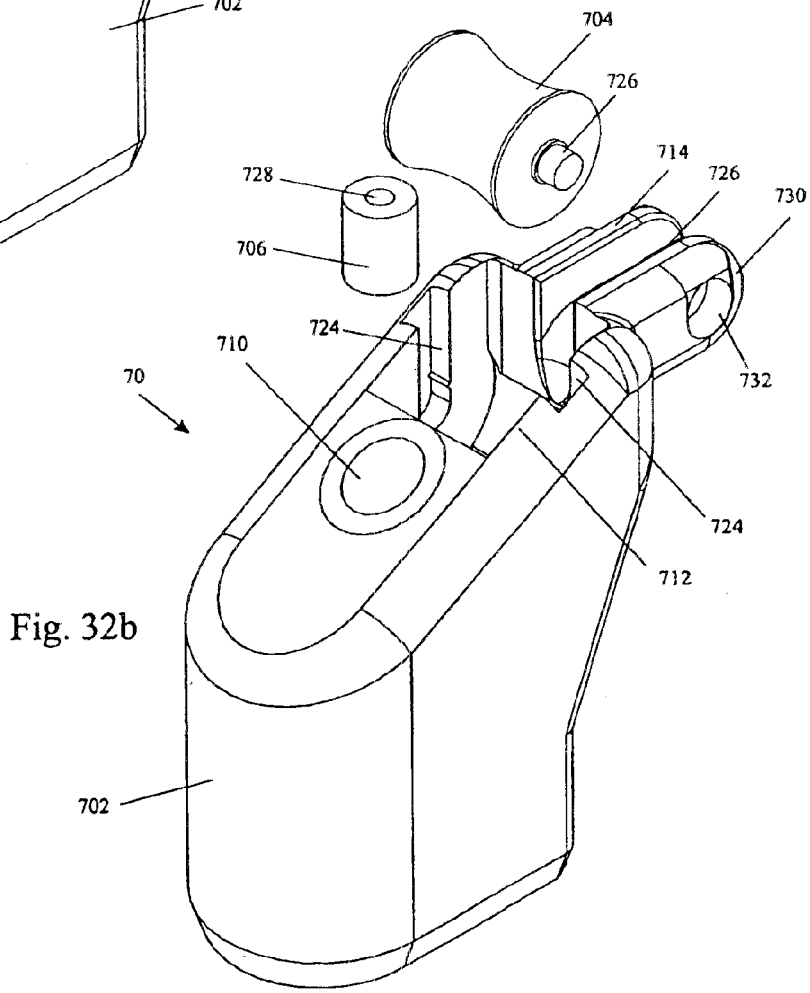
FIG. 32B is an exploded perspective view of the operator bar top attachment assembly of FIG. 32A.
Figure 33:
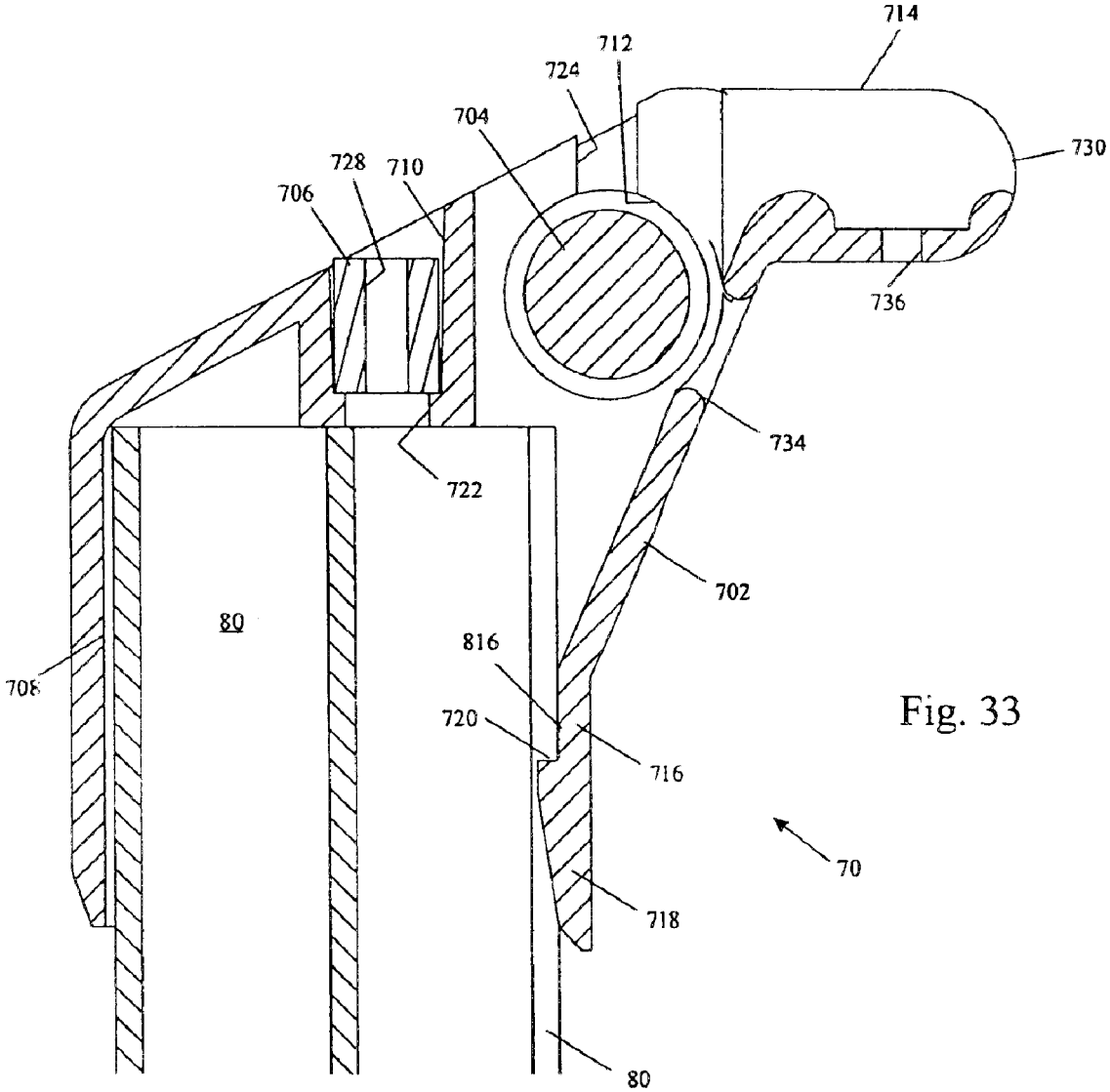
FIG. 33 is a section view along the line 33—33 of FIG. 32A.
Figure 34A:
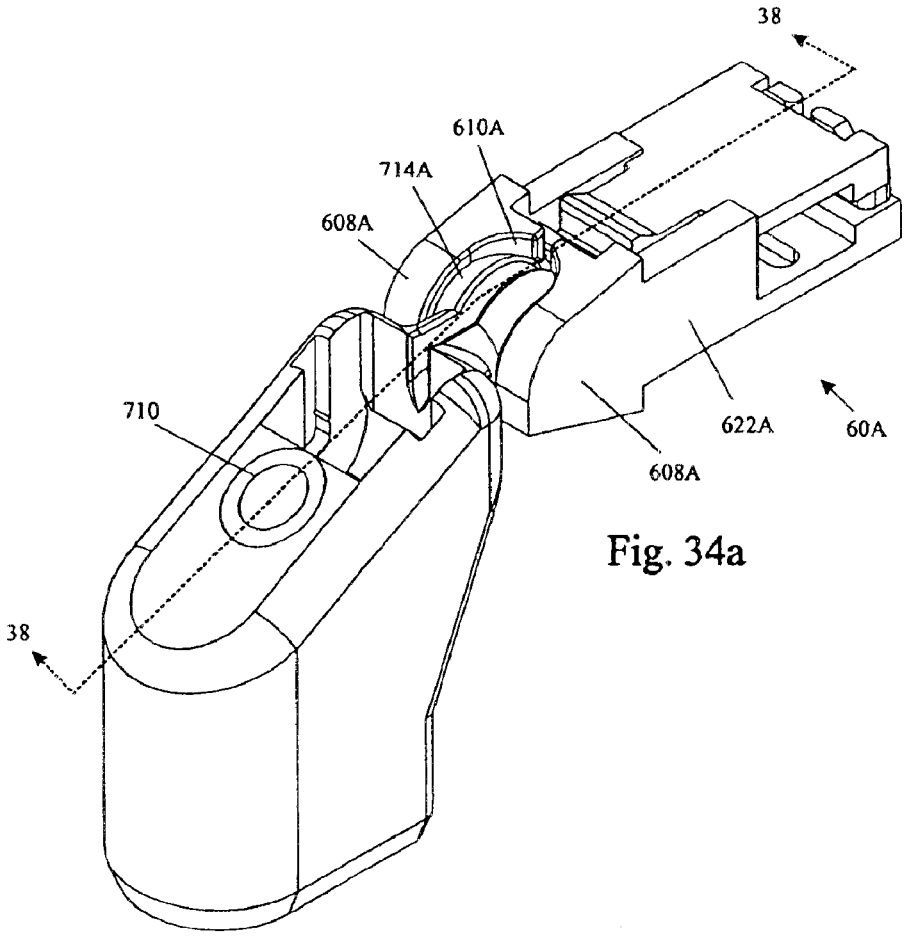
FIG. 34A is a perspective view of the ball-and-socket type operator top bar attachment assembly shown in FIG. 1A.
Figure 34B:
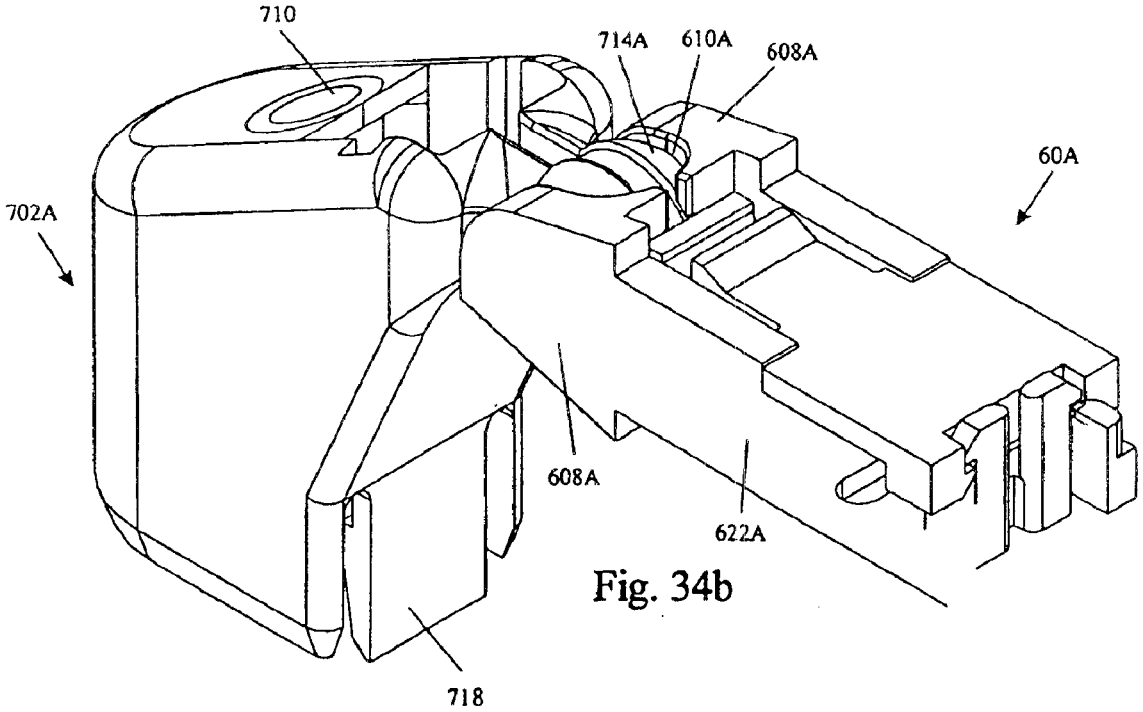
FIG. 34B is the same view as FIG. 34A but seen from the opposite end of the assembly.
Figures 35A, 35B:
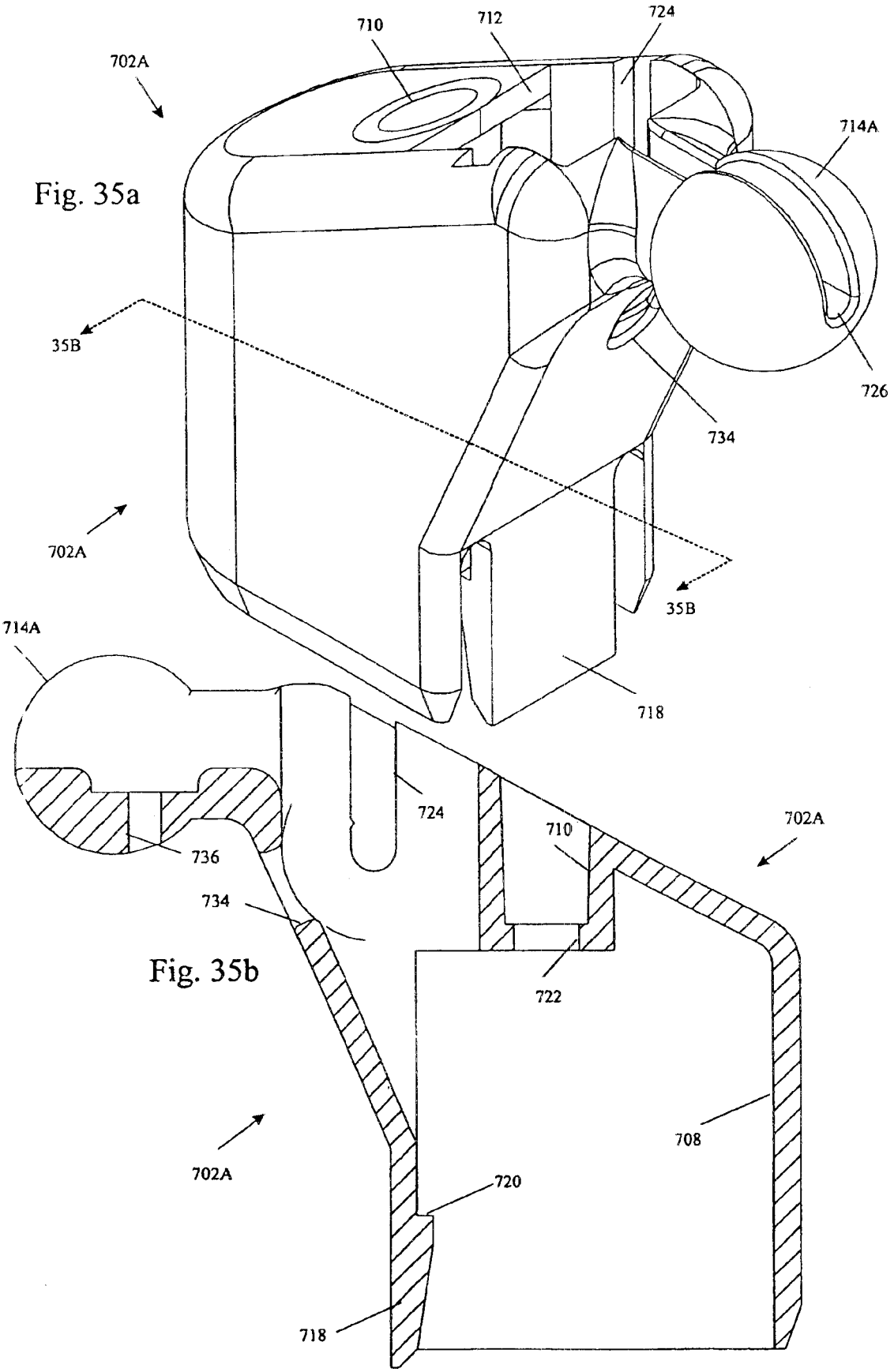
FIG. 35A is a perspective view of the "ball" part of the ball-and-socket type operator top bar attachment assembly of FIG. 34A.
FIG. 35B is a section view along the line 35B—35B of FIG. 35A.

Referring now to FIGS. 32A, 32B, and 33, the top end cap 70 includes a forward extension 714, which connects to the tilt bar top attachment 60, as will be described later. It also includes an end cap housing 702, which has a substantially rectangular shape and defines three interconnected cavities 708, 710, and 712. A roller 704 and a ferrule 706 are supported for rotation within the housing 702. The first cavity 708 within the end cap housing 702 is open at the bottom of the housing 702, and its shape matches the profile of the tilt bar 80, permitting it to receive the upper portion of the tilt bar 80. One wall 716 of this cavity 708 has a tongue 718 with an inside shoulder 720. The top end of the tilt bar 80 slides into this first cavity 708 through the open bottom of the cavity 708. The tongue 718 flexes out until the shoulder 720 clears the notch 816 on the tilt bar 80, and then it snaps back to releasably lock the tilt bar 80 to the top end cap 70, as shown in FIG. 33.

As shown in FIG. 33, the second cavity 710 is open at the top of the housing 702, and it is shaped like a hollow tube. Its inside diameter closely matches the outside diameter of the ferrule 706, and the ferrule 706 is received in that cavity 710. The purpose of the ferrule 706 is to terminate the ends of the lift cords 12. The bottom of the second cavity 710 has a smaller opening 722, which opens into the first cavity 708.

The third cavity 712 also opens to the top of the housing 702. This cavity 712 receives the roller 704. The side walls of the cavity 712 define internal vertical slots 724, which are slightly wider than the stub shafts 726 of the roller 704. Each of these slots 724 terminates at an arcuately-shaped bottom. The slots 724 slidably receive and support the stub shafts 746, such that the roller 704 is free to rotate along its axis within the cavity 712, and its axis of rotation is substantially parallel to the longitudinal axis of the head rail 20. The bottom of this third cavity 712 opens into the first cavity 708. The vertical slots 724 extend down far enough along the side walls of the cavity 712 so that, when the roller 704 is installed in the cavity 712 of the housing 702, a tangent drawn from the top of the roller 704 and perpendicular to the axis of rotation of the roller 704 will be in line with the bottom of a groove 726 which runs along the entire length of the horizontal extension 714 of the housing 702.

The lift cords 12 are routed from the exit of the tilt bar top attachment 60, along this groove 726, over and around the roller 704, and down into the first cavity 708 where they exit through the bottom of the top end cap 70 and extend downwardly along part of the tilt bar 80, as will be described in more detail later (and as may be appreciated from FIG. 38A which shows alternate but very similar embodiments of the tilt bar top attachment 60A and of the top end cap 70A). The lift cords 12 go down to a pulley 908 on the hand control 90 (as will be described in more detail later) and back up the tilt bar 80, through the first cavity 708, through the opening 722 connecting the first cavity 708 to the second cavity 710, up through an opening 728 in the ferrule 706, down around the outside of the ferrule 706 and back up through the opening 728 in the ferrule 706. As the ferrule is inserted into its cavity 710, the exterior surface of the ferrule 706 pinches the lift cords 12 against the interior surface of the opening 710, effectively securing the lift cord ends to the top end cap 70.

The forward extension 714 includes a groove 726 running the length of the extension 714. Toward the free end 730 of the extension 714, there are two, outwardly facing, opposed holes 732 which pivotably engage with the two buttons 610 in the arms 608 of the tilt bar top attachment 60, as shown in FIGS. 31. To connect the top end cap 70 and the top attachment 60 together, the forward extension 714 of the top end cap 70 is inserted between the arms 608 of the attachment, spreading the arms 608 apart until the projections 610 on the inside of the arms 608 snap fit into the holes 732 of the forward extension 714.

The housing 702 also has two more holes 734, 736 (See FIG. 33) in its forward portion. These holes are used to secure the tilt cords 16, in the event that a cord glide 50 is not used. The first hole 734 is located near the point where the housing 702 transitions to the forward extension 714, and it provides an opening from the third cavity 712 to the outside of the housing 702. The second hole 736 is located approximately midway along the bottom surface of the extension 714. This hole 736 provides a passage from the groove 726, to the outside of the housing 702. These two holes 734, 736 are used to route and tie off the tilt cables 16 in the embodiment of FIGS. 3A and 3B, when the tilt bars 80 are used to hide the tilt cables 16 and the lift cords 12. In this instance, the tilt bar top attachment 60 takes the place of the cord glide 50 along the front (room side) of the shutter blind 10B. Thus, there must be a provision for securing the tilt cables 16 to the head rail 20. The tilt cable 16 is threaded up through the first hole 734, into the third cavity 712, along the groove 726 and down through the second hole 736. An enlargement, such as a knot, is secured to the end of the tilt cable 16 such that the end of the tilt cable 16 will not slide back through the hole 736, and thus the tilt cable is secured to the top end cap 70, which in turn, is secured to the head rail 20 via the tilt bar top attachment 60.

Alternate Embodiments of the Tilt Bar Top Attachment and Top End Cap

FIGS. 34A, 34B, 35A, 35B, 37, 38, and 38A show an alternate embodiment of the tilt bar top attachment 60A and the top end cap 702A. These alternate embodiments 60A, 702A are identical to the already-described embodiments 60, 70 except for the means for connecting the tilt bar top attachment 60A to the top end cap 702A, which, in this case, is a ball and socket mechanism.

Figure 36A:
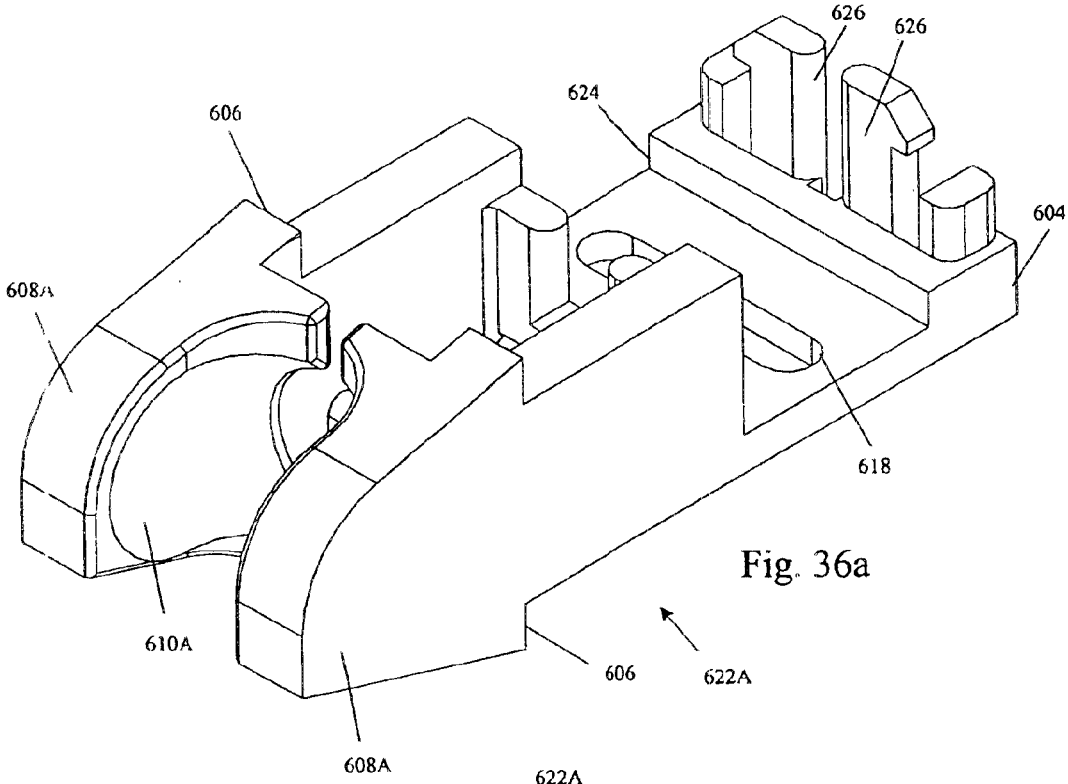
FIG. 36A is a perspective view of the "socket" part of the ball-and-socket type operator top bar attachment assembly of FIG. 34A.
Figure 36B:
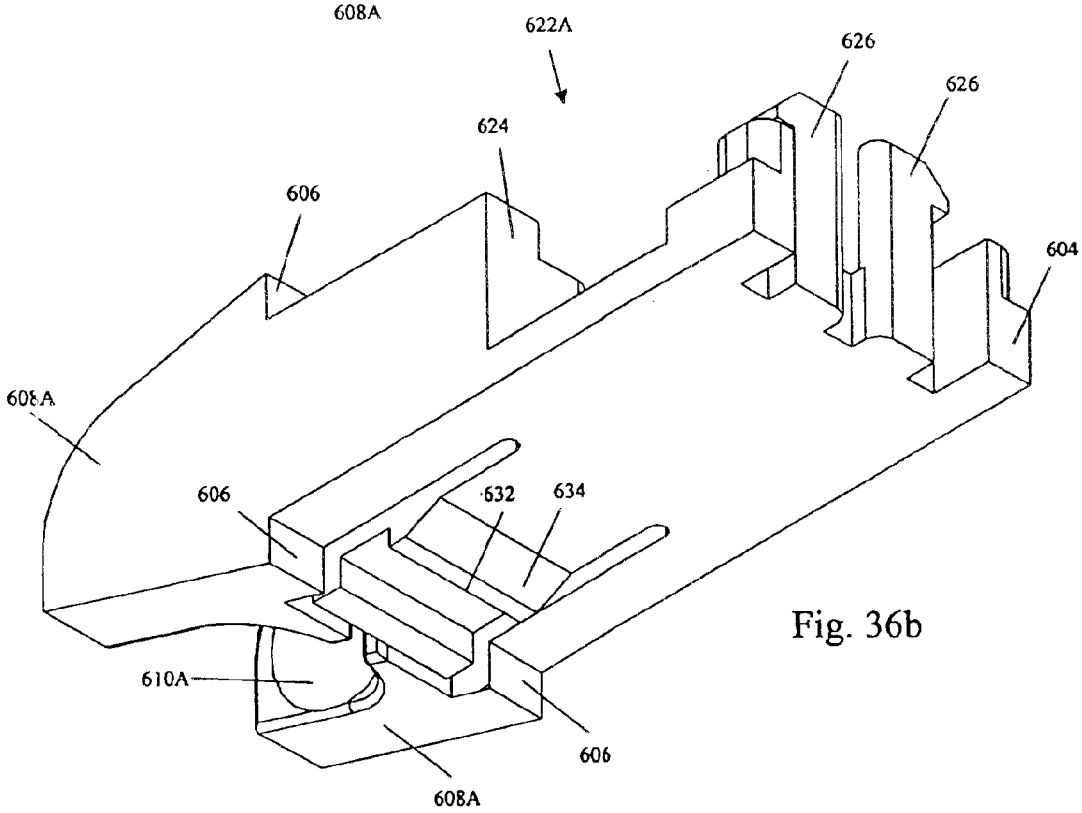
FIG. 36B is also a perspective view of the "socket" part of the ball-and-socket type operator top bar attachment assembly of FIG. 34A, but seen from the opposite end.

Instead of the two arms 608 and the inwardly facing buttons 610 of the tilt bar top attachment 60, the housing 622A of this second embodiment of the tilt bar top attachment 60A (See FIGS. 36A and 36B) has two arms 608A with interior walls forming a hollow, spherical cavity 610A, which serves as the socket component of the ball and socket mechanism. Instead of the extension 714 with the holes 732 to engage the buttons 610 of the tilt bar top attachment 60A, the housing 702A of the second embodiment of the top end cap 70A has a spherically shaped extension 714A (See FIGS. 35A and 35B), which serves as the ball component of the ball and socket mechanism. As was the case for the pieces of the first embodiments 60, 70 the arms 608A of the second embodiment 60A flex apart enough to allow the ball 714A of the second embodiment 70A to snap into the socket.

Figure 37:
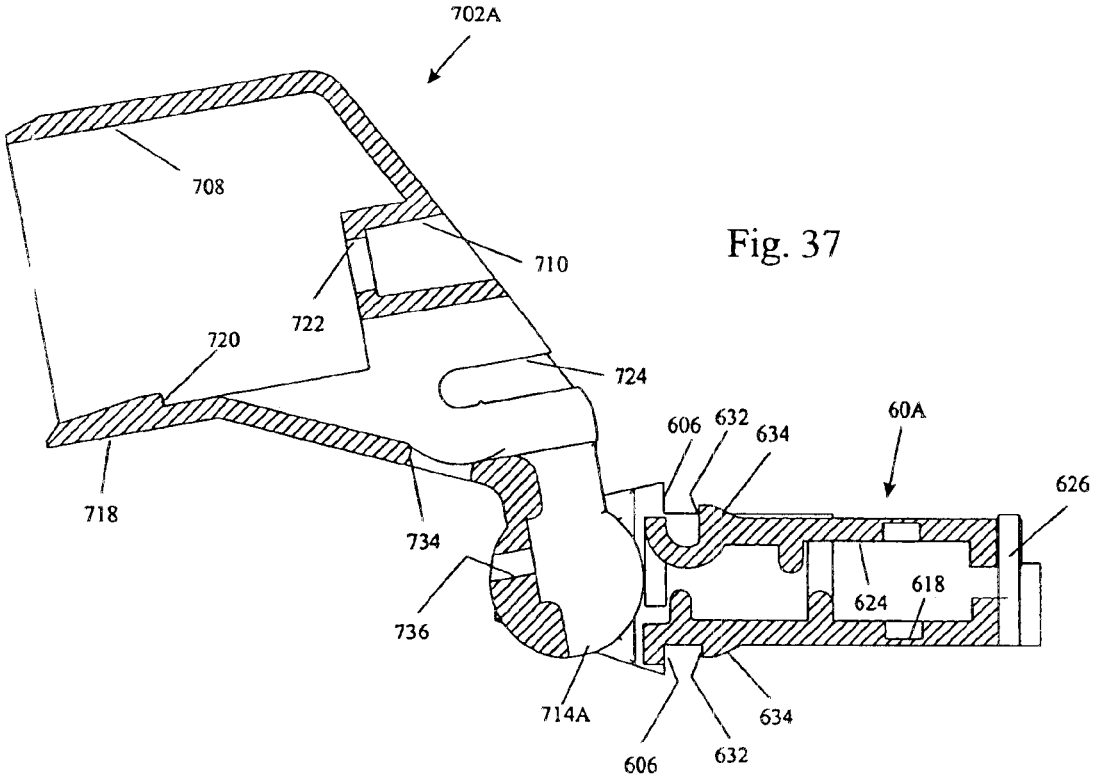
FIG. 37 is a section view, identical to that of FIG. 38, except that it shows the relative position of the ball and of the socket parts in order to initiate the assembly.
Figure 38:
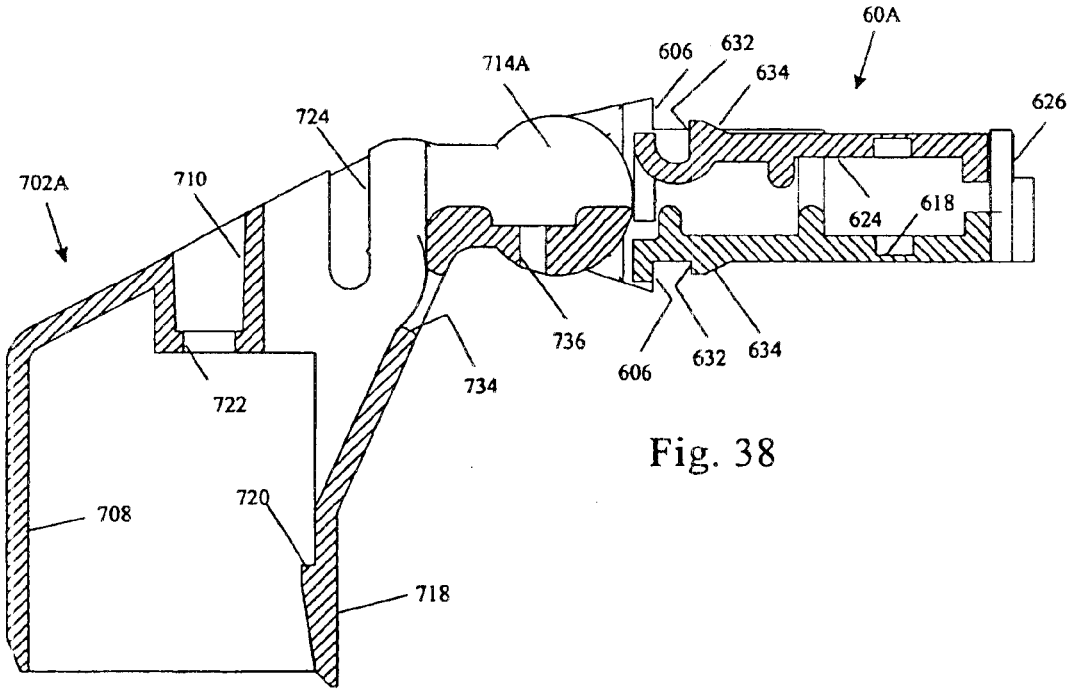
FIG. 38 is a section view along the line 38—38 of FIG. 34A.

FIGS. 37 and 38 show two possible relative positions of the tilt bar top attachment 60A and the top end cap 70A. Where the buttons-and-holes connection of the first embodiments 60, 70 allowed pivoting of the top end cap 70, relative to the tilt bar top attachment 60, only along a single axis substantially parallel to the longitudinal axis of the head rail 20, the ball and socket connection of the second embodiment 60A, 70A allows for pivoting along a plurality of axes. Thus, for example, the tilt bar 80 of FIG. 1A may be pivoted sideways, so that the length of the tilt bar 80 is substantially parallel to the longitudinal axis of the head rail 20 for shipping purposes, and then it can be straightened out so that the length of the tilt bar 80 is substantially perpendicular to the longitudinal axis of the head rail 20 during normal operation.

Figure 38A:
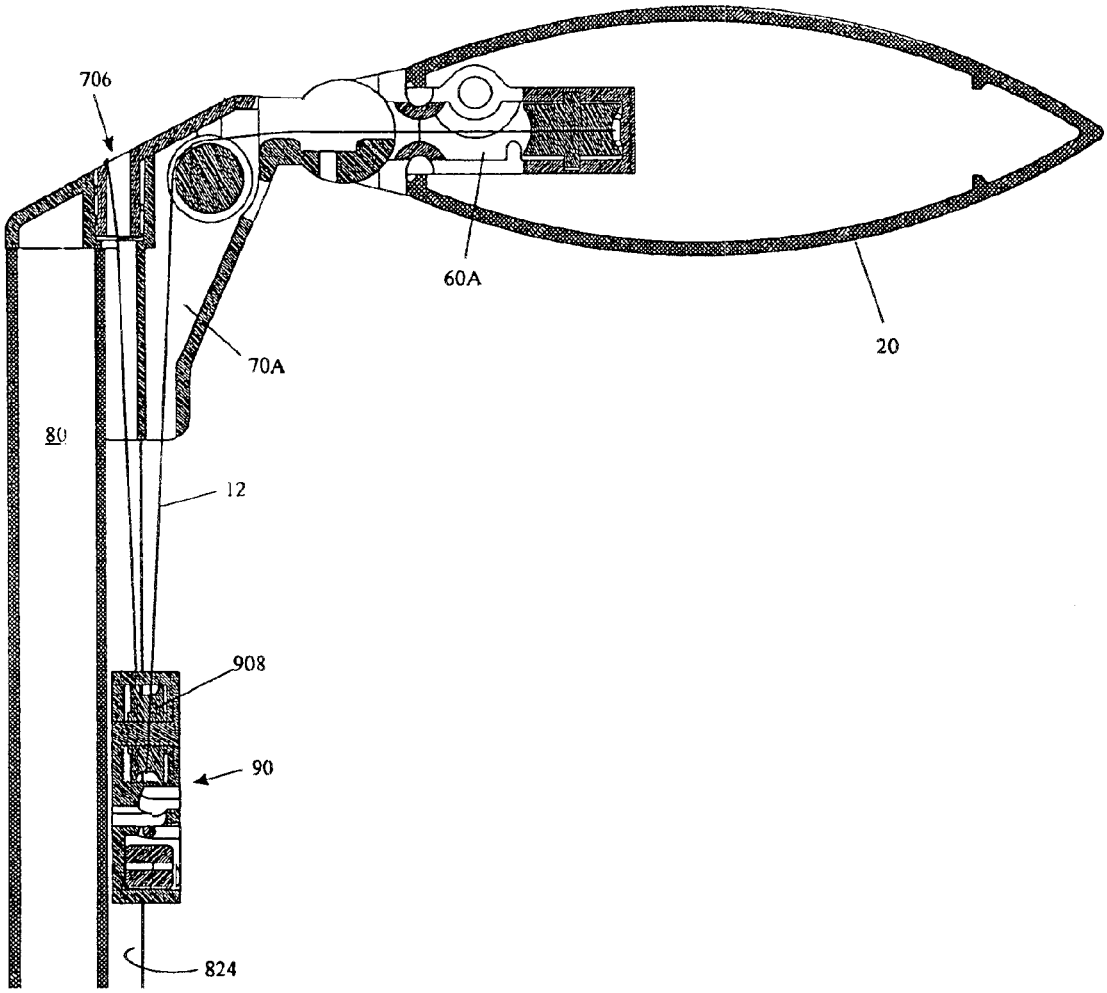
FIG. 38A is a section view of the head rail, operator bar top attachment, top end cap, tilt bar, and hand control of FIG. 1A, showing the routing of the lift cord.

FIG. 38A shows the tilt bar top attachment 60A and the top end cap 70A as they are mounted to the head rail 20 and to the tilt bar 80, respectively. This figure further shows the routing of the lift cord 12 from the head rail 20, through the tilt bar top attachment 60A, through the top end cap 70A, down along the cavity 824 of the tilt bar 80, around the pulley 908 of the hand control 90, and back up along the cavity 824 of the tilt bar 80. The end of the lift cord 12 is tied off at the top end cap 70A via the ferrule 706.

Figure 38B:
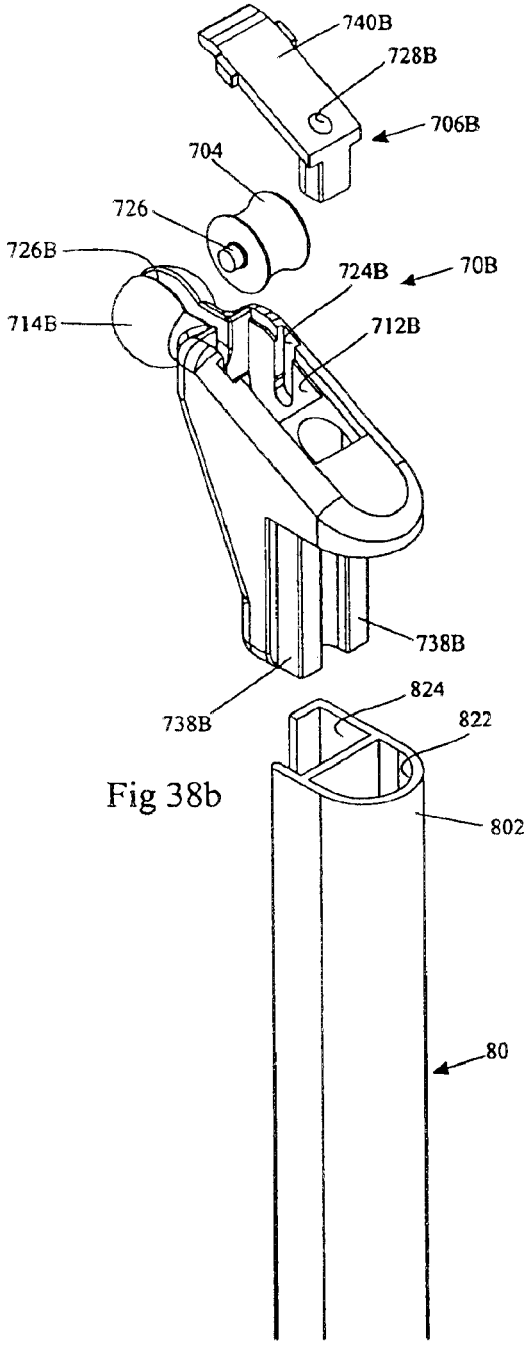
FIG. 38B is an exploded, perspective view of another embodiment of the top end cap which is similar to the top end cap of FIG. 38A.
Figure 38C:
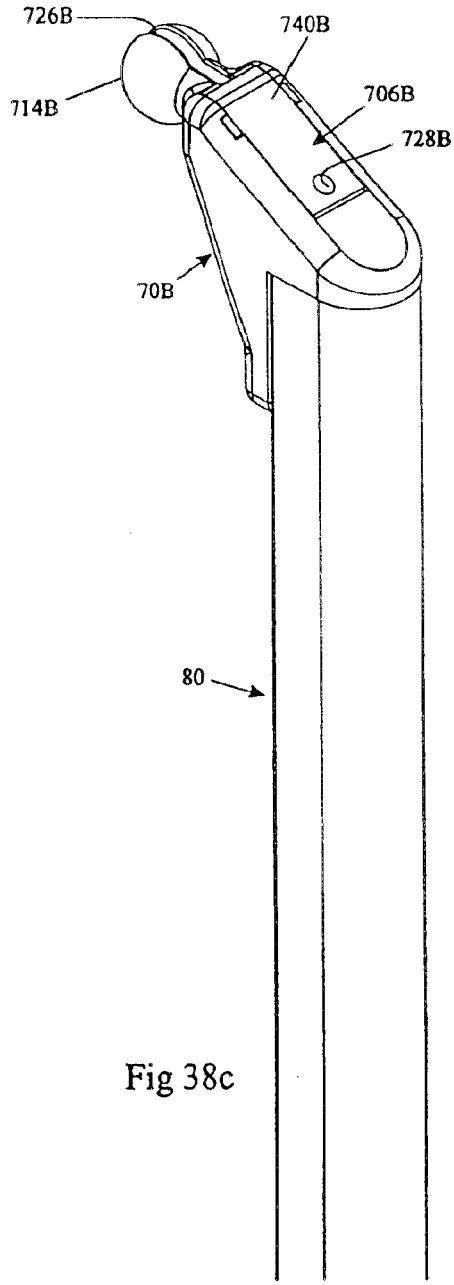
FIG. 38C is an assembled, perspective view of the end cap of FIG. 38B.
Figure 38D:
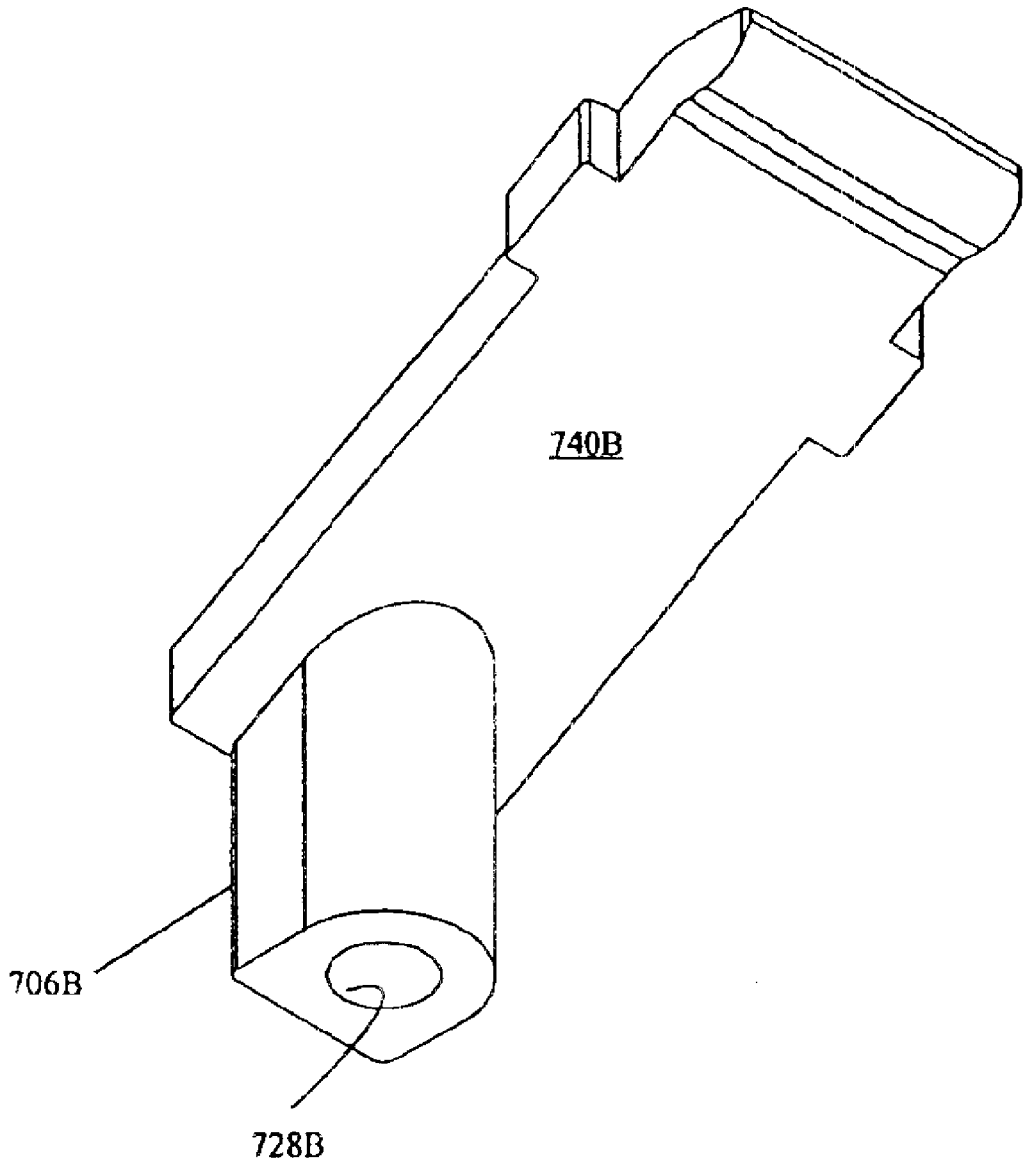
FIG. 38D is a perspective view of the ferrule which is part of the end cap of FIG. 38B.
Figure 38E:
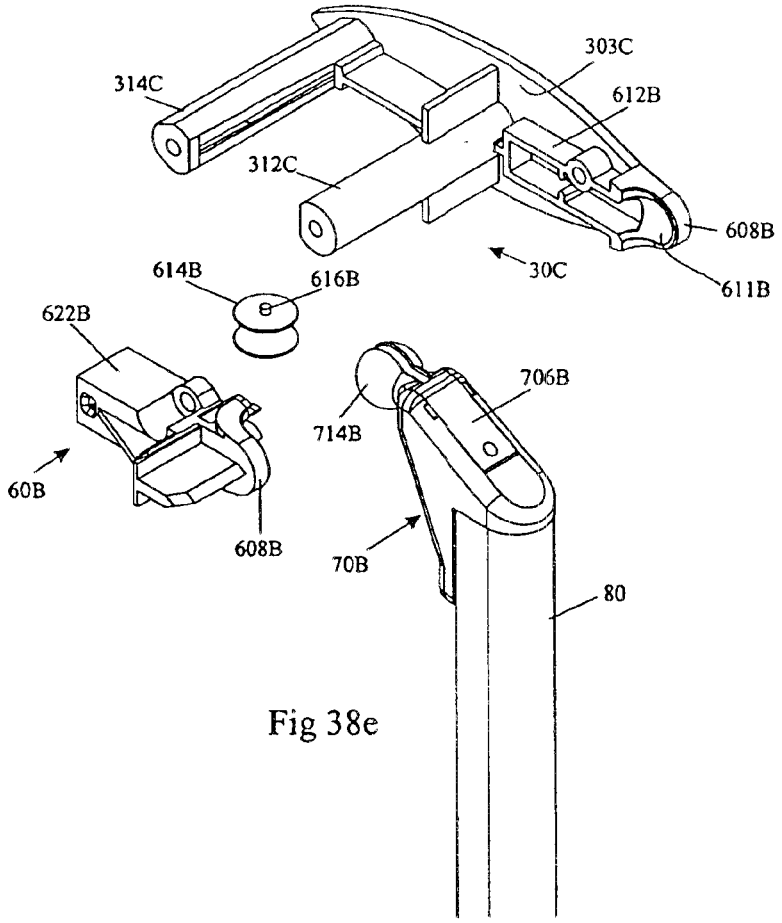
FIG. 38E is an exploded, perspective view of the top end cap of FIG. 38B together with another embodiment of an operator top bar attachment and end cap to accommodate mounting of the operator bar at one end of the head rail, as shown in FIGS. 5E and 5F.
Figure 38F:
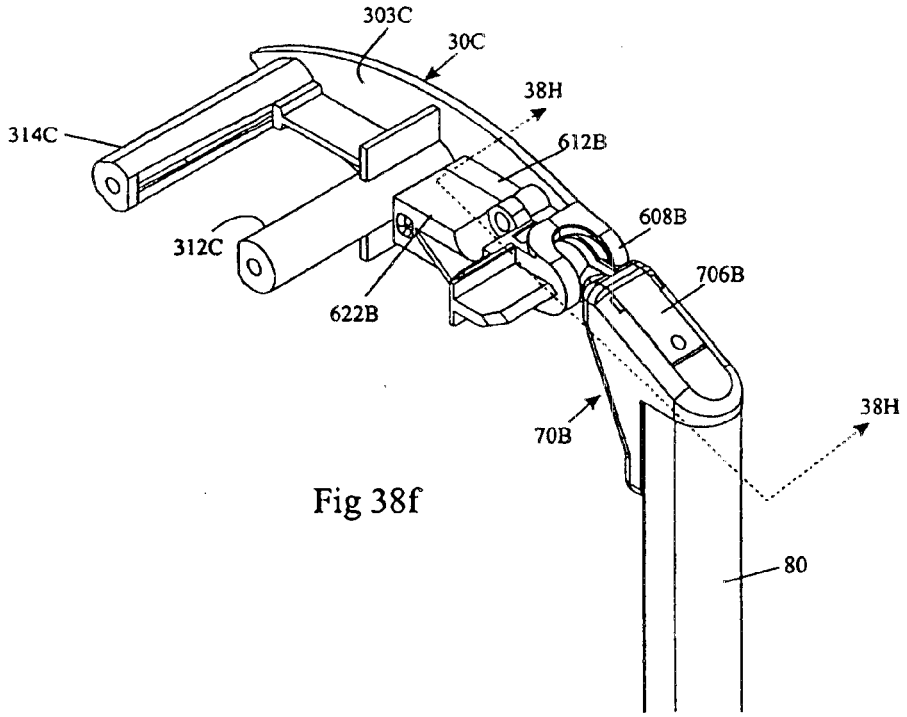
FIG. 38F is an assembled, perspective view of the end cap, top bar attachment, and top end cap of FIG. 38E.

FIGS. 38B and 38D show another embodiment of a ball and socket style top end cap 70B, which is very similar to the previous embodiment 70A described earlier. This embodiment 70B differs from the previous embodiment 70A in that it does not have a skirt to form a first cavity 708. Instead, this embodiment 70B has two legs 738B, which slide into the cavity 824 in the "L" section 804 of the tilt bar 80. Also, the ferrule 706 of the first and second embodiments 70, 70A is replaced by a ferrule 706B with a cover 740B (See FIG. 38D) extending forward to cover the top entrance to the third cavity 712B which houses the roller 704. This cover 740B traps the roller 704 in its cavity 712B and keeps dust and other foreign matter from entering the cavity 712B.

FIGS. 38E–38H depict a fixed-end embodiment of an end cap 30C, with an integral top bar attachment 60B, which is intended for usage in the shutter blind 10F shown in FIGS. 5E and 5F. This fixed-end end cap 30C is similar in many ways to the spring-loaded end cap 30 and the fixed-end end cap 30A described earlier. It includes an airfoil shaped profile 303C as well as the hollow pins 306 with stub shafts 338A, 338 (not shown in these views). As in the case of the end cap 30A with its generally T-shaped extension 346, this embodiment of the end cap 30C also has the tilt bar top attachment 60B built into it, but incorporated immediately adjacent to the airfoil shaped profile 303C, so that the tilt bar 80 may extend from the very end of the head rail 20 (as seen in FIG. 5E), instead of extending from a short distance away (as seen in FIG. 1A).

Figure 38G:
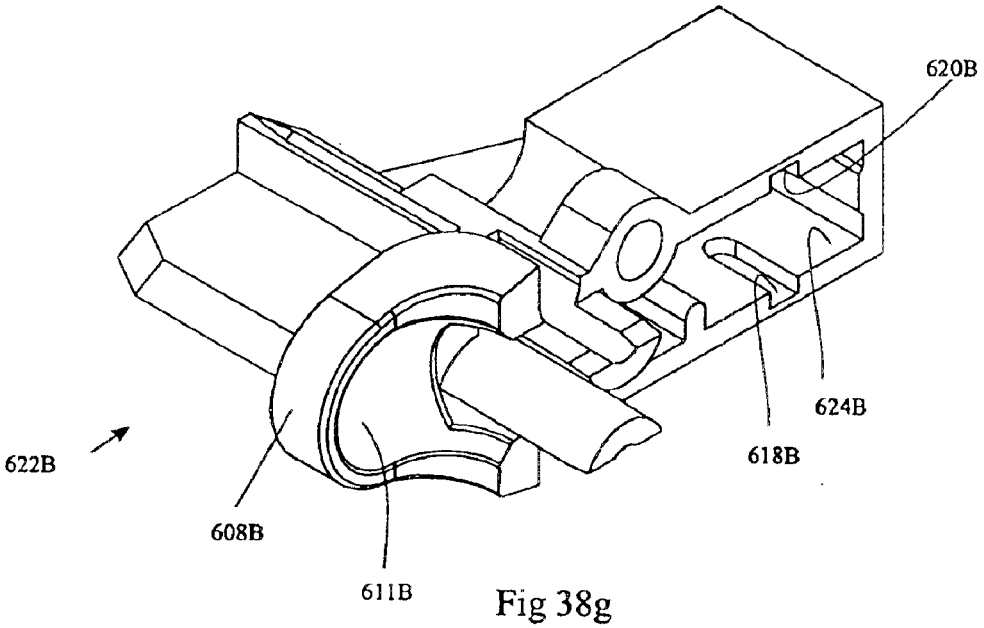
FIG. 38G is a perspective view of the top bar attachment housing which is part of the end cap and top bar attachment of FIG. 38E.
Figure 38H:
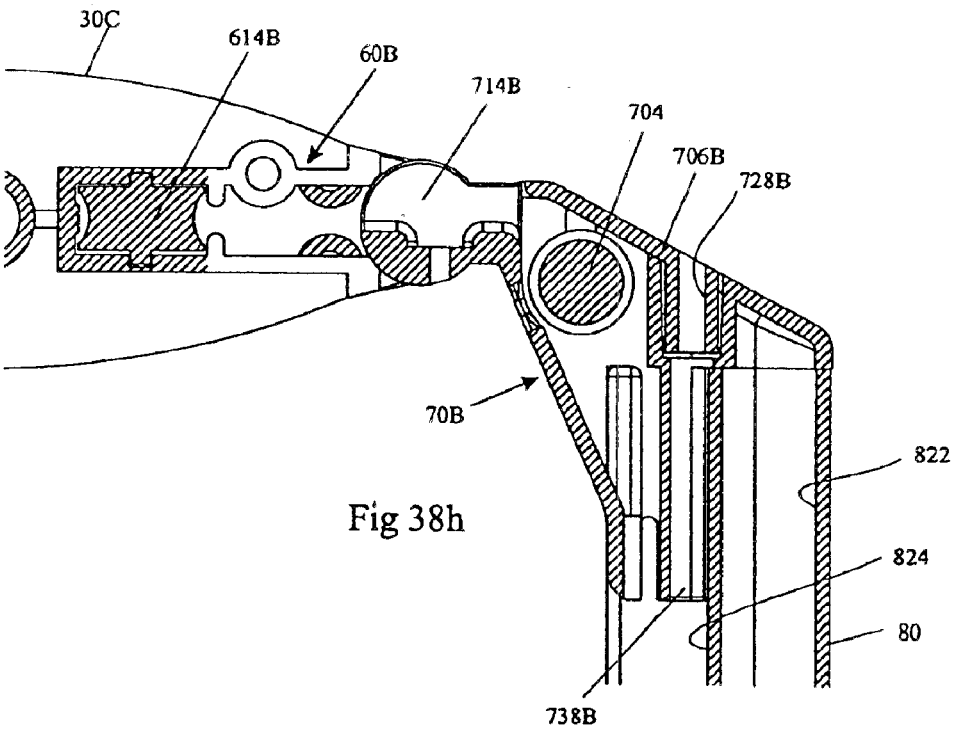
FIG. 38H is a section along line 38H—38H of FIG. 38F.

The tilt bar top attachment 60B includes a housing 622B, which mates up with a housing cover 612B (which is integral to the end cap 30C) and a pulley 614B which is housed inside the cavity 624B of the housing 622B (shown in FIG. 38G). The overall shape of the tilt bar top attachment 60B is very similar to that of the tilt bar top attachment 60A once the housing 622B is mated up to the housing cover 612B, including such features as the arms 608B, the socket 611 B, and the upper and lower slotted depressions 620B, 618B, respectively, for the guidance and support of the pulley stub shafts 616B.

Naturally, in order to use this embodiment of the end cap 30C and tilt bar top attachment 60B, the head rail 20 must have one of it slotted openings 210 located right at one of its ends (as seen in FIG. 5E) instead of a short distance from one of its ends (as seen in FIG. 1A). As may be appreciated from a comparison of FIGS. 38A and 38H, the overall layout and performance of the ball and socket embodiments 60A, 70A located a short distance from the end of the head rail 20, and the ball and socket embodiments 60B, 70B of similar embodiments but located right at the end of the head rail 20, are indeed very similar. The main difference is the lateral shift of the tilt bar 80 so that it is right along the edge of the head rail 20 in the latter set of described embodiments 60B, 70B (together with the end cap 30C).

Adjustable Bottom End Cap

Figure 39A:
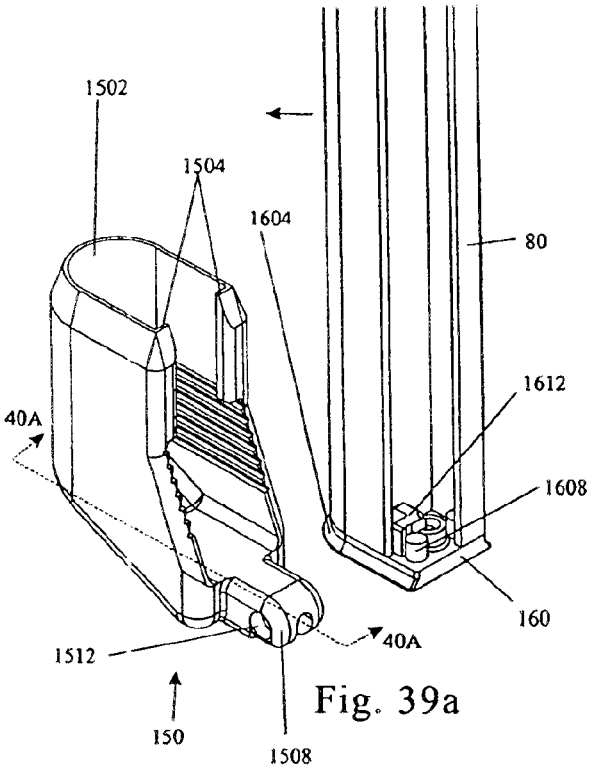
FIG. 39A is a partially exploded, partially broken away, perspective view of the operator bottom bar, adjustable attachment assembly of FIG. 3B.

FIGS. 39A–40B show the bottom end cap 150 used in the system 10B of FIGS. 3A and 3B. The adjustable bottom end cap 150 is very similar to the top end cap 70 except that it does not have second and third cavities 710, 712, since there are no lift cords to route through and to tie off to this bottom end cap 150. Also, the flexible tongue 718 and the shoulder 720 are absent, since this end cap 150 permits adjustment of the relative positions of the tilt bar 80 and the end cap 150. A bottom plug 160 (see FIGS. 41A–E) is designed to mount onto the bottom end of the tilt bar 80 and also to slide into the bottom end cap 150 in order to adjustably secure the tilt bar 50 and bottom end cap 150 together, as shown in FIGS. 39A, 39B, and 39C.

Figure 40A:
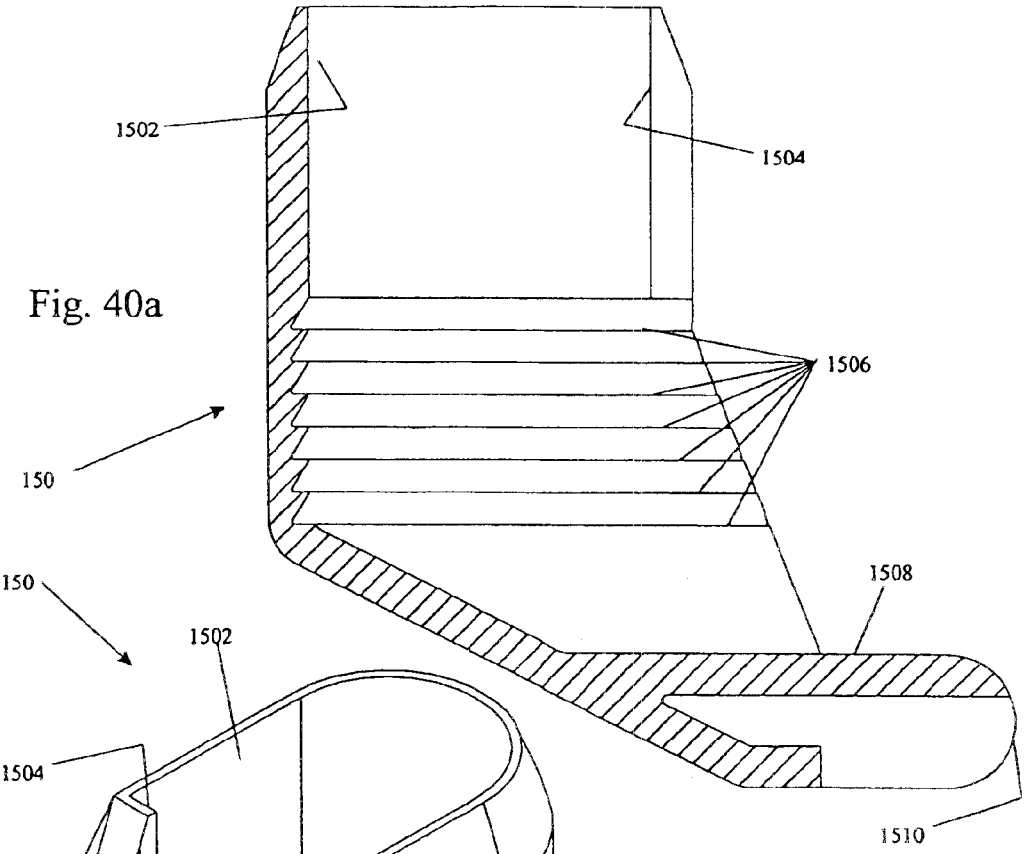
FIG. 40A is a section view along the line 40A—40A of FIG. 39A.
Figure 40B:
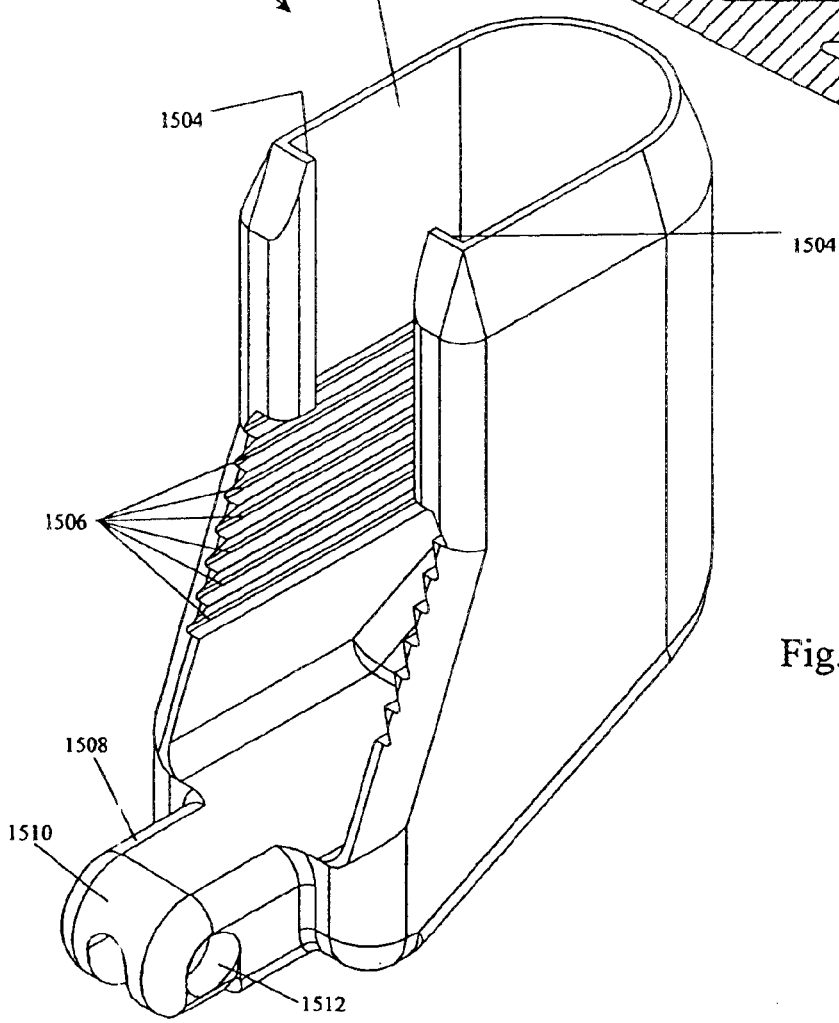
FIG. 40B is a perspective view of the adjustable attachment housing of FIG. 39A.
Figure 41A:
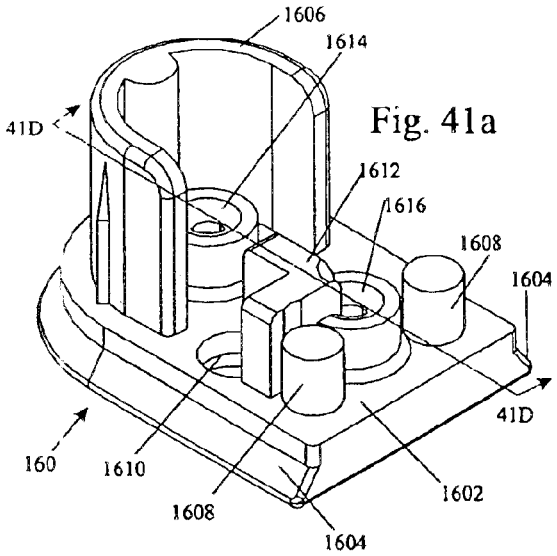
FIG. 41A is a perspective view of the operator bottom bar cap of FIG. 39A.
Figure 41B:
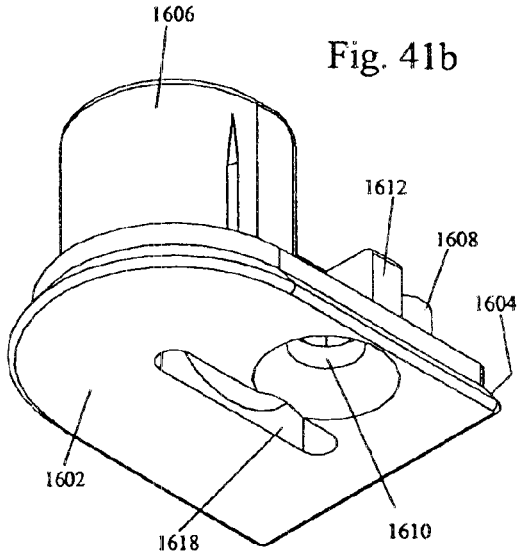
FIG. 41B is a bottom perspective view of the operator bottom bar cap of FIG. 41A.
Figure 41C:
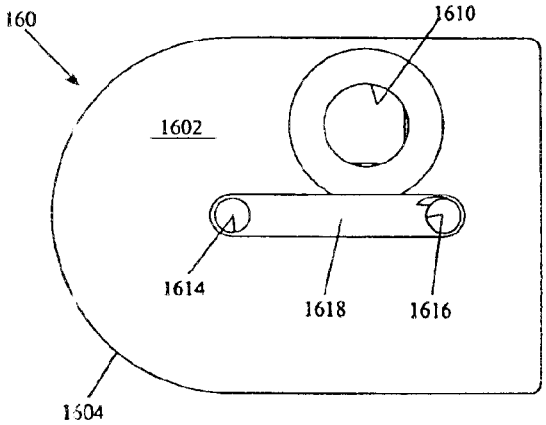
FIG. 41C is a bottom view of the operator bottom bar cap of FIG. 41A.
Figure 41D:
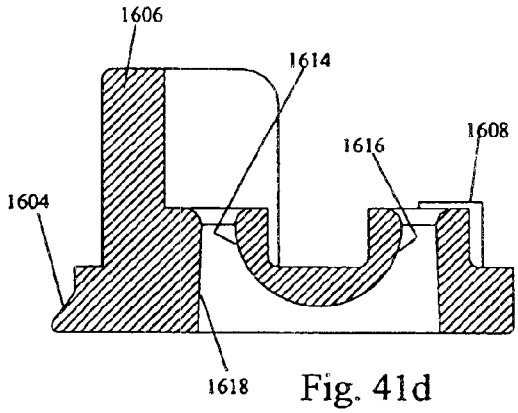
FIG. 41D is a section along the line 41D—41D of FIG. 41A.
Figure 41E:
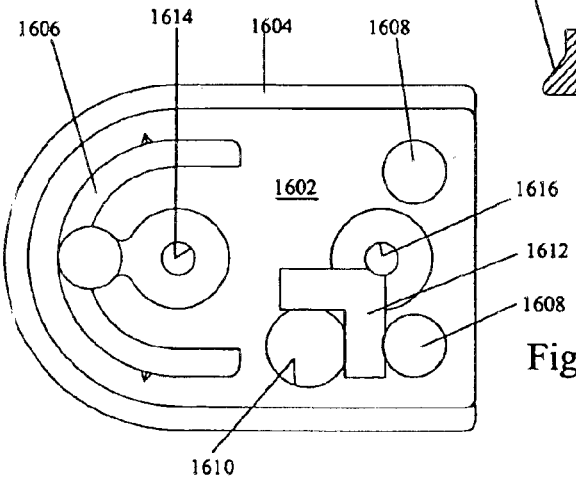
FIG. 41E is a top plan view of the operator bottom bar cap of FIG. 41A.

Referring to FIGS. 40A and 40B, the bottom end cap 150 has one major cavity 1502, which is open at the top to receive the tilt bar 80, and open in the front to receive the plug 160. Two shoulders 1504, extending down along the left and right walls that define the open front, serve to retain the tilt bar 80 in the cavity 1502, preventing the tilt bar 80 from sliding horizontally out of the bottom end cap 150. Internal serrations 1506 internally circumscribe the three walls of the cavity 1502 and engage the plug 160 to keep the tilt bar 80 from sliding vertically out of the bottom end cap 150, as will be described later. A forward projection 1508 extends forward from the lower portion of the bottom end cap 150, and toward the free end 1510 of this projection 1508, are two, outwardly facing, opposed recesses 1512 designed to pivotably engage with the two buttons 1410 in the arms 1408 of the tilt bar bottom attachment 140 of FIGS. 26A–D in the same manner that the top end cap 70 engages with the tilt bar top attachment 60.

Figure 45:
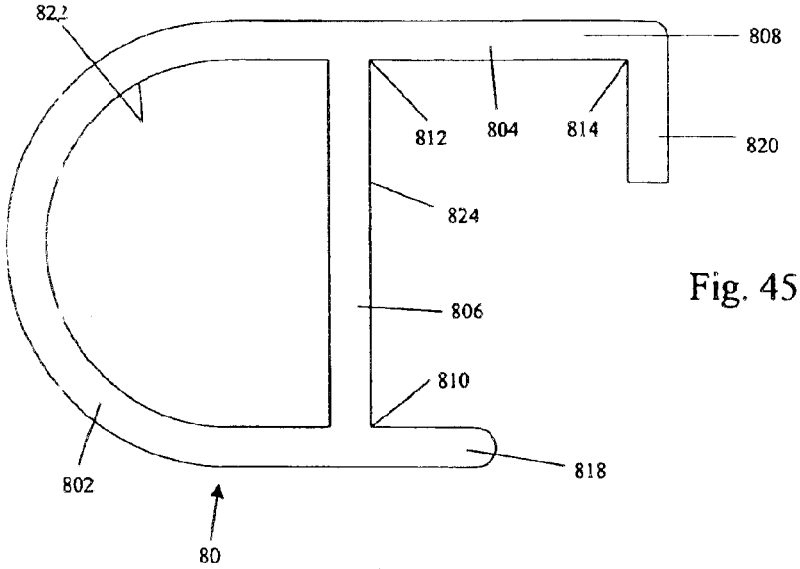
FIG. 45 is an end view of the operator bar or tilt bar extrusion of FIGS. 1–5.
Figure 46A:
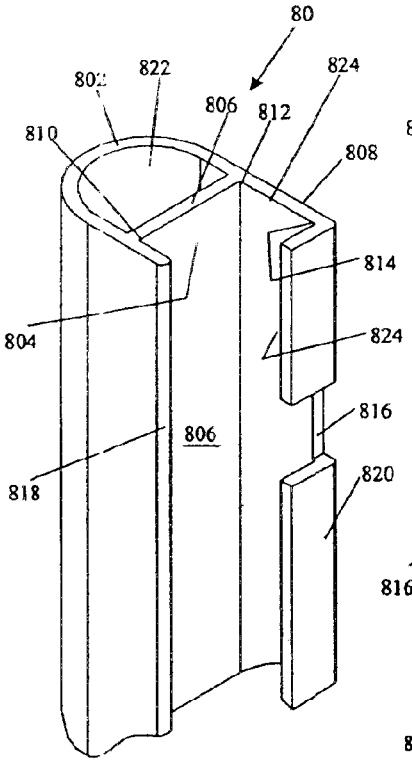
FIG. 46A is a broken away, perspective view of the top portion of the tilt bar extrusion of FIG. 45.
Figure 46B:
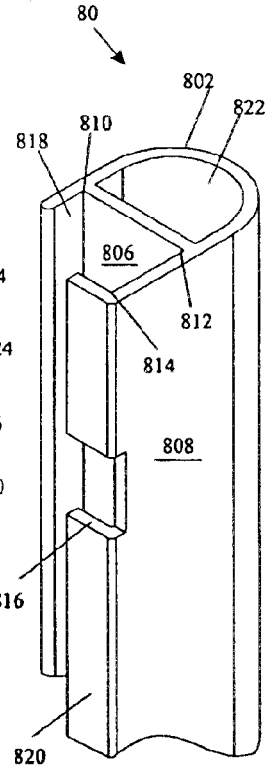
FIG. 46B is another broken away, perspective view of the top end of the tilt bar extrusion, similar to the view of FIG. 46A but showing the other side of the extrusion.
Figure 46C:
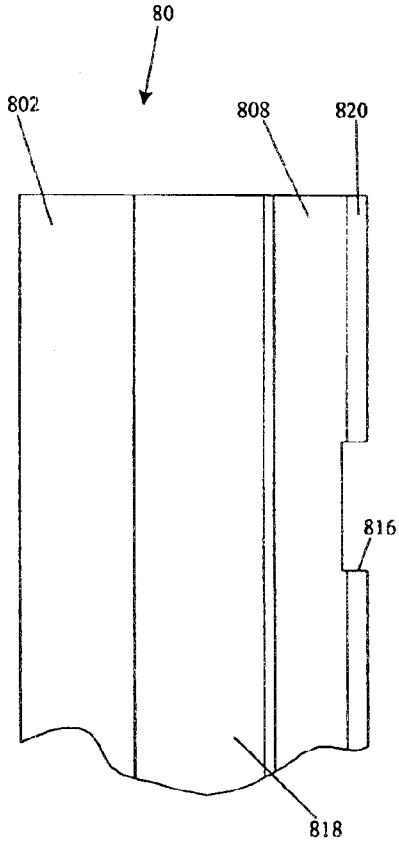
FIG. 46C is a side view of the tilt bar of FIG. 45.

The plug 160 (See FIGS. 41A through 41E) includes a substantially flat bottom portion 1602 with a contour which substantially matches the cross-sectional profile of the tilt bar 80. The edges 1604 of this flat portion flare out so they can slide into the cavity 1504 along the a desired horizontal serration 1506 on the bottom end cap 150 but, once installed along one of these serrations 1506, the plug 160 is locked against vertical movement relative to the bottom end cap 150. An upwardly-directed, semi-circular projection 1606 projects upwardly from the base 1602 and just fits inside the wall 822 of the D-shaped portion 802 of the tilt bar 80 (see FIGS. 45–46C, showing the tilt bar 80). Two pins 1608 project upwardly from the opposite end of the flat portion 1602, and one of those pins 1608 abuts the tilt bar 80 at the bottom of the free end 820 of the leg 808 of the "L" shaped portion 804 of the tilt bar 80. An L-shaped wall 1612 projects upwardly from the base 1602. A countersunk hole 1610 extends through the flat portion 1602 and emerges just inside the L-shaped wall projection 1612. Once the plug 160 is mounted onto the tilt bar 80, a self-tapping screw (not shown) is driven up from the flat portion 1602 and through the hole 1610 emerges and threads itself between the L-shaped wall projection 1612 and one of the two corners 810, 812 of the tilt bar 80, wedging itself between the tilt bar 80 and the L-shaped wall 1612, thereby effectively securing the plug 160 to one end of the tilt bar 80. Two other holes 1614, 1616 and an interconnecting groove 1618 along the bottom of the flat portion 1602 serve to provide a path by which a cord could pass from the D section 802 of the tilt bar 80, down through the hole 1614, along the groove 1618, up through the hole 1616, and then into the "L" shaped section 804 of the tilt bar 80, if desired. (No such cord is used in the embodiments described above.)

Figure 39B:
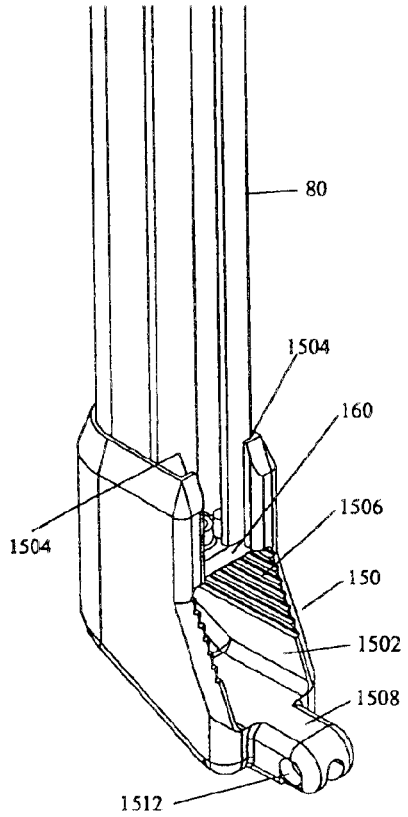
FIG. 39B is the same view as FIG. 39A, but with the parts assembled.
Figure 39C:
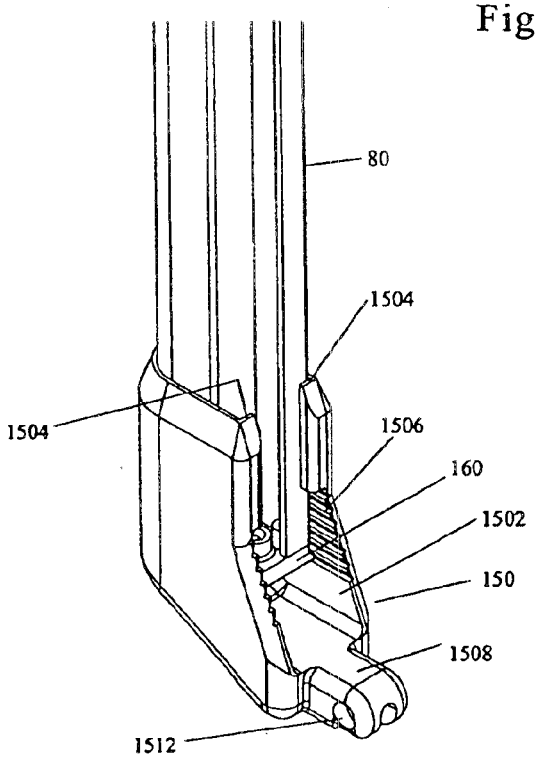
FIG. 39C is the same view as FIG. 39B, but adjusted to a different position.
Figure 39D:
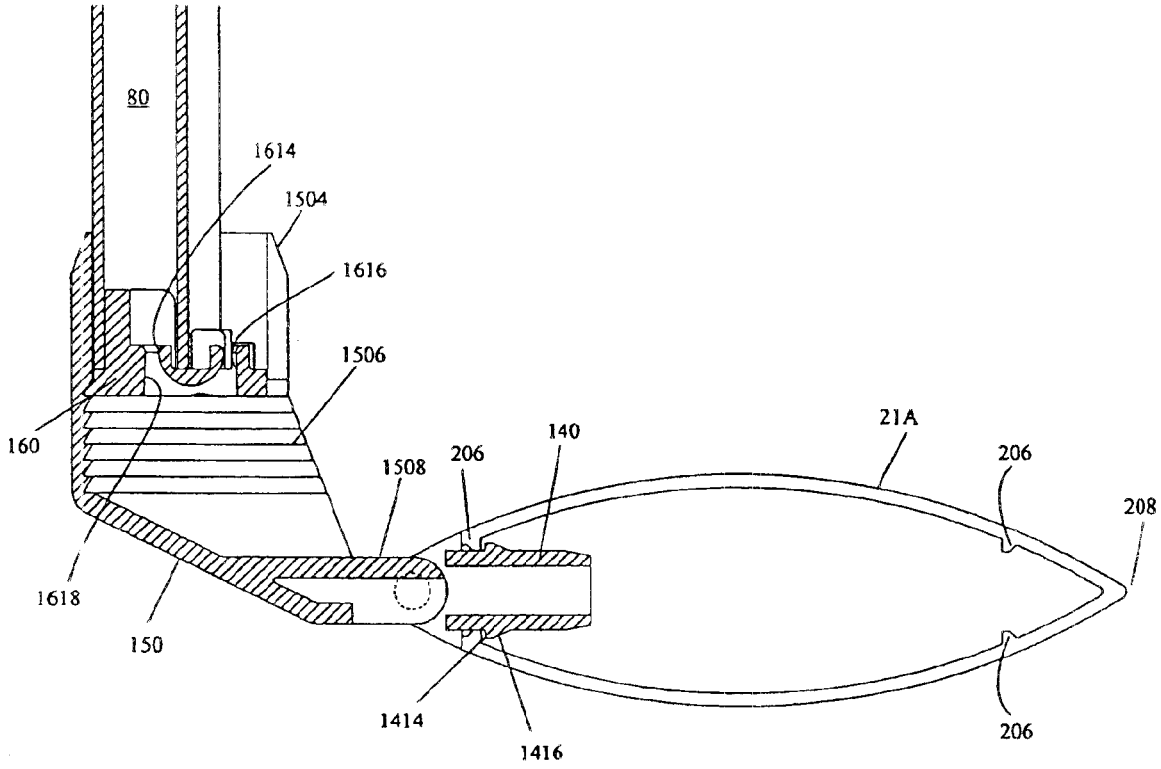
FIG. 39D is a partially broken away section view of the operator bottom bar, adjustable attachment assembly of FIG. 39B assembled into the operator bar at one end and into the bottom rail via a multi-bar bottom attachment at the other end.

To connect the bottom of the tilt bar 80 to the bottom rail 21A of the shutter blind 10B, the plug 160 is inserted into the bottom end of the tilt bar 80, and a self-tapping screw is driven up the counter sunk hole 1610 to secure the plug 160 to the tilt bar 80. This assembly is then inserted into the cavity 1502 of the bottom end cap 150 by sliding the plug 160 horizontally into the open front of the end cap 150 along one of the serrations 1506. The tilt bar 80 snaps past the shoulders 1504 of the end cap 150, as shown in FIG. 39B. If the length of the tilt bar 80 and bottom end cap 150 assembly needs to be shortened or lengthened, the tilt bar 80 and plug 160 are simply pulled forward, out of the end cap 150 and are then reinserted into the end cap 150 with the plug 160 aligned along a different serration 1506. FIG. 39C shows the plug 160 inserted along a lower serration than it was inserted in FIG. 39B, so the tilt bar 80 is effectively shorter in FIG. 39C than in FIG. 39B. FIG. 39D shows is a sectional view showing the entire assembly of the tilt bar 80, the plug 160, the bottom end cap 150, the multi-bar bottom attachment 140 and the bottom rail 21A.

Alternate Embodiment of the Adjustable Bottom End Cap

Figure 42A:
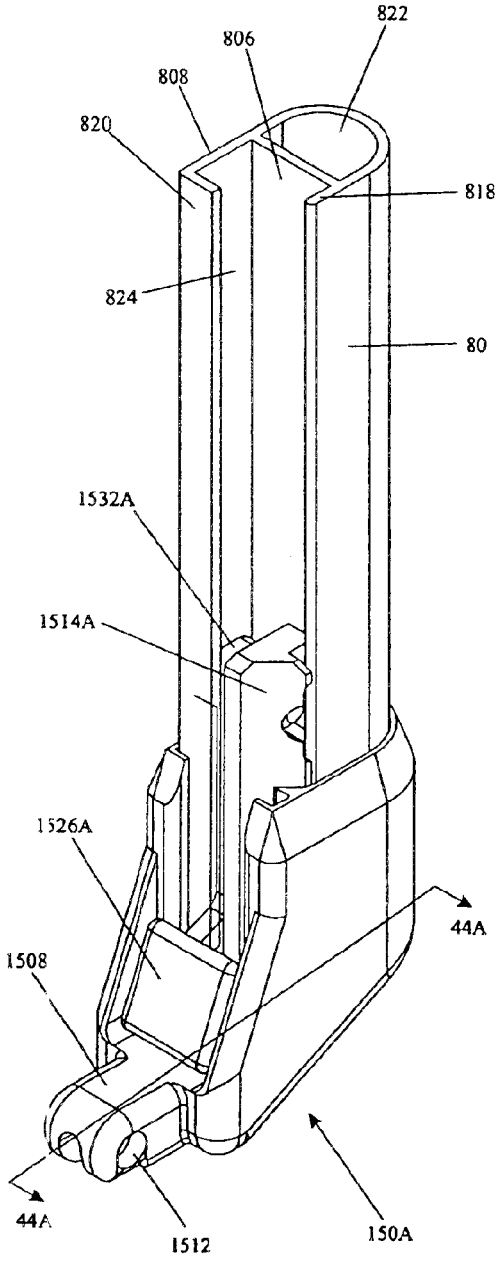
FIG. 42A is a perspective view of a second embodiment of an operator bottom bar, adjustable attachment assembly which may be used instead of the assembly shown in FIG. 39C.
Figure 42B:
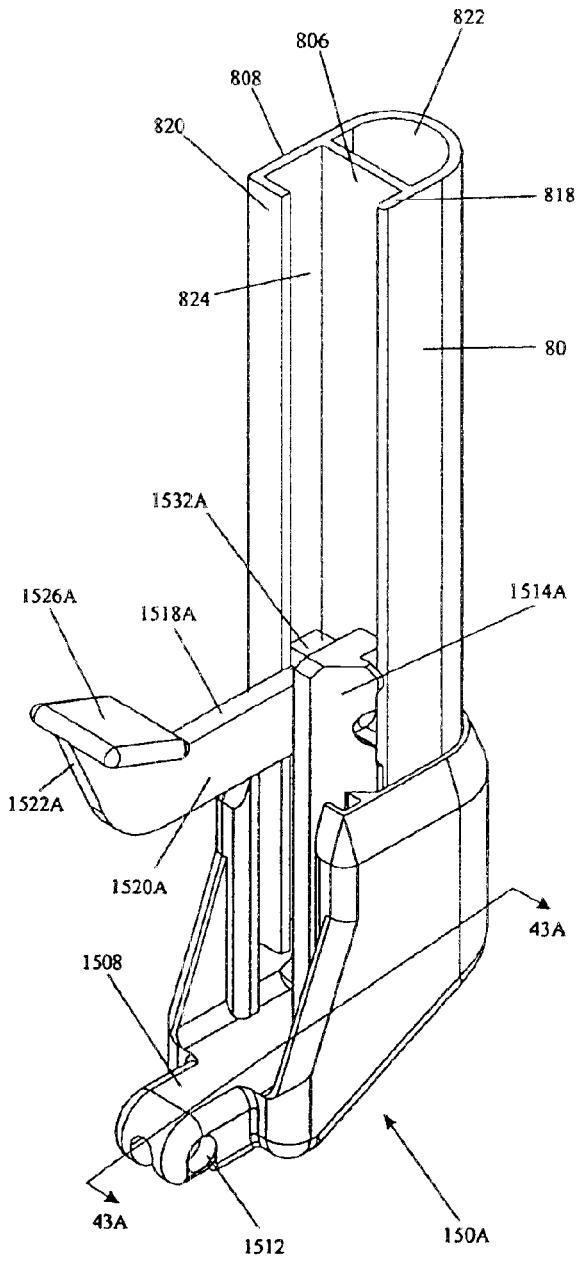
FIG. 42B is the same view as FIG. 42A, but shown in the unlocked position.
Figure 43A:
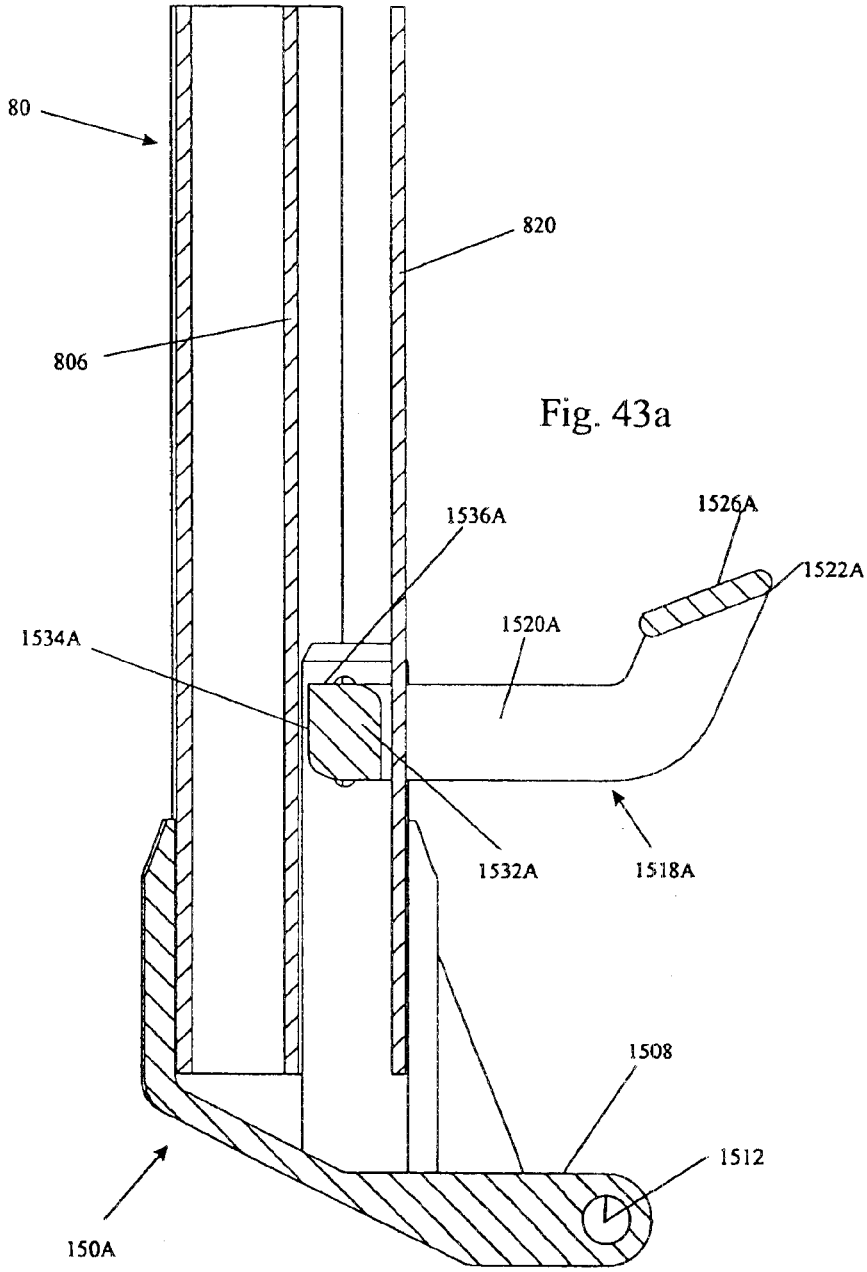
FIG. 43A is a section view along the line 43A—43A of FIG. 42B.
Figure 43B:
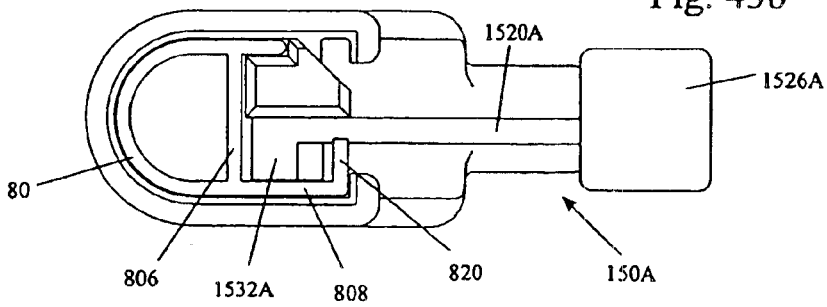
FIG. 43B is a top plan view of FIG. 42B.
Figure 44A:
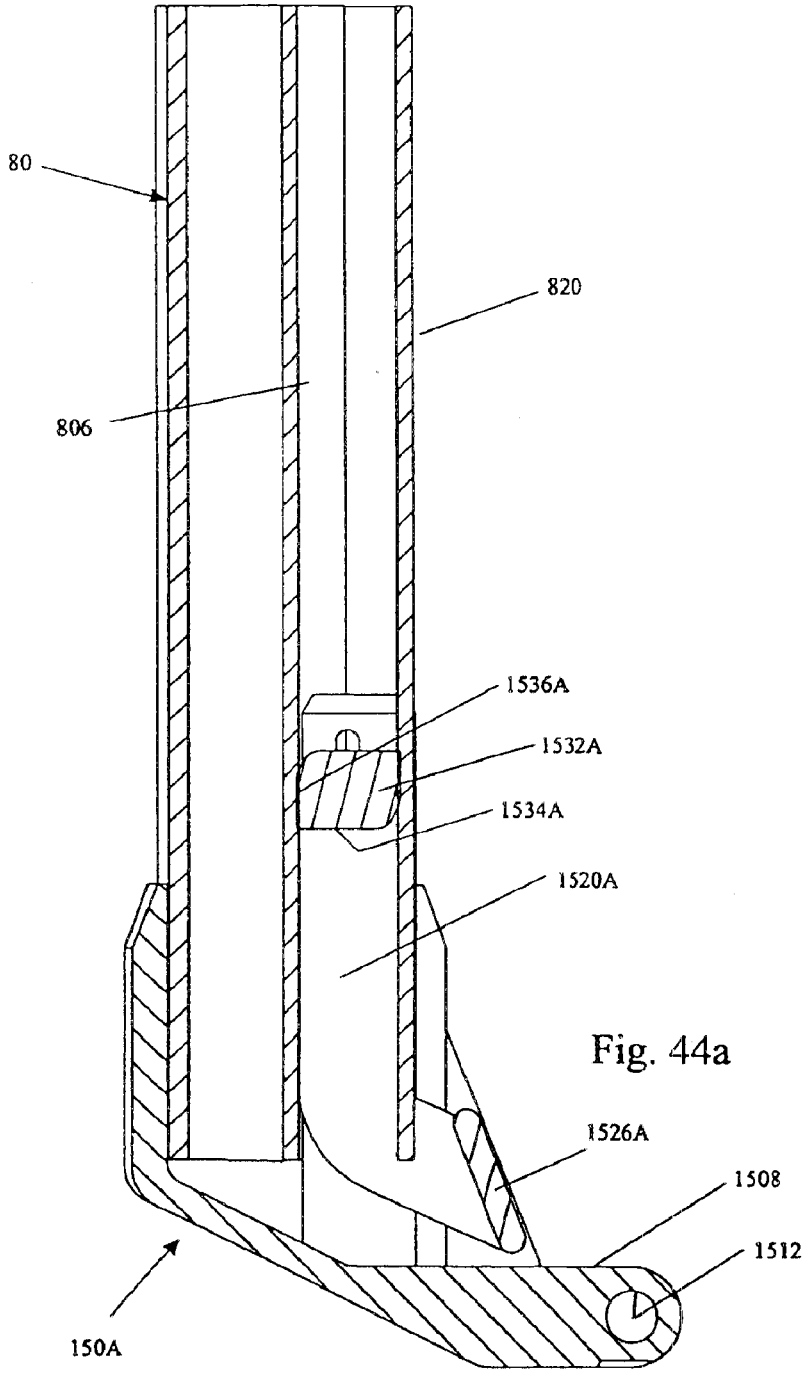
FIG. 44A is a section view along the line 44A—44A of FIG. 42A.
Figure 44B:
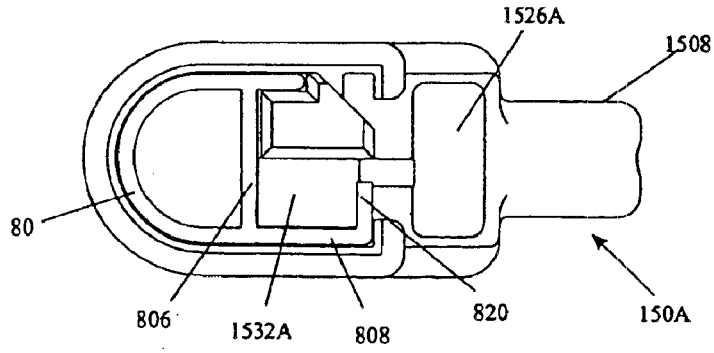
FIG. 44B is a top plan view of FIG. 42A.

FIGS. 42 through 44 show a second embodiment of the adjustable bottom end cap 150A. As may be seen in FIG. 42D, the shape of the bottom end cap 150A is similar to the shape of the bottom end cap 150 of FIG. 40B, the main difference being that there is an upwardly-projecting post 1514A within the cavity 1502A instead of the serrations 1506 of the previous embodiment. The post 1514A has a wing-nut shaped hole 1516A toward the free end of the post 1514A. The wing-nut shaped hole 1516A is a vertical slot, with an enlarged central portion. A lever 1518A (See FIG. 42E) is used to lock the end cap 150A to the tilt bar 80 at various heights. The lever 1518A has an arm 1520A with a first end 1522A and a second end 1524A. The first end 1522A has a flat head 1526A, while near the second end 1524A there is a stub shaft 1528A, with an enlarged nub 1530A extending to one side and a rectangular block 1532A extending from the opposite side. The nub 1530A on the stub shaft 1528A is snapped through the enlarged central hole 1516A on the post 1514A so that the stub shaft 1528A rests in the hole 1516A and the lever 1518A is thus pivotably mounted on the post 1514A of the adjustable bottom end cap 150A. The orientation of the rectangular block 1532A is such that its long-dimension side 1534A is perpendicular to the longitudinal axis of the arm 1520A and parallel to the axis of the stub shaft 1528A. Its short-dimension side 1536A is parallel to the longitudinal axis of the arm 1520A. The long-dimension side 1534A is slightly longer than the width of the leg 808 of the tilt bar 80, and the short-dimension side 1536A is slightly shorter than the width of the leg 808 of the tilt bar 80. Thus, when the lever 1518A is pivoted to the horizontal, unlocked position as shown in FIGS. 42B and 43A, the long-dimension side 1534A is parallel to the longitudinal dimension of the tilt bar 80 and the tilt bar 80 is able to slide up and down along the block 1532A, so the position of the tilt bar 80 relative to the bottom end cap 150A may be adjusted up or down as desired. However, when the lever 1518A is pivoted to the vertical, locked position as shown in FIGS. 42A and 44A, the long-dimension side 1534A is perpendicular to the longitudinal dimension of the tilt bar 80 and thus wedges in place by jamming the block 1532A between the wall 806 and the wall extension 820 of the tilt bar 80. The tilt bar is thus locked in place at the desired location. It should be noted in FIGS. 43A and 44A that the contour of the wedge block 1532A is curved on two opposed corners and square on the other two opposed corners. The curved corners aid in pivoting the lever arm 1520A between locked and unlocked positions, and the square corners help lock the block 1532A in place. In this arrangement, there is no plug on the bottom of the tilt bar 80 as there was in the previous embodiment.

The Mounting Bracket

Figure 50A:
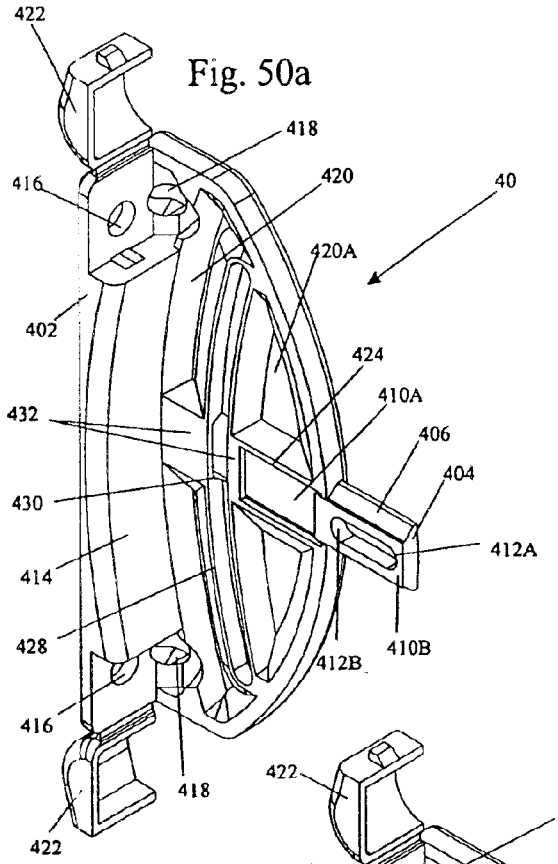
Figure 50B:
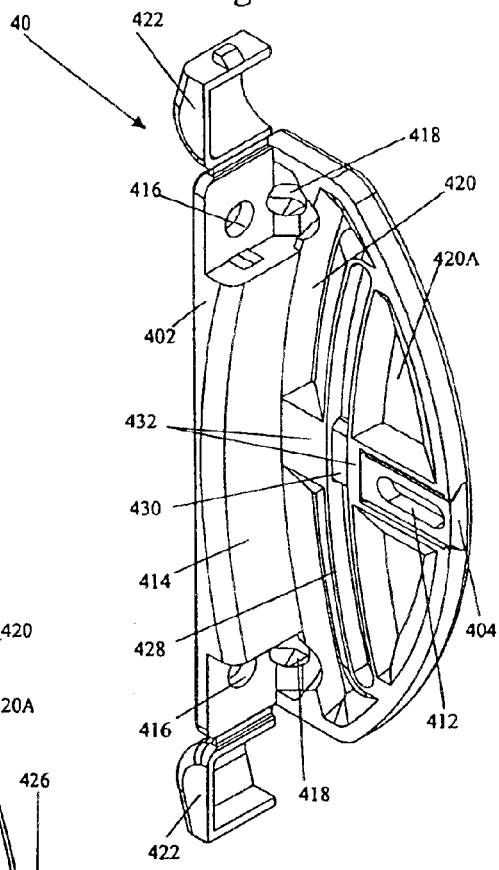
Figure 50C:
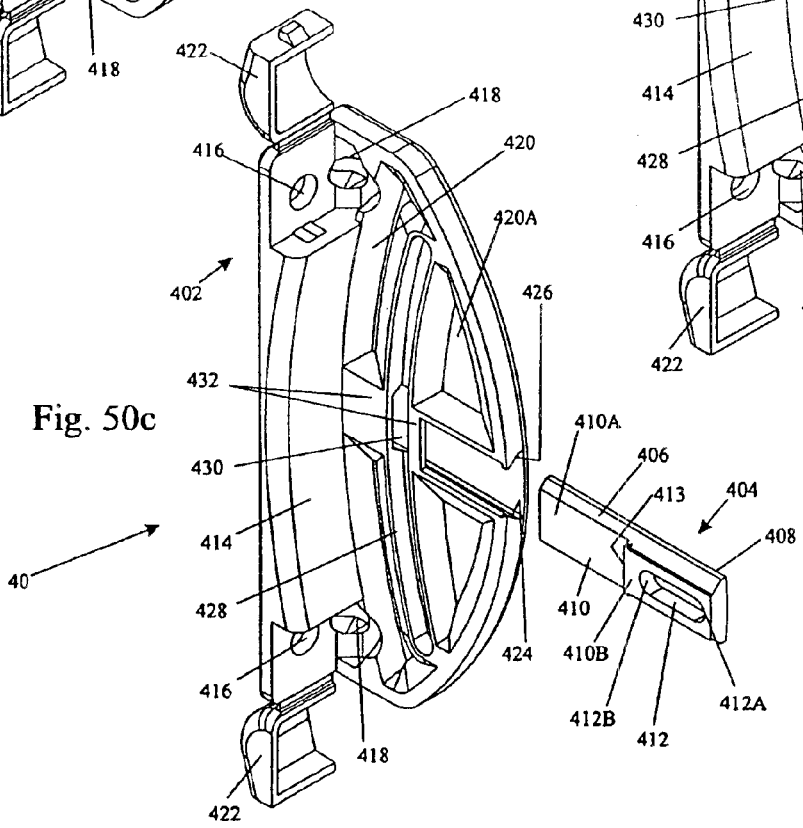

FIGS. 50A through 50C show the sliding-slot mounting bracket 40 of FIGS. 1A and 1B. This mounting bracket 40 includes a housing 402 and a sliding-slot block 404. The block is substantially rectangular with slightly tapered edges 406, a flat outer surface 408 and a two-level inner surface 410. The inner surface 410 has a shoulder or step 413 such that one part 410A of the block is thinner and another part 410B is thicker. The thicker portion 410B defines an elongated, slotted cavity 412, with the longitudinal dimension of the slotted cavity 412 substantially parallel to the longitudinal dimension of the block 404. The slotted cavity 412 has two rounded ends 412A, 412B, the purpose of which will be described later.

The mounting bracket housing 402 is a substantially □L□ shaped bracket, having a shorter leg 414 and a longer leg 420. The shorter leg 414 has two holes 416 for securing the bracket 40 to a frame via screws (not shown). Two other holes 418, located close to the first set of holes 416 but through the longer leg 420, are also for mounting the bracket 40 to the frame. This arrangement allows for flexibility in the mounting of the bracket 40, either for "inside" mounting (using the holes 418) or for "outside" mounting (using the holes 416). Hinged caps 422 snap in place to conceal the mounting screw heads once the bracket 40 is secured to its frame.

The inner surface 420A of the longer leg 420 of the bracket housing 402 has a first slotted opening 424 running along a substantially horizontal, front-to-back axis (See FIG. 50C), with slightly tapered sides 426 which slidably engage the sides of the block 404. The block 404 is thus able to slide in and out along this first slotted opening 424 along its longitudinal dimension in a substantially front-to-back horizontal direction. A second slotted opening 428, also on the inner surface 420A of the longer leg 420, defines an arc. The first slot 424 is a portion of a radius of the arc, which contacts the arcuate opening 428 at about its midpoint. Bridges 432 along the walls of the second slotted opening 428 at the intersection point 430 with the first slotted opening 424 ensure that any pin riding along this second slotted opening 428 will not stray into the first slotted opening 424, as will be described later.

The assembly and operation of the mounting bracket 40 is as follows: Once the mounting bracket 40 has been mounted, via screws or other suitable attachment means, to a frame, and the block 404 is sliding in its first slotted opening 424, the head rail 20 of FIGS. 1A and 1B, with the end caps 30, is mounted onto the bracket 40. Referring to FIG. 16A, the stub shaft 338B of the edge pin 306 of the end cap 30 is inserted in the second slotted opening 428, while the stub shaft 338A of the central pin 306 is inserted in the slotted cavity 412 of the block 404. This mounting process is repeated at both ends of the head rail 20, so that both ends of the head rail 20 are mounted onto their respective mounting brackets 40.

When the head rail 20 is in the tilted open position (as shown in FIGS. 1A and 84B), the mounting bracket 40 is in the position depicted in FIG. 50A, with the block 404 in the fully extended position. The central stub shaft 338A of the end cap 30 is in the slotted cavity 412 and pushing against the rounded end 412A of the slotted cavity 412. The edge stub shaft 338B of the end cap 30 is in the slotted opening 428 at the intersection point 430 of the first and second slotted openings 424, 428.

As the head rail 20 (and therefore all the louvers 14 and 21 of the shutter blind 10) is tilted closed, room side down, moving toward the position shown schematically in FIG. 84A, the central stub shaft 338A first moves horizontally towards the second rounded end 412B of the slotted cavity 412, while the edge stub shaft 338B moves up along the slotted opening 428. This motion encounters relatively little frictional system resistance until the central stub shaft 338A actually makes contact with the second rounded end 412B of the slotted cavity 412. At this point, the head rail 20 is tilted closed at approximately 45 degrees.

Further tilting closed requires that the central stub shaft 338A push against the second rounded end 412B of the slotted cavity 412 to push the block 404 horizontally along the first slotted opening 424, while the edge stub shaft 338B continues to ride up along the second slotted opening 428. Eventually, when the head rail 20 is in the fully tilted closed position, the mounting bracket 40 is in the position depicted in FIG. 50B, where the block 404 is fully retracted inside the slotted opening 424, and the shoulder 413 on the surface 410 of the block 404 is in contact with the bridge 432 of the housing 402. This provides a stop so that the head rail 20 can not be "over tilted".

As the operator now begins to tilt the head rail 20 from the fully tilted closed position of FIG. 84A toward the open position of FIG. 84B, the central stub shaft 338A first slides away from the second rounded edge 412B and toward the first rounded edge 412A in the slotted cavity 412, while the edge stub shaft 338B moves down along the slotted opening 428. This motion encounters relatively little frictional system resistance until the first stub shaft 338A actually makes contact with the first rounded end 412A of the slotted cavity 412. At this point, the head rail 20 is tilted open at approximately 45 degrees.

Further tilting open of the head rail 20 requires that the central stub shaft 338A push against the first rounded end 412A of the slotted cavity 412 to push the block 404 forward along the first slotted opening 424, while the edge stub shaft 338B continues to ride down along the second slotted opening 428. Eventually, when the head rail 20 is in the fully tilted open position, the mounting bracket 40 is back in the position depicted in FIG. 50A, where the block 404 is fully extended, and the edge stub shaft 338B is in contact with the bridge 432 of the housing 402. This provides a stop so that the head rail 20 cannot simply slide out of the mounting bracket 40.

The action is repeated in substantially the same manner when tilting the shutter blind 10 closed with the room side up (to the position shown schematically in FIG. 84C), except that the edge stub shaft 338B rides down along the second slotted opening 428 instead of riding up along the slotted opening 428.

Referring now to FIGS. 84A, 84B, and 84C, it is interesting to note that, in this preferred embodiment, the central stub shaft 338A is aligned with the elongated, centroidal pivot axis of the head rail 20. The head rail 20 pivots about this centroidal axis, which remains at the same height (the height of the slot 424) as the head rail 20 is tilted open or closed. Thus, as the head rail 20 is tilted open or closed, its centroid remains at the same horizontal level, but is displaced backward, toward the short leg 402 of the mounting bracket 40 (and thus toward the frame on which the bracket 40 is mounted) when the head rail is tilted closed (See FIGS. 84A and 84C), and is displaced forward, away from the short leg 402 of the mounting bracket 40 when the head rail is tilted open (See FIG. 84B). Since there is no vertical component to the displacement of the centroid when tilting the head rail 20, the effort to tilt the head rail 20 is minimized because the head rail 20 and the rest of the louvers 14, 21 which are part of the shutter blind 10, need not be raised or lowered during the tilting process. It is also interesting to note that the system friction is generally sufficient to keep the shutter blind 10 tilted in the desired position without the need for additional braking mechanisms, especially if the head rail 20 has internal weights 236 to substantially cancel out any offsetting weights in the shutter bind system, as has already been described.

Figure 50D:
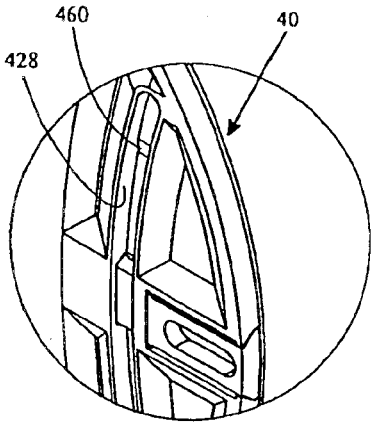
Figure 50E:
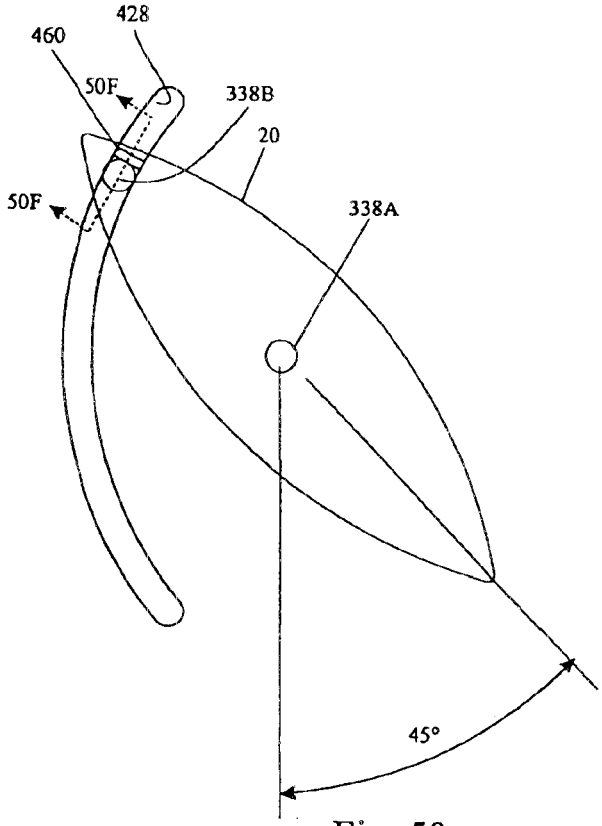
Figure 50F:
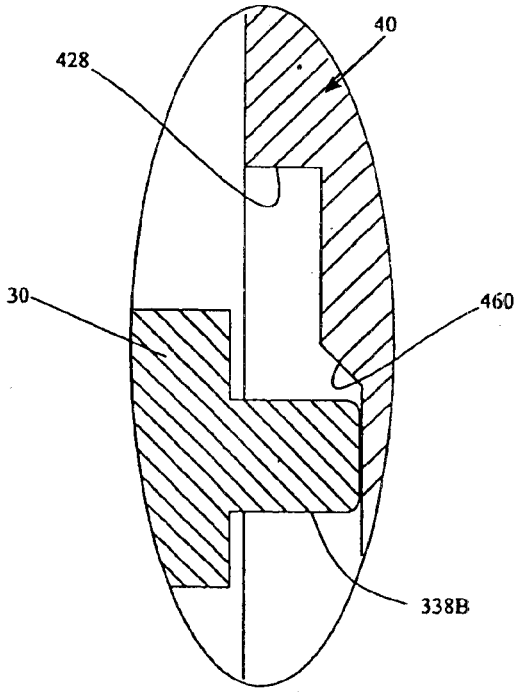

In some instances it is preferable, for aesthetic reasons, to tilt the blind closed approximately 45 degrees, room side down, before the blind is raised. This is accomplished automatically in this design by having the amount of force required to tilt the blind down to the 45 degree point be less than the force required to raise the blind, and then artificially raising the amount of force required to tilt beyond the 45 degree point so that the amount of force required is greater than that required to raise the blind. This is accomplished in the present design (See FIGS. 50D, 50E, and 50F) by placing a ramped ridge 460 in the second slotted opening 428 at the point corresponding to where the stub shaft 338B on the end cap 30 of the head rail 20 is located when the head rail 20 is tilted closed, room side down, at approximately 45 degrees. Thus, when the hand control 90 is pulled down to raise the louvers 14 in the blind 10, via the lift cord 12, which is connected to the hand control 10 and tied off at the top end cap 70A (as is described in more detail later), the head rail 20 is first tilted closed, room side down, until the stub shaft 338B of the end cap 30 reaches the ramped ridge 460 in the second slotted opening 428. At this point, corresponding to the head rail 20 being in the tilted closed position approximately 45 degrees, the stub shaft 338B will encounter increased resistance to travel along the second slotted opening 428, and, since this resistance is greater than the force required to raise the blind, the end cap 30, head rail 20, and the tilt bar 80 all come to a stop while the hand control continues to travel downwardly, thus raising the louvers 14. For complete closure of the louvers 14 without raising the louvers 14, pulling down on the tilt bar 80 results in the stub shaft 338B riding up the ramped ridge 460 and then continuing along the path of the second slotted opening 428.

Alternate Embodiments of the Mounting Bracket

Figure 47A:
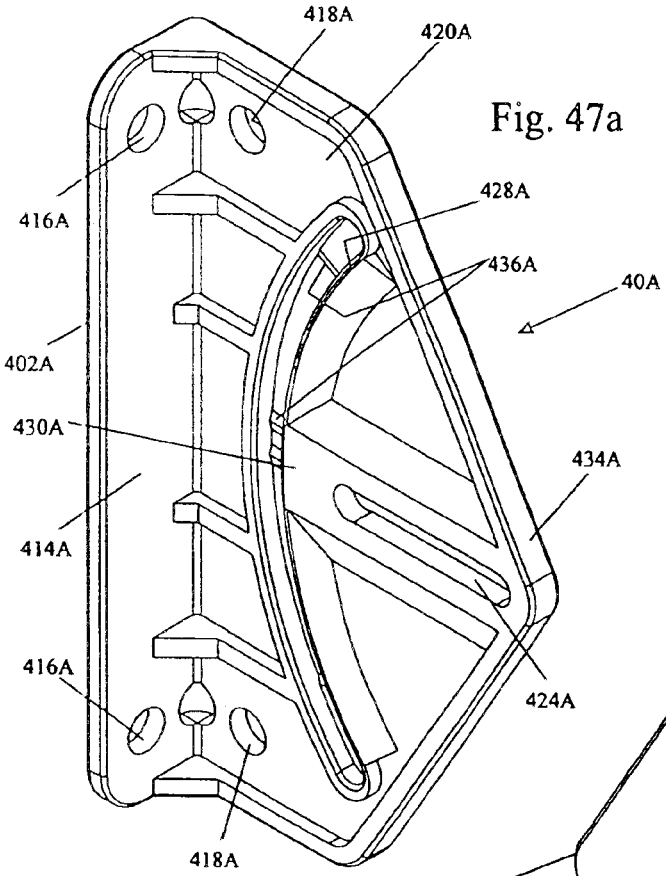
Figure 47B:
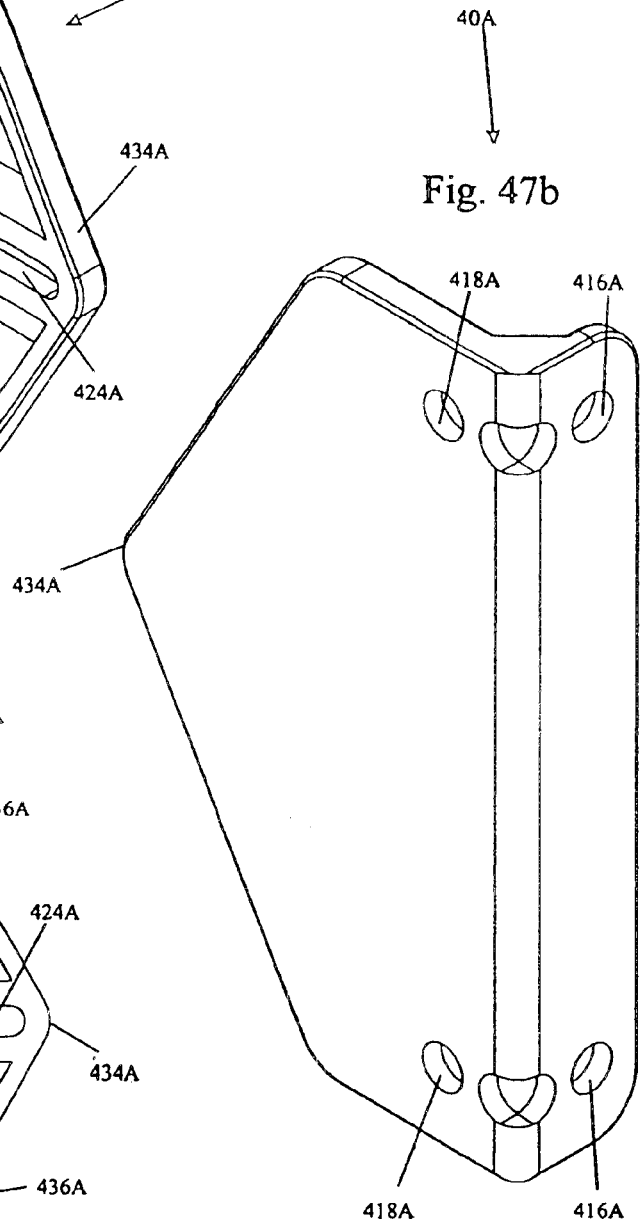
Figure 47C:
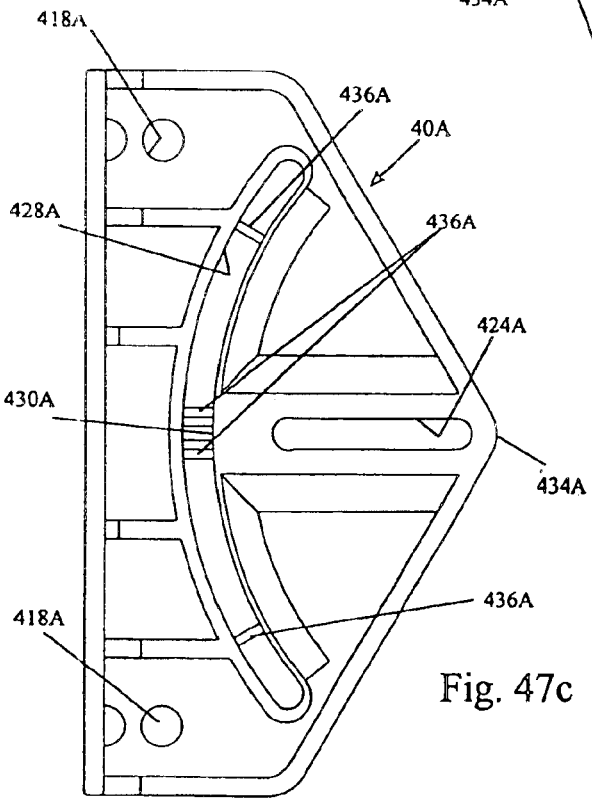

FIGS. 47A through 47C show a second embodiment of a mounting bracket 40A as shown in FIGS. 2A and 2B. This bracket 40A is very similar to that of the first preferred embodiment 40, except that it does not have a sliding block 404. Instead of a rounded front end, this embodiment 40A has a □V□ shaped front end 434A, which projects out further than the front end of the first embodiment, and the slotted opening 424 is replaced by a slotted cavity 424A. The central stub shaft 338A is inserted into this slotted cavity 424A, and the edge stub shaft 338B is inserted into the arcuate cavity 428A. Since there is no sliding block 404, there is no need for bridges 432 to span the first slotted opening 424 at the point 430 where it meets with the second slotted opening 428. The slotted cavity 424A extends in a front-to-back horizontal direction, and, if it were extended long enough, it would intersect the second slotted opening 428A in the same place 430A where the first and second slotted openings 424, 428 meet in the first embodiment 40. Small ridges or ribs 436A are located along the arc defined by the second slotted opening 428A to create additional resistance at desired points along the slide path of the edge stub shaft 338B. In this preferred embodiment, the desired points correspond to the fully open, 45 degree tilted closed room side up, and 45 degree tilted closed room side down positions of the head rail 20.

Figure 48A:
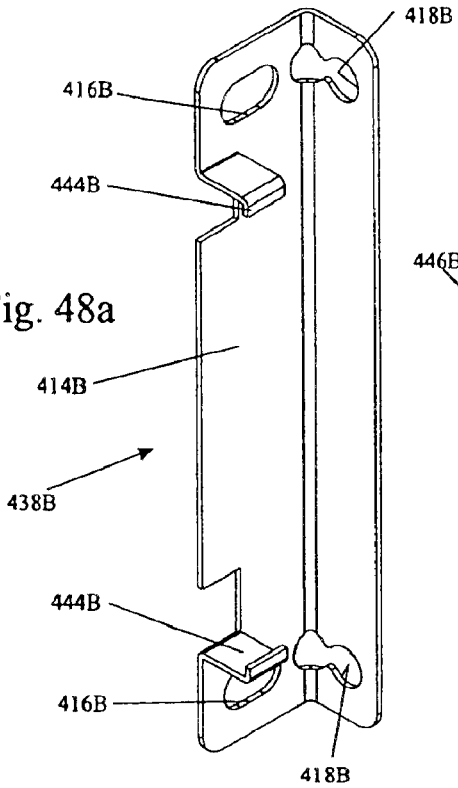
Figure 48B:
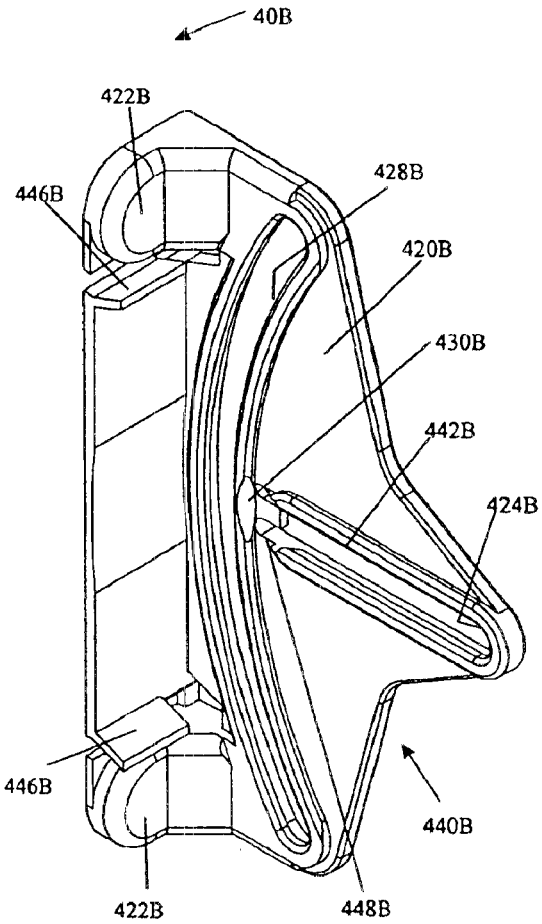
Figure 48B:
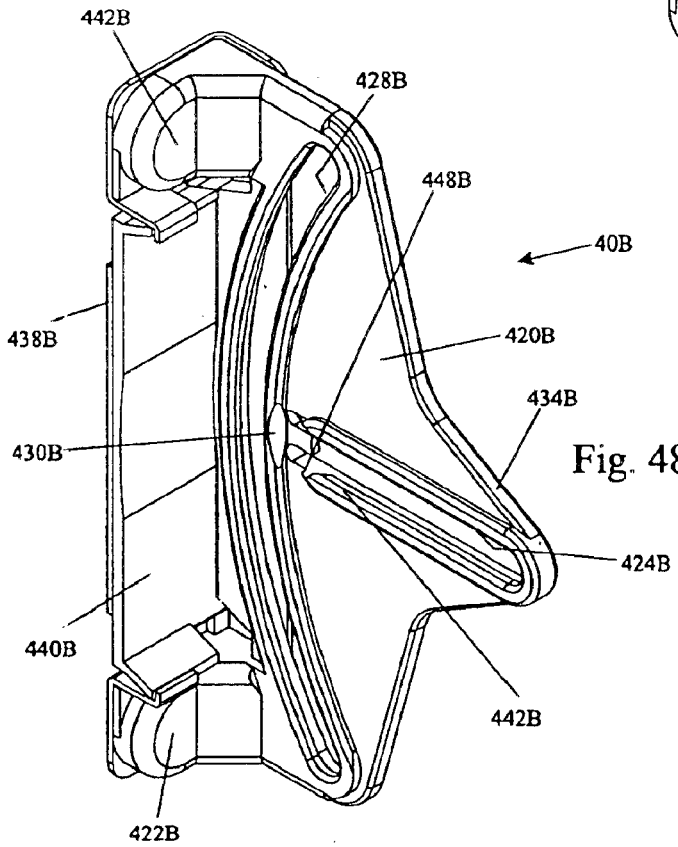

FIGS. 48A, and 48B show a third embodiment of a mounting bracket 40B. This bracket 40B is very similar to the second embodiment 40A. The main differences are that this embodiment 40B has a two piece bracket 438B, 440B, the nose 434B is more pointed than the nose 434A, and the slotted cavity 424B has a lip 442B to retain the shaft of the fixed pin end cap 30A or the floating pin end cap 30B.

The first part of the bracket is as screw-in base 438B, with holes 416B for "outside" mounting and holes 418B for "inside" mounting. Two flexible fingers 444B project horizontally from a leg 414B of the bracket 438B. The snap-on bracket 440B is also "L" shaped and has two projecting walls 446B to engage the flexible fingers 444B so as to secure the snap-on bracket 440B to the screw-in bracket 438B. Two covers 422B on the snap on bracket 440B cover the screw holes 416B and 418B to conceal the screws which secure the bracket 40B to the frame.

The front-to-back, radial slotted cavity 424B has a lip 442B around most of its outer edge. Only a small discontinuous section 448B is found close to the point 430B where the slotted cavity 424B intersects the second slotted opening 428B. This discontinuous section 448B allows for the insertion of the central pin 340 of the end cap 30A (See FIG. 20F). Once inserted in the slotted cavity 424B, the flange 344 on the pin 340 is trapped behind the lip 442B so it cannot be pulled out from the slotted cavity 424B unless the pin 340 is brought back to the small discontinuous section 448B. The operation of this mounting bracket 40B is otherwise identical to that of the first embodiment 40.

Figure 49:
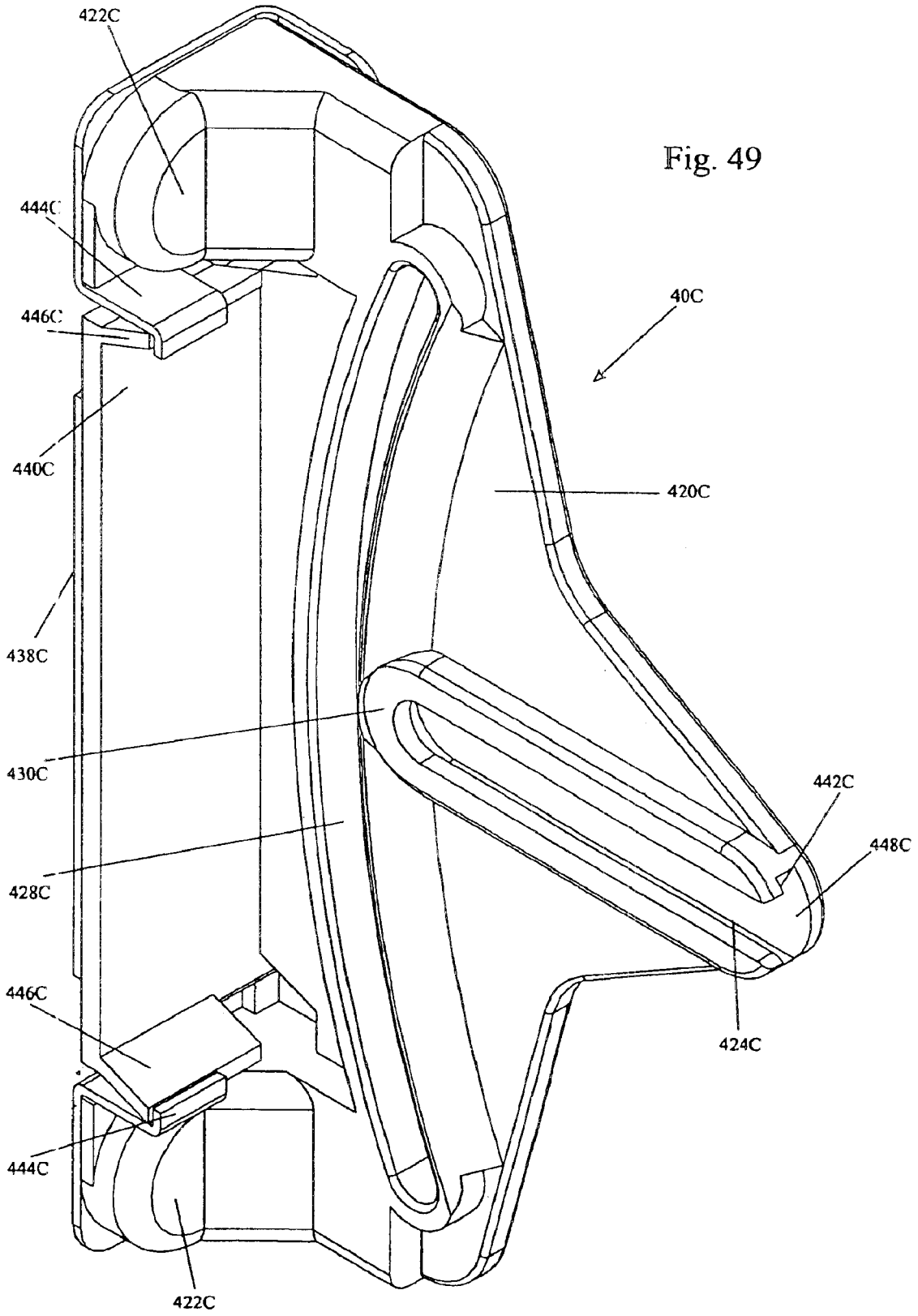

FIG. 49 depicts a fourth embodiment of a mounting bracket 40C. This embodiment is almost identical to the third embodiment 40B, except that the slotted cavity 424C has the small discontinuous section 448C at the front end of the bracket 40C, at the opposite end from the point 430C where the front-to-back slotted cavity 424C intersects the arcuate second slotted opening 428C. As in the case of the third embodiment 40B, once the pin 340 is inserted in the slotted cavity 424C, the flange 340 is trapped behind the lip 442C. The operation of this mounting bracket 40C is otherwise identical to that of the second embodiment 40A.

FIG. 51 shows a fifth embodiment of a mounting bracket 40D as it is mounted to an end cap 30C. This mounting bracket 40D resembles an old style bottle opener with a handle 450D at one end and a kidney-shaped cavity 452D at the other end. The handle 450D has two mounting holes 416D for securing the bracket 40D to a frame via screws (not shown). The cavity 452D has internal gear teeth 454D against the side of the cavity 452D opposite the handle 450D. The end cap 30C is similar to the end cap 30 described earlier except that, instead of the springs 304 and pins 306, this embodiment 30C has a single externally geared wheel 456D mounted along the centroidal axis of the head rail 20. This geared wheel 456D fits inside the cavity 452D of the mounting bracket 40D, and the teeth 458D on the geared wheel 456D mesh with the internal gears 454D in the cavity 452D. The geared wheel 456D is non-rotatably secured to the end cap 30C so that, when the head rail 20 is tilted together with its end caps 30C, the geared wheel 456D is forced to travel along the arc defined by the path of the internal gears 454D in the cavity 452D of the bracket 40D.

Assuming that the head rail 20 (represented by the end cap 30C in FIG. 51) is in the tilted closed position, then, as the head rail is tilted open, the geared wheel 456D meshes with the internal gears 454D. Thus, as the head rail pivots along its centroid, the centroid is displaced both vertically and horizontally, following the arc defined by the path of the internal gears 454D in the cavity 452D of the bracket 40D. Thus, the motion imparted by this mounting bracket 40D is similar to the motion imparted by the previous embodiments 40, 40A, 40B, and 40C in that the centroid of the head rail 20 is displaced horizontally, but it differs from those previous embodiments in that it also imparts a vertical component to the-displacement. If the externally geared wheel (or spur gear) 456D has pitch diameter equal to four times the desired linear travel of the centroid of the head rail 20, then the centroid accomplishes the desired linear travel while the head rail 20 and louvers 14 rotate through 90 degrees of arc, and does so without the need for a rear pin on the end cap 30C or a second slot on the mounting bracket 40D.

FIG. 51A shows a sixth embodiment of a mounting bracket 40E as it is mounted to an end cap 30E. This mounting bracket 40E is very similar to the fourth embodiment 40D described earlier, except the centroid of the head rail 20 is not displaced vertically as the head rail 20 tilts open or closed. A cavity 452E on the mounting bracket 450E has internal gear teeth 454E against the lower side of the cavity 452E. The end cap 30E is similar to the end cap 30C described earlier except that the single externally geared wheel 456E is not geared all the way around. This geared wheel 456E fits inside the cavity 452E of the mounting bracket 40E, and the teeth 458E on the geared wheel 456E mesh with the internal gears 454E in the cavity 452E. The geared wheel 456E is non-rotatably secured to the end cap 30E so that, when the head rail 20 is tilted together with its end caps 30E, the geared wheel 456E is forced to travel along the arc defined by the path of the internal gears 454E in the cavity 452E of the bracket 40E. Since these internal gears 454E are in a straight horizontal rack, there is no vertical component of motion imparted to the head rail 20 as the head rail 20 is tilted open or closed.

As may be appreciated, the head rail 20 and louvers 14 of the embodiment 40E depicted in FIGS. 51A and 51B may only be tilted closed room side up. FIGS. 52C and 51D depict a very similar embodiment 40F, wherein the internal gear teeth 454F are located against the upper side of the cavity 452F, and the head rail 20 and louvers 14 may only be tilted closed room side down.

FIGS. 51E–51G schematically depict an eighth embodiment of a mounting bracket 40G which may be used instead of any of the previously described embodiments 40–40C with only minor modifications to the end caps 30. The second slotted opening 428 (See FIG. 50A) found in the mounting bracket 40 is eliminated and replaced with a pivot linkage 462G which is pivotably secured at a first end to the end cap 30 at the same place 338E where the stub shaft 338B of the pin 306 is found on the end cap 30. The second end of the pivot linkage 462G is pivotably secured at a point 432G on the mounting bracket 40G which is in line with and proximate the rear end of the first slotted opening 424. The pivoting of this pivot linkage about its two pivot points 338G, 432G guides the rear pin 306 of the end cap 30 to tilt the head rail 20 as the centroid of the head rail 20 traverses toward the room side when being tilted open and away from the room side when being tilted closed.

The Hand Control for Raising and Lowering the Shutter Blind

The hand control 90, which is mounted on the tilt bar 80, as shown in FIG. 1A, is used to raise and lower the louvers 14, 21 of the shutter blind 10. It slides up and down the tilt bar 80, and it keeps the lift cords 12 untangled and concealed within the cavity 824 of the tilt bar 80 (See FIG. 45 for the details of the tilt bar 80).

Referring to FIG. 52, the hand control assembly 90 includes a wrap-around housing 902, a control button 904, a control pulley pin 906, a control pulley 908, a control locking pin 910, and a spring 912. Depressing the control button 904, retracts the locking pin 910, permitting the hand control assembly 90 to slide up and down along the tilt bar 80, while releasing the control button 904 permits the spring 912 to extend the pin 906, pressing the pin 906 into the wall 818 of the tilt bar 80 and locking the hand control assembly 90 in place on the tilt bar 80. FIG. 60A shows the hand control assembly 90 in the locked position, and FIG. 60C shows the hand control assembly 90 with the control button 904 depressed, so the hand control assembly 90 can be slid up and down the tilt bar 80.

Referring to FIGS. 54A through 54D, the housing 902 is a substantially tunnel-shaped piece with a first, longitudinal, arched cavity 914, which is open at both ends 916, 918. This cavity 914 is sized and shaped to envelop the □D□ shaped section 802 of the tilt bar 80. The arch-like cavity 914 has a first side 920 and a second side 922. A rear wall 924 extends from the rear of the first side 920 toward the second side 922 but does not entirely bridge the distance, leaving a small gap 926, which allows the passage of the leg 808 of the tilt bar 80 (as shown in FIG. 60A). The rear wall 924 includes an inwardly-directed, rectangular projection 928. Two semicircular cavities 930 in the rear surface of the rear wall 924 extend into the projection 928. A cut-away portion in the rear wall 924 forms a large gap 934. The cut does not extend completely through the rear wall, however, as it leaves a bridge 936. A small recess 938 is located on the center of the bridge 936. There are also two small shaft-receiving recesses 940 on the rear wall 924 at the edges of the cut-away portion 934, which receive the shafts for the control button, as will be described later. A space 942 extending the full length of the housing 902 between the side 920 and the rectangular projection 928 (As shown in FIG. 54B) receives the wall extension 818 of the tilt bar 80, as shown in FIGS. 60A and 60C.

The "J" shaped control button 904 (See FIGS. 55A and 55B) pivotably mounts on the control handle 902, with the shafts 944 of the control button 904 received in the recesses 940 in the back wall 924. The inner surface and outer surface of the control button 904 conform to the shape of the control bar housing 902, so, for example, the control button 904 defines a recess 942A which matches the recess 942 on the housing 902, and this recess 942A also receives the wall extension 818 of the tilt bar 80 (see FIG. 60C). Between the two stub shafts 944 and toward the end of the "hook" of the "J" there is a hole 946 with a countersunk section 948 to locate the locking pin 910, as will be described later. On the outside of the long leg 947 of the "J" there is a thumb rest 949.

FIG. 56 shows the control pulley pin 906 which includes an elongated semi circular base 950 with a countersunk circular recess 952 and a projecting pin 954 extending from the middle of the countersunk circular recess 952 and perpendicular to the base 950. The base 950 is sized and shaped to fit inside one of the elongated semi-circular cavities 930 of the housing 902. The pin 954 extends through a center opening 956 in the pulley 908 (See FIGS. 57A and 57B) and into a circular recess 931 in the cavity 930, and this pin and pulley assembly then rests inside one of the semi-circular cavities 930 of the housing 902.

The locking pin 910 (See FIGS. 58A and 58B) has a sharp first end 958, a second rounded end 960, and a flange 962 is fixedly secured approximately half-way between the two ends 958, 960 of the locking pin 910. The sharp end 958 of the locking pin 910 goes through the hole 946 of the control button 904 such that the sharp end 946 protrudes into the recess 942A, and the flange 962 rests in the countersunk hole 948. A spring 912 (See FIG. 59) slides over the rounded end 960 of the locking pin 910, and when the control button 904 is assembled to the housing 902, the rounded end 960 of the locking pin 910 rests in the depression 938 of the housing 902, with the spring 912 trapped and compressed between the flange 962 of the locking pin 910 and the depression 938 of the housing 902. As may be appreciated from the sectional view of FIG. 60A, the compressed spring 912 pushing (at one end) against the indentation 938 on the bridge 936 and (at the other end) against the flange 962, is also pushing the sharp point 958 of the locking pin 910 into the wall extension 818 of the tilt bar 80, causing the hand control 90 to lock in place. When the hand control is grabbed by the user to raise or lower the blind, the thumb naturally comes to rest on the thumb rest 949 of the control button 904. This action compresses the spring 912, and releases the sharp end 958 of the locking pin 910 from its bite on the wall extension 818 of the tilt bar 80 (See FIG. 60C). The hand control 90 is then free to slide up and down along the tilt bar 80 until the control button 904 is released, when the spring 912 again forces the sharp end 958 of the locking pin 910 to grip onto the extension 818 of the tilt bar 80, locking the hand control 90 in this new location.

To assemble and use the hand control 90 as shown in FIG. 1A, the lift cords 12 are routed from the front and rear sides of the bottom rail 21, up through the cord glides 50 into the head rail 20 and out of the head rail 20 via the tilt bar top attachment 60, through the third and first cavities 712, 708 of the top end cap 70A, down along the cavity 824 of the tilt bar 80 through the slotted opening 932 of the housing 902, around the pulley 908 (located inside the cavity 930 of the housing 902) and back up through the slotted opening 932. From here, the lift cords 12 are routed back up the same cavity 824 of the tilt bar 80, through the cavities 708 and 722 of the top end cap 70A and finally tied off via the ferrule 706 on the top end cap 70A. The control button 904 is assembled together with the locking pin 910 and the spring 912 as has already been described, and the entire assembly 90 is mounted onto the tilt bar 80 by sliding the tilt bar 80 through the hand control 90 such that the 'D' shaped section 802 of the tilt bar 80 is enveloped by the cavity 914 of the hand control 90 and the leg 808 of the tilt bar 80 extends through the gap 926 between the leg 922 and the fingers 924 of the hand control 90.

Since the lift cords 12 are routed around the pulley 908 and are tied off at the ferrule 706 of the top end cap 70A, as the hand control is pulled down along the tilt bar 80 the bottom rail 21 of the shutter blind 10 is raised. Furthermore, the pulley 908 acts as a doubler so that the hand control must travel only half the distance that the bottom rail 21 travels. Thus, the lift cords 12 remain concealed within the cavity 824 of the tilt bar 80, and simply grabbing the hand control 90 at the thumb rest 949 releases the locking pin 910, allowing the hand control 90 to slide up or down along the tilt bar 80 to lower or raise respectively the shutter blind 10, and to do so in half the distance corresponding to the height of the shutter blind 10. Furthermore, this mechanism is able to accomplish this while the tilt bar 80 swings freely through any angle ranging from vertical to horizontal and anything in between.

Alternate Embodiment of the Hand Control

The hand control 190, shown in FIGS. 85–94, may be used instead of the hand control 90 of FIG. 1A. As in the case of the hand control 90, this alternate embodiment of the hand control 190 slides up and down the tilt bar 80, and it keeps the lift cords 12 untangled and concealed within the cavity 824 of the tilt bar 80 (See FIG. 45 for the details of the tilt bar 80).

Referring to FIG. 85, the hand control 190 includes a grip cover 1902, a cover housing 1904, a pulley housing 1906, a pulley axle 1908, a pulley 1910, a lock arm 1912, and a spring 1914. As will be described in more detail below, sliding the grip housing 1902 upwardly lowers the louvers, and sliding the grip housing downwardly raises the louvers. Whether raising or lowering the louvers 14, as soon as the hand control 190 is released by the user, the weight of the louvers 14 is transmitted via the lift cord 12 and the pulley 1910 to the pulley housing 1906 and the lock arm 1912, which causes the hand control 190 to lock onto the tilt bar 80.

Before describing the operation of the hand control 190, its parts and assembly will be described in detail. Referring now to FIGS. 89A, 89B, and 89C, the rectangularly-shaped pulley housing 1906 has a substantially square cavity 1916 towards its top end. This cavity 1916 has open front and back sides, and its top end has two notched out openings 1918 for routing the lift cord 12 into and out of the cavity 1916. A pulley axle hole 1920 goes through both sides of the cavity 1916, and one of these sides has a square depression 1921 in its outer surface to accommodate the pulley axle 1908, as will be described later. A second cavity 1922 towards the bottom end of the pulley housing 1906 connects internally with a third cavity 1924, which houses the spring 1914. The second cavity 1922 has a pin 1926 projecting from the far wall of the cavity 1922, which pivotably engages the lock arm 1912, as will be described in more detail later. The overall width of the pulley housing 1906 is slightly less than the length of the long leg 806 of the tilt bar 80, and the overall thickness of the pulley housing 1906 is slightly less than the length of the short leg 808 of the tilt bar 80, such that the pulley housing 1906 may slide within the cavity 824 of the tilt bar 80 as shown in FIG. 88B.

FIGS. 92A and 92B show the pivoting lock arm 1912. This lock arm 1912 has a sharp edge 1928 at its free, wedge-shaped end 1930, and a hole 1932 at its opposite, rounded end 1934. The hole 1932 of the lock arm 1912 slides over the pin 1926 of the pulley housing 1906, as shown in FIG. 88B, so that when the lock arm 1912 is mounted within the cavity 1922, it may pivot around the axis defined by the pin 1926. The lock arm 1912 moves up and down with the pulley housing 1906 as the pulley housing 1906 slides up and down the tilt bar 80. The lock arm 1912 has a top surface 1936 and a bottom surface 1938. As shown in FIG. 88B, a biasing spring 1914 mounts in the third cavity 1924 and pushes against the top surface 1936 of the lock arm 1912 to bias the sharp edge 1928 of the lock arm 1912 outwardly against the short leg 818 of the tilt bar 80.

FIGS. 93A and 93B depict the pulley 1910 which has an axial hole 1940 extending through it. The pulley 1910 slides into the square cavity 1916 of the pulley housing 1906 via the open front or rear sides of the cavity 1916, so that the hole 1940 of the pulley 1910 lines up with the holes 1920 on the left and right sides of the pulley housing 1906. FIG. 94 shows the pulley axle assembly 1908, which includes an axle 1942 projecting from a flat, square surface 1944. Once the pulley 1910 is inserted into the square cavity 1916, and its hole 1940 is aligned with the holes 1920 in the pulley housing 1906, the axle portion 1942 of the pulley axle assembly 1908 is inserted through the holes 1920 in the pulley housing and the hole 1940 of the pulley 1910, and the flat, square surface 1944 mates into the square depression 1921 of the pulley housing 1906. The pulley 1910 is then free to rotate around the axis defined by the axle 1942, and the pulley 910 moves up and down with the pulley housing 1906 as the pulley housing 1906 slides up and down the tilt bar 80.

FIGS. 90A and 90B show the cover housing 1904. It has a square-shaped upper bracket 1946, which serves the dual purpose of acting as a route for the lift cords 12 to enter and exit the hand control 190 via the opening 1948, and of serving as a contact area to push down on the pulley housing 1906 as will be explained later. A lower, "L"-shaped bracket 1950 also serves a dual purpose. Its lower, horizontal leg 1952 serves as a contact area to push up on the pulley housing 1906 (as will be explained later), and its upper, vertical leg 1954 serves as a tab 1954, which pushes up on the bottom surface 1938 of the pivoting lock arm 1912 in order to unlock the lock arm 1912 from the tilt bar 80, as will also be explained in more detail later. A side wall 1956 on the housing cover 1904 closes the gap in the cavity 824 of the tilt bar 80, and extends in an arc 1958 beyond the wall extension 818 of the tilt bar 80 (See FIG. 88B). Two wings 1960 project from this arc 1958 with a narrow slotted crevice 1962 defined between these two wings 1960. When the housing cover 1904 is mounted onto the tilt bar 80, these wings 1960 hug the outside surface of the wall extension 818 of the tilt bar 80.

FIGS. 91A and 91B show the grip housing 1902. The grip housing 1902 defines a cavity 1964, and has three horizontal, U-shaped, slotted ridges 1966 on its inner surface. The middle slotted ridge 1966 mates with the slotted crevice 1962 on the housing cover 1904 (See FIG. 85C) such that, when the hand control 190 is installed on the tilt bar 80, the grip housing 1902 envelops the "D" section 802 of the tilt bar 80 as well as the leg 808 and the wall extension 818 of the tilt bar 80, and the housing cover 1904 moves together with the grip housing 1902 when the grip housing 1902 slides up and down the tilt bar 80.

To assemble and use the hand control 190 of FIGS. 85A and 85B, the lift cords 12 (which run right next to and are hidden by the tilt cables 16 in FIG. 1A) are routed from the front and rear sides of the bottom rail 21, up through the cord glides 50 into the head rail 20 See FIG. 83) and out of the head rail 20 via the tilt bar top attachment 60 (See FIG. 38A), through the third and first cavities 712, 708 of the top end cap 70A, down along the cavity 824 of the tilt bar 80 through the slotted opening 1948 of the cover housing 1904 (See FIG. 86B), through the notched openings 1918, around the pulley 1910 (located inside the cavity 1916 of the pulley housing 1906 and held rotationally in place by the pulley axle 1908) and back up through the notched openings 1918, and out through the slotted opening 1948. From here, the lift cords 12 are routed back up the same cavity 824 of the tilt bar 80, through the cavities 708 and 722 of the top end cap 70A and finally tied off via the ferrule 706 on the top end cap 70A. The pulley housing 1906 is assembled together with the lock arm 1912 and the spring 1914, and this sub-assembly is place between the two brackets 1946, 1950 as shown in FIG. 86A. This entire assembly is then slid down along the tilt bar 80 so that the lift cords 12 are inside the cavity 824 of the tilt bar 80, and the sharp edge 1928 of the lock arm 1912 is riding along the inside surface of the wall extension 818 of the tilt bar 80. Finally, the grip housing 1902 is secured onto the cover housing 1904 by sliding the slotted ridge 1966 into the slotted crevice 1962, as has already been described.

Since the lift cords 12 are routed around the pulley 1910 and are tied off at the ferrule 706 of the top end cap 70A, as the hand control 190 is pulled down along the tilt bar 80 the bottom rail 21 of the shutter blind 10 is raised. Furthermore, the pulley 1910 acts as a doubler, so that the hand control 190 must travel only half the distance that the bottom rail 21 travels. Also, the lift cords 12 remain concealed within the cavity 824 of the tilt bar 80.

Referring to FIGS. 86B and 87B, simply raising the grip housing 1902 also raises the cover housing 1904 (since they are interconnected via the slotted ridges 1966 and the slotted crevice 1962) so that the tab 1954 of the lower bracket 1950 is also raised until it impacts against the bottom surface 1938 of the pivoting lock arm 1912, thus unlocking the hand control 190 and allowing the hand control 190 to be raised by the lower leg 1952 of the "L"-shaped bracket 1950, as shown in FIG. 87B. By the same token (See FIG. 88B), simply lowering the grip housing 1902 also lowers the cover housing 1904, so that the upper bracket 1946 pushes down onto the pulley housing 1906, canceling out the upward force of the lift cord 12 that is wrapped around the pulley 1910. Once the upward force of the lift cord is overcome by the downward force of the person pulling down the hand control, the pivoting lock arm 1912 releases its grip on the tilt bar 80, and downward motion of the hand control 190 relative to the tilt bar 80 begins. The sharp edge 1928 of the pivoting lock arm 1912 scrapes down along the inner surface of the tilt bar 80 as the hand control 190 moves downwardly relative to the tilt bar 80. In any event, whether raising or lowering the hand control 190, as soon as the hand control 190 is released by the user, the spring 1914 pushes the lock arm 1912 against the inner surface of the tilt bar 80, and the weight of the louvers 14 on the lift cords 12 (and thus on the pulley housing 1906 and on the lock arm 1912) immediately locks the sharp edge 1928 of the lock arm 1912 onto the tilt bar 80, locking the hand control 190 in place. The greater the weight of the louvers pulling on the lift cords 12, the greater the locking force with which the hand control 190 is locked onto the tilt bar 80. As was the case for the first embodiment of the hand control 90, this hand control 190 slides up or down along the tilt bar 80 to lower or raise respectively the shutter blind 10, and to do so in half the distance corresponding to the height of the shutter blind 10. Furthermore, this mechanism is able to accomplish this while the tilt bar 80 swings freely through any angle ranging from vertical to horizontal and anything in between.

We have reviewed how one embodiment of the hand control 90 has a control pulley 908, and how the lift cord 12 exits the head rail 20 and wraps around the control pulley 908 (as seen in FIG. 38A) and ties off at the top end cap 70A, resulting in a doubling effect on the lift cord 12. Thus, for any distance that the hand control 90 moves up or down along the tilt bar 80, the lift cord 12 travels twice that distance. The blind 10 may thus be designed so that the hand control 90 operates only in the bottom half of the tilt bar 80 and yet is able to fully raise or lower the blind 10. This applies equally for the second embodiment of the hand control 190.

In some instances, it may be desirable to have an additional doubling of the effect on the tilt cord, and this may be readily accomplished by placing a pulley 242F in the head rail 20F as shown schematically in FIGS. 83A and 83B. The head rail 20F is not unlike any of the previously described head rails 20 through 20E, but it does have a pulley mechanism to double the effect on the lift cord 12. The head rail 20F has a fixed pulley 240F close to one end of the head rail 20F. A floating pulley 242F is free to travel longitudinally inside of the head rail 20F.

Referring to FIG. 83A and contrasting it against FIG. 83, we see that the lift cords 12 enter the head rail 20F via the cord glides 50 (for clarity, only the rear lift cords and rear cord glides are shown), wrap around the fixed pulley 240F, wrap around the floating pulley 242F, and are tied off at one end 244F of the head rail 20F, proximate the fixed pulley 240F. A new lift cord 12A is secured at one end to the axle of the floating pulley 242F and the other end exits the head rail 20F via the tilt bar top attachment 60B and goes on to the hand control 90 as has already been described.

FIG. 83A shows the relative position of the floating pulley 242F when the blind 10 is in the lowered position. As the hand control 90 is lowered, the lift cord 12A pulls the floating pulley 242F along the longitudinal dimension of the head rail 20F. This pulls on the lift cords 12 which are tied off at one end 244F, so the other end, tied off at the bottom rail 21 is forced to move up, raising the blind 10 with it (See FIG. 83B). For any distance that the lift cord 12A moves up or down along the tilt bar 80, the lift cord 12 travels twice that distance. If the lift cord 12A is also going through a doubler pulley 908 in the hand control 90, then for any distance that the hand control 90 moves up or down along the tilt bar 80, the lift cord 12 travels four times that distance.

The Pivot Bracket

FIGS. 61A, 61B, 65, 66A, and 66B show the pivot bracket 100 of FIGS. 1A and 1B. When the tilt bar 80 is secured to the bottom rail 21A, as in FIGS. 3A and 3B, the pivot bracket 100 is not used. However, if the tilt bar 80 is not secured to the bottom rail 21A, or 21, and it is not desired to have the tilt bar 80 free to swing about, then a pivot bracket 100 may be used.

In this preferred embodiment of a pivot bracket 100, there is a bottom attachment 1002 that has a cavity 1008 which is practically identical to the cavity 708 of the top end cap 70, complete with a shoulder on the inside of a flexible tongue 1010. This cavity 1008 accommodates the bottom end of the tilt bar 80, and the shoulder 1012 on the flexible tongue 1010 latches on to the notch 816 on the wall extension 820 of the tilt bar 80, so that the tilt bar 80 and the bottom attachment 1002 are releasably connected and move together as a single piece. The side of this bottom attachment 1002 is curved at 1014, making a right angle turn and terminating in a nose 1016. The nose 1016 defines a central projection and a hole 1018, which extends through the nose 1016 and is used to pivotably secure the bottom attachment 1002 to a connecting arm 1004 via a rivet 1020. Partially surrounding the projection and hole 1018 is a shoulder 1022, which describes an arc. This shoulder 1022 acts as a stop to prevent the pivot bracket 100, and thus the tilt bar 80 and the head rail 20 (both of which are connected to the pivot bracket 100 via the bottom attachment 1002 as previously described), to "over latch". Over latch, in this instance, is a condition wherein the mechanism, in this case the pivot bracket 100, is at or beyond the top-dead-center or beyond the bottom-dead-center, such that the vertical component of a force may cause the mechanism to continue going around a full revolution instead of reversing directions.

The connecting arm 1004 is a flat tapered piece with a first hole 1024 at one end 1028 and a second hole 1026 at the other end 1030 of the connecting arm 1004. The first hole 1024 is aligned with the hole 1018 of the bottom attachment 1002 and these two pieces 1002, 1004 are pivotably secured via a rivet 1020 as described earlier. The second hole 1026 is aligned with a hole 1032 on the frame attachment 1006, and these two pieces 1004, 1006 are similarly pivotably secured via a rivet 1020. The frame attachment 1006 has two other holes 1034, which are used to secure the frame attachment 1006 to a frame via screws (not shown).

Referring now to FIG. 1A, as the tilt bar 80 is pushed up or down by the user in order to tilt the head rail 20 (and thus the rest of the louvers 14 of the shutter blind 10), the pivot bracket 100 allows this vertical movement, with the pivot bracket 100 pivoting around both of its pivot points defined by the riveted connections through the holes 1024 and 1026 of the connecting arm 1004. By the time the head rail 20 has reached a fully tilted closed position, but before the pivot bracket 100 reaches an over latch condition, one edge 1036 or 1038 of the connecting arm 1004 impacts against the shoulder 1022 of the bottom attachment 1002, stopping any further motion in that direction.

Alternate Embodiments of the Pivot Bracket

FIG. 67A shows a second embodiment of a pivot bracket 100A, which has essentially the same elements as the first embodiment 100, even though they look different. The bottom attachment 1002A (See FIGS. 71A and 71B) is very similar to the bottom attachment 1002 of the first embodiment 100. It has a cavity 1008A to accommodate the tilt bar 80, and it curves around a right angle and terminates with a nose 1016A and a hole 1018A. The frame attachment 1006A (see FIGS. 68A–C) is also fairly readily recognizable as it has the mounting holes 1034A to secure the frame attachment 1006A to a frame. However, instead of a rivet hole 1026 as in the previous embodiment 100, this frame attachment 1006A has a raised flange 1040A (See FIGS. 68A, 68B, and 68C) which runs along the entire outer, half-oval shaped edge 1042A of the frame attachment 1006A.

The connecting arm 1004A in this embodiment is very different from the connecting arm 1004 of the previous embodiment 100. (See FIGS. 70A and 70B) In this embodiment 100A, the connecting arm 1004A is a short cylinder with an outside diameter which fits inside the hole 1018A of the bottom attachment 1002A. The cylinder has a first flanged end 1044A, wedges 1046A on the outside surface of the cylinder and approximately half way between the first flanged end 1044A and a second truncated end 1048A with a slotted cavity 1050A designed to slidably receive the raised flange 1040A of the frame attachment 1006A.

Referring to FIG. 67C, the connecting arm 1004A is inserted through the hole 1018A of the bottom attachment 1002A such that the nose 1016A is pivotably trapped between the first flanged end 1044A and the shoulders 1052A of the wedges 1046A on the outside diameter of the connecting arm 1004A. The raised flange 1040A on the half-oval shaped outer edge 1042A of the frame attachment 1006A slides into the slotted cavity 1050A on the truncated end 1048A of the connecting arm 1004A.

Referring now to FIG. 4A, as the tilt bar 80 is pushed up or down by the user in order to tilt the head rail 20 (and thus the rest of the louvers 14 of the shutter blind 10C), the pivot bracket 100A allows this vertical movement with the pivot bracket 100A pivoting around its pivot point defined by the pivotably connected bottom attachment 1002A and the connecting arm 1004A, while the connecting arm 1004A slides along the half-oval path defined by the outer edge 1042A of the frame attachment 1002A, guided along by the raised flange 1040A of the frame attachment riding inside the slotted cavity 1050A of the connecting arm 1004A as illustrated in FIGS. 69A and 69B.

FIGS. 62A, 62B, and 63A depict a third embodiment of a pivot bracket 100B which may be used instead of either of the previously described pivot brackets 100, 100A. Once again, the bottom attachment 1002B, the connecting arm 1004B, and the frame attachment 1006B are present and readily recognizable. The significant difference between this embodiment 100B and the first embodiment 100 is that, instead of a short rivet 1020 to pivotably secure the connecting arm 1004 to the bottom attachment 1002, a long stem 1054B is used, which pivotably snaps into a hollow cylinder 1056B (See FIG. 63A). The larger contact area afforded by the long stem 1054B in the hollow cylinder 1056B results in a stronger connection between these two pieces 1002B, 1004B. A □V□ shaped step 1022B, along the outer surface of the connecting arm 1004B, impacts against one of the outer edges 1058B, 1060B of the frame attachment 1006B to stop the pivot bracket 100B and thus prevent an over latch condition.

FIGS. 64A and 64B depict a fourth embodiment of a pivot bracket 100C, which may be used instead of any of the previously described pivot brackets 100, 100A, 100B. Once again, the bottom attachment 1002C, the connecting arm 1004C, and the frame attachment 1006C are present and readily recognizable. The significant difference between this embodiment 100C and the first embodiment 100 is that, as in the case of the third embodiment 100C, the stop 1022C to prevent an over latch condition is on the connecting arm 1004C, and it takes the form of a triangle 1022C. FIG. 64B clearly shows this stop 1022C in operation as one side of the triangle 1022C impacts against the side 1058C of the frame attachment 1006C, corresponding to the tilt bar 80 in the fully raised position (the shutter blind 10 in the fully tilted closed, room side up position).

FIGS. 72A, 72B, 73A, and 73B depict a fifth embodiment of a pivot bracket 100D, which may be used instead of any of the previously described pivot brackets 100, 100A, 100B, 100C. Once again, the bottom attachment 1002D, and the connecting arm 1004D are present and readily recognizable, while the frame attachment may be from any one of the previously described mounting brackets, such as the mounting bracket 40B shown in FIG. 72A. Thus, the connecting arm 1004D very closely resembles part of the air foil shaped end cap 30A (See FIGS. 20A and 73A) which was designed to mount to mounting bracket 40B. The advantage of this pivot bracket 100D is that, without actually being directly connected to the bottom louver 21, the connecting arm 1004D looks like an end cap for the bottom rail 21 and mimics the motion of the bottom rail 21 even as the bottom rail 21 tilts closed and traverses toward the wall or tilts open and traverses away from the wall.

FIGS. 73C and 73D depict a sixth embodiment of a pivot bracket 100E, which is used in the blind embodiment of FIGS. 5E and 5F, where the shutter blind 10F includes the tilt bar 80 at the very end of the head rail 20. Thus, this sixth embodiment of the pivot bracket 100E is very similar to the first embodiment 100. Once again, the bottom attachment 1002E, the connecting arm 1004E, and the frame attachment 1006E are present and readily recognizable. The significant difference between this embodiment 100E and the first embodiment 100 is that the bottom attachment 1002E is not curved at 1014.

The Custodial Wand

The custodial wand 180 and its parts are shown in FIGS. 5C, 5D, 74–76D. The custodial wand 180 is used to tilt the shutter blind 10D (as shown in FIG. 5C) when the tilt bar 80 itself is not within the user's arm's reach. The custodial wand mechanism 180 includes a custodial wand clip 1802, a custodial wand tip 1804, and the custodial wand itself 1806. The wand clip 1802 is essentially a rectangular block 1808 designed to snap in snugly within the partial cavity 824 of the tilt bar 80 (shown in detail in FIGS. 45–46C). A step 1810 at a first end 1812 of the block 1808 snaps in under the wall extension 820 of the tilt bar 80 so that the first end 1812 abuts the leg 808 of the tilt bar 80. A slotted opening 1814 in the clip 1802 accommodates the wall extension 818 of the tilt bar 80, so that a second end 1816 of the block 1808 abuts the leg 806 of the tilt bar 80. A pair of wings 1818 project from a third end 1820, and these wings 1818 hug the outside wall of the wall extension 818 of the tilt bar 80, as shown in FIG. 74. A hole 1819 extends through the block 1808 from the third end 1820 to the first end 1812 so that a self-tapping screw (not shown) may be driven through the hole 1819 and against the lower leg 808 of the tilt bar 80, to help secure the wand clip 1802 to the tilt bar 80. The wand clip 1802 is snapped anywhere along the length of the tilt bar 80, where it remains without sliding due to the snug fit between the block 1808 and the tilt bar 80, and aided by the self tapping screw as described above.

The wand tip 1804 is a hollow cap designed to receive the upper end of the cylindrical wand 1806 in its cavity 1824. Two bumps 1826 project inwardly inside the cavity 1824 to help secure the wand 1806 within this cavity 1824. Two arms 1828 project from the outside of the hollow cap 1822, and each of these arms ends in a pair of wings 1830, similar to the wings 1818 of the wand clip 1802. A U-shaped opening 1832 between the arms 1828 is designed to receive the "D" shaped section 802 of the tilt bar 80 when the custodial wand 180 is in use.

To use the custodial wand 180, one end of the wand 1806 is inserted into the cavity 1824 of the tip 1804 so that the bumps 1826 grab onto the wand 1806. The wand clip 1802 is snapped onto the tilt bar 80, anywhere along the length of the tilt bar 80, as has already been described, and the locking screw is inserted to secure the wand clip 1802 to the tilt bar 80. The wand 1806 and tip 1804 assembly is brought over to the tilt bar 80, so that the arms 1828 receive the tilt bar 80 as shown in FIG. 74. If the wings 1830 of the tip 1804 are above the wings 1818 of the clip 1802 (as shown in FIG. 74), then the wand may be pulled down so that the wings 1830, 1818 of the tip and clip engage each other, and the tip 1804 of the wand 180 may pull down on the clip 1802, thus pulling the tilt bar 80 down. To reverse this action, the wings 1830 of the wand tip 1804 are placed below the wings 1818 of the clip 1802, and the wand 1806 is pushed up, so that the wings 1830,1818 engage each other and the tip 1804 may push up on the clip 1802, thus pushing up the tilt bar 80. When the custodial wand is not being used to shift the tilt bar 80 up or down, it is stored away.

The Stop Block

FIGS. 77A through 77D show a stop block 130, as depicted in FIG. 1B. As has already been explained, the stop block 130 is secured to the tilt bar 80 to limit the upward travel of the hand control 90 on the tilt bar 80, so that the hand control 80 cannot be pushed up beyond the point where the shutter blind 10 is fully lowered, which could cause the lift cords 12 to loop out of their pulleys. The stop block 130 may also be used as a stop for the provisional lift attachment 170 (as shown in FIG. 5B) in order to limit how far down the bottom louver 21 is allowed to go.

The stop block 130 is essentially a rectangular block having a front side 1302, a rear side 1304, a top side 1306, a bottom side 1308, a right side 1310, and a left side 1312. The top side 1306 slopes down gradually from the front side 1302 to the rear side 1304. Halfway between the right side 1310 and the left side 1312, and along the rear side 1304, there is a notched out section 1314 (See FIG. 77C), designed so that a screwdriver may be inserted in the notch 1314 to pry the stop block 130 loose from the tilt bar 80. Halfway between the right side 1310 and the left side 1312, and along the front side 1302, there is a second notched out section 1316, with a hole 1317 (See FIG. 77A), designed to receive a locking pin 910, which is identical to the locking pin 910 of the cam-lock hand control 90 (See FIGS. 58A and 58B). This locking pin 910 serves the same purpose, to lock the stop block 130 in the cavity 824 of the tilt bar 80. A U-shaped opening 1318 in the front side 1302 extends from the right side 1310 through to the left side 1312 and has a depth extending substantially across the block 130 towards the rear side of the block 130. This U-shaped opening 1318 gives the block 130 some flexibility, so it may compress in order to snap into place in the cavity 824 of the tilt bar 80, and it also provides a passageway for the routing of the lift cords 12 to and from the hand control 90 and the top end cap 70, so that the lift cords 12 may remain within the cavity 824 of the tilt bar 80 at all times.

The Bottom Rail Insert

Referring to FIGS. 1B, 5B, 80 and 80A, the bottom rail insert 110 is a transparent piece which very closely resembles, in its profile, the air foil shape of the head rail 20, except that most of the bottom section of the profile, roughly corresponding to the section between the two bottom internal ribs 206 in the head rail 20, is removed. This insert 110 has no internal ribs, and the edges 1102 are relatively sharp but rounded, and continuous except for notches 1104 (roughly corresponding to the notches 210 on the head rail 20), whose purpose will be explained later. The insert is of substantially the same length as the length of the bottom louver 21.

The insert 110 is typically inserted in the bottom-most louver 14 to effectively convert it into a bottom rail 21, as shown in FIG. 1A. The insert 110 adds weight to the bottom louver 21, and it adds rigidity to the bottom louver 21, so that other items may be incorporated into the shutter blind assembly, such as the provisional lift 170 (See FIG. 5A) and the cord anchors 120, as will be described in more detail later. Since the insert is transparent, it does not affect the translucency of the louver 21, such that the louver 21 looks no different than the rest of the louvers 14 in the shutter blind 10D, despite having the enhanced physical characteristics imparted by the addition of the insert 110.

The Provisional Lift

The lift assembly 10D, shown in FIGS. 5A–C, has no lift cords and no hand control 90 to raise or lower the blind. Instead, it uses a provisional lift 170. The provisional lift 170 includes a lift clip 1702 (See FIGS. 78A, 78B, 78C) and a lift tab 1704 (See FIGS. 79A, through 79E). In this case, in order to raise and lower the blind, the operator physically lifts and lowers the bottom-most louver 21 and locks it in place on the tilt bars 80 where desired. The balance of the louvers 14 stack on top of the bottom-most louver 21 when the blind is raised, or unstack and hang suspended from the tilt cables 16 when the blind is lowered. The lift clip 1702 is attached to the bottom-most louver 21. The lift tab 1704 is mounted for sliding engagement on the tilt bar 80, and the lift clip 1702 and lift tab 1704 are connected together. When the lift tab 1704 is released, it automatically locks onto the tilt bar 80, as will be described shortly.

The lift clip 1702 includes a long, flexible bridging span 1706 with first and second ends 1708, 1710. The bridging span 1703 is designed to wrap around the bottom of the bottom louver 21, and the ends 1708, 1710 are designed to clip over the front and rear edges of the bottom louver 21 to retain the lift clip 1702 on the bottom louver 21. Each of the ends 1708, 1710 has two inwardly-projecting, spaced-apart fingers. The profile of the bridging span 1706 is shaped very much like the missing arc of the rail insert 110 described earlier, and this allows some flexibility to straighten the arc in order to snap the two fingers 1712 of each end around the insert-stiffened louver 21, such that the rounded ends 1102 of the insert 110 come to rest in U-shaped indentations 1714 at the ends 1708, 1710 of the clip 1702. The first end 1708 of the clip 1702 also has two outwardly-directed arms 1716 projecting away from the U-shaped indentation 1714, and these two arms 1716 have horizontally oriented holes 1718, used for hingedly securing the lift clip 1702 to the lift tab 1704, as will be described shortly. The second end 1710 of the lift clip 1702 has a vertically oriented hole 1720 used for routing lift cords 12 through the clip 1702.

Referring now to FIGS. 79A, through 79E, the provisional lift tab 1704 includes a flat handle tab 1722, which functions as a handle for the user to grab in order to raise or lower the blind stack. The handle tab 1722 has a front edge 1724, a rear edge 1726, a right edge 1728, and a left edge 1730. Near the right rear quarter of the flat handle tab 1722, a tilt bar attachment tab 1732 projects from the handle tab 1722, and this tilt bar attachment tab 1732 also has a front edge 1734, a rear edge 1736, a right edge 1738, and a left edge 1740. This tilt bar attachment tab 1732 is partially offset rearwardly from the flat handle tab 1722, and is connected only partially along its left edge 1740 to the right edge 1728 of the handle tab 1722, such that an □L□-shaped slotted opening 1742 is defined between these two tabs 1722, 1732 (See FIG. 79D). This "L"-shaped slotted opening 1742 matches very closely with the leg 808 and the wall extension 820 of the tilt bar 80 as shown in FIG. 79E, so that the lift tab 1704 is received in the recess 824 of the tilt bar 80 and wraps around the tilt bar 80, so that the lift tab 1704 may slide up and down along the length of the tilt bar 80 as long as the plane of the lift tab 1704 is substantially perpendicular to the longitudinal axis of the tilt bar 80. However, if the lift tab 1704 is tilted slightly either up or down, so that the plane of the tab 1704 is no longer substantially perpendicular to the longitudinal axis of the tilt bar 80, then the wall extension 820 of the tilt bar 80 engages against the inside surface of the "L"-shaped slotted opening 1742, locking the lift tab 1704 in place.

In order to connect the lift tab 1704 to the lift clip 1702, a hole 1744 (See FIG. 79C) extends through the offset rear edge 1736 of the lift tab's tilt bar attachment tab 1732, from the right edge 1738 to the left edge 1740. The offset rear edge 1736 of the tilt bar attachment tab 1732 fits between the two arms 1716 at the first end 1708 of the lift clip 1702. The hole 1744 in the lift tab 1704 lines up with the holes 1718 in the lift clip 1702, so that a pin extends through the aligned holes 1718,1744 to hingedly secure the lift clip 1702 to the lift tab 1704.

Referring briefly to FIG. 79F, to use the provisional lift 170, the lift clip 1702 is snapped onto the insert-stiffened louver 21 as has already been described, the lift clip 1702 and the lift tab 1704 are hingedly connected via a pin through the aligned holes 1744, 1718, and the lift tab 1704 is inserted into the tilt bar 80 such that the leg 808 and the wall extension 820 of the tilt bar 80 ride inside the "L"-shaped slot 1742 of the lift tab 1704. When the provisional lift 170 is not being manually lifted, the weight of the insert-stiffened louver 21 pushes the tab 1704 down at its rear edge 1736 (As shown in FIG. 79F), so that the plane of the lift tab 1704 is no longer substantially perpendicular to the longitudinal axis of the tilt bar 80, thereby causing the lift tab 1704 to lock in place onto the tilt bar 80. If the user grabs the handle tab portion 1722 of the lift tab 1704, and raises it just enough to counter the downward force exerted by the weight of the bottom rail 21, so that the plane of the lift tab 1704 is substantially perpendicular to the longitudinal axis of the tilt bar 80, then the provisional lift unlocks and the bottom louver 21 may be raised or lowered as desired. However, as soon as the handle tab 1722 is released, the weight of the bottom louver 21 immediately pushes down on the rear edge 1736 of the lift tab 1732 and the provisional lift once again locks in place on the tilt bar 80 at its new location.

The Cord Anchor

FIGS. 81A and 81B show greater detail of the cord anchor 120 depicted in FIG. 1A. FIGS. 82A–F also show the steps that are taken to insert the cord anchor 120 onto a bottom louver 21. The cord anchor 120 is used to secure the lift cords 12 and the tilt cables 16 to the insert-stiffened bottom-most louver 21, which is thus acting as a bottom rail 21.

The cord anchor 120 is a long piece with a triangular profile, having a first end 1202 and a second end 1204 and three sides 1208, 1210, 1212. Halfway between the two ends 1202, 1204 is a rectangular extension 1206 projecting from two of the sides 1208, 1210 of the cord anchor 120. Two holes 1214 extend through the cord anchor 120, perpendicular to the third side 1212 of the cord anchor 120, extending through the extension 1206. The longitudinal dimension of the cord anchor 120 is considerably larger than its width or its height. The cord anchor 120 preferably is made from a transparent material so that, like the bottom rail insert 110, it does not affect the translucent quality of the bottom rail 21 when the cord anchor 120 is installed in the bottom rail 21.

Figure 82A:
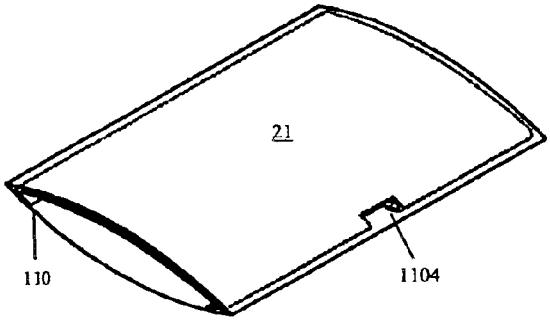

FIGS. 82A through 82F show the installation procedure for mounting the cord anchor 120 onto the insert-stiffened louver 21. In FIG. 82A, the louver 21 is shown with the insert 110 shown mostly in phantom inside the louver 21. The notch 1104 on the insert 110 is still covered over by the louver 21.

Figure 82F:
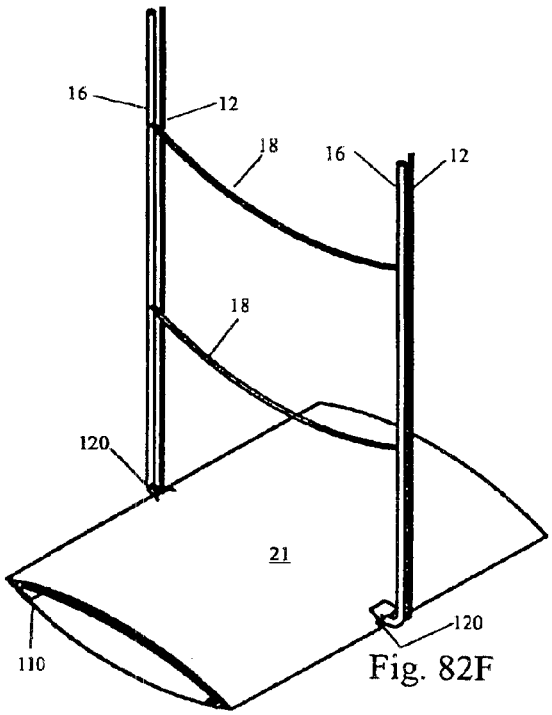
Figure 82B:
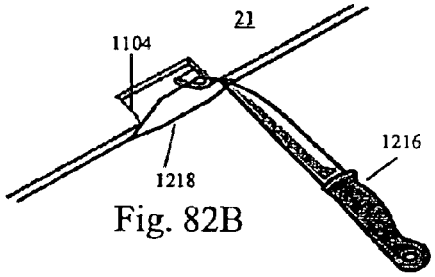
Figure 82E:
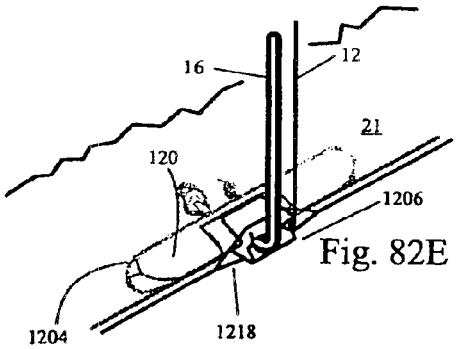
Figure 82C:
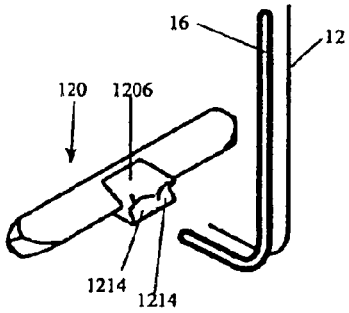

In FIG. 82B, a knife 1216 is used to cut a slit 1218 on the edge of the louver 21 corresponding to the location where the notch 1104 is located. The lift cord 12 and the tilt cable 16 are inserted through the holes 1214 in the cord anchor 120 as shown in FIG. 82C, such that the lift cord 12 and the tilt cable 16 exit on the side 1212 of the cord anchor 120 opposite the extension 1206. Knots 1220 are tied on the free ends of the lift cord 12 and the tilt cable 16, as shown in FIG. 82D, so that these cords 12, 16 may not be pulled back out of the cord anchor 120.

Figure 82D:
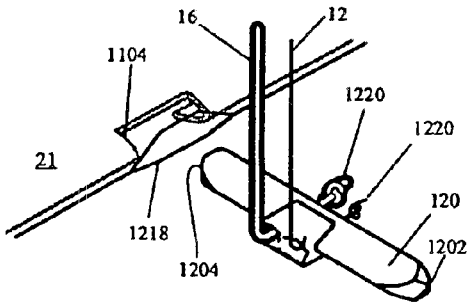

Also as shown in FIG. 82D, the cord anchor 120 is aligned with one of its narrow ends 1204 facing the notch 1104. The cord anchor 120 is then slid lengthwise through the slit 1218 and the notch 1104, until it is inside the louver 21. The notch 1104 and the slit 1218 are larger than the height and the width dimensions of the cord anchor 120, but smaller than the length dimension of the cord anchor 120. Once the cord anchor 120 with the cords 12, 16 is inside the louver 21, a slight tug on the cords 12, 16 brings the extension 1206 of the cord anchor 120 back to the notch 1104, aligning the longitudinal dimension of the cord anchor 120 with the longitudinal dimension of the louver 21, so that the cord anchor 120 is unable to pop back out through the notch 1104, as shown in FIG. 82E. FIG. 82F shows a portion of the bottom louver 21 suspended from the ladder tapes 18 and the lift cords 12 which have been secured to the louver 21 via the cord anchors 120.

While several embodiments of the present invention have been shown and described, it is not possible to describe all the possible variations and combinations that could be made within the scope of the present invention. It will be obvious to those skilled in the art that modifications may be made to the embodiments described above without departing from the scope of the invention as claimed.

What is claimed is:

1. A covering for architectural openings, comprising: a head rail having first and second ends and defining a longitudinal axis and first and second lateral edges; at least a first bracket for mounting said head rail to the architectural opening, said first bracket including first and second slots; a first pin, mounted to a first end of said head rail and substantially aligned with said longitudinal axis, said first pin being received in said first slot; and a second pin, mounted to the first end of said head rail and near one of said lateral edges, said second pin being received in said second slot, wherein the shifting of said pins in their respective slots defines a tilted open position and a first tilted closed position, with said first pin located closer to said second slot in the first tilted closed position than in the tilted open position.

2. A covering for architectural openings as recited in claim 1, wherein said second slot defines an arc, which lies on an imaginary circle, and said first slot defines a portion of a radius of said circle.

3. A covering for architectural openings, comprising a pivotal and tiltable head rail; support members on which the headrail is mounted; a plurality of slats suspended from the headrail for movement in response to pivotal and tiltable movement of the headrail; a tilt bar pivotably mounted to said headrail; a lift cord operatively connected to said slats extending along said head rail and along said tilt bar, and a handle sildably mounted on said tilt bar and engaging said lift cord for raising and lowering said slats.

4. A covering for architectural openings, comprising: a head rail defining forward and rear lateral edges and a longitudinal pivot axis; a bracket for pivotably mounting said head rail in the architectural opening; forward and rear tilt cords; forward and rear lift cords; and forward and rear mounts which are received in the forward and rear lateral edges of said head rail, each of said mounts defining separate guide paths for a tilt cable and a lift cord for the covering.

* * * * *